US005726371A

United States Patent [19]

Shiba et al.

[11] Patent Number: 5,726,371

[45] Date of Patent: *Mar. 10, 1998

[54] DATA PROCESSING APPARATUS OUTPUTTING WAVEFORM DATA FOR SOUND SIGNALS WITH PRECISE TIMINGS

[75] Inventors: Kosuke Shiba; Koichiro Daigo; Kazuo Ogura, all of Fussa; Ryuji Usami, Akigawa; Jun Hosoda, Hanno, all of Japan

[73] Assignee: Casio Computer Co., Ltd., Tokyo, Japan

[ * ] Notice: The term of this patent shall not extend beyond the expiration date of Pat. No. 5,319,151.

[21] Appl. No.: 223,589

[22] Filed: Apr. 6, 1994

Related U.S. Application Data

[60] Division of Ser. No. 855,431, Mar. 23, 1992, Pat. No. 5,319,151, which is a continuation-in-part of Ser. No. 798,822, Nov. 21, 1991, abandoned, which is a continuation of Ser. No. 455,978, Dec. 22, 1989, abandoned, Ser. No. 707,323, May 29, 1991, abandoned, and Ser. No. 707,325, May 29, 1991, abandoned.

[30] Foreign Application Priority Data

| | | | |
|---|---|---|---|
| Dec. 29, 1988 | [JP] | Japan | 63-334158 |
| Dec. 29, 1988 | [JP] | Japan | 63-334161 |
| Dec. 29, 1988 | [JP] | Japan | 63-334162 |
| Dec. 29, 1988 | [JP] | Japan | 63-334163 |
| Dec. 29, 1988 | [JP] | Japan | 63-334166 |
| Jun. 28, 1990 | [JP] | Japan | 2-171215 |
| Jun. 28, 1990 | [JP] | Japan | 2-171216 |
| Jun. 28, 1990 | [JP] | Japan | 2-171217 |
| Jun. 29, 1990 | [JP] | Japan | 2-172200 |

[51] Int. Cl.[6] ..... G10H 1/06; G10H 7/00

[52] U.S. Cl. ..... 84/603; 84/615; 84/622; 84/626

[58] Field of Search ..... 84/601–608, 622–625, 84/659–661, 692–700, 615–620, 626–633, 647, 649

[56] References Cited

U.S. PATENT DOCUMENTS

| | | |
|---|---|---|
| Re. 31,004 | 8/1982 | Niimi . |
| Re. 33,738 | 11/1991 | Okumura . |

(List continued on next page.)

FOREIGN PATENT DOCUMENTS

| | | |
|---|---|---|
| 54-161313 | 12/1979 | Japan . |
| 57-31156 | 7/1982 | Japan . |
| 57-155594 | 9/1982 | Japan . |
| 58-102296 | 6/1983 | Japan . |
| 59-50498 | 3/1984 | Japan . |
| 59-109090 | 6/1984 | Japan . |
| 60-3892 | 1/1985 | Japan . |
| 61-9693 | 1/1986 | Japan . |
| 61-112193 | 5/1986 | Japan . |
| 61-292688 | 12/1986 | Japan . |
| 1-15878 | 3/1989 | Japan . |
| 2-181795 | 7/1990 | Japan . |

(List continued on next page.)

*Primary Examiner*—Stanely J. Witkowski
*Attorney, Agent, or Firm*—Frishauf, Holtz, Goodman, Langer & Chick

[57] ABSTRACT

In a musical tone waveform generation apparatus for outputting musical tone signals generated by a software program at predetermined time intervals, sound source methods can be selected in units of tone generation channels. In the musical tone waveform generation apparatus, the sound source method or the tone color of a musical tone signal to be output is determined in accordance with performance data (pitch data, touch data, music part data, and the like). A musical tone signal is generated by CPU upon execution of a sound source processing program, associated with a modulation method stored in a memory. The generated musical tone signal is output at predetermined time intervals. As for sound source processing based on the modulation method, at least one operator processing, and algorithm processing for determining an input/output relationship among the operator processing operations are independently executed.

25 Claims, 72 Drawing Sheets

U.S. PATENT DOCUMENTS

| | | | |
|---|---|---|---|
| 4,018,121 | 4/1977 | Chowning . | |
| 4,036,096 | 7/1977 | Tomisawa et al. . | |
| 4,184,400 | 1/1980 | Niimi . | |
| 4,250,787 | 2/1981 | Segan et al. | 84/649 X |
| 4,297,933 | 11/1981 | Nishimoto . | |
| 4,338,674 | 7/1982 | Hamada . | |
| 4,387,617 | 6/1983 | Kato et al. . | |
| 4,437,377 | 3/1984 | Mitarai et al. | 84/647 |
| 4,478,124 | 10/1984 | Kikumoto . | |
| 4,539,883 | 9/1985 | Chihana . | |
| 4,653,375 | 3/1987 | Honda et al. . | |
| 4,719,833 | 1/1988 | Katoh et al. . | |
| 4,744,281 | 5/1988 | Isozaki . | |
| 4,901,616 | 2/1990 | Matsubara et al. | 84/602 |
| 4,913,025 | 4/1990 | Nakano . | |
| 4,932,303 | 6/1990 | Kimpara . | |
| 4,953,437 | 9/1990 | Starkey . | |
| 5,007,323 | 4/1991 | Usami . | |
| 5,020,410 | 6/1991 | Sasaki . | |
| 5,025,702 | 6/1991 | Oya . | |
| 5,033,352 | 7/1991 | Kellogg et al. . | |
| 5,119,710 | 6/1992 | Tsurumi et al. | 84/602 X |

FOREIGN PATENT DOCUMENTS

| | | |
|---|---|---|
| 2-181796 | 7/1990 | Japan . |
| 2-181797 | 7/1990 | Japan . |
| 2 013 386 | 8/1979 | United Kingdom . |
| 2 162 988 | 2/1986 | United Kingdom . |
| 2 168 190 | 6/1988 | United Kingdom . |

| PCM | | DPCM | | FM | | TM | |
|---|---|---|---|---|---|---|---|
| S | SOUND SOURCE METHOD NO. | S | SOUND SOURCE METHOD NO. | S | SOUND SOURCE METHOD NO. | S | SOUND SOURCE METHOD NO. |
| $A_I$ | CURRENT ADDRESS INTEGRAL PART | $A_I$ | CURRENT ADDRESS INTEGRAL PART | $A_1$ | CURRENT ADDRESS (OP1) | $A_1$ | CURRENT ADDRESS (OP1) |
| $A_F$ | CURRENT ADDRESS DECIMAL PART | $A_F$ | CURRENT ADDRESS DECIMAL PART | $A_2$ | CURRENT ADDRESS (OP2) | $A_2$ | CURRENT ADDRESS (OP2) |
| $A_E$ | END ADDRESS INTEGRAL PART | $A_E$ | END ADDRESS INTEGRAL PART | | | | |
| $A_L$ | LOOP ADDRESS INTEGRAL PART | $A_L$ | LOOP ADDRESS INTEGRAL PART | | | | |
| $P_F$ | PITCH DATA DECIMAL PART | $P_F$ | PITCH DATA DECIMAL PART | $P_1$ | PITCH DATA (OP1) | $P_1$ | PITCH DATA (OP1) |
| $P_I$ | PITCH DATA INTEGRAL PART | $P_I$ | PITCH DATA INTEGRAL PART | $P_2$ | PITCH DATA (OP2) | $P_2$ | PITCH DATA (OP2) |
| $X_P$ | IMMEDIATELY PRECEDING SAMPLE DATA | $X_P$ | IMMEDIATELY PRECEDING SAMPLE DATA | | | | |
| $X_N$ | NEXT SAMPLE DATA | OLD $A_I$ | CURRENT ADDRESS INTEGRAL PART BEFORE CHANGE | | | | |
| D | DIFFERENCE BETWEEN ADJACENT SAMPLE DATA | D | DIFFERENCE BETWEEN ADJACENT SAMPLE DATA | | | | |
| E | ENVELOPE VALUE | E | ENVELOPE VALUE | $E_1$ | ENVELOPE (OP1) | $E_1$ | ENVELOPE (OP1) |
| | | $X_{PL}$ | SAMPLE DATA OF AL | $E_2$ | ENVELOPE (OP2) | $E_2$ | ENVELOPE (OP2) |
| | | | | $M_{L2}$ | MODULATION LEVEL (OP2) | $M_{L2}$ | MODULATION LEVEL (OP2) |
| | | | | $M_{O2}$ | MODULATION OUTPUT (OP2) | $M_{O2}$ | MODULATION OUTPUT (OP2) |
| | | | | $F_{L2}$ | FEEDBACK LEVEL (OP2) | $F_{L2}$ | FEEDBACK LEVEL (OP2) |
| | | | | $F_{O2}$ | FEEDBACK OUTPUT (OP2) | $F_{O2}$ | FEEDBACK OUTPUT (OP2) |
| O | OUTPUT | O | OUTPUT | $O_1$ | OP1 OUTPUT | $O_1$ | OP1 OUTPUT |
| | | | | $O_2$ | OP2 OUTPUT | $O_2$ | OP2 OUTPUT |

FIG.37

| | |
|---|---|
| ch1 | X |
| ch2 | X |
| ch3 | X |
| ch4 | X |
| ch5 | Y |
| ch6 | Y |
| ch7 | Y |
| ch8 | Y |

FIG.57

| | |
|---|---|
| ch1 | X |
| ch2 | X |
| ch3 | Y |
| ch4 | X |
| ch5 | X |
| ch6 | Y |
| ch7 | Y |
| ch8 | X |

FIG.58

| PCM | | DPCM | | FM | | TM | |
|---|---|---|---|---|---|---|---|
| G | SOUND SOURCE METHOD NO. | G | SOUND SOURCE METHOD NO. | G | SOUND SOURCE METHOD NO. | G | SOUND SOURCE METHOD NO. |
| $A_I$ | CURRENT ADDRESS INTEGRAL PART | $A_I$ | CURRENT ADDRESS INTEGRAL PART | $A_1$ | CURRENT ADDRESS (OP1) | $A_1$ | CURRENT ADDRESS (OP1) |
| $A_F$ | CURRENT ADDRESS DECIMAL PART | $A_F$ | CURRENT ADDRESS DECIMAL PART | $A_2$ | CURRENT ADDRESS (OP2) | $A_2$ | CURRENT ADDRESS (OP2) |
| $A_E$ | END ADDRESS INTEGRAL PART | $A_E$ | END ADDRESS INTEGRAL PART | | | | |
| $A_L$ | LOOP ADDRESS INTEGRAL PART | $A_L$ | LOOP ADDRESS INTEGRAL PART | | | | |
| $P_F$ | PITCH DATA DECIMAL PART | $P_F$ | PITCH DATA DECIMAL PART | $P_1$ | PITCH DATA (OP1) | $P_1$ | PITCH DATA (OP1) |
| $P_I$ | PITCH DATA INTEGRAL PART | $P_I$ | PITCH DATA INTEGRAL PART | $P_2$ | PITCH DATA (OP2) | $P_2$ | PITCH DATA (OP2) |
| $X_P$ | IMMEDIATELY PRECEDING SAMPLE DATA | $X_P$ | IMMEDIATELY PRECEDING SAMPLE DATA | | | | |
| $X_N$ | NEXT SAMPLE DATA | OLD $A_I$ | CURRENT ADDRESS INTEGRAL PART BEFORE CHANGE | | | | |
| D | DIFFERENCE BETWEEN ADJACENT SAMPLE DATA | D | DIFFERENCE BETWEEN ADJACENT SAMPLE DATA | | | | |
| E | ENVELOPE VALUE | E | ENVELOPE VALUE | $E_1$ | ENVELOPE (OP1) | $E_1$ | ENVELOPE (OP1) |
| | | $X_{PL}$ | SAMPLE DATA OF $A_L$ | $E_2$ | ENVELOPE (OP2) | $E_2$ | ENVELOPE (OP2) |
| | | | | $M_{L2}$ | MODULATION LEVEL (OP2) | $M_{L2}$ | MODULATION LEVEL (OP2) |
| | | | | $M_{O2}$ | MODULATION OUTPUT (OP2) | $M_{O2}$ | MODULATION OUTPUT (OP2) |
| | | | | $F_{L2}$ | FEEDBACK LEVEL (OP2) | $F_{L2}$ | FEEDBACK LEVEL (OP2) |
| | | | | $F_{O2}$ | FEEDBACK OUTPUT (OP2) | $F_{O2}$ | FEEDBACK OUTPUT (OP2) |
| O | OUTPUT | O | OUTPUT | $O_1$ | OP1 OUTPUT | $O_1$ | OP1 OUTPUT |
| | | | | $O_2$ | OP2 OUTPUT | $O_2$ | OP2 OUTPUT |
| C | | C | | C | | C | |

FIG.74

DATA PROCESSING APPARATUS OUTPUTTING WAVEFORM DATA FOR SOUND SIGNALS WITH PRECISE TIMINGS

CROSS-REFERENCE TO THE RELATED APPLICATIONS

This is a division of U.S. Ser. No. 07/855,431 filed on Mar. 23, 1992 (now U.S. Pat. No. 5,319,151), which in turn is a Continuation-In-Part application of each of U.S. Ser. No. 07/798,822 filed on Nov. 21, 1991 (now abandoned), which in turn is a continuation application of U.S. Ser. No. 07/455,978 filed on Dec. 22, 1989 (now abandoned); U.S. Ser. No. 07/707,323 filed on May 29, 1991 (now abandoned); and U.S. Ser. No. 07/707,325 filed on May 29, 1991 (now abandoned).

BACKGROUND OF THE INVENTION

1. Field of the Invention

The present invention relates to a data processing apparatus for electronic musical instruments, and, more particularly, to the use of a microcomputer in electronic musical instruments.

2. Description of the Related Art

Although recent electronic musical instruments are computerized, that portion associated with tone generation which requires a high-speed computation of a vast amount of data, is still excited by exclusive or special-purpose hardware called a sound source circuit. A microcomputer merely processes control inputs to a musical instrument, such as an input from a keyboard or console panel, input from a MIDI or other external units and input from an internal or external unit, and sends proper commands to the sound source circuit.

Sound source circuits, which have different structures depending on the system for generating musical tones, normally have a large circuit scale irrespective of the structure of the sound source systems. The circuit scale of typical sound source circuits is about two times that of a microcomputer (central processing unit).

FIG. 1 exemplifies in a block diagram of a sound source circuit involving a PCM sound source (refer to the U.S. patent application Ser. No. 226,936, filed on Aug. 1, 1988). A microcomputer 2, which controls a PCM sound source 1, sends data (command) necessary for tone generation to the PCM sound source 1. Such a command is set in individual sections in the sound source through a sound source command analyzer 3.

For instance, data is set through the following procedures at the beginning of tone generation.

(a) Addresses (normally consisting of a start address, end address and loop address) to be waveform memory 8, in which waveforms to be generated are stored, are sent and set in an address controller 5.

(b) Pitch data of a musical tone to be generated is sent and set in a pitch controller 6.

(c) Envelope data is sent and set in an envelope controller 7.

(d) Channel control is set ON (data is set in a channel ON/OFF controller 4).

With the use of a polyphonic sound source, these data should have a matched channel number and the individual sections of the sound source 1 should be operated in time-shnring manner. When the above data is set the PCM sound source 1 produces a musical tone in the following manner.

The address controller 5 reads out from the waveform memory 8 waveform data located at two adjacent addresses closest to an accumulated result of the pitch data from the pitch controller 6, the waveform data representing an immediately preceding waveform value and an immediately following waveform value. The waveform data is sent to a waveform processor 9 which in turn computes the difference between these two waveform values. The difference and the immediately preceding waveform value are sent to a multiplier 10, which multiplies the computed difference by a decimal point portion PD of the address of the waveform memory (given from the pitch controller 6 in the diagram) and adds the immediately preceding waveform value to the resultant value to thereby provide an interpolation value. The multiplier 10 then multiplies this interpolation value by an envelope value ED produced in the envelope controller 7, thus providing an instantaneous value of a tone waveform of the channel. This instantaneous value is accumulated by an adder 11 for all the channels, and the resultant data is sent to a D/A converter 12 to be an analog tone signal.

As is obvious from this example, it is necessary to provide an arithmetic operation unit and a memory for temporary storage of data, here and there at the data processing storage, thus requiring a large-scale circuit. A specific sound source circuit has a structure to simply realize a specific sound source system and 1 or combination of a specific number of polyphonic sounds, so that changing the polyphonic number necessitates great alteration of the circuit and/or addition of a circuit. It is also necessary to design a set of commands to be sent to the sound source circuit from the microcomputer in accordance with the sound source, thus requiring a significant time for developing a sound source control program.

There may be a controller for an electronic musical instrument whose architecture permits a microcomputer alone to simultaneously execute processing of control inputs to a musical instrument and tone generation. To realize such a controller, there is a demand for a microcomputer having an architecture to ensure tone generation that requires a high-speed data processing of a vast amount of data.

For instance, typical microcomputers use an internal register or a general-purpose internal register, called an accumulator, as memory means for temporary storage of computing data. The accumulator may hold data from a data memory on one occasion, and holds the result of computation (e.g., addition) of two pieces of data from the data memory performed by a computing circuit on another occasion. Data temporarily held in the accumulator is sent back to the memory location specified on the data memory. Using a microcomputer with such a structure for tone generation requires a considerable time for frequent data transfer between the data memory and the accumulator (or general-purpose register) and thus becomes a hindrance to achieving tone generation processing that should deal with a vast amount of data.

A description will now be given of the envelope controller 7 (envelope generator) which is incorporated in hardware of a sound source circuit. FIG. 2 illustrates a typical envelope controller. Various values from a microcomputer are set in an envelope Δx register 24, an envelope Δy register 25 and a target envelope register 26 via the sound source analyzer 3 which serves as an interface. In operation, the content of an envelope Δx timer 21 is counted up by an INC counter 22. When the count value of this timer 21 coincides with the content of the envelope Δy register 24, a comparator 23 outputs a coincidence signal to clear the INC counter 22. The coincidence signal further opens an AND gate G1, and data Δy from the envelope Δy register 25 is input to an adder-subtracter 27. This data Δy is added to or subtracted from a present envelope value from a present envelope resister 29 in accordance with an adding/subtracting flag (a specific bit of the envelope Δy resister 25). The result of the computation is compared with a target envelope level from a target envelope register 29 by a second comparator 28. The comparison result is used to determine a new present envelope value. In other words, if the computed result has not reached the target envelope, it is output as a new present envelope value via a gate G2 and set back to the resister 29. If the computed result reaches the target envelope, however, the coincidence signal from the comparator 28 opens a gate G3 through an inverter INV to output the target envelope as a new present envelope value, which is then set back to the register 29. The coincidence signal from the comparator 28 is held in a coincidence signal holding circuit 30 to request setting of data of the next envelope step (Δx, Δy, a target envelope).

The envelope generator as shown in FIG. 2 has a shortcoming that it is part of the hardware of the sound source circuit. Once the microcomputer sets data of Δx, Δy and the target value; therefore, it cannot grasp a present envelope value thereafter. (Permitting the microcomputer to read out the present envelope value, though possible, requires a significantly complex circuit.) When it is necessary to jump the envelope step, therefore, it is difficult to set Δx, Δy, the target value) suitable for the present envelope value. Assuming that data for a release envelope which consists of three segments is on the microcomputer side as shown in FIG. 3, due to the present envelope value unclear, the microcomputer cannot determine data (Δx, Δy, the target value) to which segment should be sent to the sound source. A conventional solution to this problem is to send an envelope step update signal (the output of the coincidence signal holding circuit 30 in FIG. 2) to the microcomputer to request updating of the step and to transfer data for the next step to the sound source from the microcomputer. With this arrangement, although the microcomputer cannot grasp the present envelope value being produced by the sound source, it can grasp the envelope step being executed by the sound source. This permits the microcomputer to select a release envelope segment corresponding to a value which this envelope step can take at a tone release time, i.e., a release envelope segment having a target value lower than but closest to the target value of the present envelope, then transfer data for the selected release envelope segment to the sound source. This particular design, however, has a problem that a zigzag line characteristic of a release envelope is restricted by another envelope portion. This is because that release envelope data should be prepared in advance to match with the range of the envelope value of another step, thus limiting characteristic that the envelope can have.

With a design to allow a microcomputer itself to generate musical tones, it is very difficult, if not impossible, to completely keep constant the period of the sample sequence of digital musical tones to be sent to a digital-to-analog (D/A) converter from the microcomputer due to the nature of a program-controlled operation. In other words, since the amount of processing that should be done by the microcomputer varies with time by inputs to the microcomputer, the amount of processing required for tone generation included in intended data processing also varies. This means a variation in period for generating a digital musical tone. When a digital musical tone varying in an unstable period is converted into an analog signal, the resultant musical tone would be distorted, which is very crucial to electronic musical instruments.

SUMMARY OF THE INVENTION

Accordingly, it is the primary object of this invention to provide a data processing apparatus for an electronic musical instrument which has a new and improved structure to ensure tone generation under the program control of a computer, e.g., a microcomputer, without requiring special-purpose hardware of a sound source circuit.

To achieve this object, there is provided a digital musical tone signal outputting apparatus, comprising:

a processor means and an output means coupled to the processor means;

the processor means comprising:

program storage means for storing a first program for processing input data to control the apparatus, and for storing a second program for generating a digital musical tone signal as a function of processed input data;

data storage means for storing data necessary for generation of the digital musical tone signal, at least a portion of the data stored in the data storage means corresponding to processed input data processed by the first program;

computing means responsive to commands of the second program for computing the digital musical tone signal according to at least the data stored in the data storage means;

control means for decoding each command of the first and second programs stored in the program storage means and controlling operation of the data storage means and the computing means; and timing signal generating means for generating a timing signal for each predetermined sampling period of a computed digital musical tone signal; and the output means comprising:

first latch means for latching the digital musical tone signal generated by the processor means at an outputting timing of the digital musical tone signal from the processor means, the outputting timing not always corresponding in time to the timing signal; and second latch means for outputting the digital musical tone signal by latching an output signal of the first latch means when the timing signal is generated from the timing signal generating means to thereby produce, at an output of the second latch means, an accurately timed digital musical tone signal.

The above apparatus requires no hardware of a sound source circuit for generating musical tones. The data processing apparatus for an electronic musical instrument having this novel architecture has significant advantages. The first advantages is freedom of design. More specifically, alteration of the number of polyphonic sounds and alteration of a tone combining system can be coped with design alteration of a program. The second advantage is its capability to significantly reduce the overall circuit scale because no sound circuit hardware is needed. Conventionally, since a source circuit LSI chip has a large circuit scale, there is a limit to improving the yield in production of chips (the yield being substantially inversely proportional to the chip area). Those advantages can therefore considerably reduce the cost for manufacturing electronic musical instruments.

In one structural example, the program storage means comprises a read only memory (ROM). The microcomputer is realized by an integrated circuit chip on which a D/A converter for converting a digital musical tone into an analog signal and a port for receiving an input to control the electronic musical instrument are mounted in addition to the aforementioned components of the microcomputer. The arithmetic operation means may include a multiplier for computing waveform data.

It is another object of the present invention to provide a digital musical tone signal outputting apparatus, comprising:

a processor means and an output means coupled to the processor means; the processor means comprising:

program storage means for storing a first program for processing input data to control the apparatus, and for storing a second program for generating a digital musical tone signal as a function of processed input data;

data storage means for storing data necessary for generation of the digital musical tone signal, at least a portion of the data stored in the data storage means corresponding to processed input data processed by the first program;

computing means responsive to commands of the second program for computing the digital musical tone signal according to at least the data stored in the data storage means;

control means for decoding each command of the first and second programs stored in the program storage means and controlling operation of the data storage means and the computing means; and timer interrupt control means for generating an interrupt signal in a musical tone sampling period, the control means including means for fetching the second program for generating a digital musical tone signal from the program storage means responsive to receiving the interrupt signal from the timer interrupt control means, and wherein tone generation is effected by the computing means executing the fetched second program; and the output means comprising:

first latch means for latching the digital musical tone signal generated by the processor means at an outputting timing of the digital musical tone signal from the processor means, the outputting timing not always corresponding in time to the interrupt signal; and second latch means for outputting the digital musical tone signal by latching an output signal of the first latch means when the interrupt signal is generated from said timer interrupt control means to thereby produce, at an output of the second latch means, an accurately timed digital musical tone signal.

The program for generating musical tones is executed by interrupt program processing (interrupt processing) invoked by an interrupt signal which is generated in a tone sampling period. The use of such timer interrupt technique can ensure accurate tone generation. Further, programs to be stored in the program storage means can be efficiently prepared and the total number of steps of each program can be reduced, thus requiring less memory capacity for the program storage means. Furthermore, generation of an interrupt signal at every given time can be utilized so that if a routine for measuring the elapse of time is incorporated in the interrupt program, it is possible to acquire time data necessary in a main program (main flow), such as period with respect to the resolution of a tempo for an automatic musical performance or accompaniment.

Of parameters of a musical tone to be generated, an envelope gently changes with time, so that its generation may not be executed in the interrupt process. In that case, the timing at which the envelope is updated (at which a new envelope value is computed) can be known from the result of the time measuring process executed in the interrupt process while running the envelope producing process (if the envelope needs to be updated at a constant period).

In another structural example, the microcomputer is realized by an integrated circuit chip on which a D/A converter for converting a digital musical tone data into an analog signal and a port for receiving an input to control the electronic musical instrument are mounted in addition to the aforementioned components of the microcomputer.

It is a different object to provide a digital musical tone signal outputting apparatus, comprising:

a processor means and an output means coupled to the processor means;

the processor means comprising:

program storage means for storing a first program for processing input data to control the apparatus, and for storing a second program for generating a digital musical tone signal as a function of processed input data;

arithmetic operation storage means comprising a plurality of registers directly addressable by the programs in the program storage means, the registers including a first number of registers which are used by computing means for an arithmetic operation in executing the second program for generating a digital musical tone signal and exclusively holding musical tone parameters;

computing means responsive to commands of the second program for executing arithmetic operations between registers of the arithmetic operation storage means for computing the digital musical tone signal according to at least the data stored in the data storage means;

data storage means for storing data necessary for generation of the digital musical tone signal, the data storage means being addressable indirectly through the registers of the arithmetic operation storage means by the programs in the program storage means; and control means for decoding each command of the first and second programs stored in the program storage means and controlling operation of the arithmetic operation storage means, the data storage means and the computing means, whereby a digital musical tone signal is generated by executing the second program for generating a digital musical tone signal, and the first number of registers of the arithmetic operation storage means store exclusively tone parameters by execution of the second program for generating a digital musical tone signal; and timing signal generating means for generator a timing signal for each predetermined sampling period of a computed and generated digital musical tone signal; and the output means comprising:

first latch means for latching the digital musical tone signal generated by the processor means at an outputting timing of the digital musical tone signal from the processor means, the outputting timing not always corresponding in time to the timing signal; and second latch means for outputting the digital musical tone signal by latching an output signal of the first latch means when the timing signal is generated from the timing signal generating means to thereby produce, at an output of the second latch means, an accurately timed digital musical tone signal.

With the above arrangement, the registers in the arithmetic operation storage means can serve as means to store data as well as a so-called accumulator. This can eliminate the need for an ordinary accumulator. Further, the individual registers in the arithmetic operation storage means can be directly addressed by a program stored in the program storage means (which does not mean that it is not possible to execute indirect addressing such as the one done by an index). Accordingly, an arithmetic operation between the resisters can be directly executed (without going through the accumulator) using the arithmetic operation means. Furthermore, the individual registers in the arithmetic operation storage means can be used exclusively; general use of the registers is also possible so that the "exclusive use" does not mean to deny the general use of part of the registers. Particularly, the arithmetic operation storage means includes a group of registers which are used for arithmetic operation and for exclusively storing various musical tone parameters (such as an envelope rate, a phase value parameter and a phase change degree parameter). Running the tone generating program can ensure efficient execution of arithmetic operations (with the highest efficiency) between those resisters exclusive for the various musical tone parameters in an operational sequence until digital data sample of a musical tone is obtained, thus reducing the number of times data in the tone data storage means is referred to. This ensures quicker processing of a vast amount of data (musical tone parameters) and facilitates tone generation in real time. For instance, one resister is exclusively used to hold the value of the present phase (phase of a waveform), while another resister is exclusively used to hold data of the degree of a change in phase value. When conditions for updating the present phase value are met, the tone generating program issues a command to add the degree of change to the present phase value. At that time, it is not particularly necessary to read out data of the present phase value and the degree of change from the tone data storage means or to store the envelope value resulting from the required arithmetic operation. If the register (first register) for storing the present phase value is directly assigned as the first operand (item to be operated) and the register (second register) for storing the degree of change as the second operand (item to operate) and addition of these two values is specified by an operation code, then the data of the first register and the data of the second register are output and input to the arithmetic operation means where an adder performs the addition, and the output of this means (new phase value) is returned to the first register, all automatically, i.e., under the control of the operation control means. In case of a more complicated system where the degree of change in phase value varies depending on the phase ranges, a group of registers (referred to as group A) for exclusive storage of data about the degree of change within the respective ranges and another group of registers (referred to as group B) for exclusive storage of the phases at the boundaries of the phase ranges (boundary value data) should be prepared and the boundary values in the resister group B need to be compared with the present phase value prior to executing the phase addition. Based on the comparison result, the register storing the selected or desired degree of change is determined among the register group A. During the process carried out in the above two examples, it is totally unnecessary to access to the tone data storage means to acquirer data (musical tone parameters). In other words, unlike a typical microcomputer, it is possible to eliminate a process for reading data from the tone data storage means and holding it in an accumulator (or a general-purpose register).

As one effective means for maintaining the sampling period for tone generation, there may be a structure which utilizes the control mechanism of a timer interrupt and executes a tone generating program upon each occurrence of an interrupt. (A musical tone is generated by a timer interrupt program in the second embodiment to be described later.) Upon reception of an interrupt, ordinary microcomputers need to save the states of a process at that point of time in order to continue the process after the interrupt processing is completed. In this case, in running the tone generating program (the program which has made the interrupt), only an exclusive register is used to store musical tone parameters. This means that no data rewriting or updating is performed to those registers which are used program that has been interrupted, while the tone generating program is running. If the content of that register involved in a process is not updated, the status of that process need not be saved. This can eliminate the need to save and recover the status of a process (states of a general-purpose register), thus resulting in reduction in the processing time. (The status of a program counter or an equivalent element has only to be saved at the beginning of an interrupt.)

In one structural example, the microcomputer is realized by an integrated circuit chip. In preferred embodiments which will be described later, an input/output port for receiving control inputs to a musical instrument, a timer interrupt controller for causing an interrupt and a D/A converter for converting a digital data sample of a generated musical tone into an analog signal are also mounted on this IC chip. In addition, the arithmetic operation means includes a multiplier used for computing waveform data.

It is a further object to provide a data processing apparatus for an electronic musical instrument which can generate a musical tone without using exclusive sound source circuit hardware and can produce an envelope whose characteristic is free of any restriction at an accurate timing.

This object can be achieved by a digital musical tone signal outputting apparatus, comprising:

a processor means and an output means coupled to the processor means;

the processor means comprising:

program storage means for storing a first program for processing input data to control the apparatus, and for storing a second program for generating a digital musical tone signal as a function of processed input data;

data storage means for storing data necessary for generation of the digital musical tone signal, at least a portion of the data stored in the data storage means corresponding to processed input data processed by the first program;

computing means responsive to commands of the second program for computing the digital musical tone signal according to at least the data stored in the data storage means;

control means for decoding each command of the first and second programs stored in the program storage means and controlling operation of the data storage means and the computing means; and timer interrupt control means for generating an interrupt signal in a musical tone sampling period, the control means including means for fetching the second program for generating a digital musical tone signal from the program storage means responsive to receiving the interrupt signal from the timer interrupt control means, and wherein the second program includes a routine for computing a waveform of a musical tone and a routine for computing an envelope of a musical tone, and generation of the waveform of the musical tone is executed substantially in synchronism with generation of the envelope of the musical tone; and the output means comprising:

first latch means for latching the digital musical tone signal generated by the processor means at an outputting timing of the digital musical tone signal from the processor means, the outputting timing not always corresponding in time to the interrupt signal; and second latch means for outputting the digital musical tone signal by latching an output signal of the first latch means when the interrupt signal is generated from the timer interrupt control means to thereby produce, at an output of the second latch means, an accurately timed digital musical tone signal.

The elimination of the need for sound source circuit hardware results in reduction in circuit scale, improvement of the yield in production and design freedom. In addition, the generation of an envelope at an accurate timing can provide a better envelope. Furthermore, since the functions of an electronic musical instrument are realized entirely under a program control according to the present invention, the microcomputer can always grasp the present envelope value which is originated from execution of a routine to compute the envelope of a musical tone. Accordingly, it is free to jump the steps of an envelope, thus totally eliminating any restriction to the characteristic of an envelope that can be generated.

In a different structural example, the microcomputer is realized by an integrated circuit chip on which a D/A converter for converting a digital musical tone into an analog signal and a port for receiving an input to control the electronic musical instrument are mounted in addition to the aforementioned components of the microcomputer.

It is a still another object of the present invention to provide a data processing apparatus for an electronic musical instrument which can extract a digital musical tone generated by a microcomputer itself at an accurate sampling period and output it as an analog signal with less distortion.

To achieve this object, there is provided a musical tone signal outputting apparatus comprising:

a digital processor means for generating a digital musical tone signal under a program control, the processor means comprising:

time signal generating means for outputting an accurate sampling time signal with a predetermined sampling period; and computing means for computing a digital musical tone signal at timings which may vary with reference to the sampling time signal;

first latch means for latching the digital musical tone signal computed by the computing means at an ending timing of computation of the digital musical tone signal at timings which may vary with reference to the sampling time signal; and second latch means, provided between an output of the first latch means and an input of a digital-to-analog converting means, for latching an output signal of the first latch means at a timing of the sampling time signal to thereby produce, at an output of the second latch means, an accurately timed digital musical tone signal.

With the above arrangement, a digital musical tone signal supplied to the input of the D/A converting means can be switched at a timing of an accurate sampling time signal by the function of the second latch means. This means that the conversion period for converting a digital signal into an analog signal in the D/A converting means is accurately maintained. Therefore, distortion on an analog musical tone signal which may occur during D/A conversion can be reduced as much as possible, so that an acoustic signal with a good quality can be output.

In one structural example, the microcomputer is realized by an integrated circuit chip on which a D/A converter for converting a digital musical tone into an analog signal and a port for receiving an input to control the electronic musical instrument are mounted in addition to the aforementioned components of the microcomputer.

It is a still further object of the present invention to provide an electronic musical instrument having a microcomputer, thus eliminating the need for exclusive sound source circuit hardware.

It is a still different object of the present invention to provide an electronic musical instrument having a microcomputer without requiring exclusive sound source circuit hardware and which apparatus can generate an envelope free of restriction on its characteristic at an accurate timing.

It is a still another object of this invention to provide an electronic musical instrument having a microcomputer that controls a tone generating program to generate a musical tone and which apparatus can extracts a digital musical tone at an accurate sampling period to thereby acquire an analog signal with less distortion.

It is a still further object of the present invention to attain high-grade sound source processing which can assign different sound source methods to a plurality of tone generation channels under the program control of a microprocessor without requiring a special-purpose sound source circuit.

It is another object of the present to allow generation of musical tone signals in different tones or different sound source methods in units of regions, or operation velocities, or music parts having a split point as a boundary under the program control of a microprocessor without requiring a special-purpose sound source circuit.

According to the first aspect of the present invention, there is provided a musical tone waveform generation apparatus comprising: storage means for storing a plurality of sound source processing programs corresponding to a plurality of types of sound source methods; musical tone signal generation means for generating musical tone signals in arbitrary sound source methods in tone generation channels by executing the plurality of sound source programs stored in the storage means; and musical tone signal output means for outputting the musical tone signals generated by the musical tone signal generation means at predetermined output time intervals.

According to the musical tone waveform generation apparatus of the first aspect of the present invention, high-grade sound source processing which can assign different sound source methods to a plurality of tone generation channels without using a special-purpose sound source circuit can be performed. Since a constant output rate of a musical tone signal can be maintained upon operation of the musical tone signal output means, a musical tone waveform will not be distorted.

According to the second aspect of the present invention, there is provided a musical tone waveform generation apparatus comprising: program storage means for storing a performance data processing program for processing performance data, and a plurality of sound source processing programs corresponding to a plurality of sound source methods for obtaining a musical tone signal; address control means for controlling an address of the program storage means; data storage means for storing musical tone generation data necessary for generating a musical tone signal by an arbitrary one of the plurality of sound source methods in units of tone generation channels; arithmetic processing means for performing a predetermined arithmetic operation; program execution means for executing the performance data processing program and the sound source processing program stored in the program storage means while controlling the address control means, the data storage means, and the arithmetic processing means, for normally executing the performance data processing program to control musical tone generation data on the data storage means, for executing the sound source processing program at predetermined time intervals, for executing the performance data processing program again upon completion of the sound source processing program, and for executing time-divisional processing on the basis of musical tone generation data on the data storage means upon execution of the sound source processing program so as to generate musical tone signals by the sound source methods assigned to the tone generation channels; and musical tone signal output means for holding the musical tone signals obtained upon execution of the sound source processing programs by the program execution means, and outputting the held musical tone signals at predetermined output time interval.

In the musical tone waveform generation apparatus according to the second aspect of the present invention, the program storage means, the address control means, the data storage means, the arithmetic processing means, and the program execution means have the same arrangement as a versatile microprocessor, and no special-purpose sound source circuit is required at all. The musical tone signal output means is versatile in the category of a musical tone waveform generation apparatus although it has an arrangement different from that of a versatile microprocessor.

The circuit scale of the overall musical tone waveform generation apparatus can be greatly reduced, and when the apparatus is realized by an LSI, the same manufacturing technique as that of a normal processor can be adopted. Since the yield of chips can be increased, manufacturing cost can be greatly reduced. Since the musical tone signal output means can be constituted by simple latch circuits, addition of this circuit portion causes almost no increase in manufacturing cost.

When a modulation method is required to be switched, or when the number of polyphonic channels is required to be changed, a sound source processing program stored in the program storage means need only be changed to meet the above requirements. Therefore, the development cost of a new musical tone waveform generation apparatus can be greatly reduced, and a new modulation method can be presented to a user by means of, e.g., a ROM card.

The above-mentioned effects can be provided since the second aspect of the present invention can realize the following program and data architectures.

More specifically, the musical tone waveform generation apparatus according to the second aspect of the present invention realizes a data architecture in which musical tone generation data necessary for generating musical tones are stored on the data storage means. When a performance data processing program is executed, corresponding musical tone generation data on the data storage means are controlled, and when a sound source processing program is executed, musical tone signals are generated on the basis of the corresponding musical tone generation data on the data storage means. In this manner, a data communication between the performance data processing program and the sound source processing program is performe via musical tone generation data on the data storage means, and access of one program to the data storage means can be performed regardless of an execution state of the other program. Therefore, the two programs can have substantially independent module arrangements, and hence, a simple and efficient program architecture can be attained.

In addition to the data architecture, the musical tone waveform generation apparatus according to the second aspect of the present invention realizes the following program architecture. That is, the performance data processing program is normally executed to execute, e.g., scanning of keyboard keys and various setting switches, demonstration performance control, and the like. During execution of this program, the sound source processing program is executed at predetermined time intervals, and upon completion of the processing, the control returns to the performance data processing program. Thus, the sound source processing program forcibly interrupts the performance data processing program on the basis of an interrupt signal generated from the interrupt control means at predetermined time intervals. For this reason, the performance data processing program and the sound source processing program need not be synchronized.

When the program execution means executes the sound source processing program, its processing time changes depending on sound source methods. However, the change in processing time can be absorbed by the musical tone signal output means. Therefore, no complicated timing control program for outputting musical tone signals to, e.g., a D/A converter is required.

As described above, the data architecture for attaining a data link between the performance data processing program and the sound source processing program via musical tone generation data on the data storage means, and the program architecture for executing the sound source processing program at predetermined time intervals while interrupting the performance data processing program are realized, and the musical tone signal output means is arranged. Therefore, sound source processing under the efficient program control can be realized by substantially the same arrangement as a versatile processor.

Furthermore, the data storage means stores musical tone generation data necessary for generating musical tone signals in an arbitrary one of a plurality of sound source methods in units of tone generation channels, and the program execution means executes the performance data processing program and the sound source processing program by time-divisional processing in correspondence with the tone generation channels. Therefore, the program execution means accesses the corresponding musical tone generation data on the data storage means at each time-divisional timing, and executes a sound source processing program of the assigned sound source method while simply switching the two programs. In this manner, musical tone signals can be generated by different sound source methods in units of tone generation channels.

In this manner, according to the second aspect of the present invention, musical tone signals can be generated by different sound source methods in units of tone generation channels under the simple control, i.e., by simply switching between time-divisional processing for musical tone generation data in units of tone generation channels on the data storage means, and a sound source processing program based on the musical tone generation data.

According to the third aspect of the present invention, there are provided a musical tone waveform generation apparatus comprising: storage means for storing a sound source processing program; musical tone signal a generation means for executing the sound source processing program stored in the storage means to generate a musical tone signal; pitch designation means for designating a pitch of the musical tone signal generated by the musical tone signal generation means; tone color determination means for determining a tone color of the musical tone signal generated by the musical tone signal generation means in accordance with the pitch designated by the pitch designation means; control means for controlling the musical tone signal generation means to generate the musical tone signal having the pitch designated by the pitch designation means and the tone color determined by the tone color determination means; and musical tone signal output means for outputting the musical tone signal generated by the musical tone signal generation means at predetermined time intervals.

According to the fourth aspects of the present invention, there are provided a musical tone waveform generation apparatus comprising: storage means for storing a sound source processing program; musical tone signal generation means for executing the sound source processing program stored in the storage means to generate a musical tone signal; a performance operation member for instructing the musical tone signal generation means to generate the musical tone signal; tone color determination means for determining a tone color of the musical tone signal to be generated by the musical tone signal generation means in accordance with an operation velocity of the performance operation member; control means for controlling the musical tone signal generation means to generate the musical tone signal having the tone color determined by the tone color determination means; and musical tone signal output means for outputting the musical tone signal generated by the musical tone signal generation means at predetermined time intervals.

According to the fifth aspect of the present invention, there are provided a musical tone waveform generation apparatus comprising: storage means for storing a sound source processing program; musical tone signal generation means for executing the sound source processing program stored in the storage means to generate a musical tone signal; output means for outputting performance data of a plurality of parts constituting a music piece; tone color determination means for determining a tone color of the musical tone signal to be generated by the musical tone signal generation means in accordance with one of the plurality of parts to which the performance data output from the output means belongs; control means for controlling the musical tone generation means to generate the musical tone signal having the tone color determined by the tone color determination means; and musical tone signal output means for outputting the musical tone signal generated by the musical tone signal generation means at predetermined time intervals.

According to the musical tone waveform generation apparatuses of the third, fourth, and fifth aspects of the present invention, musical tone signals can be generated in different tone colors in units of regions, or operation velocities, or musical parts having a split point as a boundary without using a special-purpose sound source circuit. Since a constant output rate of musical tone signals can be maintained upon operation of the musical tone signal output means, a musical tone waveform will not be distorted.

According to the sixth aspect of the present invention, there are provided a musical tone waveform generation apparatus comprising: program storage means for storing a performance data processing program for processing performance data, and a sound source processing program for obtaining a musical tone signal; address control means for controlling an address of the program storage means; split point designation means for causing a player to designate a split point to divide a range of a performance data value into a plurality of ranges; tone color designation means for designating tone colors of the plurality of ranges having the split point designated by the split point designation means as a boundary; data storage means for storing musical tone generation data necessary for generating the musical tone signal in correspondence with a plurality of tone colors; arithmetic processing means for processing data; program execution means for executing the performance data processing program and the sound source processing program stored in the program storage means while controlling the address control means, the data storage means, and the arithmetic processing means, for normally executing the performance data processing program to control musical tone generation data stored in the data storage means, for executing the sound source processing program at predetermined time intervals, for executing the performance data processing program again upon completion of the sound source processing program, and for generating, upon execution of the sound source processing program, the musical tone signal on the basis of the musical tone generation data on the data storage means corresponding to the tone color designated by the tone color designation means in correspondence with the range which has the split point designated by the split point designation means as a boundary, and to which the performance data value belongs; and musical tone signal output means for holding the musical tone signals in units of tone generation operations obtained upon execution of the sound source processing program by the program execution means, and outputting the held musical tone signals at predetermined output time intervals.

According to the seventh aspect of the present invention, there are provided a musical tone waveform generation apparatus comprising: program storage means for storing a performance data processing program for processing performance data, and a plurality of sound source processing programs corresponding to a plurality of sound source methods for obtaining a musical tone signal; address control means for controlling an address of the program storage means; split point designation means for causing a player to designate a split point to divide a range of a performance data value into a plurality of ranges; sound source method designation means for causing the player to designate the sound source methods for the divided ranges having the split point designated by the split point designation means as a boundary; data storage means for storing musical tone generation data necessary for generating the musical tone signal in correspondence with the plurality of sound source methods; arithmetic processing means for processing data; program execution means for executing the performance data processing program or the sound source processing program stored in the program control means while controlling the address control means, the data storage means, and the arithmetic processing means, for normally executing the performance data processing program to control musical tone generation data on the data storage means, for executing the sound source processing program at predetermined time intervals, for executing the performance data processing program again upon completion of the sound source processing program, and for generating, upon execution of the sound source processing program, the musical tone signal on the basis of the musical tone generation data corresponding the sound source method corresponding to the range to which the performance data value belongs, and by the sound source processing program corresponding to the sound source method; and musical tone signal output means for holding the musical tone signals obtained upon execution of the sound source processing programs by the program execution means, and outputting the held musical tone signals at predetermined output time intervals.

According to the eighth aspects of the present invention, there are provided a musical tone waveform generation apparatus comprising: program storage means for storing a performance data processing program for processing performance data, and a sound source processing program for obtaining a musical tone signal; address control means for controlling an address of the program storage means; tone color designation means for causing a player to designate tone colors in units of music parts of musical tone signals to be played; data storage means for storing musical tone generation data necessary for generating a musical tone signal in an arbitrary one of the plurality of tone colors; arithmetic processing means for processing data; program execution means for executing the performance data processing program and the sound source processing program stored in the program control means while controlling the address control means, the data storage means, and the arithmetic processing means, for normally executing the performance data processing program to control musical tone generation data on the data storage means, for executing the sound source processing program at predetermined time intervals, for executing the performance data processing program again upon completion of the sound source processing program, and for generating, upon execution of the sound source processing program, the musical tone signal on the basis of the musical tone generation data on the data storage means corresponding to the tone color designated by the tone color designation means in correspondence with the music part of the musical tone signal generated by the sound source processing program; and musical tone signal output means for holding the musical tone signals in units of tone generation operations obtained upon execution of the sound source processing program by the program execution means, and outputting the held musical tone signals at predetermined output time intervals.

According to the ninth aspect of the present invention, there are provided a musical tone waveform generation apparatus comprising: program storage means for storing a performance data processing program for processing performance data, and a plurality of sound source processing programs corresponding to a plurality of sound source methods for obtaining a musical tone signal; address control means for controlling an address of the program storage means; sound source method designation means for causing a player to designate sound source methods in units of music parts of musical tone signals to be played; data storage means for storing musical tone generation data necessary for generating a musical tone signal by an arbitrary one of the plurality of sound source methods; arithmetic processing means for processing data; program execution means for executing the performance data processing program and the sound source processing program stored in the program control means while controlling the address control means, the data storage means, and the arithmetic processing means, for normally executing the performance data processing program to control musical tone generation data on the data storage means, for executing the sound source processing program at predetermined time intervals, for executing the performance data processing program again upon completion of the sound source processing program, and for generating, upon execution of the sound source processing program, the musical tone signal on the basis of the musical tone generation data corresponding to the sound source method corresponding to the music part of the musical tone signal generated by the sound source processing program, and by the sound source processing program corresponding to the sound source method; and musical tone signal output means for holding the musical tone signals obtained upon execution of the sound source processing programs by the program execution means, and outputting the held musical tone signals at predetermined output time intervals.

According to the musical tone waveform generation apparatuses according to the sixth and seventh aspects of the present invention, a player can designate a split point, and can also designate tone colors or sound source methods in units of ranges having the designated split point as a boundary, so that musical tone signals can be generated by switching the corresponding tone colors or sound source methods in accordance with the above-described ranges of predetermined performance data.

According to the musical tone waveform generation apparatuses according to the eighth and ninth aspects of the present invention, tone colors or sound source methods can also be switched in accordance with not a split point but music parts.

It is a further object of the present invention to realize sound source processing based on a modulation method under the program control of a microprocessor without requiring a special-purpose sound source circuit.

It is another object of the present invention to realize sound source processing based on a modulation method, which can be operated in various musical tone generation algorithms under the program control of a microprocessor without requiring a special-purpose sound source circuit.

According to the tenth aspect of the present invention, there is provided a musical tone waveform generation apparatus comprising: storage means for storing a sound source processing program based on a predetermined modulation method; musical tone signal generation means for generating a musical tone signal on the basis of a process of the modulation method by executing the sound source processing program stored in the storage means; and musical tone signal output means for outputting the musical tone signal generated by the musical tone signal generation means at predetermined time intervals.

According to the musical tone waveform generation apparatus of the tenth aspect of the present invention, high-level sound source processing based on a modulation method can be realized without using a special-purpose sound source circuit, and since a constant output rate of a musical tone signal can be maintained upon operation of the musical tone signal output means, a musical tone waveform free from a distortion can be obtained.

According to the eleventh aspect of the present of invention, there is provided a musical tone waveform generation apparatus comprising: program storage means for storing a performance data processing program for processing performance data, and a sound source processing program, based on a modulation method, for obtaining a musical tone signal; address control means for controlling an address of the program storage means; data storage means for storing musical tone generation data necessary for generating a musical tone signal based on the modulation method; arithmetic processing means for performing arithmetic processing; program execution means for executing the performance data processing program and the sound source processing program stored in the program storage means while controlling the address control means, the data storage means, and the arithmetic processing means, the program execution means normally executing the performance data processing program to control musical tone generation data on the data storage means, executing the sound source processing program at predetermined time intervals, executing the performance data processing program again upon completion of the sound source processing program, and generating a musical tone signal by the modulation method on the basis of the musical tone generation data on the data storage means upon execution of the sound source processing program; and musical tone signal output means for holding the musical tone signal obtained when the program execution means executes the sound source processing program, and outputting the held musical tone signal at predetermined output time intervals.

According to the musical tone waveform generation apparatus of the eleventh aspect of the present invention, the program storage means, the address control means, the data storage means, the arithmetic processing means, and the program execution means have the same arrangement as a versatile microprocessor, and no special-purpose sound source circuit is required at all. The musical tone signal output means is versatile in the category of a musical tone waveform generation apparatus although it has an arrangement different from that of a versatile microprocessor.

The circuit scale of the overall musical tone waveform generation apparatus can be greatly reduced, and when the apparatus is realized by an LSI, the same manufacturing technique as that of a normal processor can be adopted. Since the yield of chips can be increased, manufacturing cost can be greatly reduced. Since the musical tone signal output means can be constituted by simple latch circuit, addition of this circuit portion causes almost no increase in manufacturing cost.

When a modulation method is required to be switched between, e.g., a phase modulation method and a frequency modulation method, or when the number of polyphonic channels is required to be changed, a sound source processing program stored in the program storage means need only be changed to meet the above requirements. Therefore, the development cost of a new musical tone waveform generation apparatus can be greatly reduced, and a new modulation method can be presented to a user by means of, e.g., a ROM card.

The above-mentioned effects can be provided since the eleventh aspect of the present invention can realize the following program and data architectures.

More specifically, the eleventh aspect of the present invention uses the data architecture for storing musical tone generation data necessary for generating musical tones in a modulation method on the data storage means. When a performance data processing program is executed, the musical tone generation data on the data storage means are controlled, and when a sound source processing program is executed, musical tone signals are generated on the basis of the musical tone generation data on the data storage means. A data communication between the performance data processing program and the sound source processing program is performed via musical tone generation data on the data storage means, and access of one program to the data storage means can be performed regardless of an execution state of the other program. Therefore, the two programs can have substantially independent module arrangements, and hence, a simple and efficient program architecture can be attained.

In addition to the data architecture, the eleventh aspect of the present invention uses the following program architecture. That is, the performance data processing program is normally executed for scanning of keyboard keys and various setting switches, demonstration performance control, and the like. During execution of this program, the sound source processing program is executed at predetermined time intervals, and upon completion of the processing, the control returns to the performance data processing program. Thus, the sound source processing program forcibly interrupts the performance data processing program on the basis of an interrupt signal generated from the interrupt control means at predetermined time intervals. For this reason, the performance data processing program and the sound source processing program need not be synchronized.

When the program execution means executes the sound source processing program, its processing time changes depending on the type of modulation method or a selected musical tone generation algorithm in the modulation method. However, the change in processing time can be absorbed by the the musical tone signals output means. Therefore, no complicated timing control program for outputting musical tone signals to, e.g., a D/A converter is required.

As described above, the data architecture for attaining a data link between the performance data processing program and the sound source processing program via musical tone generation data on the data storage means, and the program architecture for executing the sound source processing program at predetermined time intervals while interrupting the performance data processing program are realized, and the musical tone signal output means is arranged. Therefore, sound source processing under the efficient program control can be realized by substantially the same arrangement as a versatile processor.

According to the twelfth aspect of the present invention, there is provided a musical tone waveform generation apparatus comprising: storage means for storing a sound source processing program associated with a modulation method, having an operator processing program for executing operator processings, and an algorithm processing program for executing algorithm processing for determining an input/output relationship among operator processing; musical tone signal generation means for generating musical tone signal by executing the operator processing operations based on the operator processing program at a time, and executing the algorithm processing program independently of the operator processing program; and musical tone signal output means for outputting the musical tone signal generated by the musical tone signal generation means at predetermined output time intervals.

According to the musical tone waveform generation apparatus of the twelfth aspect of the present invention, high-level sound source processing which can be operated in various musical tone generation algorithms can be realized without using a special-pourpose sound source circuit, and a constant output rate of a musical tone signal can be maintained upon operation of the musical tone signal output means. Therefore, a musical tone waveform free from a distortion can be obtained.

According to the thirteenth aspect of the present invention, there is provided musical tone waveform generation apparatus comprising: program storage means for storing a performance data processing program for processing performance data, and a sound source processing program based on a modulation method for obtaining a musical tone signal, the sound source processing program having a processing architecture in which algorithm processing operations for determining an input/output relationship among a plurality of operations processing operations are executed at a time after or before execution of the plurality of operator processing operation at a time as modulation processing units; address control means for controlling an address of the program storage means; data storage means for storing musical tone generation data necessary for generating a musical tone signal based on the modulation method; arithmetic processing means for processing data; program execution means for executing the performance data processing program and the sound source processing program stored in the program storage means while controlling the address control means, the data storage means, and the arithmetic processing means, for normally executing the performance data processing program to control musical tone generation data on the data storage means, for executing the sound source processing program at predetermined time intervals, for executing the performance data processing program again upon completion of the sound source processing program, and for generating a musical tone signal by the modulation method on the basis of the musical tone generation data on the data storage means upon execution of the sound source processing program; and musical tone signal output means for holding the musical tone signal obtained when the program execution means executes the sound source processing program, and outputting the held musical tone signal at predetermined output time intervals.

The musical tone waveform generation apparatus according to the thirteenth aspect of the present invention has, as an architecture of the sound source processing program, a processing architecture for simultaneously executing algorithm processing operations for determining the I/O (input/output) relationship of operator processing operations before or after simultaneous execution of the operator processing operations as modulation processing units. Since a conventional apparatus has a processing architecture in that the I/O relationship of the next operator is determined by a designated algorithm upon completion of one operator processing, a plurality of types of sound source processing programs including operator processing portions must be prepared in units of algorithms. In contrast to this, in the musical tone waveform generation apparatus according to the thirteenth aspect of the present invention, a plurality of types of only algorithm processing portions are prepared, and are switched as needed even when sound source processing is to be performed by an algorithm selected from a plurality of algorithms. Therefore, the sound source processing program can be rendered very compact.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

FIG. 37 shows a data format in units of sound source methods on the RAM;

FIGS. 57 and 58 are views showing assignment methods of X and Y tone colors to tone generation channels;

FIG. 74 shows an architecture of data formats in units of sound source methods on the RAM;

DETAILED DESCRIPTION OF THE PREFERRED EMBODIMENTS

First Embodiment

The first preferred embodiment of this invention will now be described referring to the accompanying drawings.

Figure 1:
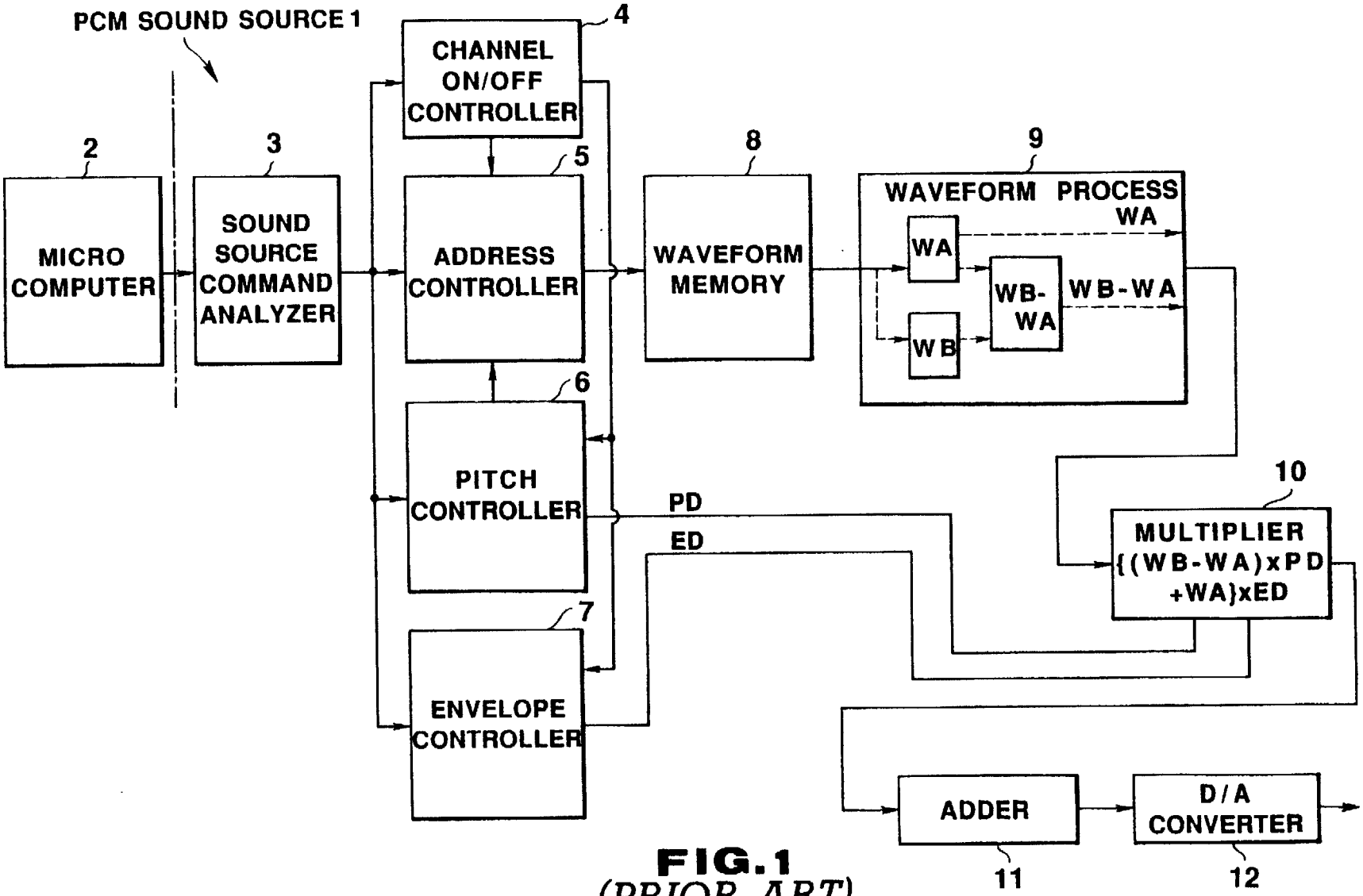
FIG. 1 (PRIOR ART)
FIG. 1 is a general diagram of a conventional electronic musical instrument of a PCM sound source system.
Figure 2:
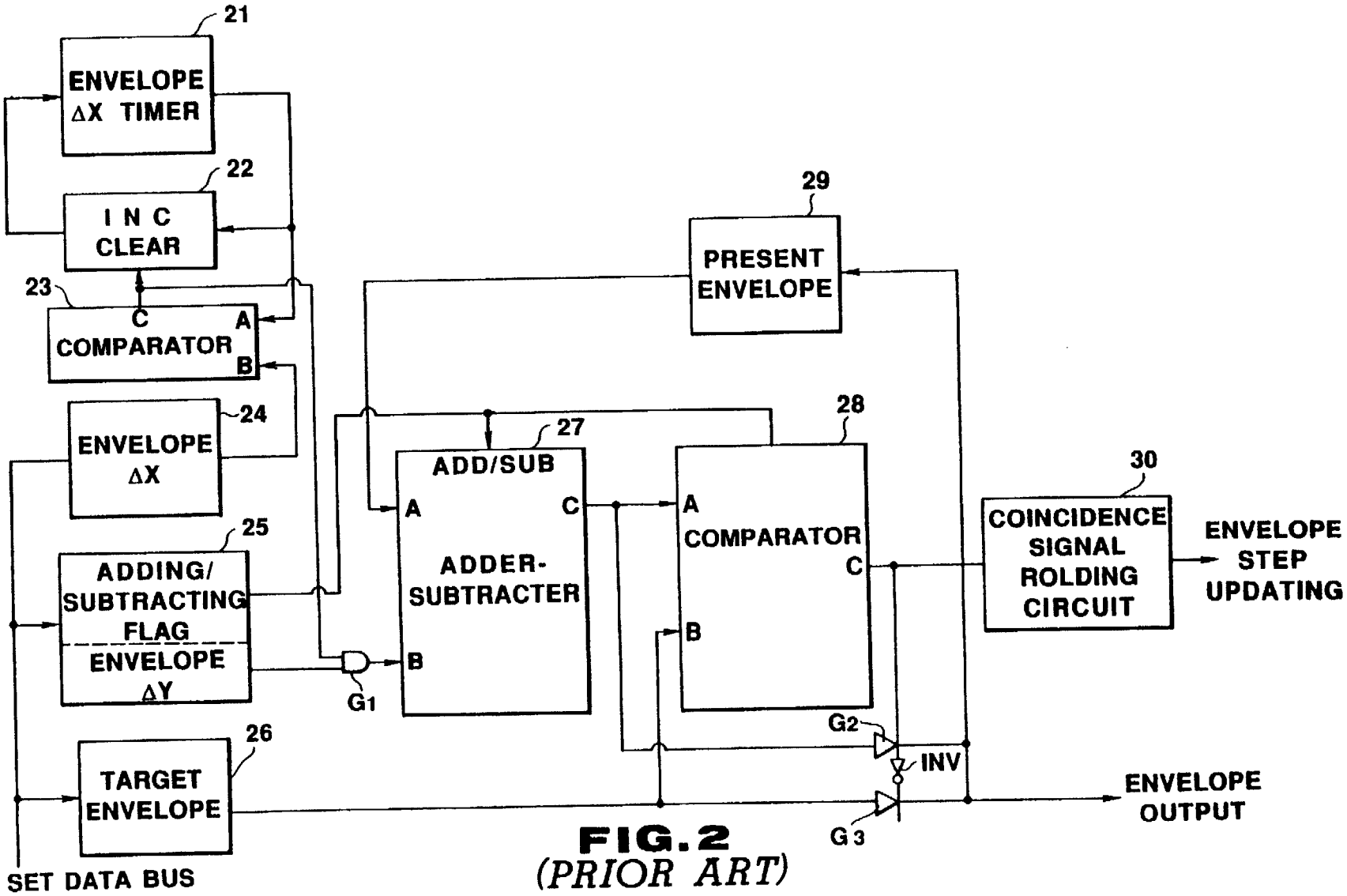
FIG. 2 (PRIOR ART)
FIG. 2 is a diagram illustrating a conventional envelope generator for providing an envelope.
Figure 3:
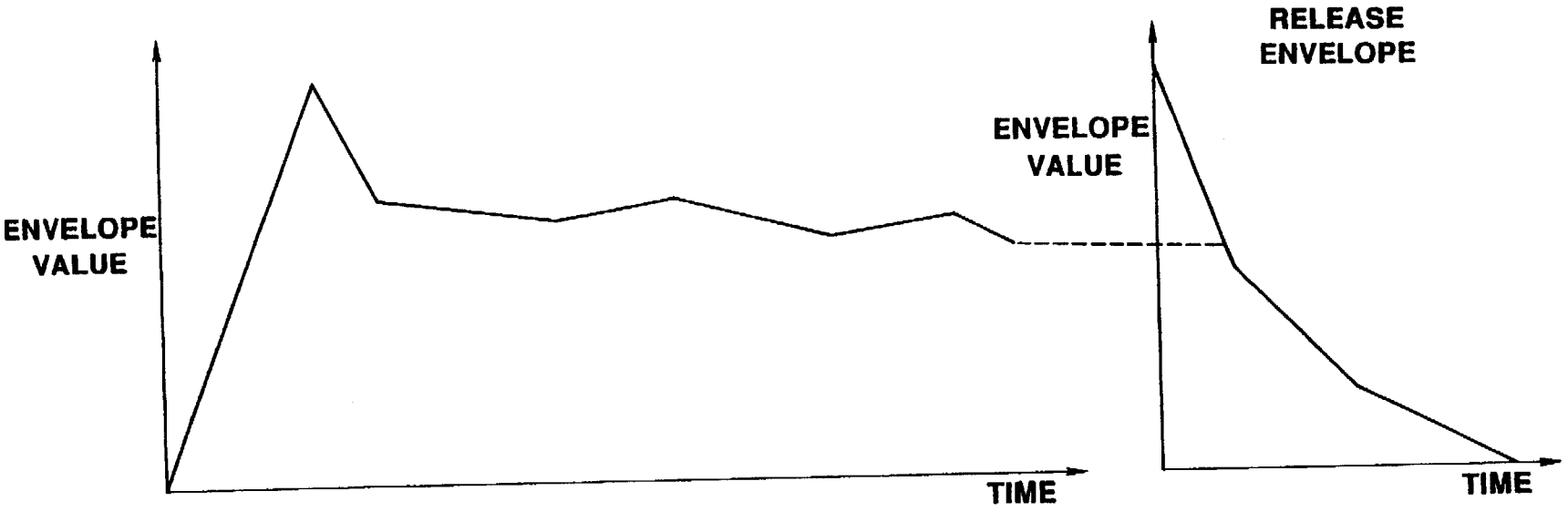
FIG. 3 (PRIOR ART)
FIG. 3 is a diagram illustrating the status of producing an envelope according to the prior art.
Figure 4:
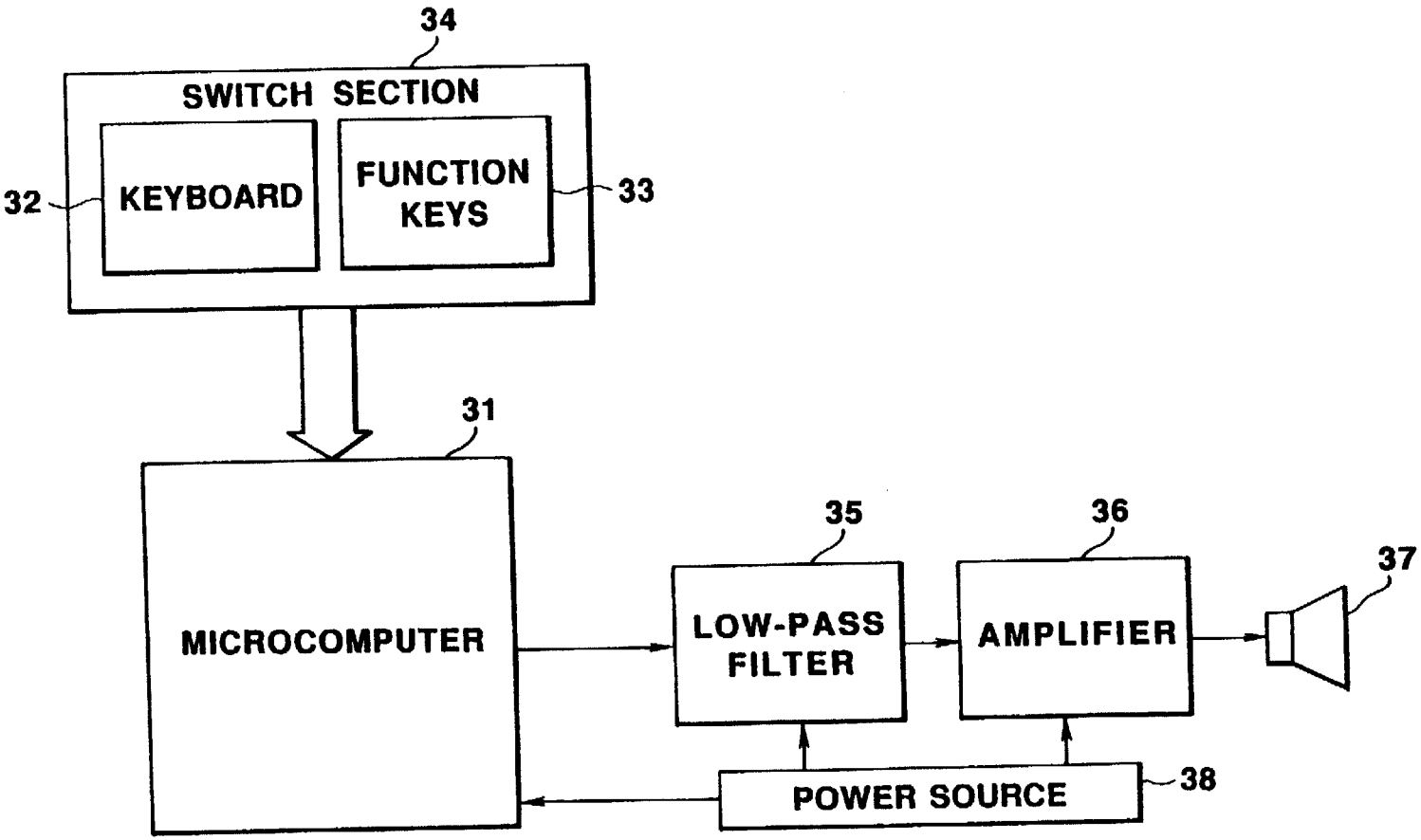
FIG. 4 is a general block diagram of an electronic musical instrument according to the present invention.

FIG. 4 illustrates the general structure of an electronic musical instrument associated with the first embodiment. The general control of the apparatus is executed by a microcomputer 31. In other words, the microcomputer 31 executes not only processing of control inputs to a musical instrument but also a tone generation process, so that no sound source circuit hardware is required for tone generation. A switch section 34 comprising a keyboard 32 and function keys 33 serves as a source to enter control inputs to a musical instrument, and data entered via this switch section 34 is processed by the microcomputer 31. A digital tone signal generated by the microcomputer 31 is converted into an analog signal by a D/A converter (included within the microcomputer 31), filtered by a low-pass filter 35 and amplified by an amplifier 36 so that a musical sound is produced through a loudspeaker 37. A power source 38 serves to supply the necessary power to the microcomputer 31, low-pass filter 35 and amplifier 36.

Figure 5:
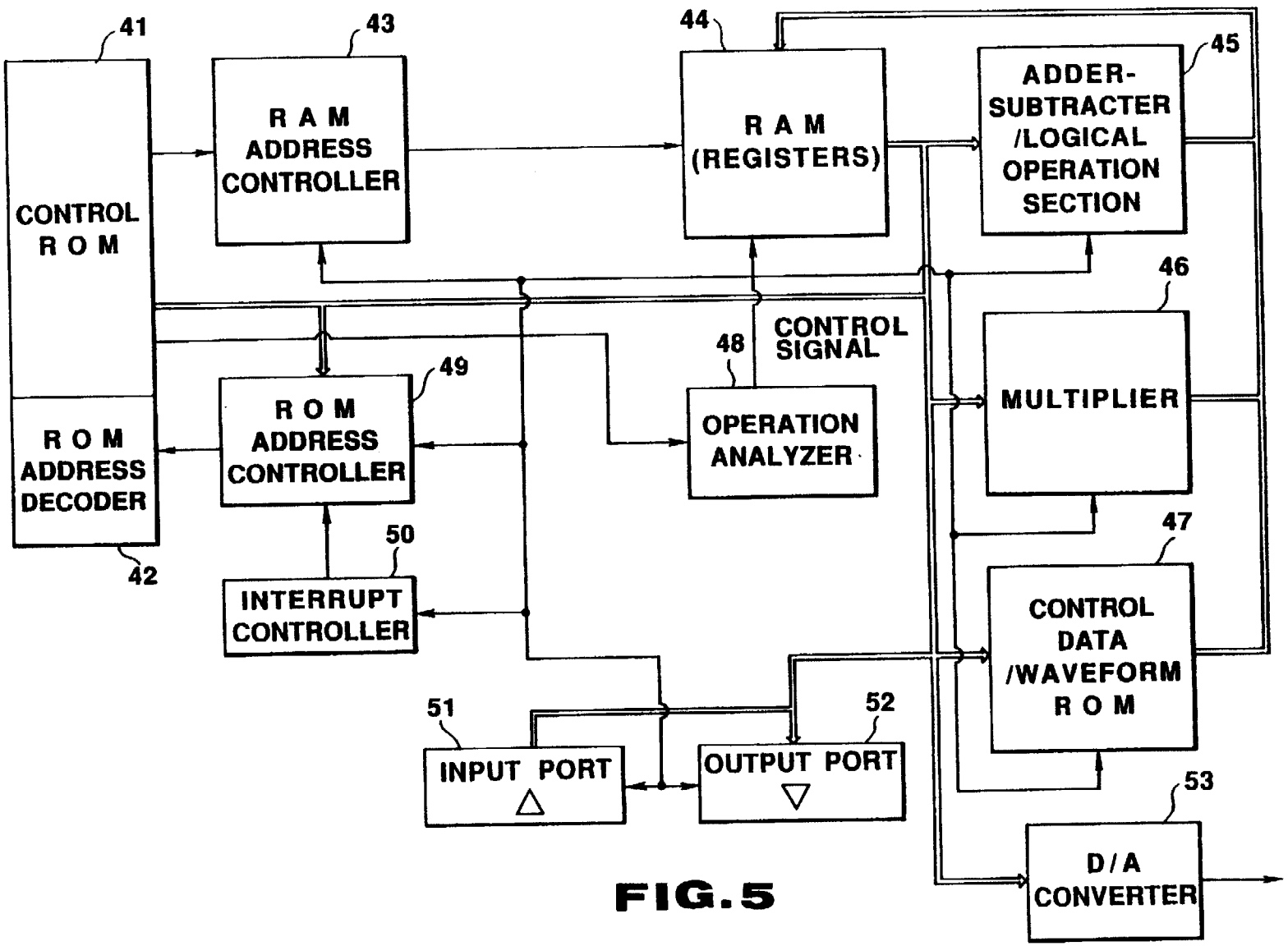
FIG. 5 is a block diagram of a microcomputer.

FIG. 5 illustrates in a block diagram the internal structure of the microcomputer 31. The individual elements illustrated are mounted on one chip. The microcomputer 31 actually manufactured with a chip size of 5 mm×5 mm is capable of generating eight polyphonic sounds simultaneously and is of a PCM (Pulse Code Modulation) type tone forming system. It should however be noted that the present invention can well apply to other microcomputers capable of generating a different number of polyphonic sounds and having a different tone forming system.

A program for processing various control inputs to a musical instrument and a program for generating musical tones are stored in a control ROM 41, and program words (commands) located at addresses specified via a ROM address decoder 42 by a ROM address controller 49 are sequentially output. In the specific embodiment, a program word has a length of 28 bits and part of the program word is input as a lower portion of the next address to be read out (address within a page) to the ROM address controller 49; this is a so-called next address system. Alternately, a program counter system may also be employed.

Figure 11:
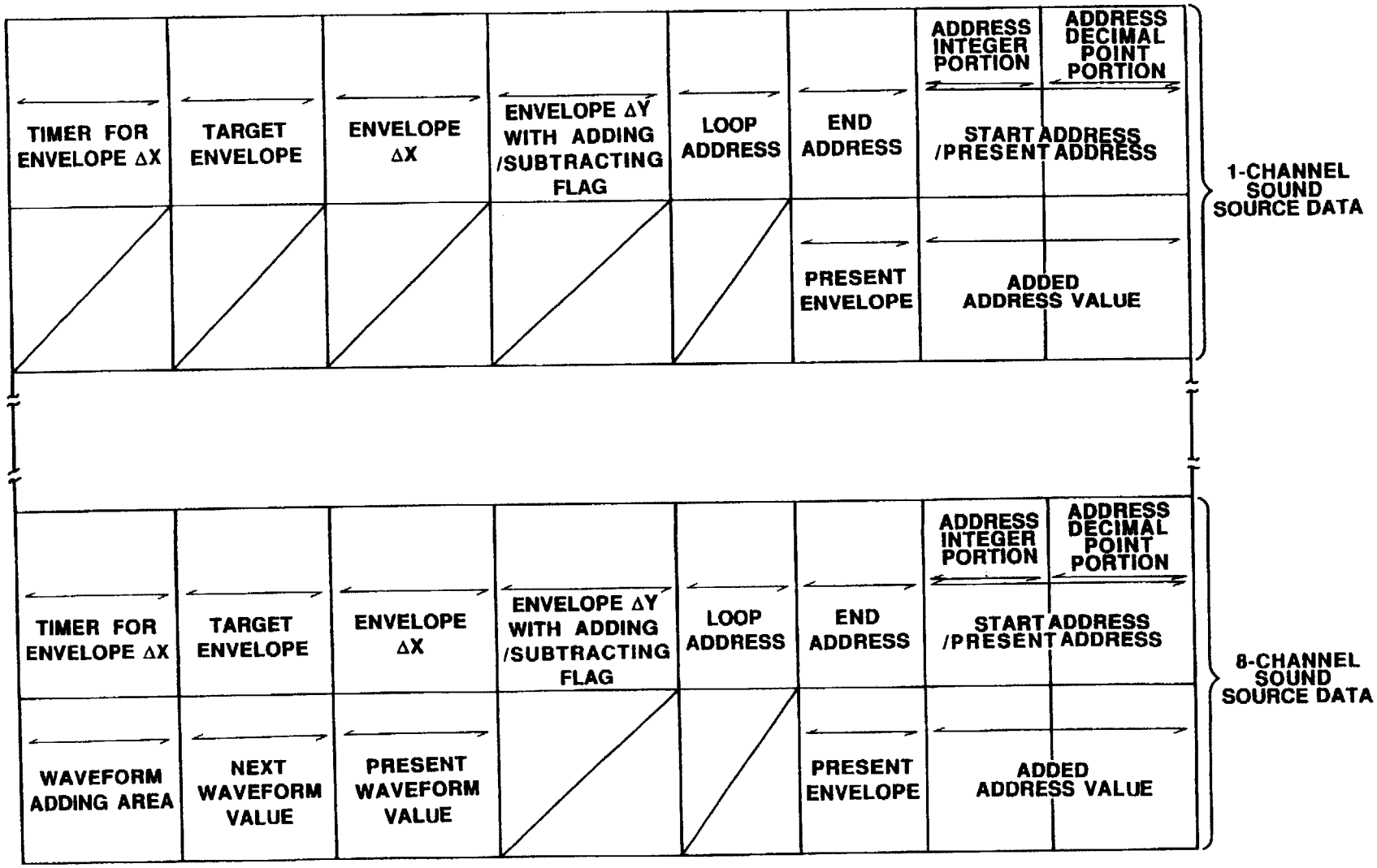
FIG. 11 illustrates a table of a sound source processing RAM.

When an operand of a command from the control ROM 41 specifies a register, a RAM address controller 43 specifies the address of an associated resister in a RAM 44. The operand may also serve to set a numerical value in the register. The RAM 44 comprises resisters which are used for general arithmetic operations, flag operations, arithmetic operations for musical tones, and so forth. As exemplified in FIG. 11, many registers are used exclusively for arithmetic operations for musical tones. A unit 45 serving as an adder-subtracter and logical operation section and a multiplier 46 constitute an arithmetic unit (AU), which is used when a command from the control ROM 42 is an arithmetic instruction. Particularly, the multiplier 46 is used for an arithmetic operation of a musical tone waveform, and first and second data inputs (e.g., 16-bit data) are multiplied and data having the same length as the inputs (i.e., 16 bits) is output in order to optimize the operation.

A ROM 47 for control data and waveform stores various musical tone control parameters such as pitch data, envelope data (rate, level), and musical tone waveform data of a PCM type. The envelope data and tone waveform data are prepared for each timbre of a musical tone.

As illustrated, the ROM 47 is accessed indirectly by referring to the contents of the register on the RAM 44 specified by the operand in a program stored in the control RAM 41. In the present embodiment, the ROM 47 is an internal memory and its operation is directly controlled by an operation controller 48 which controls the operation of the RAM 44, so that the time of accessing to the ROM 47 is the same as the time of accessing the RAM 44. An operation analyzer (operation controller) 48 decodes an operation (OP) code of a command from the control ROM 41 and sends control signals to its individual units in order to execute the specified operation.

In order to run a tone generating program stored in the control ROM 41 every given time, a timer interrupt is employed in this embodiment. That is, an interrupt controller 50 having a timer (hardware counter) sends a control signal (interrupt request signal) to the ROM address controller 49. In response to this signal, the ROM address controller 49 saves (holds) the address of the next command of the main program and sets the head address of an interrupt program (subroutine) that generates a musical tone in place of the former address. Then, the interrupt program starts running. Since a return command is placed at the end of the interrupt program, the ROM address controller 49 sets the saved address again and the flow returns to the main program when this return command is decoded by the operation analyzer 48.

Although the interrupt controller 50, which causes the microcomputer 31 to stop a presently-executing task and requests a special process, is illustrated as an internal element of the microcomputer 31 (CPU) in the diagram, it is logically an external element (peripheral unit) of the microcomputer 31. The interrupt program includes a routine for computing the waveform of a musical tone on each channel as will be described later, the waveform and envelope can be generated in the interrupt period.

An input port 51 and an output port 52 are used for scanning the keys of the keyboard 32 and the function keys 33. A digital musical tone generated in the interrupt program is converted by a D/A converter 53 into an analog signal which is then output.

Figure 6:
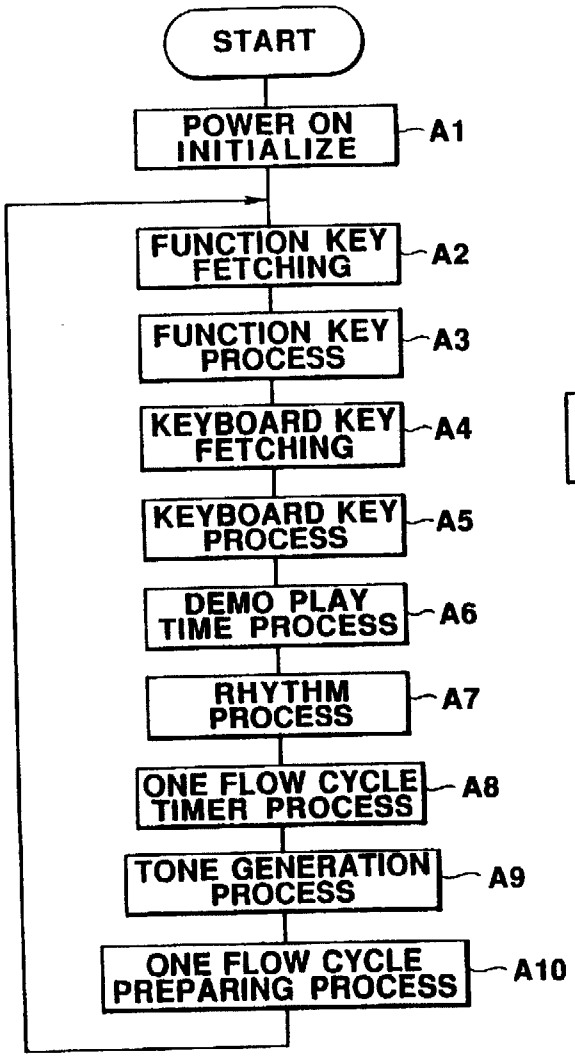
FIG. 6 is a flowchart of a main program for a microcomputer.

FIG. 6 illustrates the flow of the main program of the microcomputer 31 of this embodiment. Step A1 is an initializing process which clears the RAM (registers) 44 of the microcomputer 31 and sets the initial values of a rhythm tempo, etc. when power is turned on. In step A2, the microcomputer 31 outputs a key scan signal from the output port 52, and fetches the status of the switch section 34 from the input port 51 to thereby set the statuses of the function keys 33 and keys on the key-board in the key buffer area of the RAM 44. In step A3 that function key whose status has changed is descriminated from the statuses of the function keys 33 acquired in step A2 and the previous statuses thereof, and the specified function is executed (e.g., setting of a tone number, an envelope number, a rhythm number, etc.). In step A4, that key whose status has changed (being pressed or released) is discriminated from the newest statuses of the keys on the keyboard 32 acquired in step A2 and the previous key statuses. In the subsequent step A5, key assigning for the tone generation process A9 is executed in accordance with the processing result attained in step A4. In step A6, when a "demo" play key included in the function keys 33 is pressed, "demo" play data (sequencer data) is sequentially read out from the ROM 47 and is processed to thereby execute a key assign process for the tone generation process A9. In A7, when a rhythm start key is pressed, rhythm data is sequentially read out from the ROM 47 to perform key assigning for the tone generation process A9. In a one flow cycle timer process AS, in order to know the timing of the necessary event in the main flow, an arithmetic operation is performed on the basis of the one flow cycle time to acquire the reference value for the envelope timer (arithmetic operation cycle of the envelope) and the reference value of a rhythm. (The one flow cycle time is obtained by measuring the number of timer interrupts executed during one flow cycle: this measuring is performed in an interrupt timer process B3 to be described later.) In the tone generation process A9, various arithmetic operations for actually generating musical sounds are executed based on the data set in steps A5, A6 and A7. The results of the operations are set in a sound source processing register (FIG. 11) in the RAM 44. For instance, when a key is depressed, the envelope $\Delta x$ of the attack portion and the envelope $\Delta y$ for the target envelope increment/decrement flag as parameters for envelope generation are computed or read out and set in the associated resisters in FIG. 11, and the start address, end address, loop address and the value of added addresses as parameters for waveform generation are computed or fetched and set in the associated resisters. With regard to updating of an envelope, the content of the present envelope register is checked and if it is at the target level, envelope data for the next step ($\Delta x$, $\Delta y$, the target envelope) are set back in the associated registers. The content of the present envelope register is also checked upon key depression. A release envelope is selected from the checked value and its data is set. Step A10 is a preparation process for a pass to the next main flow. In this processing, for example, the "NEW ON" status indicating a change to the key-depressed state obtained by the present pass is set during "ON Continuing" status, the "NEW OFF" status indicating a change to a key-released state is changed during "OFF Continuing" status.

Figure 7:
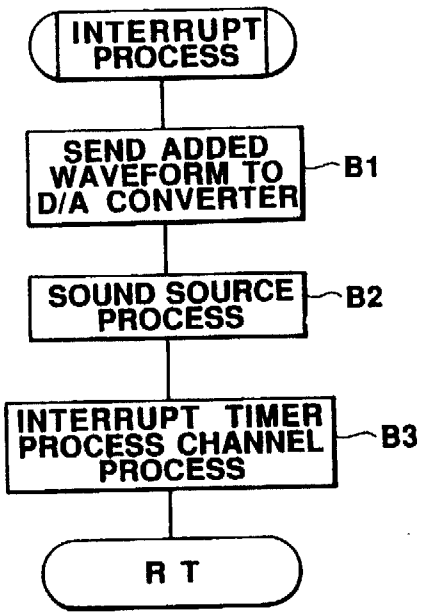
FIG. 7 is a flowchart of an interrupt program that generates a musical tone.

FIG. 7 illustrates the flow of the interrupt program which executes tone generation. In step B1, tone waveform data (accumulated waveform values for eight sounds) which has been produced in a sound source process B2 in the previous interrupting process is sent to the D/A converter 53. In this manner, samples of a musical tone are given to the D/A converter 53 in a constant interval. The subsequent sound source process B2 is a key point in this embodiment; this processing is conventionally executed by sound source circuit hardware. (Its detailed description will be given later.) In the next interrupt timer process B3, the content of a timer register (located in the RAM 44) for measuring one flow cycle is incremented by "1" every time an interrupt, which occurs for every given time, passes this timer register.

According to this embodiment, since the contents of those registers in which data is written in the main program are not rewritten in the interrupt program, it is unnecessary to execute saving and recovering of the contents of the registers which are carried out at the beginning and the end of an ordinary interrupting process. That is, since those resisters on the RAM 44 which are associated with tone processing are independent of those associated with tone processing, it is possible to leave the main program and go to the interrupting process quickly without delay.

Figure 8:
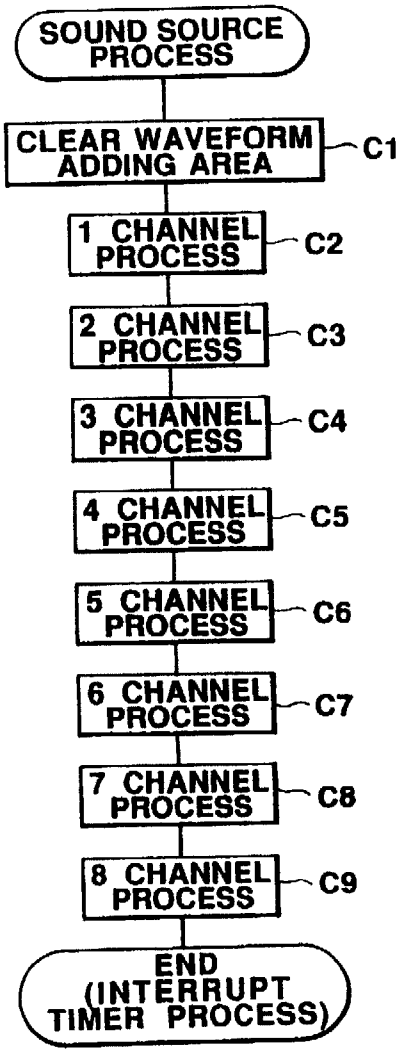
FIG. 8 is a flowchart of a sound source process.

FIG. 8 gives a detailed illustration of the sound source process B2. After the RAM area (see FIG. 11) for addition of waveforms is cleared in step C1, steps C2 to C9 for eight channels are sequentially executed. At the end of each channel process, the waveform value of a musical tone on the channel is added to the data stored in this RAM area.

Figure 9:
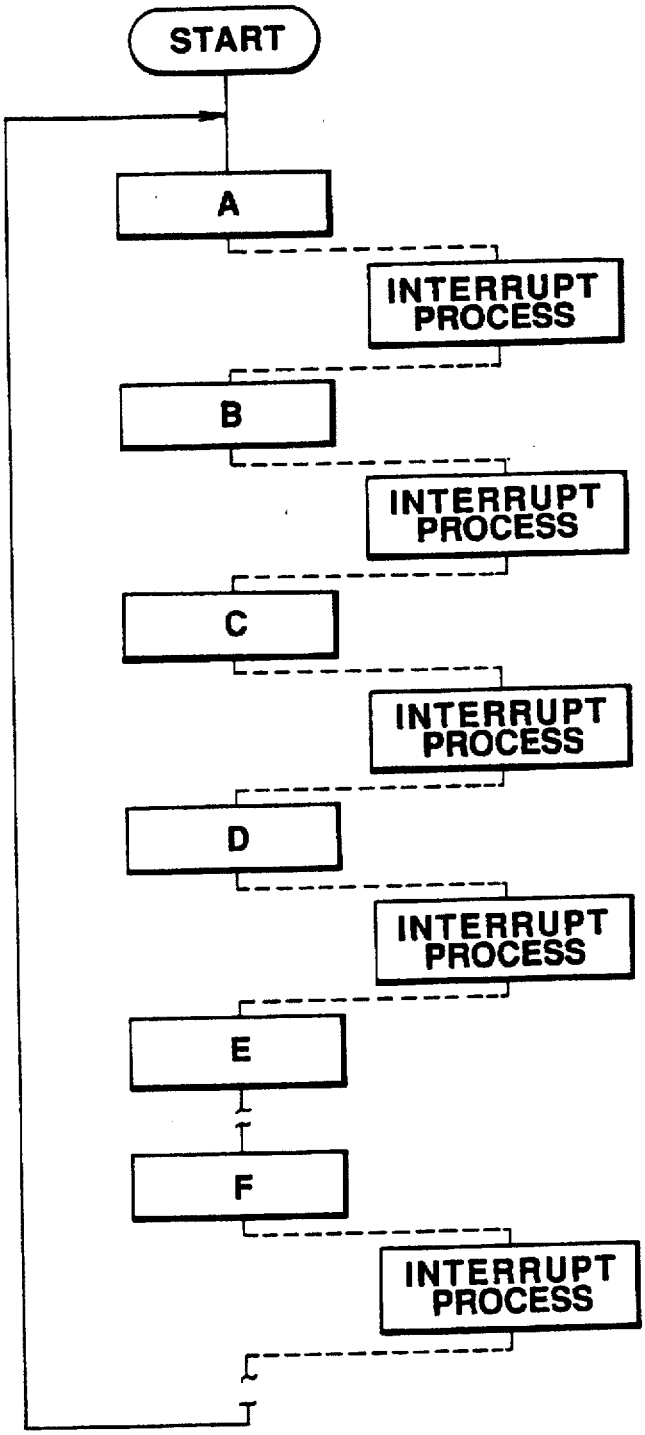
FIG. 9 is a diagram illustrating the flow of the operation in the first embodiment.
Figure 10:
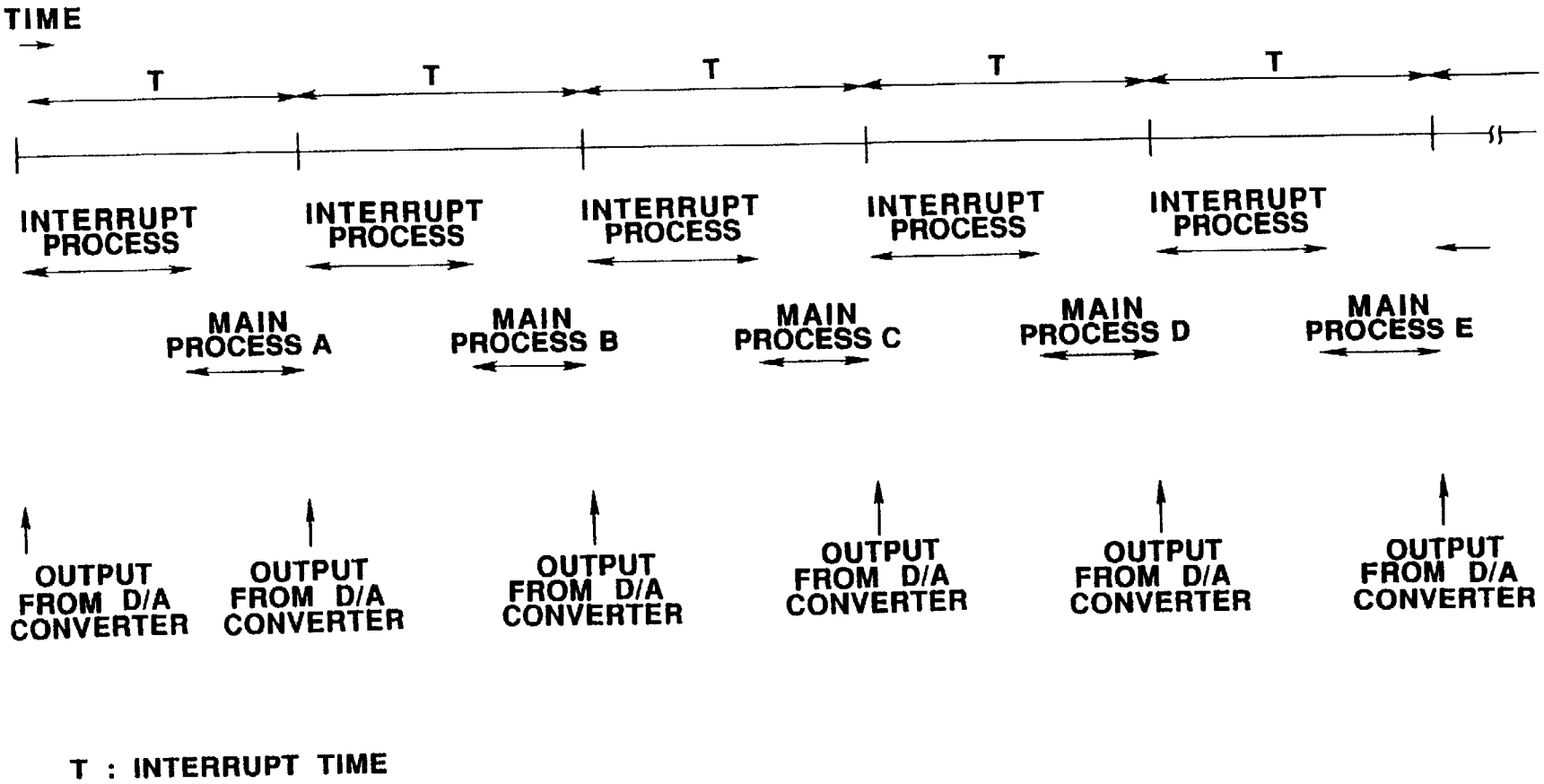
FIG. 10 is a time chart illustrating the operation in the first embodiment.

FIG. 9 illustrates the flow of the operation of the first embodiment with time. "A" through "F" are parts of the main program (FIG. 6), and an interrption (FIG. 7) is executed for each given time. The time chart of the operation is shown in FIG. 10. As illustrated, every time an interrput occurs, a tone waveform signal is input to the D/A converter 53 and the corresponding analog signal is output therefrom.

Figure 12:
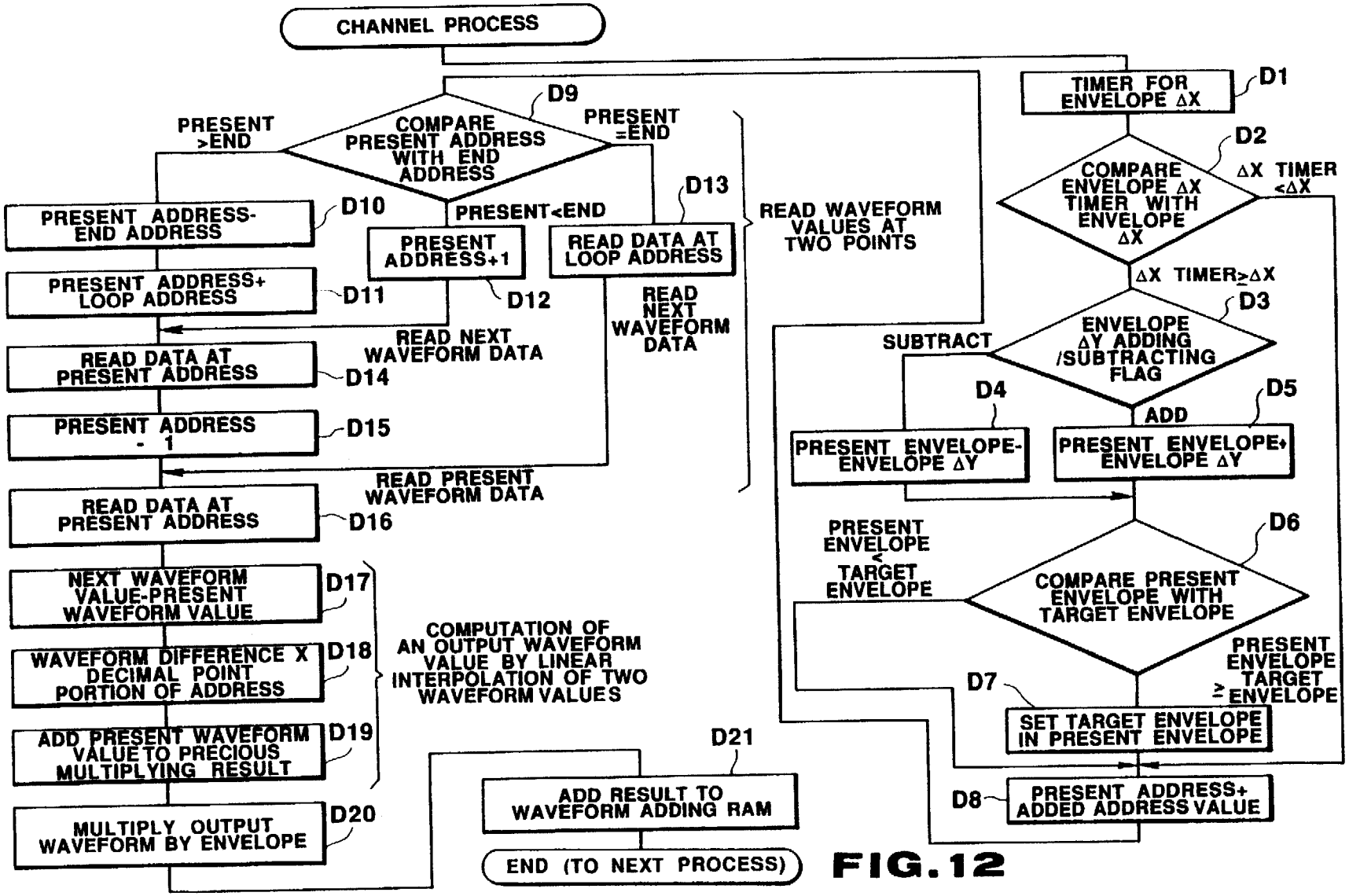
FIG. 12 is a detailed flowchart illustrating one channel processing shown in FIG. 8.

FIG. 12 presents a detailed illustration of one of the steps C2–C9 in FIG. 8 with respect to one of eight channels. The channel process mainly consists of an envelope process (D1 to D7) and a waveform process (D8 to D21).

Figure 13:
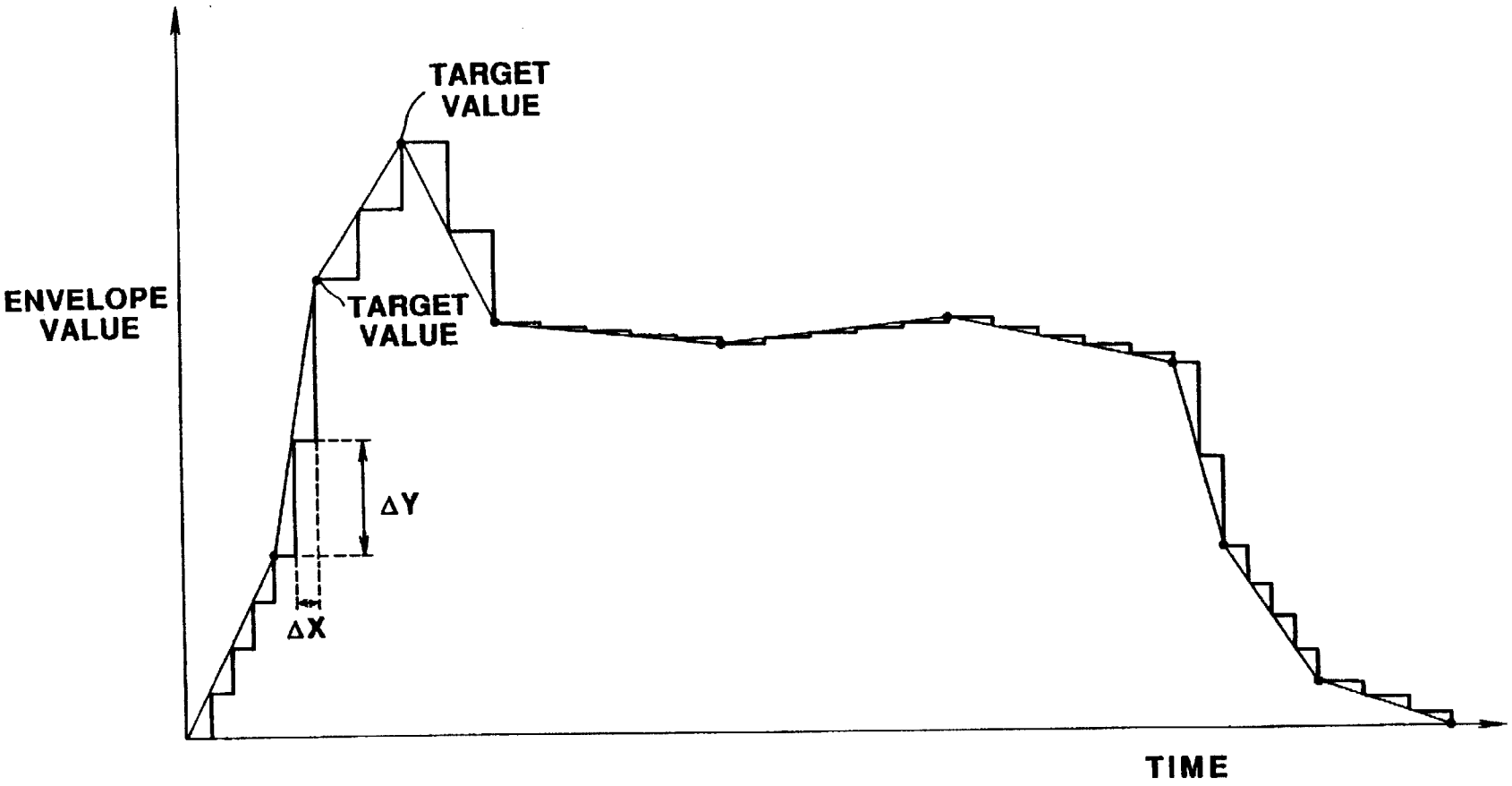
FIG. 13 is a diagram illustrating the status of an envelope to be generated.

FIG. 13 illustrates an envelope produced by the envelope process. The envelope of one musical tone consists of several steps (segments). In the diagram, Δx represents an updating period of the envelope, and Δy the degree of change in the envelope value. The envelope process (D1–D7) for each channel performs computation of updating the envelope for each updating time and checks if the step target level is reached. When the target level is reached, the target value is set in the present envelope register (see FIG. 11) and this event is detected in the tone generation process A9 of the main program. Then, envelope data for the next step (Δx, Δy, the target envelope value) is set in the respective resisters.

The above process will be described below more specifically. The content of the timer register used for comparison with the computed period Δx of the envelope is incremented for each occurrence of an interruption in step D1. When the content of the timer register coincides with Δx in the step D2, the adding/subtracting flag (code bit) of the data Δy, a change in the envelope, is checked to see if the envelope is rising or falling in step D3. In the subsequent steps D4 and D5, the present envelope is subjected to subtraction and addition, respectively. In step D6, it is determined whether or not the present envelope has reached the target value. If the decision is affirmative, the target level is set to the present envelope. As a result, data of the next envelope step is set in the tone generation process A9 of the main program. If the read present envelope is zero in the process A9, it is treated as the end of tone generation.

As should be obvious from the foregoing description, according to the present electronic musical instrument, the microcomputer 31 can always grasp the status of the present envelope. In other words, in the embodiment, an envelope is generated in the program-controlled envelope processes (D1–D7), the value of the present envelope is checked in the tone generation process A9 also controlled by the program, and a process according to the checking result is executed. This can eliminate the need for an envelope generator which is conventionally hardware, and can thus overcome the otherwise accompanying conventional problems. The reasion why the program-controlled envelope process is executed particularly in the timer interrput program will be discussed below referring to FIGS. 14 and 15.

Figure 15:
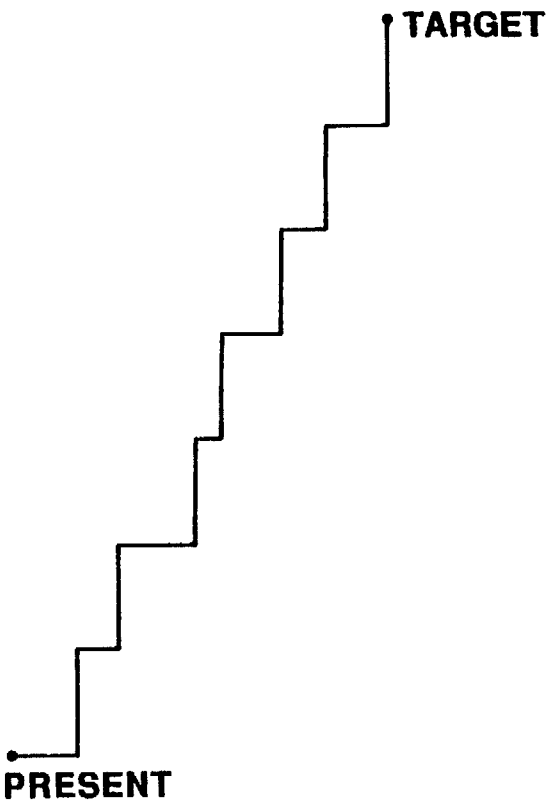
FIG. 15 is a diagram illustrating part of an envelope which is generated by an ordinary subroutine process.
Figure 14:
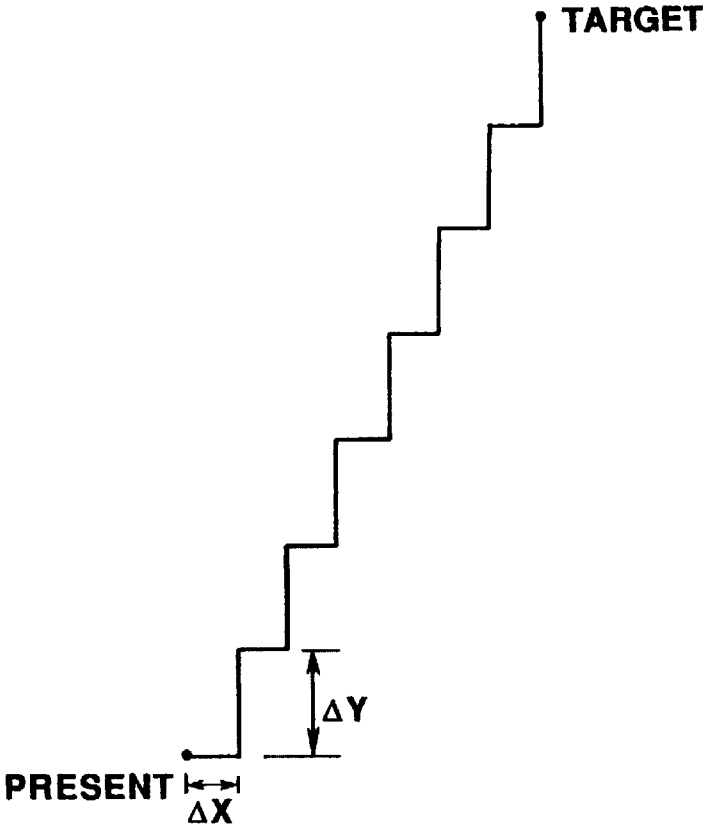
FIG. 14 is a diagram illustrating part of an envelope which is generated by a timer interrupt process.

FIG. 14 illustrates part of an envelope generated by a timer interrupt. Assuming that an envelope process is carried out in an ordinary subroutine, the result would be as shown in FIG. 15. If the subroutine for computing an envelope is placed in the main flow, the amount of processing to be done varies and the image between subroutines for envelope computation also varies. This results in a change in time for measuring Δx; the updating of time may come earlier on one occasion or may come late on another, so that the slope of the expected envelope cannot be accurately realized. If the envelope process is done in the timer interrupt process, the updating period Δx can be kept constant due to the periodic occurrence of an interrupt, and the expected envelope can be obtained as shown in FIG. 14. Further, since the generated envelope is used in the waveform process within the same interrupting process, waveform generation can be effected in synchronism with changing the envelope.

The waveform processes D8–D21 will now be described. In this processing, waveform data at two adjacent addresses are read out from the waveform ROM 47 using the integer portion of the present address, and the waveform value expected with respect to the present address indicated by (integer portion+decimal point portion) is attained through interpolation. The reason for requiring the interpolation is that the interrupt-initiated waveform sampling period is constant and the value of added addresses (pitch data) lies in a certain tone range in view of application to a musical instrument (with a musical instrument which produces only notes, if waveform data is prepared for each note, no interpolation is necessary with an unallowable increase in memory capacity, though). Since interpolation-originated deterioration and distortion of a timbre is prominent in a high pitch region, the original sound is normally reproduced in frequency higher than the record sampling frequency of the original sound. In this embodiment, the reproducing frequency of an original sound (A4) is doubled (see FIG. 16). With the value of the added addresses being 0.5, therefore, the sound of A4 can be obtained. In this case, for note A4, the added address value becomes 0.529 and for note A3 it is 1. These added address values are stored as pitch data in the ROM 47. Upon depression of a key in the keyboard 32, pitch data associated with this key, and the waveform start address, waveform end address and waveform loop address of the selected timbre are set in the respective registers of the RAM 44, namely, added address register, start address/present address register, end address register and loop address resister.

Figure 17:
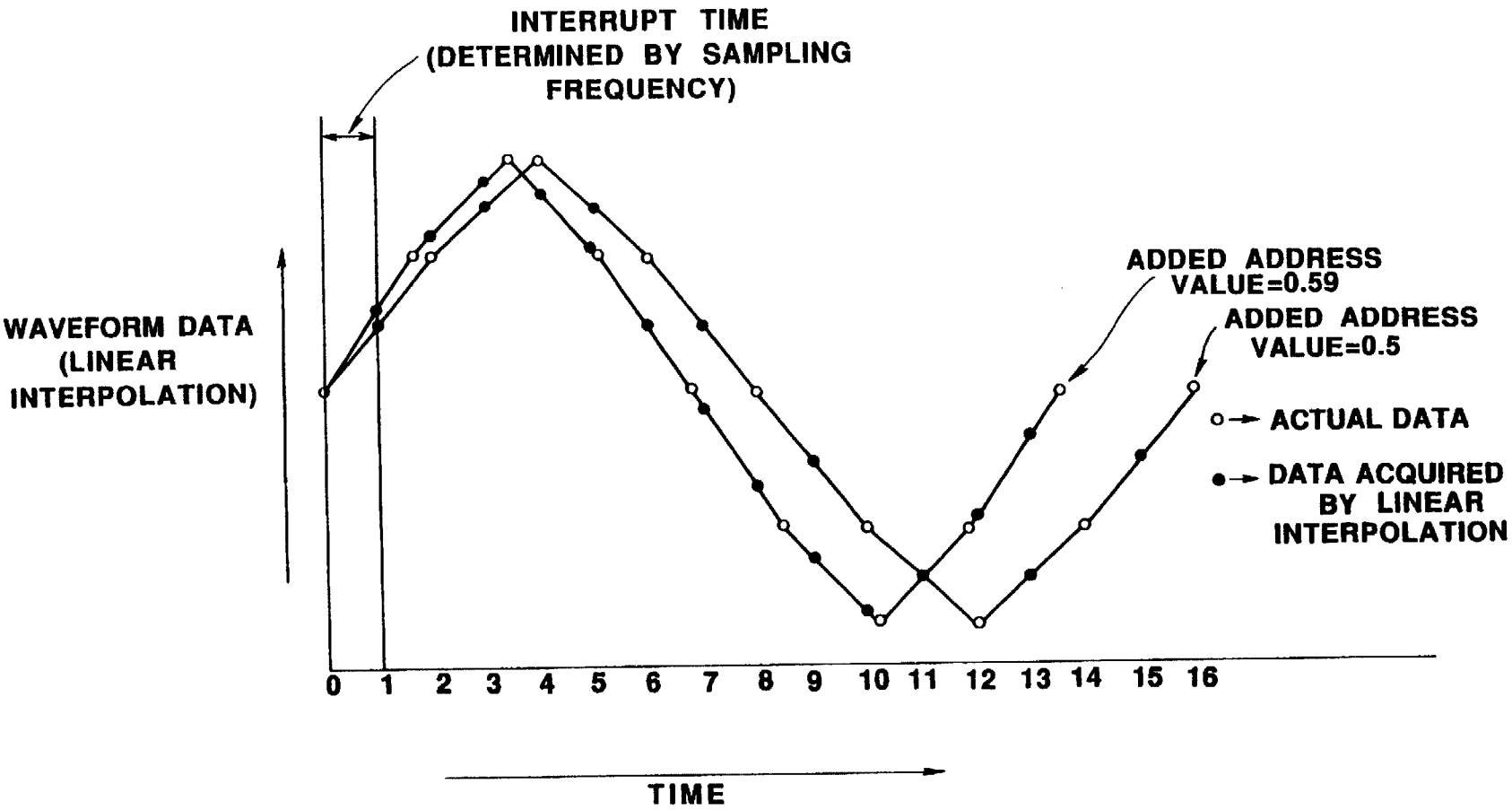
FIG. 17 is a diagram illustrating interpolation waveform data with respect to time.

FIG. 17 illustrates one example of interpolation waveform data with respect to time. In the diagram, white marks indicate waveform data values located at addresses of the waveform ROM, and black marks inter-values.

Figure 16:
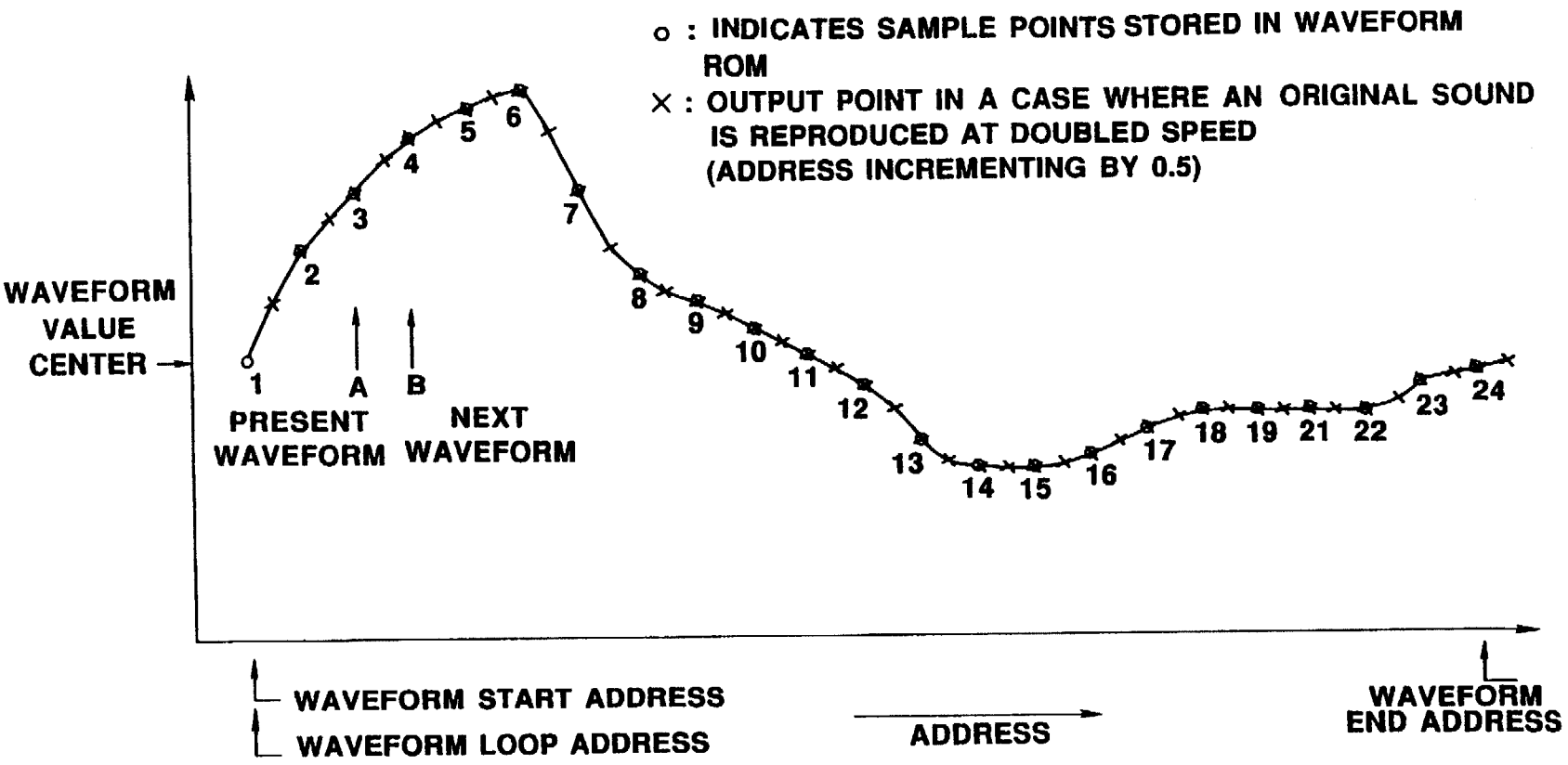
FIG. 16 is a diagram illustrating an original sound and waveform data read out with a doubled frequency.

Although there are various interpolating systems, linear interpolation is employed in this embodiment. A detailed description of the waveform generation processes D8–D21 in FIG. 12 will be given below. First, in step D8, the present address is added with the added address value to provide a new present address. The present address is compared with the end address in step D9. If the present address>the end address, the physical (address) or logical (operational) next address is computed through steps D10 and D11. If the present address<the end address, the next address is computed through a step D12. In step D14, the waveform ROM is accessed using the integer portion of the address to acquire the next waveform data. The loop address is the address next to the end address from an operational point of view. In the case of FIG. 16, the illustrated waveform data is read out repeatedly. When the present address=end address, therefore, the waveform data at the loop address as the next address is read out (D13). In steps D15 and D16, the waveform ROM is accessed using the integer portion of the present address to read out the present waveform data. In step D17, the present waveform value is subtracted from the next waveform value, and the difference is multiplied by the decimal point portion of the present address in step D18. The result is added to the present waveform value in step D19 to thereby obtain linear interpolation value of the waveform. The linearly-interpolated data is multiplied by the present envelope value to obtain a tone data value of the channel (D20), and the obtained value is added to the content of the waveform adding register to accumulate tone data (D21).

In the case involving the channel processing program as shown in FIG. 12, data in the ROM 47 that is indirectly accessed is referred to only in steps D14 (or D13) and D16 of the entire steps. All the remaining steps are for performing arithmetic operations on the exclusive registers on the RAM 44 which can be directly addressed. The channel process (tone generation process) can therefore be executed at a high speed. The high-speed processing comes from the structure of the microcomputer. The structural features include the design to permit direct addressing to the RAM 44, many registers constituting the RAM 44, and employment of exclusive register structure in the RAM 44 for exclusively storing various tone parameters in the tone generation process.

With regard to the circuit scale and the operation time of the specific embodiment (PCM sound source system capable of producing eight polyphonic sounds), the control ROM has a size of 112K bits, RAM 445.4K bits and the control data/waveform ROM 47 (for 100 timbres) 508K bits; one machine cycle is about 276 nanoseconds with a maximum number of cycles of the interrupt program when invoked being about 150; and the executing period of the interrupting process (tone output sampling period) is about 47 microseconds.

As described above, according to the first embodiment, since the microcomputer 31 performs tone generation under the control of the timer interrupt program, sound source circuit hardware which is essential in the prior art is not necessary, thus result in reduction in circuit scale, improvement of the yield, reduction in manufacturing cost and high design freedom. Further, since a process for computing the waveform of a musical tone and a process for computing the envelope of the musical tone are executed by the timer interrupt program which is invoked by an interrupt signal that is accurately issued from the interrupt controller 50 at every tone sampling time, an envelope with the desired characteristic can accurately be generated. The microcomputer may be simply replaced with computer means or processing means for the mentioned operations.

Second Embodiment

Figure 18:
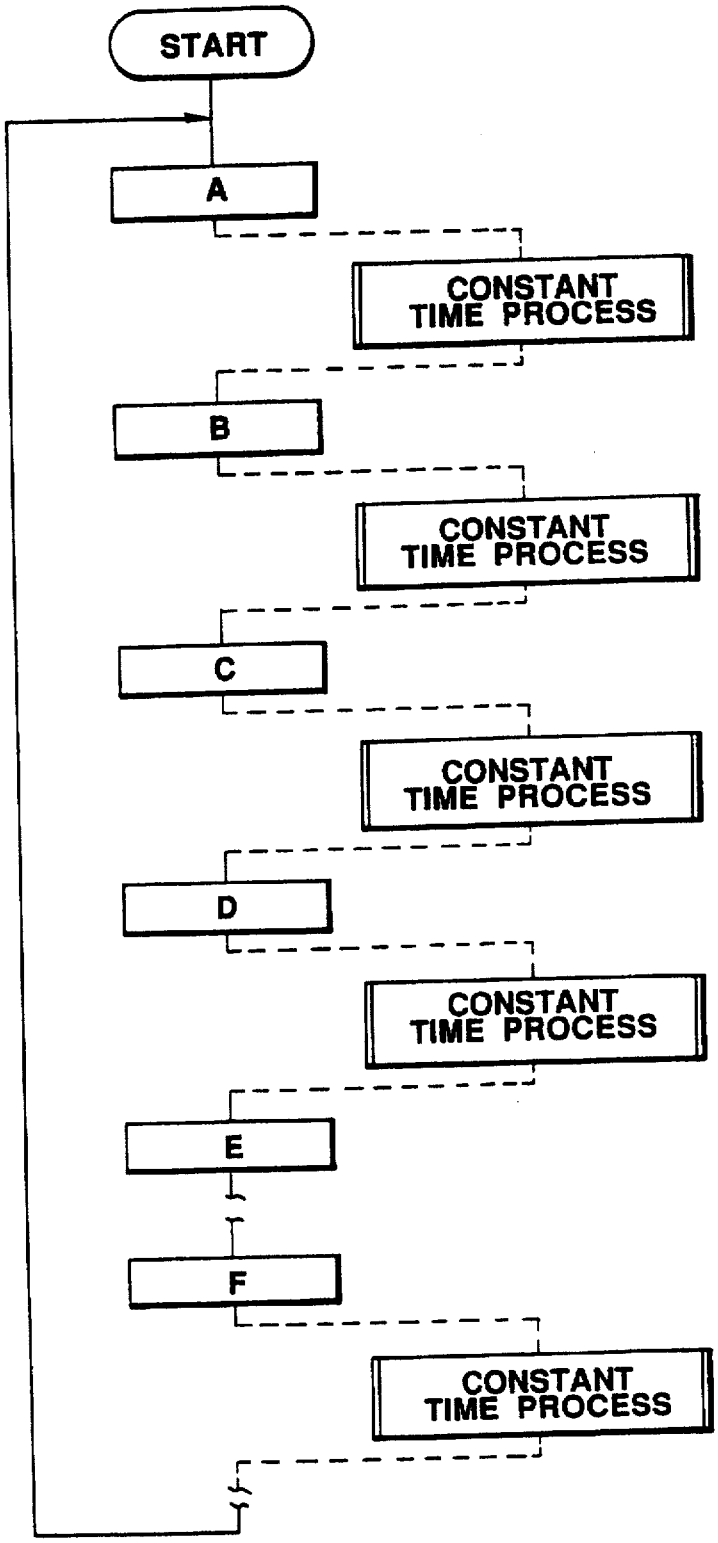
FIG. 18 is a flowchart illustrating the operational flow when a subroutine that is executed for a given period of time is used.

In the first embodiment described above, a timer interrupt is issued to output a tone waveform sample for each given time and a musical tone is generated by running an interrupt program. In the second embodiment, however, a dummy command (NOP command) is set in a program to execute the process in place of the interrupting process at each constant interval of time; this processing will be hereinafter called constant time process (See FIGS. 18 to 21.) Since the time for executing each command of a program is determined by a master clock, a constant time processing program for generating a musical tone during that part of the main program which corresponds to the constant time (see FIG. 18) is inserted as a subroutine.

To secure a constant time, all the branches in the main program and the constant time processing program in the subroutine should be processed by the same time.

Figure 19:
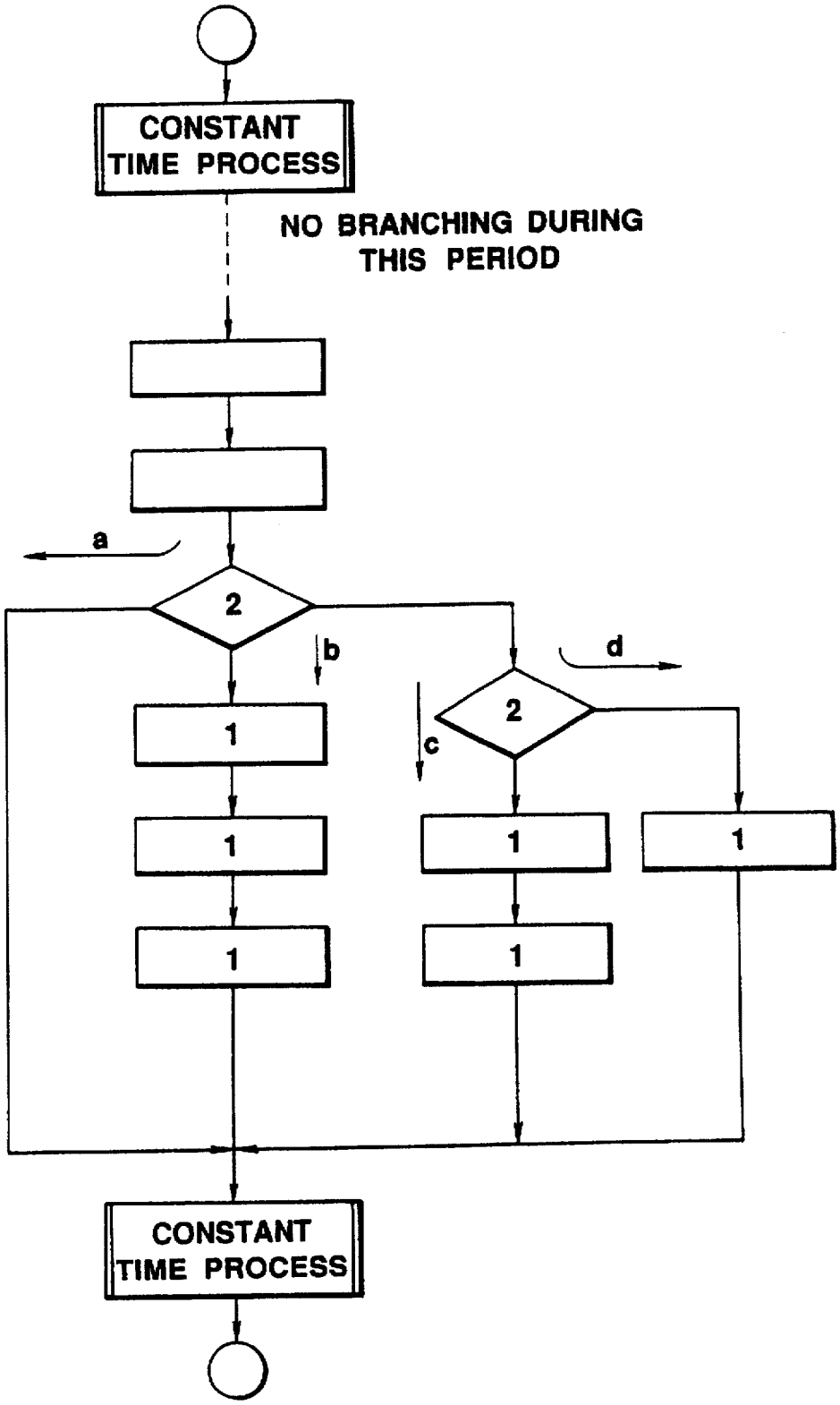
FIG. 19 is a diagram illustrating part of a main flowchart in FIG. 18.
Figure 20:
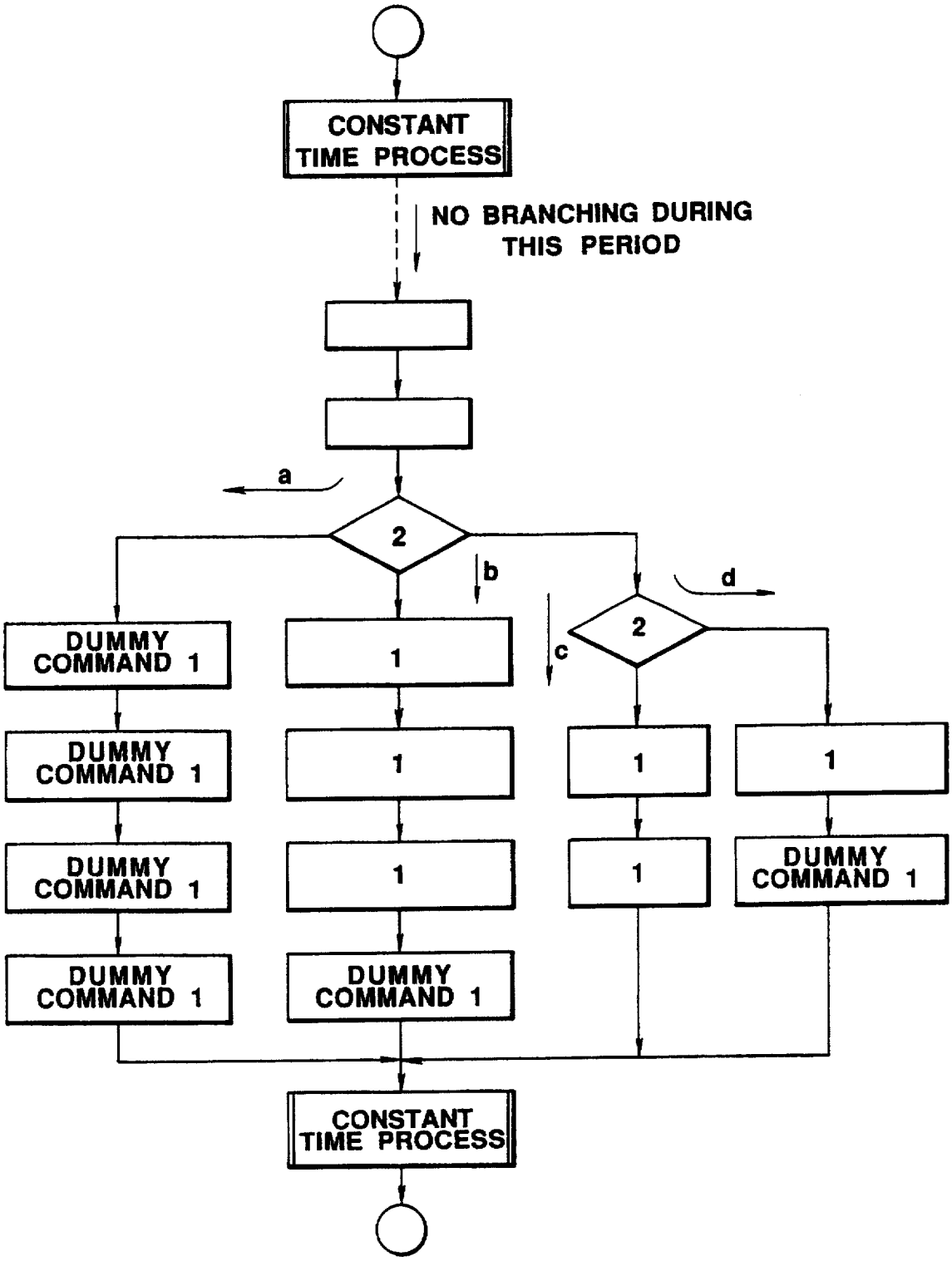
FIG. 20 is a diagram illustrating part of a main flowchart involving a constant processing time.

Assume that the main program has the flow as shown in FIG. 19 and constant time process is executed at the beginning and end of the flow. For the sake of simplicity and easy understanding, it is assumed that branch commands need two units of time while an ordinary command one unit of time. In the flow shown in FIG. 19, the time from the first branching to the constant time process requires two units of time when the route a is taken, five units of time for the route b, six units of time for the route c and five units of time for the route d; that is, the time varies depending on which route to take. If four dummy commands are put in the route a and one dummy command is put in the routes b and d, then, the units of time requires for taking each route becomes six as shown in FIG. 20.

Figure 21:
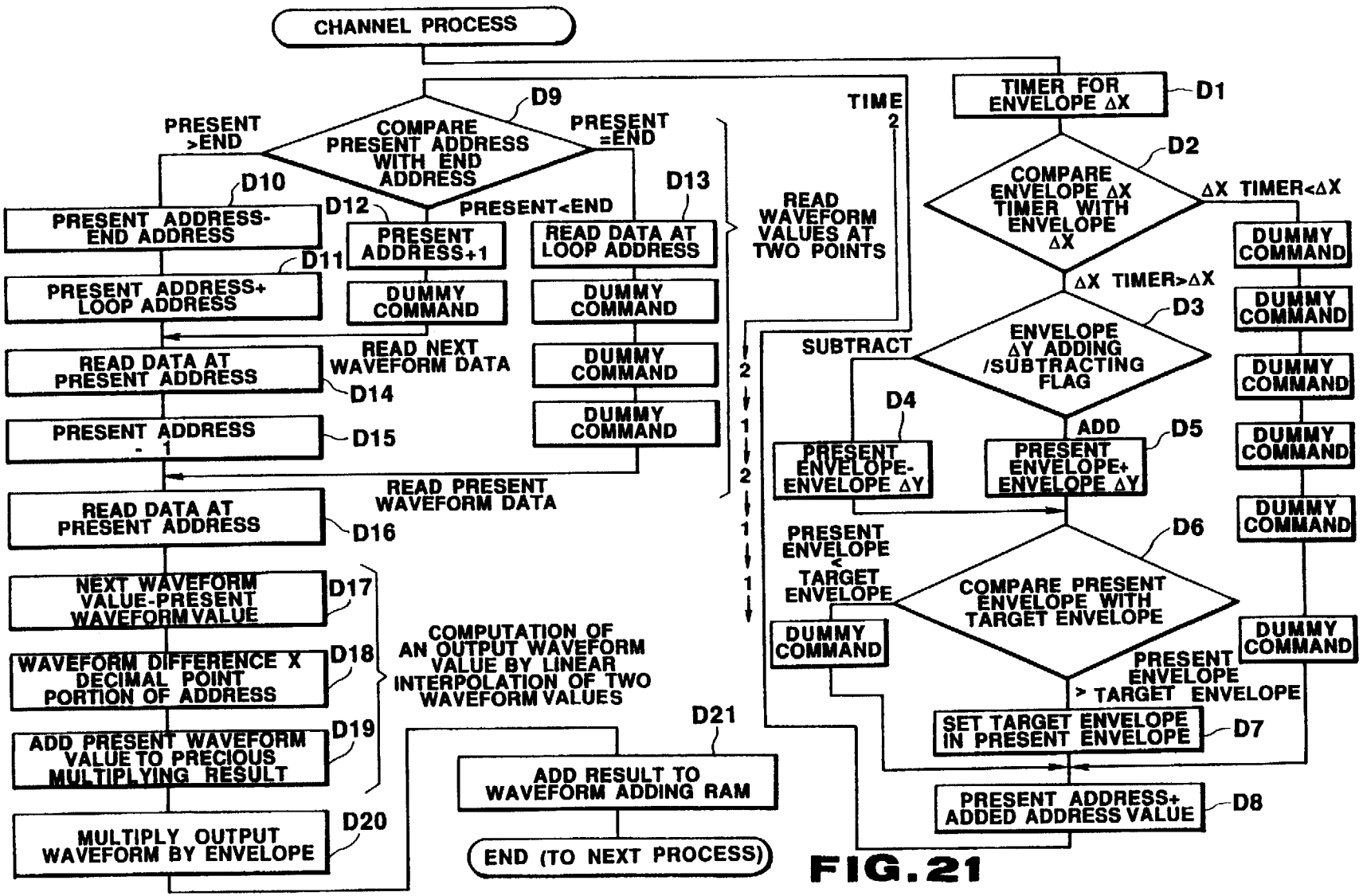
FIG. 21 is a flowchart illustrating a process for one channel in which all the processing times are constant.

If processing time differs depending on branches even in a constant time process, the time required to jump to the next constant time process changes. It is therefore necessary to insert a dummy command in the constant time process in order to make the processing time required for all the branching routes constant. FIG. 21 illustrates an example of the above case where a dummy command is put in tone generation process in constant time process.

Third Embodiment

Figure 22:
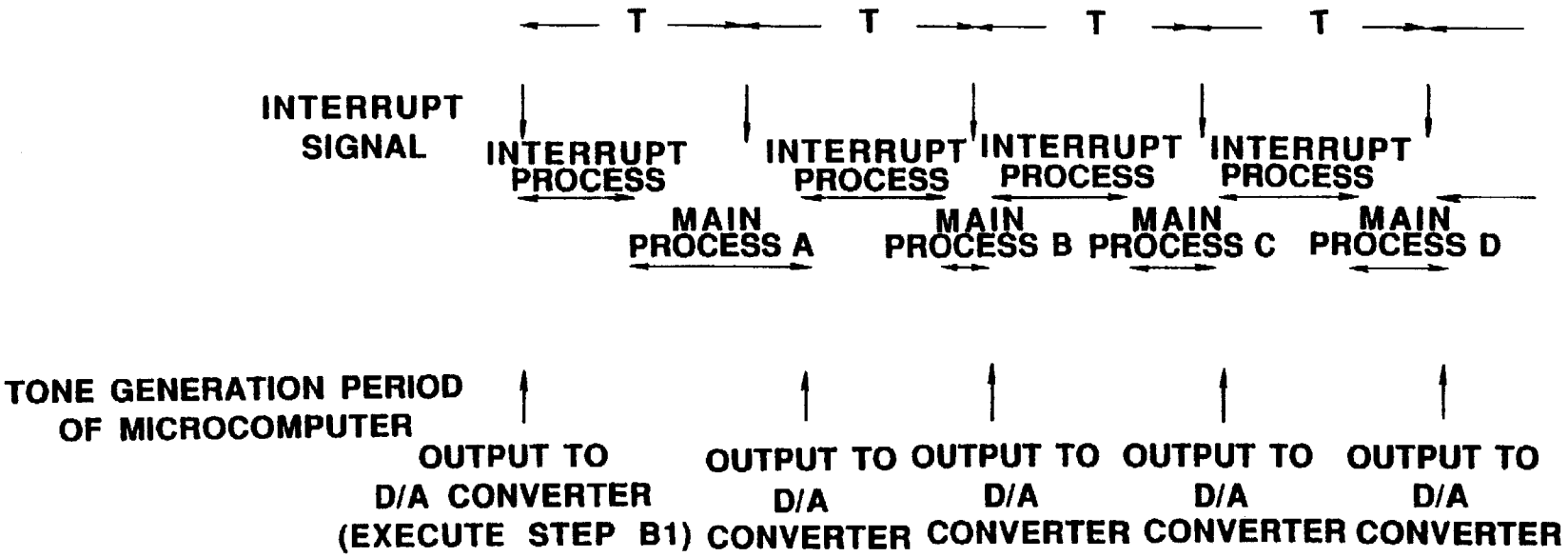
FIG. 22 is a time chart illustrating a waveform generating operation according to the third embodiment.

Referring to FIG. 10, the interval T in which an interrupt signal is generated is very stable. This is because the interrupt signal is produced by a hardware counter in an interrupt controller 50. The stability of the signal generation is determined by the stability of a clock generator (typically, a crystal oscillator) though not illustrated. According to the first and second embodiments, the main process is interrupted by this interrupt signal and tone generation process (interrupting process) is executed during the interruption so as to keep the tone generation sampling period constant. Of course, this technical approach can set the averaged, tone generation sampling period equal to the interrupt signal generation interval T. Nevertheless, the timing at which the interrupting process actually starts may vary as emphasized in FIG. 22. This variation is originated in the program-controlled operation. More specifically, even an external interrupt is made to the microcomputer 31, the microcomputer 31 cannot immediately stop the presently-executing operation, so that the interrupting process starts upon termination of that operation. If the microcomputer 31 is in a process whose interruption is not desirable, the interruption is held until a sequence of operations for this process is completed. Transition to an interrupting process depends on the process which is being performed upon occurrence of an interrupt, so that the tone generation period inevitably becomes unstable. Specifically, the timing of the process executed in step B1 in FIG. 7, i.e., fetching digital tone data from the waveform adding register in the RAM 44 and setting it at the input port of the D/A converter 53, is shifted forward or backward. If the sampling period of the D/A converter 53 is the same as the executing interval of the step B1, a significant distortion would be caused on the signal during D/A conversion. This shortcoming is solved by the third embodiment.

Figure 23:
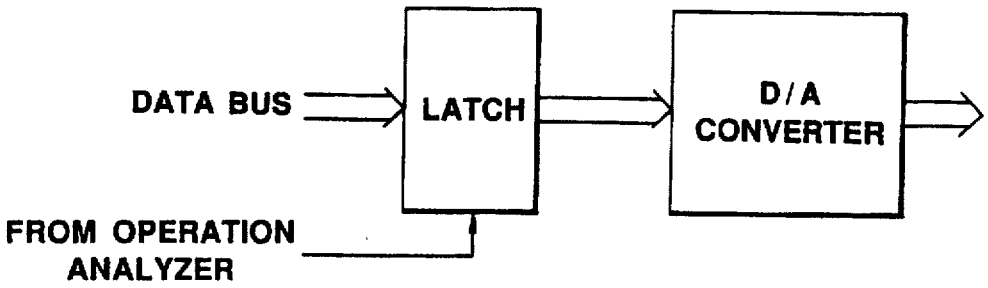
FIG. 23 is a structural diagram in a case where the sampling period for tone generation is synchronized with the conversion period of a D/A converter.
Figure 25:
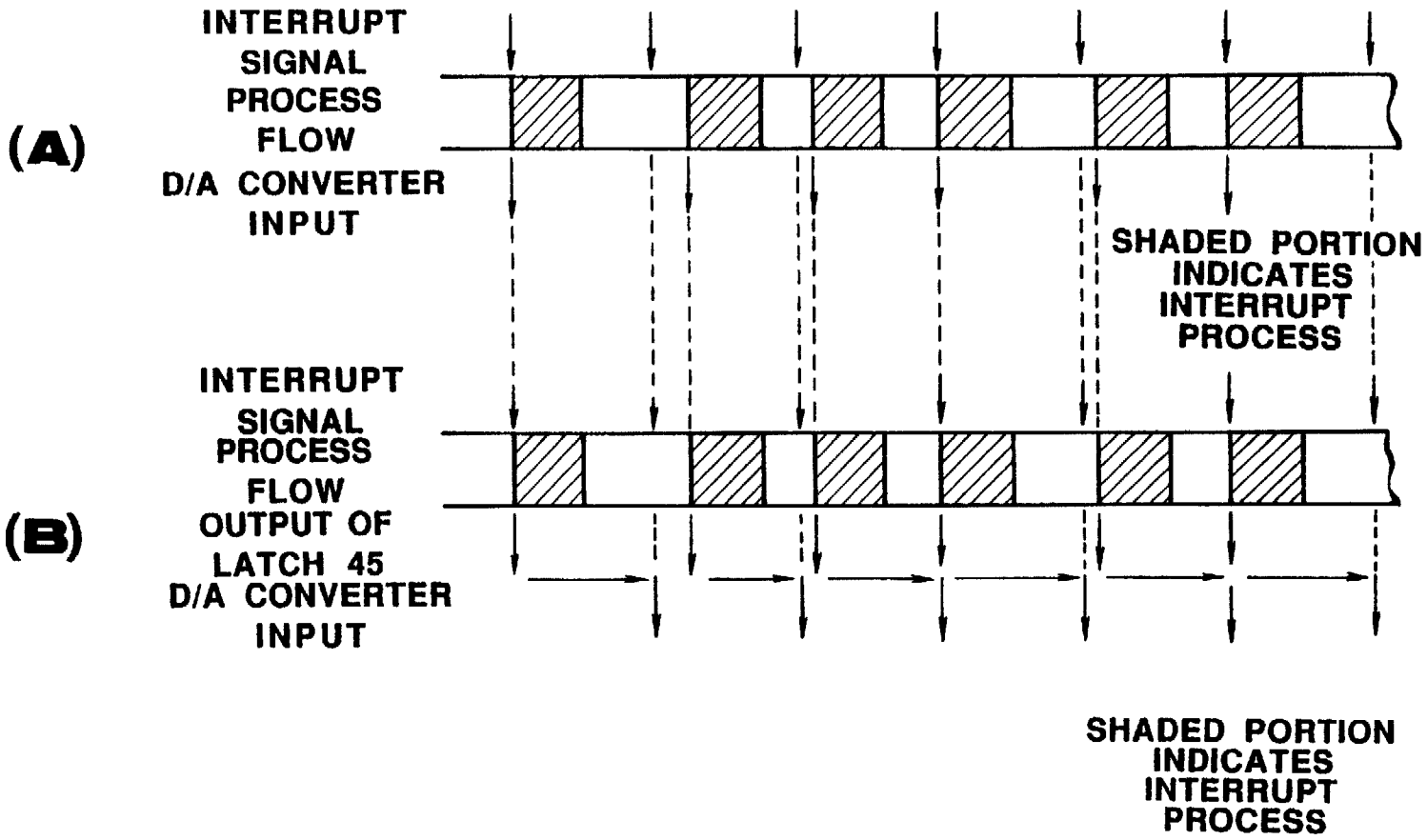
FIG. 25(A) is a diagram illustrating an interrupt process and the status of a timing at which data is input to a D/A converter when the arrangement shown in FIG. 23 is used.
FIG. 25(B) is a diagram illustrating an interrupt process and the status of a timing at which data is input to a D/A converter when the arrangement shown in FIG. 24 is used.

The sampling period of tone generation by the microcomputer 31 is not strictly constant. FIG. 23 illustrates the structure which sets the sampling period of tone generation equal to the conversion period of the D/A converter 53. More specifically, a software-controlled latch 55 is provided as a port of the D/A converter 53, and this latch 55 is controlled by a program control signal from the operation analyzer 48 to supply the output of the latch 55 to a control gate of an associated bit switch in a block 53A (not illustrated; typically, a current-controlled type electronic switch). As the block 53A actually converts a digital signal into an analog signal, it will be called D/A converter hereinafter. In the case of FIG. 23, the waveform adding resister in the RAM 44 is specified under the control of the operation analyzer 48 while the step B1 in the interrupt program, and newest digital tone data to be stored in the register is fetched on a data bus. A program control signal for strobe is supplied to a clock input of the latch 55 from the operation analyzer 48 at a timing where the digital tone data is on the data bus. Then, the data on the data bus is set, and new digital tone data is input to the D/A converter 53A from the latch 55. As shown in FIG. 25A, therefore, digital tone data to be input to the D/A converter 53A is switched at an unstable period due to the program control involved. If the conversion period (sampling period) of the D/A converter 53A is not significantly stable, large distortion occurs in the converted signal during the conversion. For instance, with the machine cycle of the microcomputer 31 being several tone of nanoseconds or several hundreds of nanoseconds, even a delay of one machine cycle significantly hinders the necessary accuracy of the conversion period for converting a digital signal of audio-frequency into an analog signal with high fidelity. In other words, even deviation of the order of nanoseconds causes such distortion that can be audibly sensed by a person.

Figure 24:
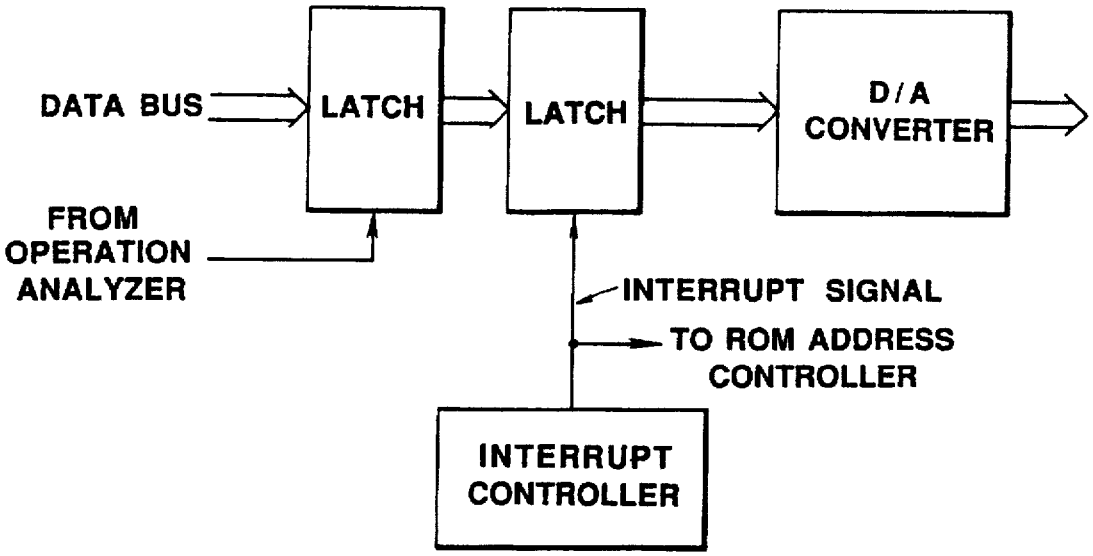
FIG. 24 is a structural diagram in a case where the timing for generating a waveform under a program control does not coincide with the conversion period of a D/A converter.

This problem may be overcome by utilizing the structure as shown in FIG. 24. An interrupt-controlled latch 56, which is controlled by an interrupt signal or accurate timing signal from the interrupt controller 50, is provided between the software-controlled latch 55 controllable by a program control signal from the operation analyzer 48 and the D/A converter 53A. As the period for generating an interrupt signal depends on the stability of the clock generator, it is significantly stable. The output of the latch 56 is switched in synchronism with the timing of the interrupt signal. That is, the interrupt signal generating period is the conversion (sampling) period of the D/A converter 53A. FIG. 25B illustrates a time chart for the structure shown in FIG. 24. As illustrated, although the timing at which the output of the latch 55 is switched varies according to a shift of the timing of the interrupt process, the latch 56 which functions by the interrupt signal permits the timing for switching the input data of the D/A converter 53A to be synchronized with the interrupt signal. Because of the presence of the latch 56, the digital tone signal input to the D/A converter 53A is delayed by one period of the interrupt signal on the average. This delay, however, is quite insignificant. For instance, the period of the interrupt signal is 47 microseconds, and such a short period of time cannot be audibly sensed by people. In general, the order of several milliseconds is the audible limit for human beings.

Although the present invention has been explained in the foregoing description with reference to some particular embodiments, this invention is not restricted to those described but may be modified in various manners within the scope and spirit of the invention.

For instance, although a waveform generating process is executed by a microcomputer in the above-described embodiments, it may be carried out by a minicomputer. The present invention can be worked out irrespective of the size of a computer or a processing system involved, as long as the computer or processor functions under software control.

Fourth Embodiment

The fourth embodiment of the present invention will be describe below with reference to the accompanying drawings.

Arrangement of the Fourth Embodiment

Figure 26:
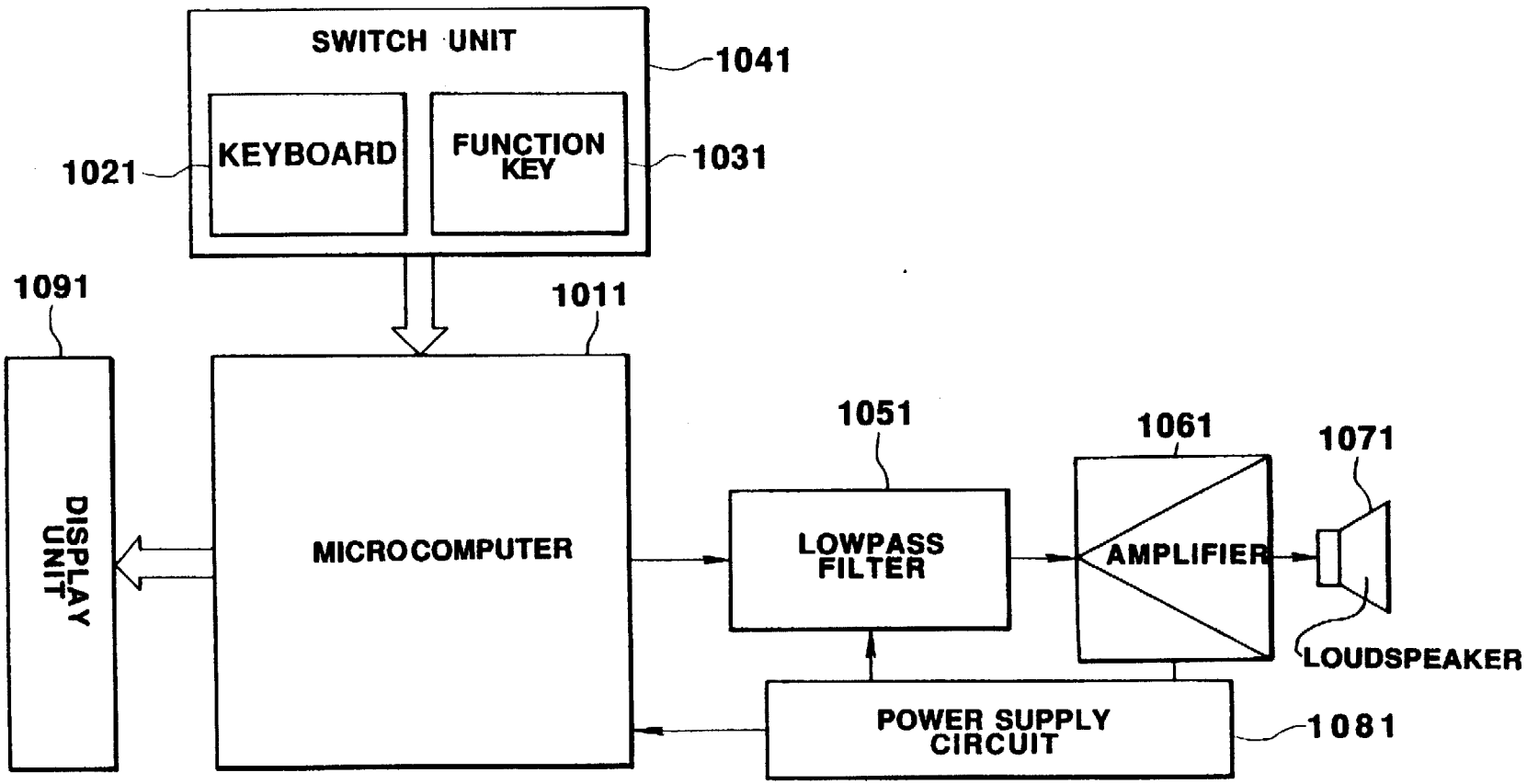
FIG. 26 is a block diagram showing the overall arrangement according to the fourth embodiment of the present invention.

FIG. 26 is a block diagram showing the overall arrangement according to the fourth embodiment of the present invention.

In FIG. 26, the entire apparatus is controlled by a microcomputer 1011. In particular, not only control input processing for an instrument but also processing for generating musical tones are executed by the microcomputer 1011, and no sound source circuit for generating musical tones is required.

A switch unit 1041 comprising a keyboard 1021 and function keys 1031 serves as an operation/input section of a musical instrument, and performance data input from the switch unit 1041 are processed by the microcomputer 1011. Note that the function keys 1031 will be described in detail later.

A display unit 1091 includes red and green LEDs indicating which tone color on the function keys 1031 is designated when a player determines a split point and sets different tone colors to keys as will be described later. The display unit 1091 will be described in detail later in a description of FIGS. 46 or 51.

An analog musical tone signal generated by the microcomputer 1011 is smoothed by a low-pass filter 1051, and the smoothed signal is amplified by an amplifier 1061. Thereafter, the amplified signal is produced as a tone via a loudspeaker 1071. A power supply circuit 1081 supplies a necessary power supple voltage to the low-pass filter 1051 and the amplifier 1061.

Figure 27:
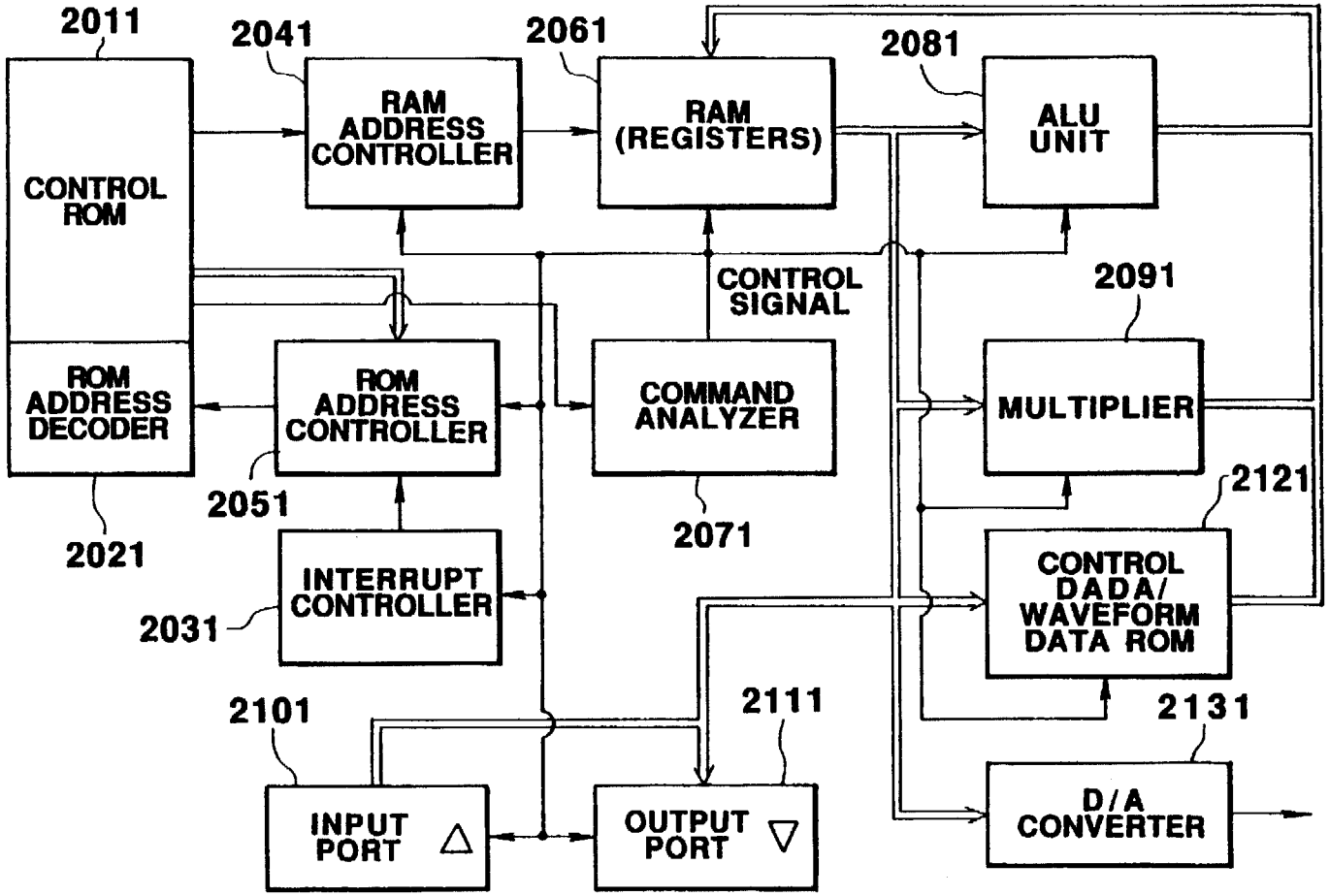
FIG. 27 is a block diagram showing the internal arrangement of a microcomputer.

FIG. 27 is a block diagram showing the internal arrangement of the microcomputer 1011.

A control data/waveform data ROM 2121 stores musical tone control parameters such as target values of envelope values (to be described later), musical tone waveform data in respective sound source methods, musical tone difference data, modulated waveform data, and the like. A command analyzer 207 accesses the data on the control data/waveform data ROM 2121 while sequentially analyzing the content of a program stored in a control ROM 2011, thereby executing software sound source processing.

The control ROM 2011 stores a musical tone control program (to be described later), and sequentially outputs program words (commands) stored at addresses designated by a ROM address controller 2051 via a ROM address decoder 2021. More specifically, the word length of each program word is 28 bits, and a next address method is employed. In this method, a portion of each program word is input to the ROM address controller 2051 as lower bits (intra-page address) of an address to be read out next. Note that the control ROM 2011 may comprise a CPU of a conventional program counter type.

The command analyzer 2071 analyzes operation codes of commands output from the control ROM 2011, and supplies control signals to the respective units of the circuit so as to execute the designated operations.

When an operand of a command from the control ROM 2011 designates a resister, a RAM address controller 2041 designates an address of a corresponding register in a RAM 2061. The RAM 2061 stores various musical tone control data (to be described later with reference to FIGS. 34 and 35) for eight tone generation channels, and various buffers (to be described later), and is used in sound source processing (to be described later).

When a command from the control ROM 2011 is an arithmetic command, an ALU unit 2081 and a multiplier 2091 respectively execute a subtraction/addition and logic arithmetic operation, and a multiplication on the basis of an instruction from the command analyzer 2071.

An interrupt controller 2031 supplies an interrupt signal to the ROM address controller 2051 and a D/A converter unit 2131 at predetermined time intervals on the basis of an internal hardware timer (not shown).

An input port 2101 and an output port 2111 are connected to the switch unit 1041 and the display unit 1091 (FIG. 26).

Various data read out from the control ROM 2011 or the RAM 2061 are supplied to the ROM address controller 2051, the ALU unit 2081, the multiplier 2091, the control data/waveform data ROM 2121, the D/A converter unit 2131, the input port 2101, and the output port 2111 via a bus. The outputs from the ALU unit 2081, the multiplier 2091, and the control data/waveform data ROM 2121 are supplied to the RAM 2061 via the bus.

Figure 29:
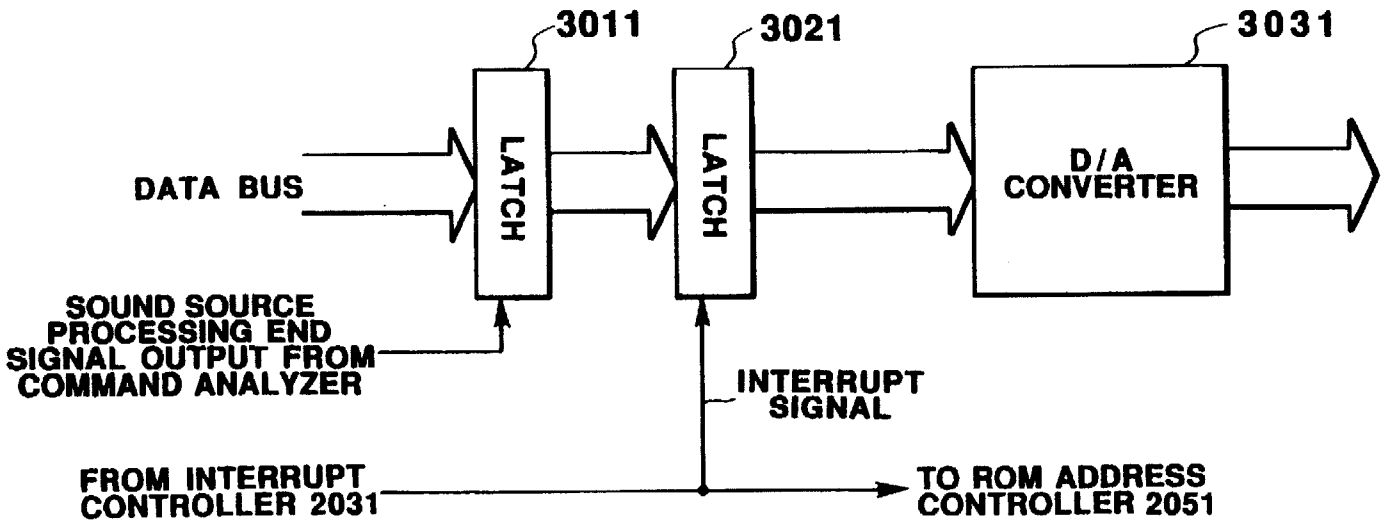
FIG. 29 is a block diagram of a D/A converter unit according to the fourth embodiment.
Figure 30:
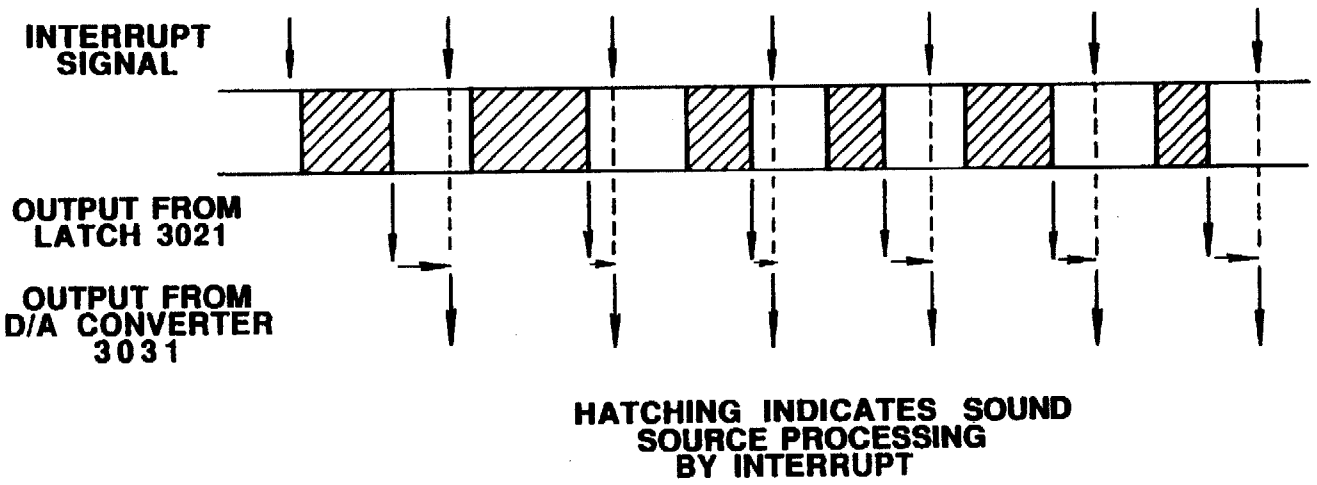
FIG. 30 is a timing chart in D/A conversion.

FIG. 29 shows the internal arrangement of the D/A converter unit 2131 shown in FIG. 26. Data of musical tones for one sampling period generated by sound source processing are input to a latch 3011 via a data bus. When the clock input of the latch 3011 receives a sound processing end signal from the command analyzer 2071 (FIG. 27), the musical tone data for one sampling period on the data bus are latched by the latch 3011, as shown in FIG. 30.

Figure 28:
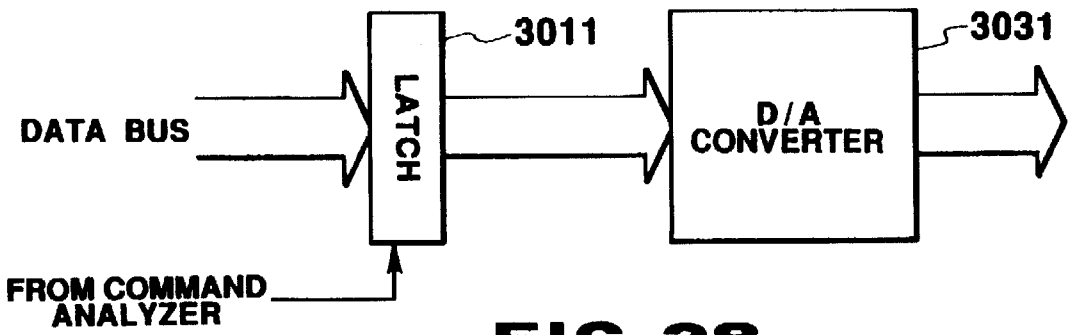
FIG. 28 is a block diagram of a conventional D/A converter unit.

Since a time required for the sound source processing changes depending on execution conditions of sound source processing software, a timing at which the sound source processing is ended, and the musical tone data are latched by the latch 3011 is not fixed. For this reason, as shown in FIG. 28, the output from the latch 301 cannot be directly input to a D/A converter 3031.

In the fourth embodiment, as shown in FIG. 29, the musical tone signals output from the latch 3011 are latched by a latch 3021 in response to interrupt signals equal to a sampling clock interval, which signals are output from the interrupt controller 2031 (FIG. 27), and are output to the D/A converter 3031 at predetermined time intervals.

Since a change in processing time in the respective sound source methods can be absorbed by using the two latches, a complicated timing control program for outputting musical tone data to the D/A converter can be omitted.

Over Operation of the Fourth Embodiment

The overall operation of the fourth embodiment will be described below.

Figure 31:
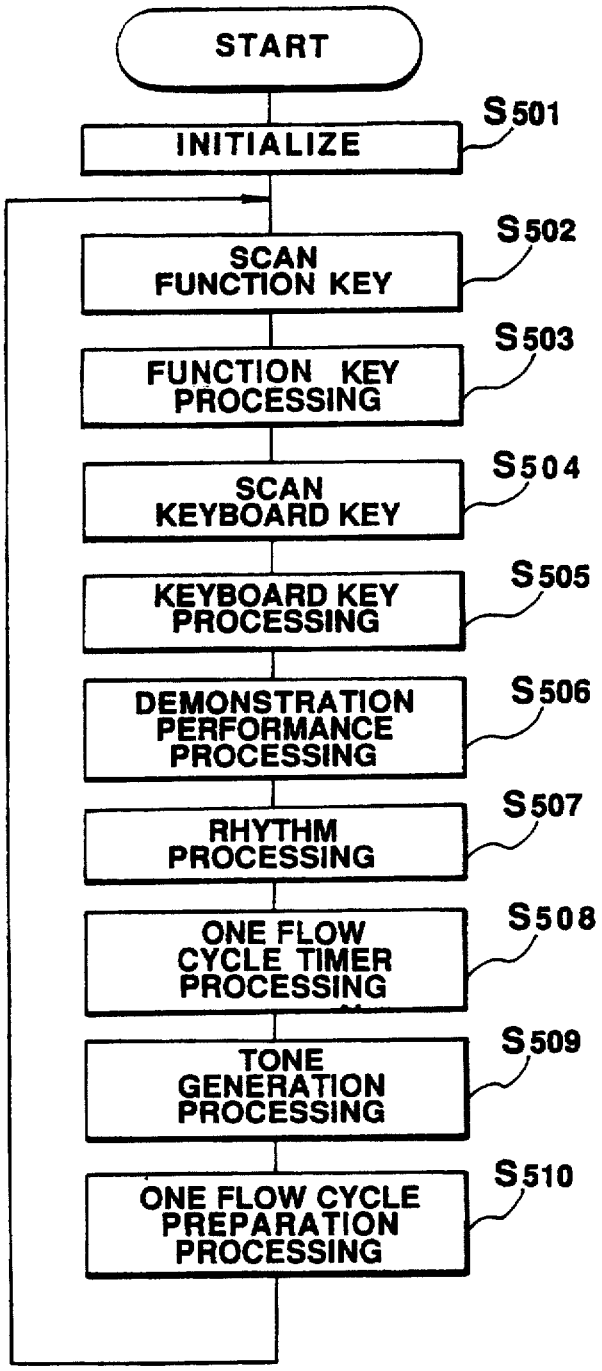
FIGS. 31 to 33 are flow charts showing the overall operations of the fourth embodiment.

In the fourth embodiment, the microcomputer 1011 repetitively executes a series of processing operations in steps $S_{502}$ to $S_{510}$, as shown in the main flow chart of FIG. 31. Sound source processing is executed as interrupt processing in practice. More specifically, the program executed as the main flow chart shown in FIG. 31 is interrupted at predetermined time intervals, and a sound source processing program for generating musical tone signals for eight channels is executed based on the interrupt. Upon completion of this processing, the musical tone signals for eight channels are added to each other, and the sum signal is output from the D/A converter unit 2131 shown in FIG. 27. Thereafter, the control return from the interrupt state to the main flow. Note that the above-described interrupt operation is periodically performed on the basis of the internal hardware timer in the interrupt controller 2031 (FIG. 27). This period is equal to the sampling period when musical tones are output.

The schematic operation of the fourth embodiment has been described. The overall operation of the fourth embodiment will be described in detail below with reference to FIGS. 31 to 33.

The main flow chart of FIG. 31 shows a flow of processing operations other than the sound source processing, which are executed by the microcomputer 1011 in a non-interrupt state from the interrupt controller 2031.

The power switch is turned on, and the contents of the RAM 2061 (FIG. 27) in the microcomputer 1011 are initialized ($S_{501}$).

Switches of the function keys 1031 (FIG. 26) externally connected to the microcomputer 1011 are scanned ($S_{502}$), and states of the respective switches are fetched from the input port 2101 to a key buffer area in the RAM 2061. As a result of scanning, a function key whose state is changed is discriminated, and processing of a corresponding function is executed ($S_{503}$). For example, a musical tone number and an envelope number are set, and if a rhythm performance function is presented as an optional function, a rhythm number is set.

Thereafter, ON keyboard key data on the keyboard 1021 (FIG. 26) are fetched in the same manner as the function keys described above ($S_{504}$), and keys whose states are changed are discriminated, thereby executing key assignment processing ($S_{505}$). The keyboard key processing is particularly associated with the present invention, and will be described later.

When a demonstration performance key (not shown) of the function keys 1031 (FIG. 26) is depressed, demonstration performance data (sequencer data) are sequentially read out from the control data/waveform data ROM 2121 to execute, e.g., key assignment processing ($S_{506}$). When a rhythm start key is depressed, rhythm data are sequentially read out from the control data/waveform data ROM 2121 to execute, e.g., key assignment processing ($S_{507}$). The demonstration performance processing ($S_{506}$) and the rhythm processing ($S_{507}$) are also particularly associated with the present invention, and will be described in detail later.

Thereafter, timer processing to be described below is executed ($S_{508}$). More specifically, a value of time data which is incremented by interrupt timer processing ($S_{512}$) (to be described later) is discriminated. The time data value is compared with time control sequencer data sequentially read out for demonstration performance control or time control rhythm data read out for rhythm performance control, thereby executing time control when a demonstration performance in step $S_{506}$ or a rhythm performance in step S507 is performed.

In tone generation processing in step $S_{509}$, pitch envelope processing, and the like are executed. In this processing an envelope is added to a pitch of a musical tone to be subjected to tone generation processing, and pitch data is set in a corresponding tone generation channel.

Furthermore, one flow cycle preparation processing is executed ($S_{510}$). In this processing, processing for changing a state of a tone generation channel of a note number corresponding to an ON event detected in the keyboard key processing in step $S_{505}$ to an ON event state, and processing for changing a state of a tone generation channel of a note number corresponding to an OFF event to a muting state, and the like are executed.

Interrupt processing will be described below with reference to FIG. 32.

Figure 32:
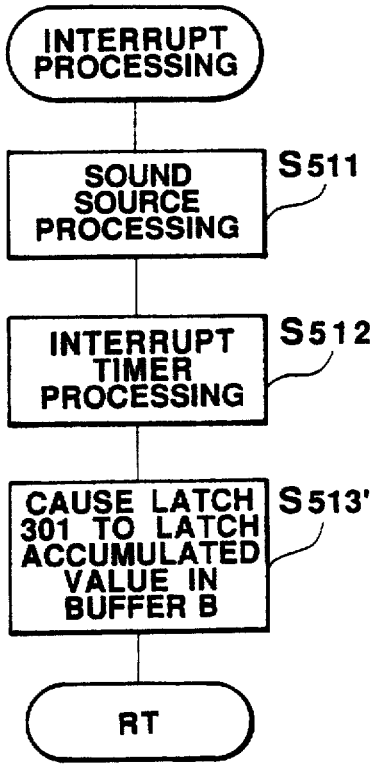

When the program corresponding to the main flow shown in FIG. 31 is interrupted by the interrupt controller 2031 shown in FIG. 27, processing of the program is interrupted, and execution of the interrupt processing program shown in FIG. 32 is started. In this case, control is made to inhibit contents of registers to be subjected to write access in the main flow program in FIG. 31 from being rewritten in the interrupt processing program. Therefore, register save/restoration processing normally executed at the beginning and end of interrupt processing can be omitted. Thus, transition between the processing of the main flow chart shown in FIG. 31 and the interrupt processing can be quickly performed.

Figure 33:
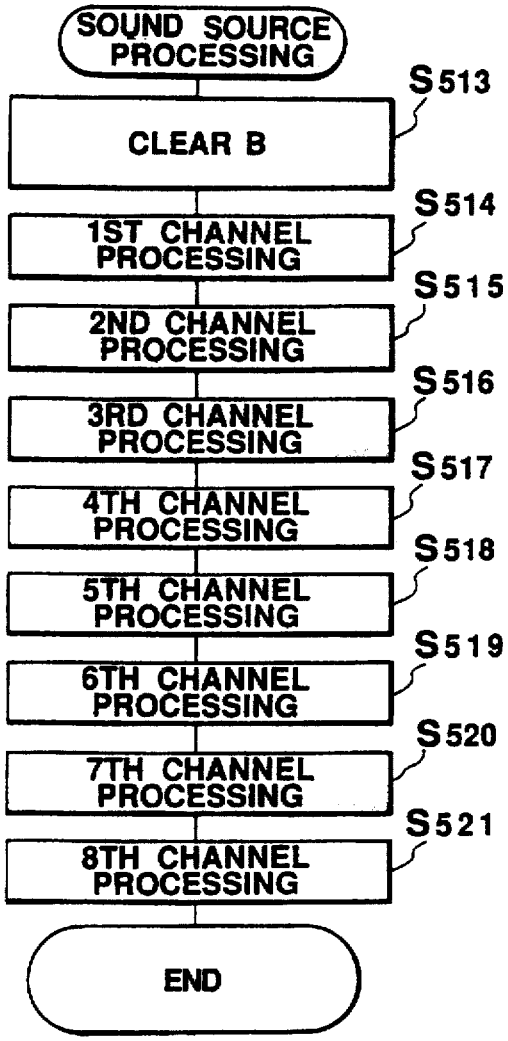

Subsequently, in the interrupt processing, sound source processing is started ($S_{511}$). The sound source processing is shown in FIG. 33. As a result, musical tone waveform data obtained by accumulating tones for eight tone generation channels is obtained in a buffer B (to be described later) of the RAM 2061 (FIG. 27).

In step $S_{512}$, interrupt timer processing is executed. In this processing, the value of time data (not shown) on the RAM 2061 (FIG. 27) is incremented by utilizing the fact that the interrupt processing shown in FIG. 32 is executed for every predetermined sampling period. More specifically, a time elapsed from power-on can be detected based on the value of the time data. The time data obtained in this manner is used in time control in the timer processing in step S508 in the main flow chart shown in FIG. 31, as described above.

In step $S_{513}$, the content of the buffer area is latched by the latch 3011 (FIG. 29) of the D/A converter unit 2131.

Operations of the sound source processing executed in step $S_{511}$ in the interrupt processing will be described below with reference to the flow chart shown in FIG. 33.

A waveform addition area on the RAM 2061 is cleared ($S_{513}$). Then, sound source processing is executed in units of tone generation channels ($S_{514}$ to $S_{521}$). After the sound source processing for the eighth channel is completed, waveform data obtained by adding those for eight channels is obtained in a predetermined buffer area B. These processing operations will be described in detail later.

Figure 34:
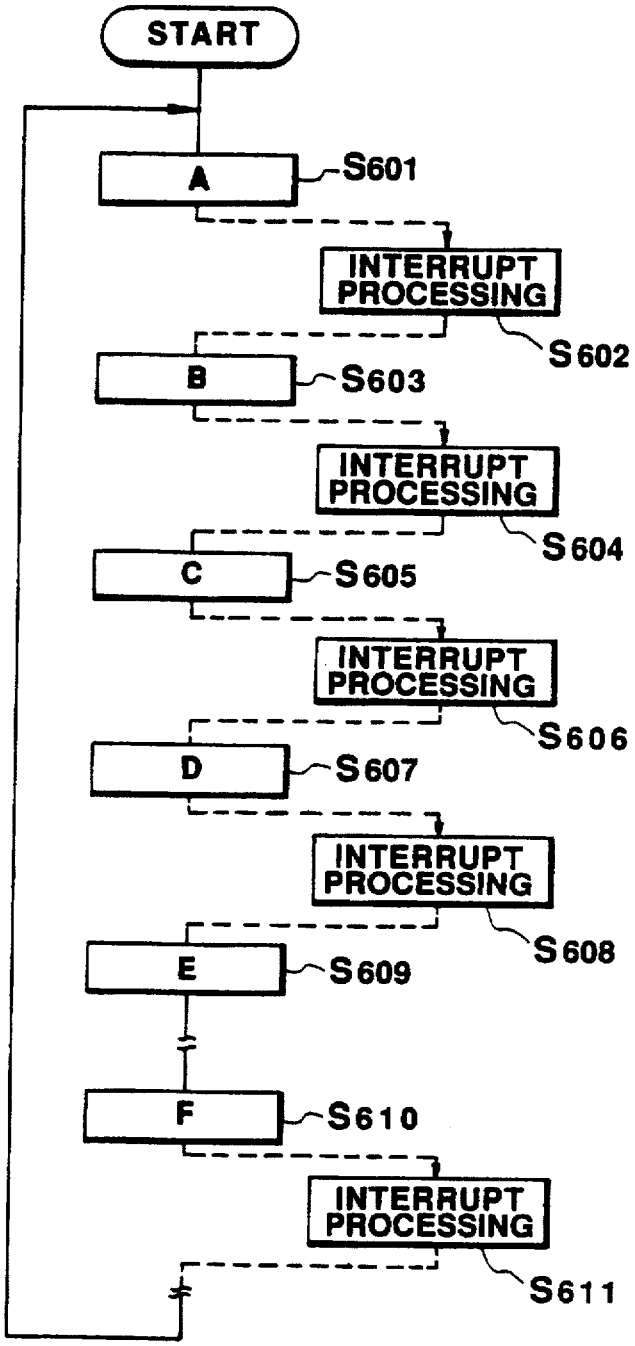
FIG. 34 is a schematic chart showing the relationship between the main operation flow chart and interrupt processing.
Figure 36:
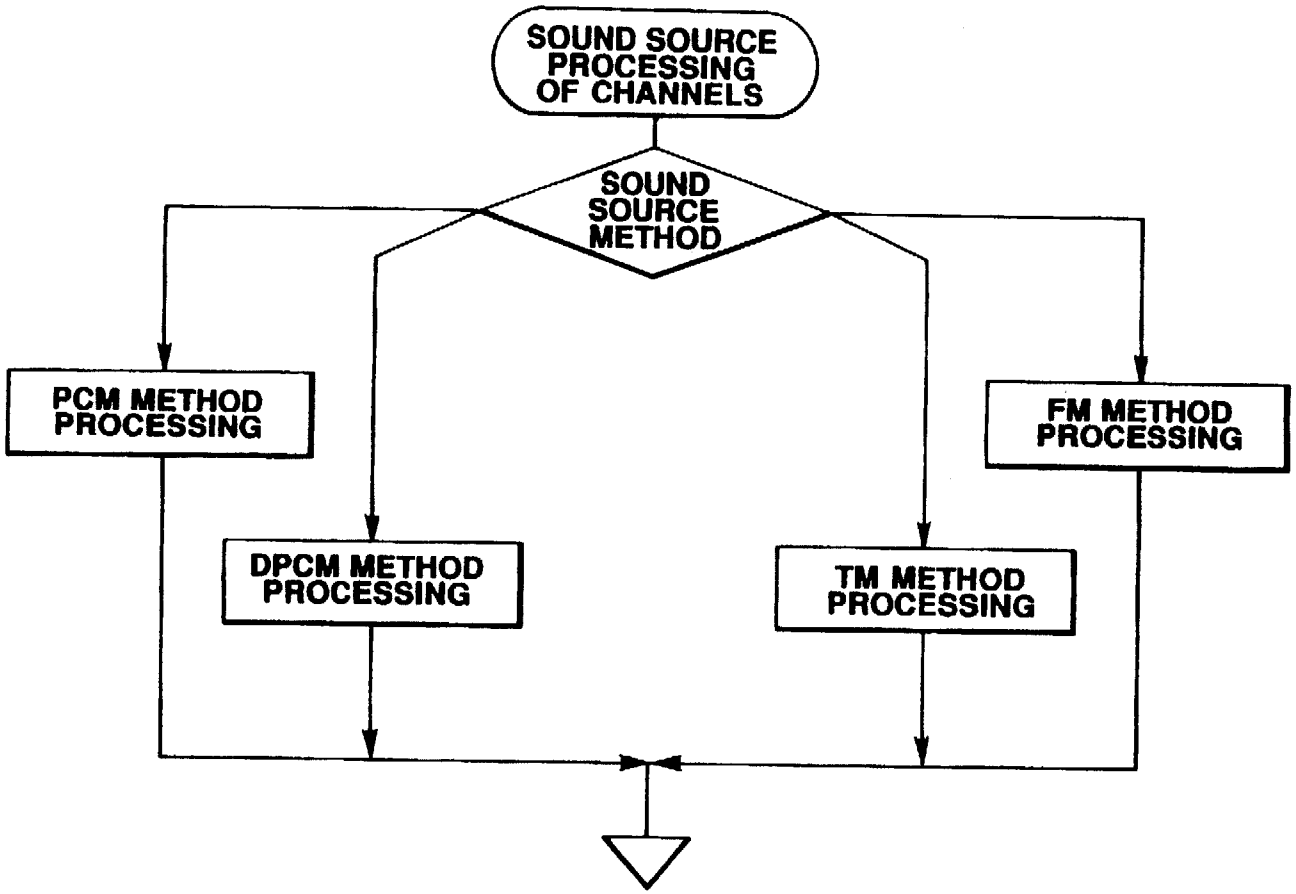
FIG. 36 is a schematic chart when a sound source processing method of each tone generation channel is selected.

FIG. 34 is a schematic flow chart showing the relationship among the processing operations of the flow charts shown in FIGS. 31 and 32. Given processing A (the same applies to B, C, . . . , F) is executed ($S_{601}$). This "processing" corresponds to, e.g., "function key processing", or "keyboard key processing" in the main flow chart of FIG. 31. Thereafter, the control enters the interrupt processing, and sound source processing is started ($S_{602}$). Thus, a musical tone signal for one sampling period obtained by accumulating waveform data for eight tone generation channels can be obtained, and is output to the D/A converter unit 2131. Thereafter, the control returns to some processing B in the main flow chart.

The above-mentioned operations are repeated while executing sound source processing for each of eight tone generation channels ($S_{604}$ to $S_{611}$). The repetition processing continues as long as musical tones are being produced.

Data Architecture in Sound Source Processin

The sound source processing executed in step S511 in FIG. 32 will be described in detail below.

Figure 35:
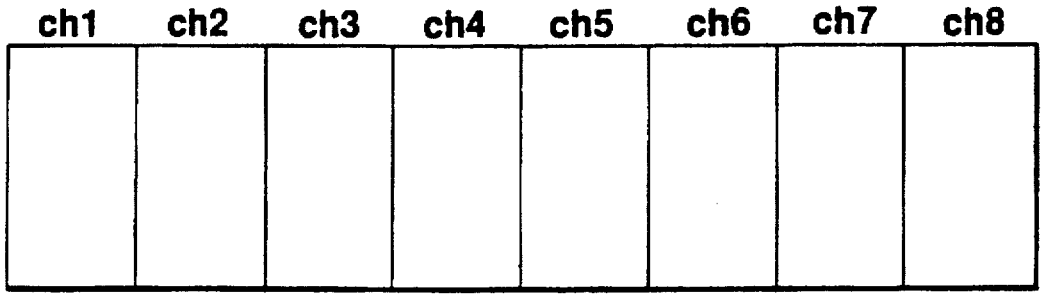
FIG. 35 is a view showing storage areas in units of tone generation channels on a RAM.

In the fourth embodiment, the microcomputer 1011 executes sound source processing for eight tone generation channels. The sound source processing data for eight channels are set in areas in units of tone generation channels of the RAM 2061 (FIG. 27), as shown in FIG. 35.

Figure 48:
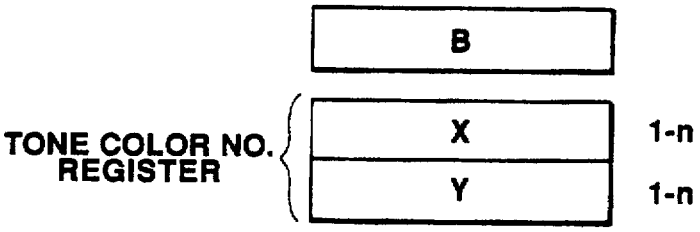
FIG. 48 is a view showing an arrangement of a buffer B and registers X and Y on a RAM 2061.
Figure 49:
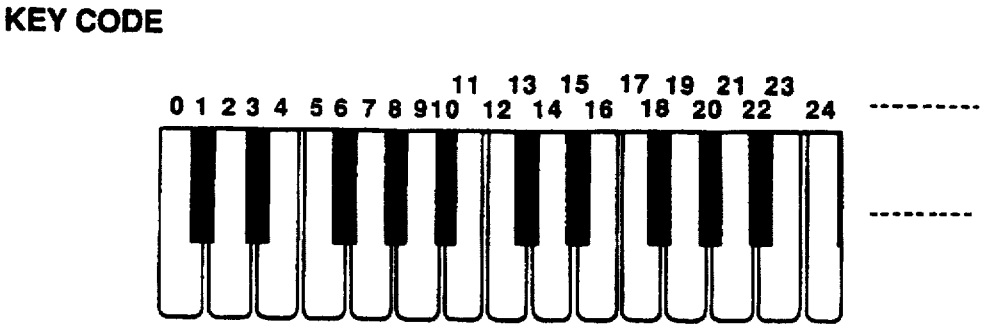
FIG. 49 is an explanatory view of keyboard key (64 keys)

The waveform data accumulation buffer B and tone color No. registers X and Y are allocated on the RAM 2061, as shown in FIG. 48.

In this case, a sound source method is set in (assigned to) each tone generation channel area shown in FIG. 35 by operations to be described in detail later, and thereafter, control data from the control data/waveform data ROM 2121 are set in the area in data formats in units of sound source methods, as shown in FIG. 37. The data formats in the control data/waveform data ROM 2121 will be described in detail later with reference to FIG. 47. In the fourth embodiment, different sound source methods can be assigned to tone generation channels, as will be described later.

In Table 1 showing the data formats of the respective sound source methods shown in FIG. 37, S indicates a sound source method No. as a number for identifying the sound source methods. A represents an address designated when waveform data is read out in the sound source processing, and $A_I$, $A_1$, and $A_2$ represent integral parts of current addresses, and directly correspond to addresses of the control data/waveform data ROM 2121 (FIG. 27) where waveform data are stored. $A_F$ represents a decimal part of the current address, and is used for interpolating waveform data read out from the control data/waveform data ROM 2121. $A_E$ and $A_L$ respectively represent end and loop addresses. $P_I$, $P_1$ and $P_2$ represent integral parts of pitch data, and $P_F$ represents a decimal part of pitch data. For example, $P_I$=1 and $P_F$=0 express a pitch of an original tone, $P_I$=2 end $P_F$=0 express a pitch higher than the original pitch by one octave, and $P_I$=0 and $P_F$=0.5 express a pitch lower by one octave. $X_p$ represents storage of previous sample data, and $X_N$ represents storage of the next sample data. D represents a difference between magnitudes of two adjacent sample data, and E represents an envelope value. Furthermore, O represents an output value. Various other control data will be described later in descriptions of sound source methods.

In the fourth embodiment, when the main flow chart shown in FIG. 31 is executed, sound source method No. data, and control data necessary for sound source processing of the sound source method, e.g., pitch data, envelope data, and the like are set in a corresponding tone generation channel area. In the sound source processing shown in FIG. 33 executed as sound source processing in the interrupt processing shown in FIG. 32, musical tone generation processing is executed while using the control data set in the tone generation channel area. In this manner, a data communication between the main flow program and the sound source program is performed via control data (musical tone generation data) in the tone generation channel areas on the RAM 2061. For this reason, since access of one program to the tone generation channel area can be performed regardless of an execution state of the other program, the two programs can have substantially independent module arrangements, and hence, a simple and efficient program architecture can be attained.

The sound source processing operations of the respective sound source methods executed using the above-mentioned data architecture will be described below in turn. These sound source processing operations are realized by analyzing and executing a sound source processing program stored in the control ROM 2011 by the command analyzer 2071 of the microcomputer 1011. Assume that the processing is executed under this condition unless otherwise specified.

In the flow chart shown in FIG. 33, when the sound source processing (one of steps $S_{517}$ to $S_{524}$) for each channel is started, the sound source method No. data S of the data in the data format (Table 1) shown in FIG. 37 stored in the corresponding tone generation channel area of the RAM 2061 is discriminated to determine sound source processing of a sound source method to be described below.

Sound Source Processing Based on PCM Method

Figure 38:
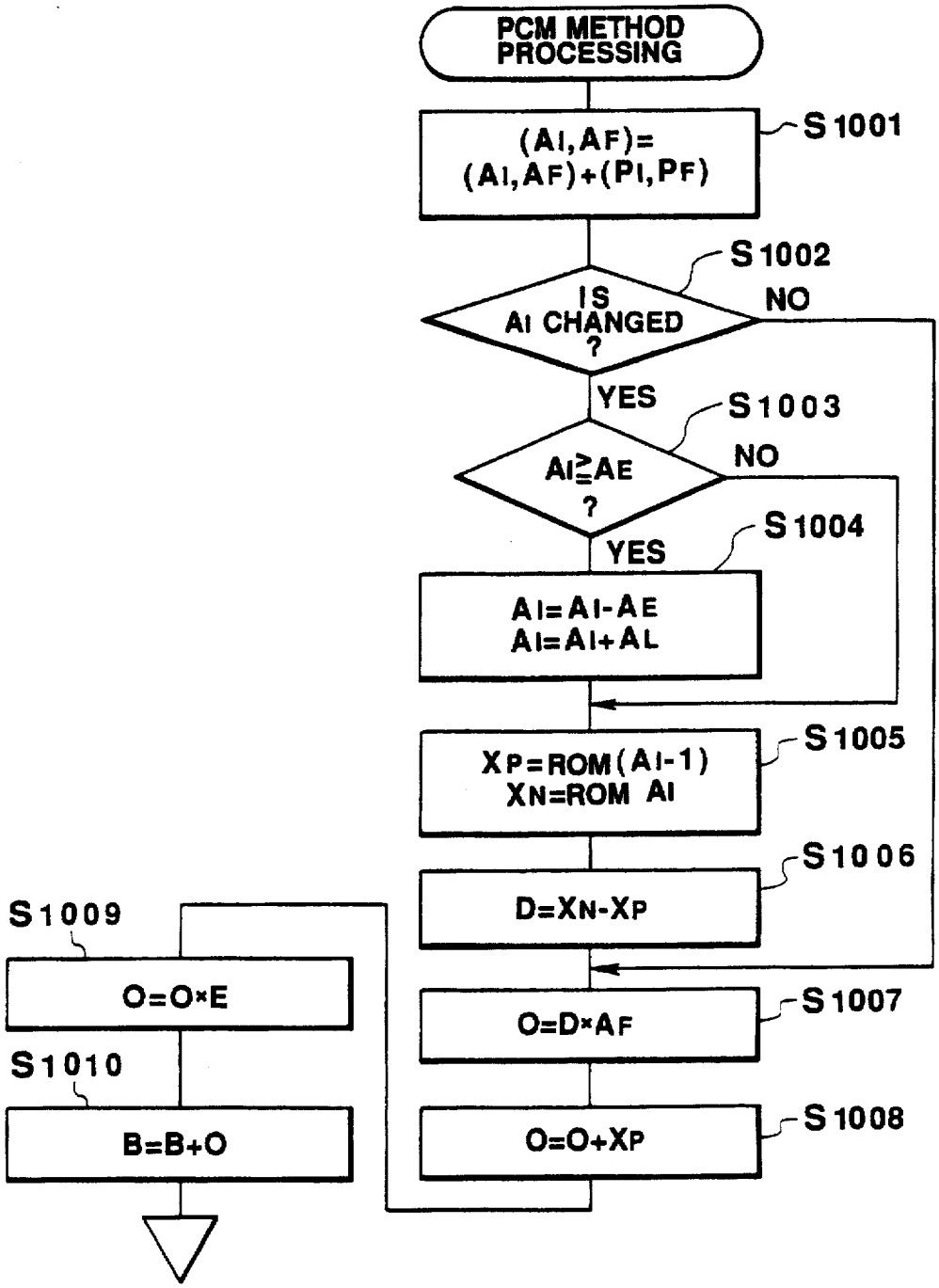
FIG. 38 is an operation flow chart of sound source processing based on a PCM method.

When the sound source method No. data S indicates the PCM method, sound source processing based on the PCM method shown in the operation flow chart of FIG. 38 is executed. Variables in the flow chart are PCM data of Table 1 shown in FIG. 37, which data are stored in the corresponding tone generation channel area (FIG. 35) on the RAM 2061 (FIG. 27).

Figure 40:
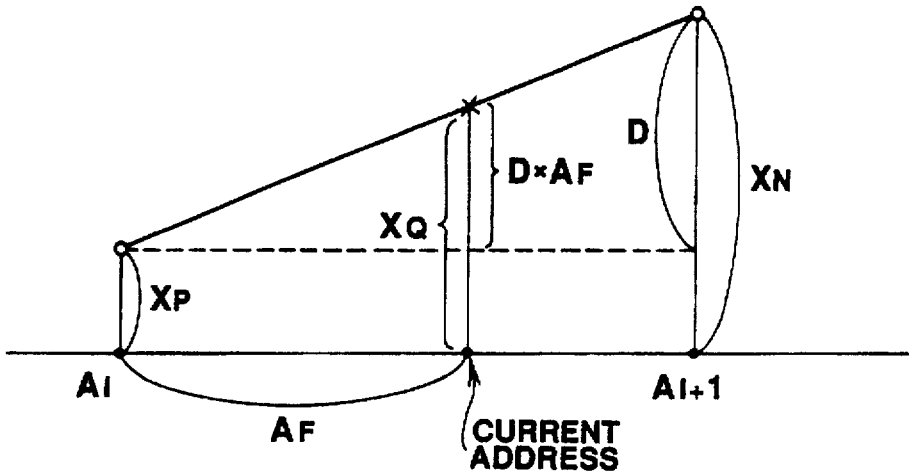
FIGS. 40 and 41 are charts for explaining the principle when an interpolation value $X_Q$ is calculated using a difference D and a present address $A_F$ in the PCM and DPCM methods, respectively.

Of an address group on the control data/waveform data ROM 2121 (FIG. 27) where PCM waveform data are stored, an address where waveform data as an object to be currently processed is stored is assumed to be ($A_I$, $A_F$) shown in FIG. 40.

Pitch data ($P_I$, $P_F$) is added to the present address ($S_{101}$). The pitch data corresponds to the type of a key determined as an ON key of the keyboard 1021 shown in FIG. 26.

It is then checked if the integral part $A_I$ of the sum address is changed ($S_{1002}$). If NO in step $S_{1002}$, an interpolation data value O corresponding to the decimal part $A_F$ of the address is calculated by arithmetic processing $D \times A_F$ using a difference D as a difference between sample data $X_N$ and $X_p$ at addresses ($A_I$+1) and $A_I$ shown in FIG. 40 ($S_{1007}$). Note that the difference D has already been obtained by the sound source processing at the previous interrupt timing (see step $S_{1006}$ to be described later).

The sample data $X_p$ corresponding to the integral part $A_I$ of the address is added to the interpolation data value O to obtain a new sample data value O (corresponding to $X_Q$ in FIG. 40) corresponding to the current address ($A_I$, $A_F$) ($S_{1008}$).

Thereafter, the sample data is multiplied with the envelope value E ($S_{1009}$), and the content of the obtained interpolation data value O is added to the content of the waveform data buffer B (FIG. 48) in the RAM 2061 (FIG. 27) ($S_{1010}$).

Thereafter, the control returns to the main flow chart shown in FIG. 31. The control is interrupted in the next sampling period, and the operation flow chart of the sound source processing shown in FIG. 38 is executed again. Thus, pitch data ($P_I$, $P_F$) is added to the current address ($A_I$, $A_F$) ($S_{1001}$).

The above-mentioned operations are repeated until the integral part $A_I$ of the address is changed ($S_{1002}$).

Before the integral part is changed, the sample data $X_p$ and the difference D are left unchanged, and only the interpolation data value O is updated in with the address $A_F$. Thus, every time the address $A_F$ is updated, new sample data $X_Q$ is obtained.

If the integral part $A_I$ of the current address is changed ($S_{1002}$) as a result of addition of the current address ($A_I$, $A_F$) and the pitch data ($P_I$, $P_F$) in step $S_{1001}$, it is checked if the address $A_I$ has reached or exceeded the end address $A_E$ ($S_{1003}$).

If YES in step S1003, the next loop processing is executed. More specifically, a value ($A_I$–$A_E$) as a difference between the updated current address and the end address $A_E$ is added to the loop address $A_L$ to obtain a new current address ($A_I$, $A_F$). A loop reproduction is started from the integral part $A_I$ of obtained new current address ($S_{1004}$). The end address $A_E$ is an end address of an area of the control data/waveform data ROM 2121 (FIG. 27) where PCM waveform data are stored. The loop address $A_L$ is an address of a position where a player wants to repeat an output of a waveform. With the above-mentioned operations, known loop processing is realized by the PCM method.

If NO in step $S_{1003}$, the processing in step $S_{1004}$ is not executed.

Sample data is then updated. In this case, sample data corresponding to the new updated current address $A_I$ and the immediately preceding address ($A_I$–1) are read out as $X_N$ and $X_p$ from the control data/waveform data ROM 2121 (FIG. 27) ($S_{1005}$).

Furthermore, the difference so far is updated with a difference D between the updated data $X_N$ and $X_p$ ($S_{1006}$).

The following operation is as described above.

In this manner, waveform data by the PCM method for one tone generation channel is generated.

Sound Source Processing Based on DPCM Method

The sound source processing based on the DPCM method will be described below.

The operation principle of the DPCM method will be briefly described below with reference to FIG. 41.

Figure 41:
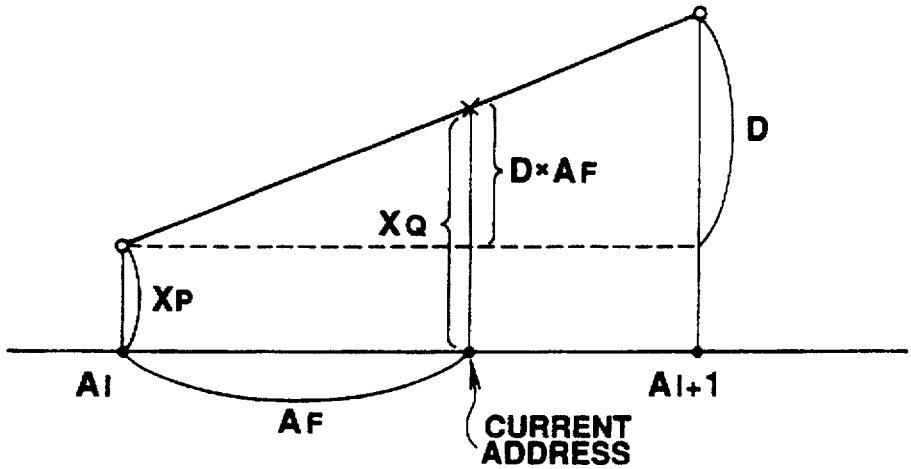

In FIG. 41, sample data $X_p$ corresponding to an address $A_I$ of the control data/waveform data ROM 2121 (FIG. 27) is obtained by adding sample data corresponding to an address ($A_I$–1) (not shown) to a difference between the sample data corresponding to the address ($A_I$–1) and sample data corresponding to the address $A_I$.

A difference D with sample data at the next address ($A_I$+1) is written at the address $A_I$ of the control data/waveform data ROM 2121. Sample data at the next address ($A_1$+1) is obtained by $X_p$+D.

In this case, if the current address is represented by $A_F$, as shown in FIG. 41, sample data corresponding to the current address $A_I$+$A_F$ is obtained by $X_p$+$D \times A_F$.

In this manner, in the DPCM method, a difference D between sample data corresponding to the current address and the next address is read out from the control data/waveform data ROM 2121, and is added to the current sample data to obtain the next sample data, thereby sequentially forming waveform data.

If the DPCM method is adopted, when a waveform such as a voice or a musical tone which generally has a small difference between adjacent samples is to be quantized, quantization can be performed by a smaller number of bits as compared to the normal PCM method.

Figure 39:
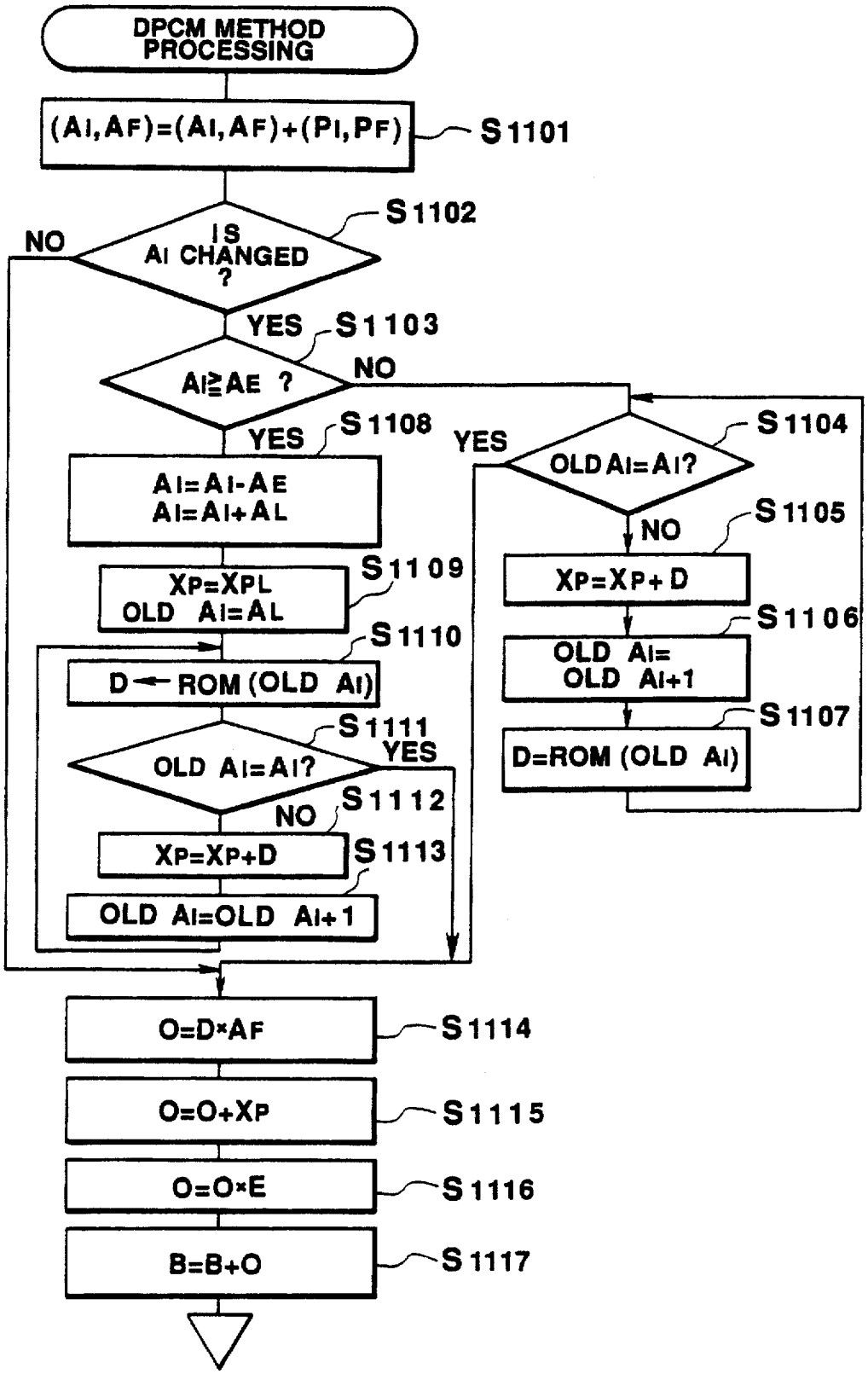
FIG. 39 is an operation flow chart of sound source processing based on a DPCM method.

The operation of the above-mentioned DPCM method will be described below with reference to the operation flow chart shown in FIG. 39. variables in the flow chart are DPCM data in Table 1 shown in FIG. 37, which data are stored in the corresponding tone generation area (FIG. 35) on the RAM 2061 (FIG. 27).

Of addresses on the control data/waveform data ROM 2121 where DPCM differential waveform data are stored, an address where data as an object to be currently processed is stored is assumed to be ($A_I$, $A_F$) shown in FIG. 41.

Pitch data ($P_I$, $P_F$) is added to the present address ($A_I$, $A_F$) ($S_{1101}$).

It is then checked if the integral part $A_I$ of the sum address is changed ($S_{1102}$). If NO in step $S_{1102}$, an interpolation data value O corresponding to the decimal part $A_F$ of the address is calculated by arithmetic processing $D \times A_F$ using a difference D at the address $A_I$ in FIG. 41 ($S_{1114}$). Note that the difference D has already been obtained by the sound source processing at the previous interrupt timing (see steps $S_{1106}$ and $S_{1110}$ to be described later).

The interpolation data value O is added to sample data $X_p$ corresponding to the integral part $A_I$ of the address to obtain a new sample data value O (corresponding to $X_Q$ in FIG. 41) corresponding to the current address ($A_I$, $A_F$) ($S_{1115}$).

Thereafter, the sample data value O is multiplied with an envelope value E ($S_{1116}$), and the obtained value is added to a value stored in the waveform data buffer B (FIG. 48) in the RAM 2061 (FIG. 27) ($S_{1117}$).

Thereafter, the control returns to the main flow chart shown in FIG. 31. The control is interrupted in the next sampling period, and the operation flow chart of the sound source processing shown in FIG. 39 is executed again. Thus, pitch data ($P_I$, $P_F$) is added to the current address ($A_I$, $A_F$) ($S_{1101}$).

The above-mentioned operations are repeated until the integral part $A_I$ of the address is changed.

Before the integral part is changed, the sample data $X_p$ and the difference D are left unchanged, and only the interpolation data O is updated in accordance with the address $A_F$. Thus, every time the address $A_F$ is updated, new sample data $X_Q$ is obtained.

If the integral part $A_I$ of the present address is changed ($S_{1102}$) as a result of addition of the current address ($A_I$, $A_F$) and the pitch data ($P_I$, $P_F$) in step $S_{1101}$, it is checked if the address $A_I$ has reached or exceeded the end address $A_E$ ($S_{1103}$).

If NO in step $S_{1103}$, sample data corresponding to the integral part $A_I$ of the updated present address is calculated by the following loop processing in steps $S_{1104}$ to $S_{1107}$. More specifically, a value before the integral part $A_I$ of the present address is changed is stored in a variable "old $A_I$" (see the column of DPCM in Table 1 shown in FIG. 37). This can be realized by repeating processing in step $S_{1106}$ or $S_{1113}$ (to be described later). The old $A_I$ value is sequentially incremented in $S_{1106}$, and differential waveform data on the control data/waveform data ROM 2121 (FIG. 27) addressed by the incremented old $A_I$ values are read, out as D in step $S_{1107}$. The readout data D are sequentially accumulated on sample data $X_p$ in step $S_{1105}$. When the old $A_I$ value becomes equal to the integral part $A_I$ of the changed current address, the sample data $X_p$ as a value corresponding to the integral part $A_I$ of the changed current address.

When the sample data $X_p$ corresponding to the integral part $A_I$ of the current address is obtained in this manner, YES is determined in step $S_{1104}$, and the control starts the arithmetic processing of the interpolation value ($S_{1114}$) described above.

The above-mentioned sound source processing is repeated at the respective interrupt timings, and when the judgement in step $S_{1103}$ is changed to YES, the control enters the next loop processing.

An address value ($A_I$–$A_E$) exceeding the end address $A_E$ is added to the loop address $A_L$, and the obtained address is defined as an integral part $A_I$ of a new current address ($S_{1108}$).

An operation for accumulating the difference D several times depending on an advance in address from the loop address $A_L$ is repeated to calculate sample data $X_p$ corresponding to the integral part $A_I$ of the new current address. More specifically, sample data $X_p$ is initially set as the value of sample data $X_{PL}$ (see the column of DPCM in Table 1 shown in FIG. 37) at the current loop address $A_L$, and the old $A_I$ is set as the value of the loop address $A_L$ ($S_{1109}$). The following processing operations in steps $S_{1110}$ to $S_{1113}$ are repeated. More specifically, the old $A_I$ value is sequentially incremented in step $S_{1113}$, and differential waveform data on the control data/waveform data ROM 2121 designated by the incremented old $A_I$ values are read out as data D. The data D are sequentially accumulated on the sample data $X_p$ in step $S_{1112}$. When the old $A_I$ value becomes equal to the integral part $A_I$ of the new current address, the sample data $X_p$ has a value corresponding to the integral part $A_I$ of the new current address after loop processing.

When the sample data $X_p$ corresponding to the integral part $A_I$ of the new current address is obtained in this manner, YES is determined in step $S_{1111}$, and the control enters the above-mentioned arithmetic processing of the interpolation value ($S_{1114}$).

As described above, waveform data by the DPCM method for one tone generation channel is generated.

Sound Source Processing Based on FM Method

The sound source processing based on the FM method will be described below.

In the FM method, hardware or software elements having the same contents, called "operators", are normally used, and are connected based on connection rules, called algorithms, thereby generating musical tones. In the fourth embodiment, the FM method is realized by a software program.

Figure 42:
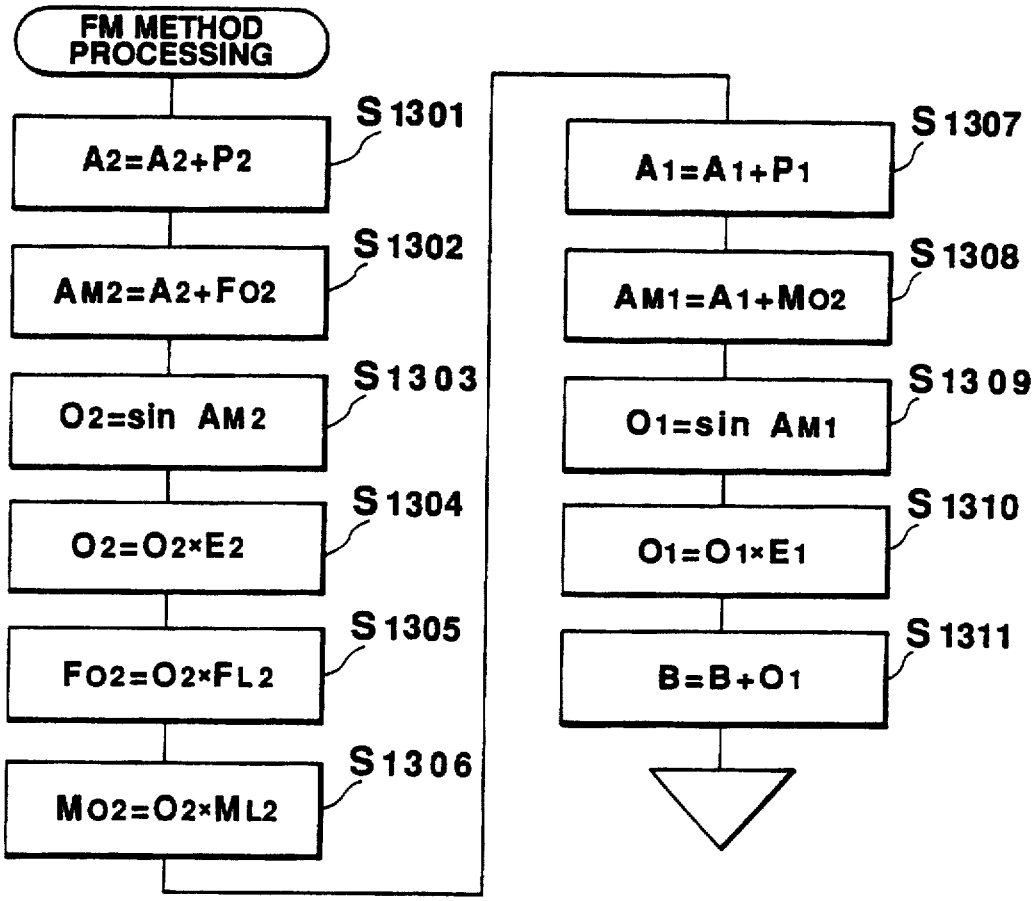
FIG. 42 is an operation flow chart of sound source processing based on an FM method.
Figure 43:
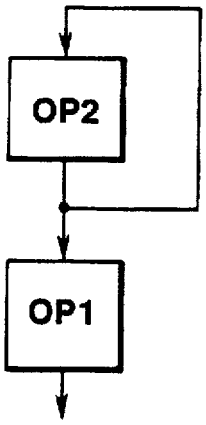
FIG. 43 is a chart showing an algorithm of the sound processing method based on the FM method.

The operation of one embodiment executed when the sound source processing is performed using two operators will be described below with reference to the operation flow chart shown in FIG. 42. The algorithm of the processing is shown in FIG. 43. Variables in the flow chart are FM data in Table 1 shown in FIG. 37, which data are stored in the corresponding tone generation channel area (FIG. 35) on the RAM 2061 (FIG. 27).

First, processing of an operator 2 (OP2) as a modulator is performed. In pitch processing (processing for accumulating pitch data for determining an incremental width of an address for reading out waveform data stored in the ROM 2121), since no interpolation is performed unlike in the PCM method, an address consists of only an integral address $A_2$. More specifically, modulation waveform data are stored in the control data/waveform data ROM 2121 (FIG. 27) at sufficiently fine incremental widths.

Pitch data $P_2$ is added to the current address $A_2$ ($S_{1301}$).

A feedback output $F_{O2}$ is added to the address $A_2$ as a modulation input to obtain a new address $A_{M2}$ ($S_{1302}$). The feedback output $F_{O2}$ has already been obtained upon execution of processing in step $S_{1305}$ (to described later) at the immediately preceding interrupt timing.

The value of a sine wave corresponding to the address $A_{M2}$ (phase) is calculated. In practice sine wave data are stored in the control data/wavefrom data ROM 2121, and are obtained by addressing the ROM 2121 by the address $A_{M2}$ to read out the corresponding data ($S_{1303}$).

Subsequently the sine wave data is multiplied with an envelope value $E_2$ to obtain an output $F_{O2}$ ($S_{1304}$).

Thereafter, the output $O_2$ is multiplied with a feedback level $F_{L2}$ to obtain a feedback output $F_{O2}$ ($S_{1305}$). In the fourth embodiment, this output $F_{O2}$ serves as an input to the operator 2 (OP2) at the next interrupt timing.

The output $O_2$ is multiplied with a modulation level $M_{L2}$ to obtain a modulation output $M_{O2}$ ($S_{1306}$). The modulation output $O_2$ serves as a modulation input to an operator 1 (OP1).

The control then enters processing of the operator 1 (OP1). This processing is substantially the same as that of the operator 2 (OP2) described above, except that there is no modulation input based on the feedback output.

The present address $A_1$ of the operator 1 (OP1) is added to pitch data $P_1$ ($S_{1307}$), and the sum is added to the above-mentioned modulation output $M_{O2}$ to obtain a new address $A_{M1}$ ($S_{1308}$).

The value of sine wave data corresponding to this address $A_{M1}$ (phase) is read out from the control data/waveform data ROM 2121 ($S_{1309}$), and is multiplied with an envelope value $E_1$ to obtain a musical tone waveform output $O_1$ ($S_{1310}$).

This output $O_1$ is added to a value held in the buffer B (FIG. 48) in the RAM 2061 ($S_{1311}$), thus completing the FM processing for one tone generation channel.

Sound Source Processing Based on TM (Triangular Wave Modulation) Method (Part 1)

The sound source processing based on the TM method will be described below. The principle of the TM method will be described below.

The FM method described above is based on the following formula:

$$e=A.\sin\{\omega_c t+I(t).\sin\omega_m t\}$$

where $\omega_c t$ is the carrier wave phase angle (carrier signal), $\sin\omega_m t$ is the modulation wave phase angle (modulation signal), and I(t) is the modulation index.

In contrast to this, a phase modulation method called the TM method in the fourth embodiment is based on the following formula:

$$e=A.f_T\{f_c(t)+I(t).\sin\omega_m t\}$$

where $f_T(t)$ is the triangular wave function, and is defined by the following functions in units of phase angle regions (where ω is the input):

$$f_T(\omega)=2/\pi.\omega\ldots\text{(region: } 0\leqq\omega\leqq\pi/2)$$

$$f_T(\omega)=-1+2/\pi(3\pi/2-\omega)\ldots\text{(region: } \pi/2\leqq\omega\leqq3\pi/2)$$

$$f_T(\omega)=-1+2/\pi(\omega-3\pi/2)\ldots\text{(region: } 3\pi/2\leqq\omega\leqq2\pi)$$

$f_c$ is called a modified sine wave, and is the carrier signal generation function obtained by accessing by the carrier phase angle $\omega_c t$ the control data/waveform data ROM 2121 (FIG. 27) for storing different sine waveform data in units of phase angle regions. $f_c$ of each phase angle region is defined as follows:

$$f_c(t)=\pi/2\ \sin\omega_c t\ldots\text{(region: } 0\leqq\omega t\leqq\pi/2)$$

$$f_c(t)=\pi-\pi/2\ \sin\omega_c t\ldots\text{(region: } \pi\leqq\omega t\leqq3\pi/2)$$

$$f_c(t)=2\pi+\pi/2\ \sin\omega_c t\ldots\text{(reigon: } 3\pi/2\leqq\omega_c t\leqq2\pi$$

(where n is an integer)

In the TM method, the above-mentioned triangular wave function is modulated by a sum signal obtained by adding a carrier signal generated by the above-mentioned function $f_c(t)$ to the modulation signal $\sin\omega_m(t)$ at a ratio indicated by the modulation index I(t). In this manner, when the value of the modulation index I(t) is 0, a sine wave can be generated, and as the value I(t) is increased, a very deeply modulated waveform can always be generated. Various other signals may be used in place of the modulation signal $\sin\omega_m(t)$, and as will be described later, the same operator output in the previous arithmetic processing may be fed back at a predetermined feedback level, or an output from another operator may be input.

Figure 44:
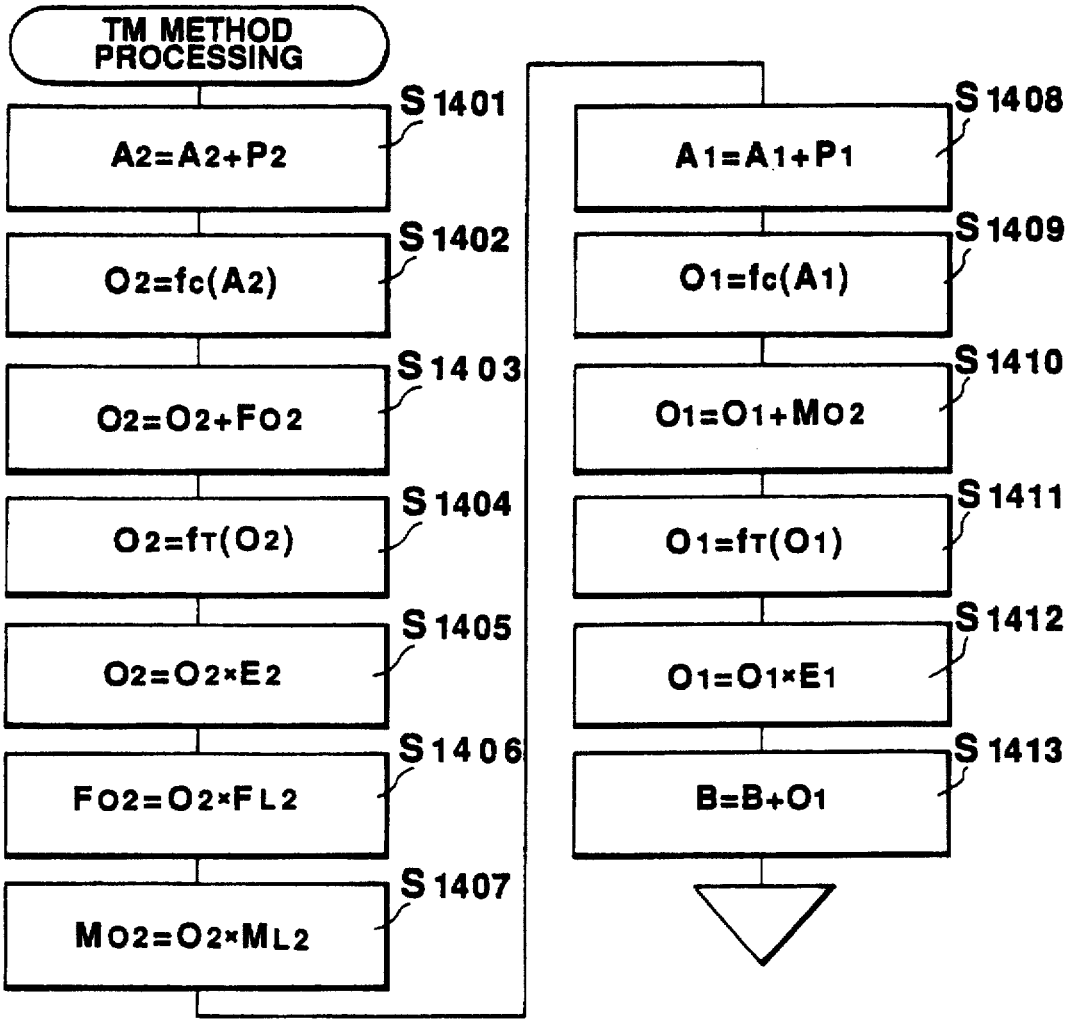
FIG. 44 is an operation flow chart of sound source processing based on a TM method.
Figure 45:
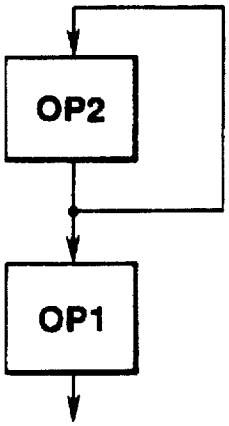
FIG. 45 is a chart showing an algorithm of the sound source processing based on the TM method.

The sound source processing based on the TM method according to the above-mentioned principle will be described below with reference to the operation flow chart shown in FIG. 44. The sound source processing is also performed using two operators like in the FM method shown in FIGS. 42 and 43, and the algorithm of the processing is shown in FIG. 45. Variables in the flow chart are TM format data in Table 1 shown in FIG. 37, which data are stored in the corresponding tone generation channel area (FIG. 35) on the RAM 2061 (FIG. 27).

First, processing of an operator 2 (OP2) as a modulator is performed. In pitch processing, since no interpolation is performed unlike in the PCM method, an address consists of only an integral address $A_2$.

The present address $A_2$ is added to pitch data $P_2$ ($S_{1401}$).

Modified sine wave data corresponding to the address $A_2$ (phase) is read out from the control data/waveform data ROM 2121 (FIG. 27) by the modified sine conversion fc, and is output as a carrier signal $O_2$ ($S_{1402}$).

Subsequently, the carrier signal $O_2$ is added to a feedback output $F_{O2}$ ($S_{1406}$) as a modulation signal, and the sum signal is output as a new address $O_2$ ($S_{1403}$). The feedback output $F_{O2}$ has already been obtained upon execution of processing in step $S_{1406}$ (to be described later) a the immediately preceding interrupt timing.

The value of a triangular wave corresponding to the carrier signal $O_2$ is calculated. In practice, the above-mentioned triangular wave data are stored in the control data/waveform data ROM 2121 (FIG. 27), and are obtained by addressing the ROM 2121 by the address $O_2$ to read out the corresponding triangular wave data ($S_{1404}$).

Subsequently, the triangular wave data is multiplied with an envelope value $E_2$ to obtain an output $O_2$ ($S_{1405}$).

Thereafter, the output $O_2$ is multiplied with a feedback level $F_{L2}$ to obtain a feedback output $F_{O2}$ ($S_{1407}$). In the first embodiment, the output $F_{O2}$ serves as an input to the operator 2 (OP2) at the next interrupt timing.

The output $O_2$ is multiplied with a modulation level $M_{L2}$ to obtain a modulation output $O_2$ ($S_{1407}$). The modulation output $M_{O2}$ serves as a modulation input to an operator 1 (OP1).

The control then enters processing of the operator 1 (OP1). This processing is substantially the same as that of the operator 2 (OP2) described above, except that there is no modulation input based on the feedback output.

The present address $A_1$ of the operator 1 is added to pitch data $P_1$ ($S_{1408}$), and the sum is subjected to the above-mentioned modified sine conversion to obtain a carrier signal $O_1$ ($S_{1409}$).

The carrier signal $O_1$ is added to the above-mentioned modulation output $M_{O2}$ to obtain a new value $O_1$ ($S_{1410}$), and the value $O_1$ is subjected to triangular wave conversion ($S_{1411}$). The converted is multiplied with an envelope value $E_1$ to obtain a musical tone waveform output $O_1$ ($S_{1412}$).

The output $O_1$ is added to a value held in the buffer B (FIG. 48) in the RAM 2061 (FIG. 27) ($S_{1413}$), the completing the TM processing for one tone generation channel.

The sound source processing operations based on four methods, i.e., the PCM, DPCM, FM, and TM methods have been described. Of these methods, the FM and TM methods are modulation methods, and, in the above examples, two-operator processing operations are executed based on the algorithms shown in FIGS. 43 and 45. However, in sound source processing in an actual performance, more operators may be used, and the algorithms may be more complicated.

Summary of Keyboard Key Processing

The operations of keyboard key processing ($S_{505}$) in the main flow chart shown in FIG. 31 when an actual electronic musical instrument is played will be described in detail below.

In the above-described sound source processing, data in units of sound source methods (FIG. 37) are set in the corresponding tone generation channel areas (FIG. 35) on the RAM 2061 (FIG. 27) by the function keys 1031 (FIG. 26). The function keys 1031 are connected to, e.g., an operation panel of the electronic musical instrument via the input port 2101 (FIG. 27).

In the fourth embodiment, split points based key codes and velocities, and two tone colors are designated in advance, thus allowing characteristic assignment of tone colors to the tone generation channels.

Figure 46:
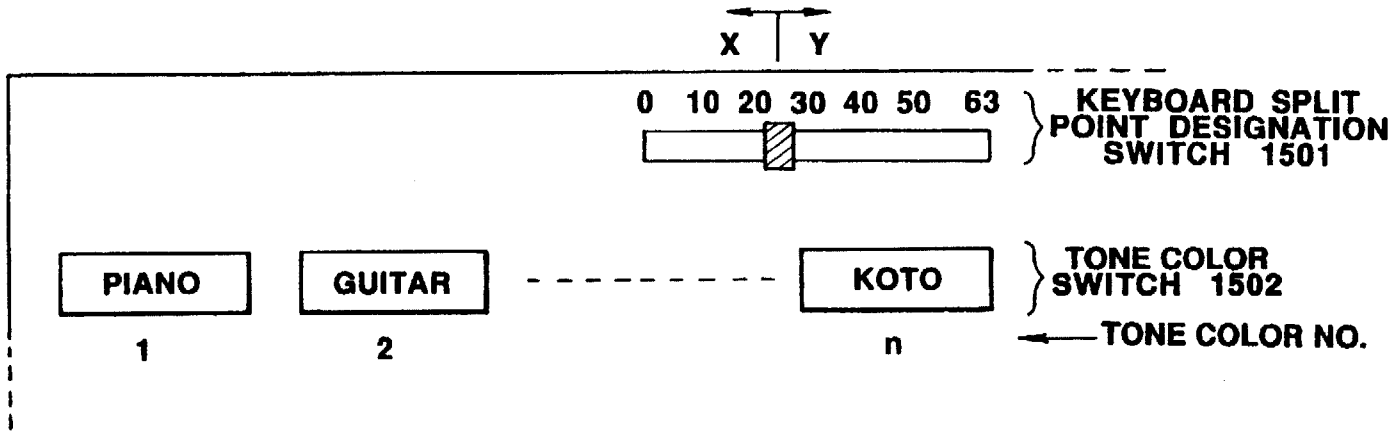
FIG. 46 is a view showing an arrangement of some function keys (Part 1)
Figure 52:
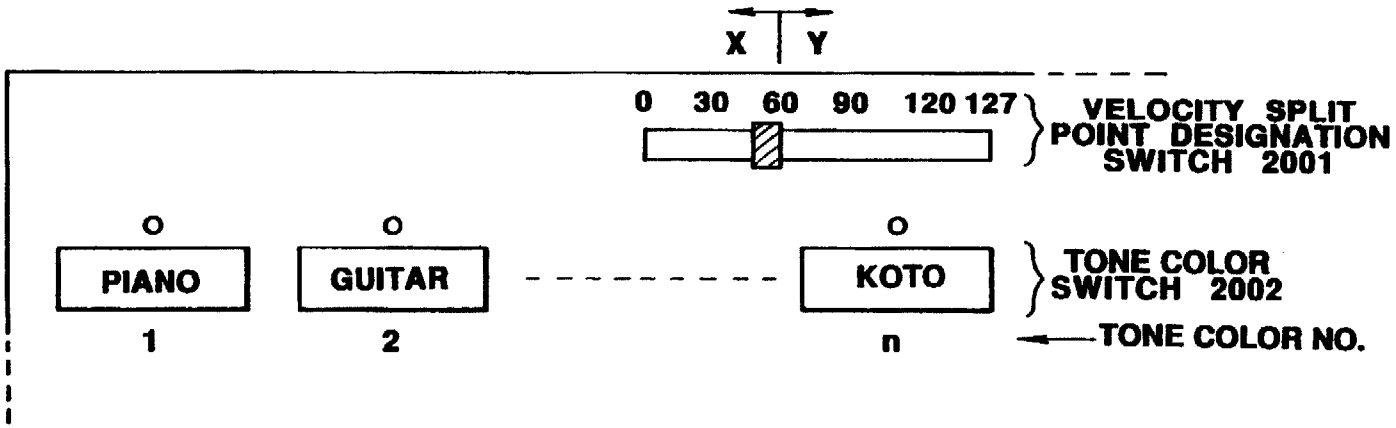
FIG. 52 is a view showing an arrangement of some function keys (Part 2)

The split points and the tone colors are designated, as shown in FIG. 46 or 52.

FIG. 46 shows an arrangement of some function keys 1031 (FIG. 26). A keyboard split point designation switch 15011 comprises a slide switch which has a click feeling, and can designate a split point based on key codes of ON keys in units of keyboard key. When two tone colors, e.g., "piano" and "guitar" are designated as X and Y tone colors by tone color switches 15021, the X tone color is designated for a bass tone range, and the Y tone color is designated for a high tone range to have the above-mentioned split point as a boundary. In this case, a tone color designated first is set as the X tone color, and for example, a red LED is turned on. A tone color designated next is set as the Y tone color, and green LED is turned on. The LEDs correspond to the display unit 1091 (FIG. 26).

A split point based on velocities is designated by a velocity split point designation switch 15031 shown in FIG. 52. For example, when the switch 15031 is set at velocity= 60, an X tone color is designated for ON events having a velocity of 60 or less, and a Y tone color is designated for ON events having a velocity faster than 60. In this case, the X and Y tone colors are designated by tone color switches 20021 (FIG. 52) in same manner as in FIG. 46 (the case of a split point based on key codes).

The arrangement shown in FIG. 46 or 52 can constitute an independent embodiment. However, an embodiment having both these functions may be realized. In order to allow the above-mentioned tone color setting operations, the control data/waveform data ROM 2121 (FIG. 27) stores various tone color parameters in data formats shown in FIG. 47. More specifically, tone color parameters for the four sound source methods, i.e., the PCM, DPCM, FM, and TM methods are stored in units of instruments corresponding to the tone color switches 15021 of "piano" as the tone color No. 1, "guitar" as the tone color No. 2, and the like shown in FIG. 46. The tone color parameters for the respective sound source methods are stored in the data formats in units of sound source methods shown in FIG. 37. On the other hand, the buffer B for accumulating waveform data for eight tone generation channels, and the tone color No. registers for holding the tone color Nos. of the X and Y tone colors are allocated on the RAM 2061 (FIG. 27).

Figure 47:
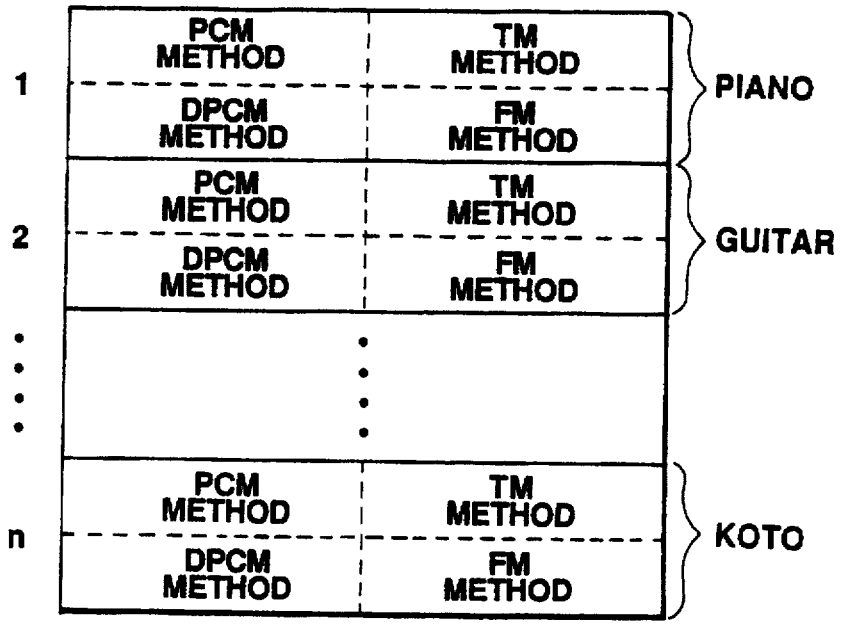
FIG. 47 is a view showing a data architecture of tone color parameters.

Tone color parameters in units of sound source methods, which have the data formats shown in FIG. 47, are set in the tone generation channel areas (FIG. 35) for the eight channels of the RAM 2061, and sound source processing is executed based on these parameters. Processing operations for assigning tone color parameters to the tone generation channels in accordance with ON events on the basis of the split point and the two, i.e., X and Y tone colors designated by the function keys shown in FIG. 46 or 52 will be described below in turn.

Embodiment A of Keyboard Key Processing

The embodiment A of keyboard key processing will be described below.

The embodiment A is for an embodiment having the arrangement shown in FIG. 46 as some function keys 1031 shown in FIG. 26. Based on an operation of the keyboard split point designation switch 15011 shown in FIG. 46 by a player, key codes of ON keys are split into two groups at the split point. Then, musical tone signals in two, i.e., X and Y tone colors designated upon operation of the tone color switches 15021 (FIG. 46) by the player are generated. Furthermore, one of the four sound source methods is selected in accordance with the magnitude of a velocity (corresponding to an ON key speed) obtained upon an ON event of a key on the keyboard 1021 (FIG. 26). Tone color generation is performed on the basis of the tone colors and the sound source method determined in this manner.

In the embodiment A, as shown in FIG. 57, musical tone signals in the X tone color are generated using the first to fourth tone generation channels (ch1 to ch4), and musical tone signals in the Y tone color are generated using the fifth to eighth tone generation channels (ch5 to Ch8).

Note that operations of the keyboard split point designation switch 15011 and the tone color switches 15021 shown in FIG. 46 by the player are detected in the function key scanning processing in step $S_{502}$ in the main flow chart of FIG. 31, and in the function key processing in step $S_{503}$ in FIG. 31, key codes corresponding to the operation states are held in registers (not shown) on the RAM 2061. In addition, the X and Y tone colors are held in the X and Y tone color No. registers (FIG. 48) in the RAM 2061.

Figure 50:
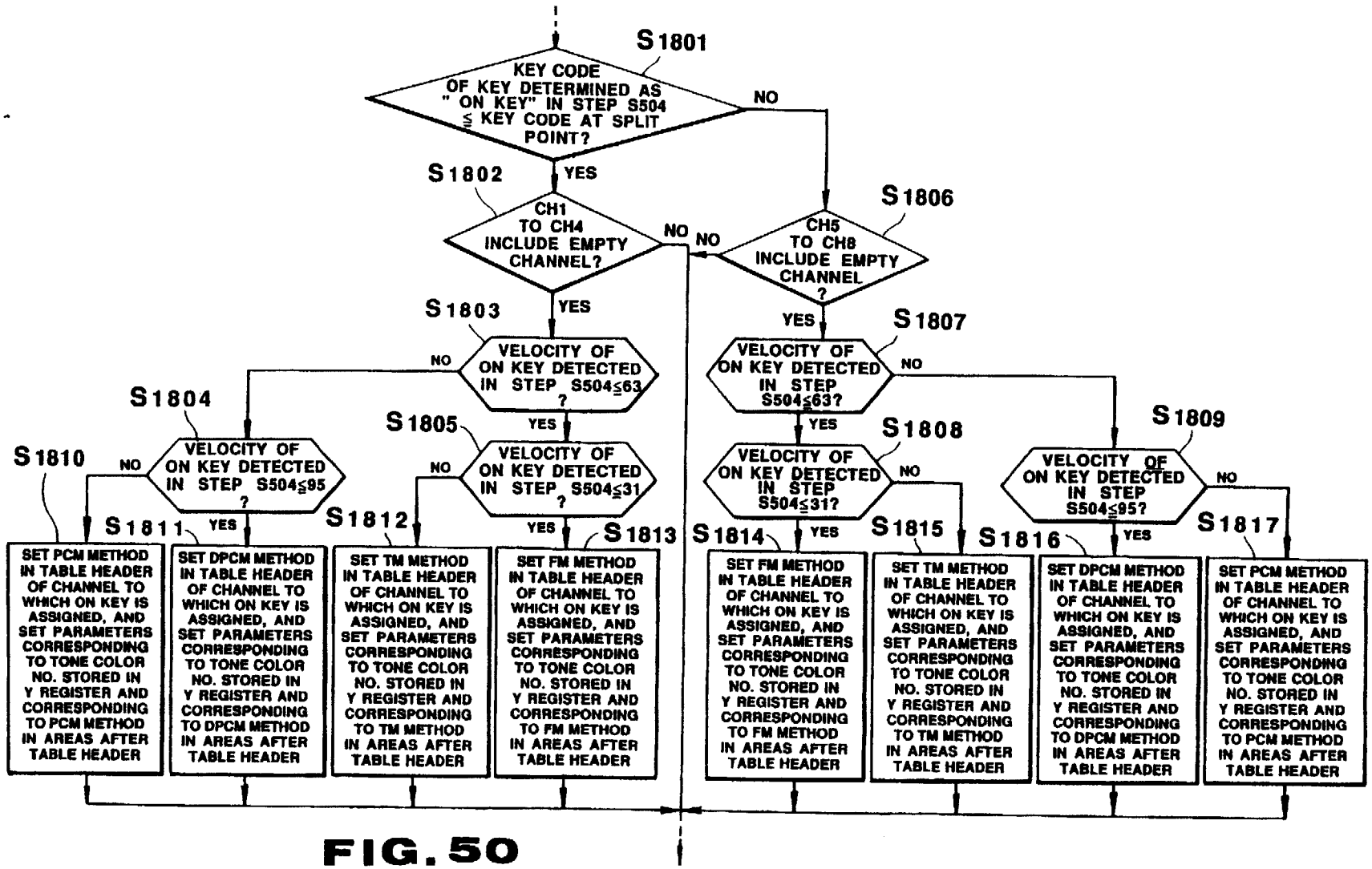
FIG. 50 is an operation flow chart of an embodiment A of keyboard key processing.

FIG. 50 is an operation flow chart of the embodiment A of the keyboard key processing in step $S_{505}$ in the main flow chart shown in FIG. 31.

It is checked if a key code of a key determined as an "ON key" in step S504 in the main flow chart shown in FIG. 31 is equal to or smaller than that at the split point designated in advance ($S_{1801}$).

If YES in step $S_{1801}$, tone color parameters of the X tone color designated beforehand by the player are set in one of the first to fourth tone generation channels (FIG. 57) by the following processing operations in steps $S_{1802}$ to $S_{1805}$ and $S_{1810}$ to $S_{1813}$. It is checked if the first to fourth tone generation channels include an empty channel ($S_{1802}$).

If it is determined that there is no empty channel, and NO is determined in step $S_{1802}$, no assignment is performed.

If it is determined that there is an empty channel, and YES in step $S_{1802}$, tone color parameters for the X tone color, and corresponding to one of the PCM, DPCM, TM, and FM methods are set in the empty channel in accordance with the velocity value as follows.

It is checked if the velocity value of a key determined as an "ON key" in step $S_{504}$ in the main flow chart in FIG. 31 is equal to or smaller than 63 (almost corresponding to mezzo piano mp) ($S_{1803}$).

If YES in step $S_{1805}$, e.i., if it is determined that the velocity value is equal to or smaller than 63, it is then checked if the value is equal to or smaller than 31 (almost corresponding to piano p) ($S_{1805}$).

If YES in step $S_{1805}$, e.i., if it is determined that the velocity value V falls within a range of $0 \leqq v \leqq 31$, the tone color parameters for the X tone color are set in the FM format shown in FIG. 37 in one tone generation channel area (empty channel area) of the first to fourth channels (FIG. 27) to which the ON key is assigned on the RAM 2061. More specifically, sound source method No. data S representing the FM method is set in the first area of the corresponding tone generation channel area (see the column of FM in FIG. 37). Then, the tone color parameters corresponding to the tone color of the tone color No. presently stored in the X tone color No. resister (FIG. 48) on the RAM 2061 are read out from a data architecture portion shown in FIG. 47 of the control data/waveform data ROM 2121, and are set in the second and subsequent areas of the tone generation channel area ($S_{1813}$).

If YES in step $S_{1805}$, i.e., if it is determined that the velocity value falls within a range of $31 \leqq v \leqq 63$, tone color parameters for the X tone color are set in the TM format shown in FIG. 37 in the tone generation channel area on the RAM 2061 to which the ON key is assigned ($S_{1812}$). In this case, the parameters set in the same manner as in step $S_{1813}$.

If NO in step $S_{1803}$, it is then checked if the velocity value is equal to or smaller than 95 (almost corresponding to piano p) ($S_{1804}$).

If YES in step $S_{1804}$, i.e., if it is determined that the velocity value v falls within a range of $63<v \leqq 95$, tone color parameters for the X tone color are set in the DPCM format shown in FIG. 37 in the tone generation channel area on the RAM 2061 to which the ON key is assigned ($S_{1811}$). In this case, the parameters set in the same manner as in step $S_{1813}$.

If NO in step $S_{1804}$, i.e., if it is determined that the velocity value V falls within a range of $95<V \leqq 127$, tone color parameters for the X tone color are set in the PCM format shown in FIG. 37 in the tone generation channel area on the RAM 2061 to which the ON key is assigned ($S_{1810}$). In this case, the parameters are set in the same manner as in step $S_{1813}$.

On the other hand, if NO in first step $S_{1801}$, tone color parameters for the Y tone color designated in advance by the player are set in one of the fifth to eighth tone generation channels (FIG. 57) by the following processing in steps $S_{1806}$ to $S_{1809}$ and $S_{1814}$ to $S_{1817}$.

It is checked if the fifth to eighth tone generation channels include an empty channel ($S_{1806}$).

If it is determined that there is no empty channel, and NO is determined in step $S_{1806}$, no assignment is performed.

If it is determined that there is an empty channel, and YES is determined in step $S_{1806}$, tone color parameters for the Y tone color, and corresponding to one of the PCM, DPCM, TM, and FM methods are set in the empty channel in accordance with the velocity value as follows.

First, it is checked if the velocity value of an ON key is equal to or smaller than 63 ($S_{1807}$).

If YES in step $S_{1807}$, i.e., if it is determined that the velocity value is equal to or smaller than 63, it is then checked if the value is equal to or smaller than 31 ($S_{1808}$).

If YES in step S1808, i.e., if it is determined that the velocity value V falls within a range of $0 \leqq v \leqq 31$, tone color parameters for the Y tone color are set in the FM format in FIG. 37 in one of the fifth to eighth channels to which the ON key is assigned. More specifically, sound source method No. data S representing the FM method is set in the first area of the corresponding tone generation channel area (see the column of FM in FIG. 37). Then, the tone color parameters corresponding to the tone color of the tone color No. presently stored in the Y tone color No. resister (FIG. 48) on the RAM 2061 are read out from a data architecture portion shown in FIG. 47 of the control data/waveform data ROM 2121, and are set in the second and subsequent areas of the tone generation channel area ($S_{1814}$).

If YES in step $S_{1808}$, i.e., if it is determined that the velocity value falls within a range of $31 \leqq V \leqq 63$, tone color parameters for the Y tone color are set in the TM format shown in FIG. 37 in the tone generation channel area on the RAM 2061 to which the ON key is assigned (S1815). In This case, the parameters are set in the same manner as in step $S_{1814}$.

If NO in step $S_{1807}$, it is checked if the velocity value is equal to or smaller than 95 ($S_{1809}$). If YES in step $S_{1809}$, i.e., if it is determined that the velocity value V falls within a range of $63<v \leqq 95$, tone color parameters for the Y tone color are set in the DPCM format shown in FIG. 37 in the tone generation channel area on the RAM 2061 to which the ON key is assigned ($S_{1816}$). In this case, the parameters are set in the same manner as in step $S_{1814}$.

If NO in step $S_{1816}$, i.e., if it is determined that the velocity value V falls within a range of $95<V \leqq 127$, tone color parameters for the Y tone color are set in the PCM format shown in FIG. 37 in the tone generation channel area on the RAM 2061 to which the ON key is assigned ($S_{1817}$). In this case, the parameters are set in the same manner as in step $S_{1814}$.

As described above, one of the X and Y tone colors is selected in accordance with whether the key code is lower or higher than the split point, and one of the four sound source methods is selected in accordance with the magnitude of an ON key velocity, thus generating musical tones.

Embodiment B of Keyboard Key Processing

The embodiment B of the keyboard key processing will be described below.

In the embodiment A described above, as shown in FIG. 57, the tone generation channels to which the X and Y tone colors are assigned are fixed as the first to fourth tone generation channels and the fifth to eighth tone generation channels, respectively. In the embodiment B, channels to which each tone color is assigned are not fixed, and the X and Y tone colors are sequentially assigned to empty channels, as shown in FIG. 58.

Figure 51:
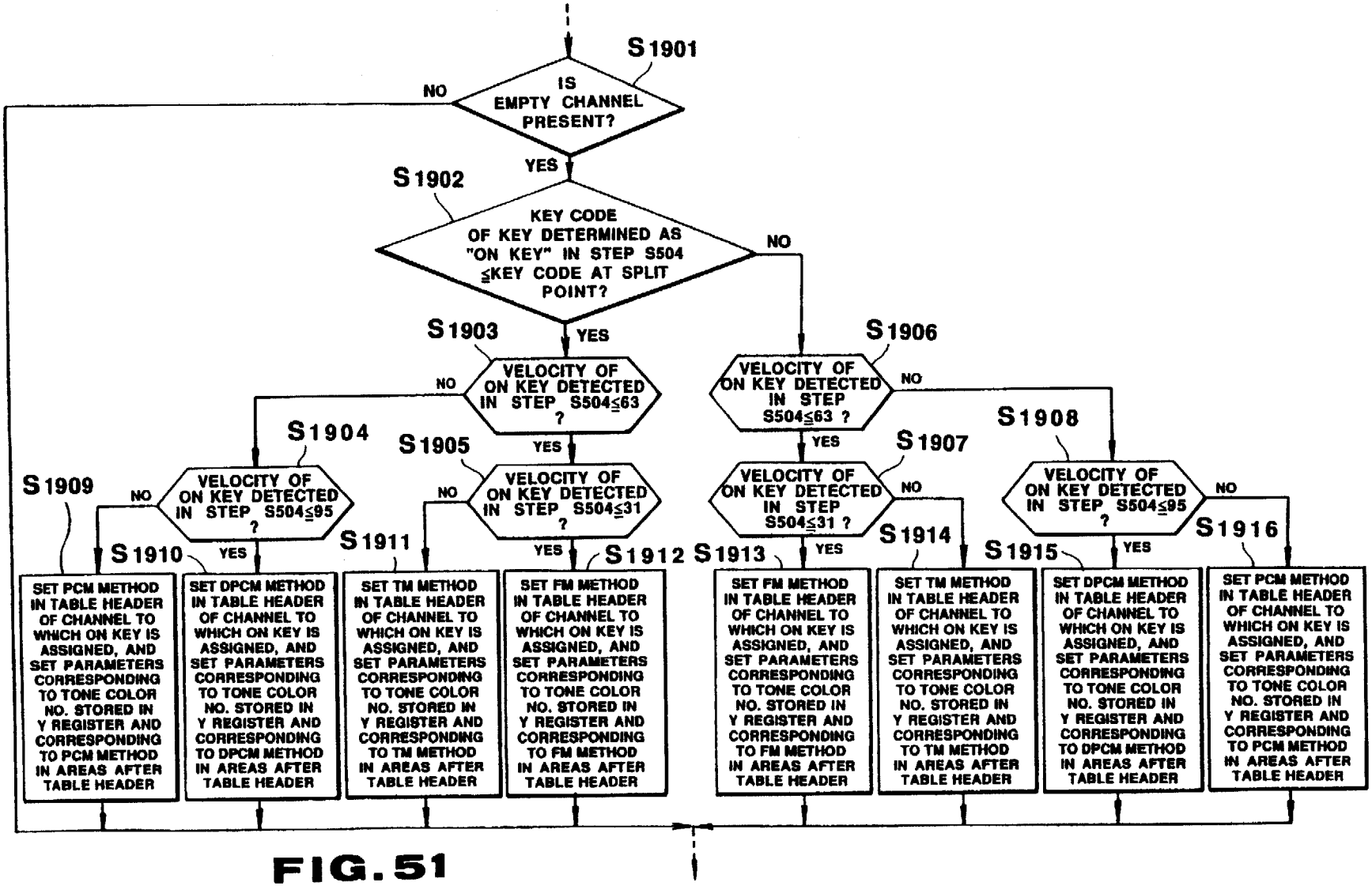
FIG. 51 is an operation flow chart of an embodiment B of keyboard key processing.

FIG. 51 is an operation flow chart of the embodiment B of the keyboard key processing in step $S_{505}$ in the main flow chart shown in FIG. 31. As shown in FIG. 51 it is checked if the first to eighth channels include an empty channel ($S_{1901}$). If there is an empty channel, tone color assignment is performed. The processing operations in steps $S_{1902}$ to $S_{1916}$ the same those in steps $S_{1801}$, $S_{1803}$ to $S_{1805}$, and $S_{1806}$ to $S_{1817}$ in the embodiment A.

According to the embodiment B, flexible tone color assignment to the tone generation channels can be performed.

Embodiment C of Keyboard Key Processing

The embodiment C of the keyboard key processing will be described below.

The embodiment C corresponds to a case wherein processing for a key code and processing for a velocity in the embodiment A are replaced.

More specifically, the embodiment C is for an embodiment having an arrangement shown in FIG. 52 as some function keys 1031 shown in FIG. 26, and velocities of ON keys are split into two groups at the split point upon operation of the velocity split point designation switch 20011 (FIG. 52) by the player. Then, musical tone signals are generated in the two, i.e., X and Y tone colors designated upon operation of the tone color switches 20021 (FIG. 52) by the player. In this case one of the four sound source methods is selected in accordance with a key code value of an ON key on the keyboard 1021 (FIG. 26) by the player. Tone color generation is performed in accordance with the tone colors and the sound source method determined in this manner. The X and Y tone colors are assigned to the tone generation channels, as shown in FIG. 57, in the same manner as in the embodiment A.

Figure 53:
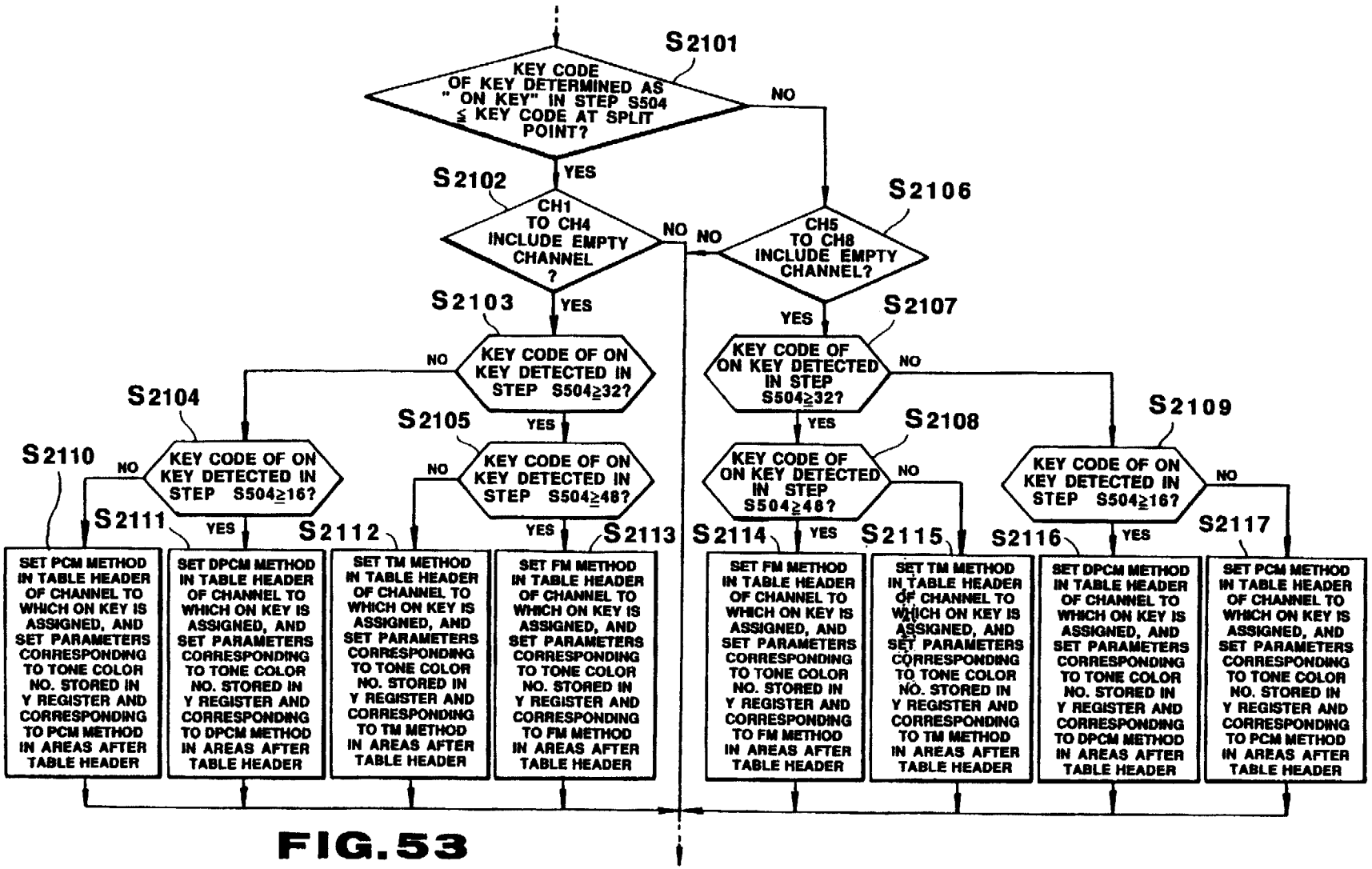
FIG. 53 is an operation flow chart of an embodiment C of keyboard key processing.

FIG. 53 is an operation flow chart of the embodiment C of the keyboard key processing in step $S_{505}$ in the main flow chart of FIG. 31.

It is checked if the velocity of a key determined as an "ON key" in step $S_{504}$ in the main flow chart in FIG. 31 is equal to or smaller than the velocity at the split point designated in advance by the player ($S_{2101}$).

If YES in step $S_{2101}$, tone color parameters for the X tone color designated in advance by the player are set in one of the first to fourth tone generation channels (FIG. 57) by the following processing in steps $S_{2102}$ to $S_{2105}$ and $S_{2110}$ to $S_{2113}$.

It is checked if the first to fourth tone generation channels include an empty channel ($S_{2102}$).

If it is determined that there is no empty channel, and NO is determined in step $S_{2102}$, no assignment is performed.

If it is determined that there is an empty channel, and YES is determined in step $S_{2102}$, tone color parameters for the X tone color, and corresponding to one of the PCM, DPCM, TM, and FM methods are set in the empty channel in accordance with the key code value as follows.

It is checked if the key code value of a key determined as an "ON key" in step $S_{504}$ in the main flow chart in FIG. 31 is equal to or larger than 32 ($S_{2103}$).

If YES in step $S_{2103}$, i.e., if it is determined that the key code value is equal to or larger than 32, it is then checked if the value is equal to or larger than 48 ($S_{2105}$).

If YES in step $S_{2105}$, i.e., if it is determined that the key code value K falls within a range of $48 \leqq K \leqq 63$ (63= maximum value), tone color parameters for the X tone color are set in the FM format shown in FIG. 37 in one of the first to fourth channels area on the RAM 2061 to which the ON key is assigned (FIG. 27). In this case, the parameters are set in the same manner as in step $S_{1813}$ in the embodiment A.

If YES in step $S_{2105}$, i.e., if the key code value falls within a range of $32 \leqq v < 48$, tone color parameters for the X tone color are set in the TM format shown in FIG. 37 in the tone generation channel area on the RAM 2061 to which the ON key is assigned ($S_{2112}$). In this case, the parameters are set in the same manner as in step $S_{1813}$ in the embodiment A.

If NO in step $S_{2103}$, it is checked if the key code value is equal to or larger than 16 ($S_{2104}$).

If YES in step $S_{2104}$, i.e., if it is determined that the key code value K falls within a range of $16 \leqq K \leqq 32$, tone color parameters for the X tone color are set in the DPCM format shown in FIG. 37 in the tone generation channel area on the RAM 2061 to which the ON key is assigned ($S_{2111}$). In this case, the parameters are set in the same manner as in step $S_{1813}$ in the embodiment A.

Furthermore, if NO in step S2104, i.e., if it is determined that the key code value K falls within a range of $0 \leqq V < 16$, tone color parameters for the X tone color are set in the PCM format shown in FIG. 37 in the tone generation channel area on the RAM 2061 to which the ON key is assigned ($S_{2110}$). In this case, the parameters are set in the same manner as in step $S_{1813}$ in the embodiment A.

If NO in first step $S_{2101}$, tone color parameters for the Y tone color designated in advance by the player are set in one of the fifth to eighth tone generation channels (FIG. 57) by the following processing in steps $S_{2106}$ to $S_{2109}$ and $S_{2114}$ to $S_{2117}$.

It is checked if the fifth to eighth tone generation channels include an empty channel ($S_{2106}$).

If it is determined that there is no empty channel, and NO is determined in step $S_{2106}$, no assignment is performed.

If there is an empty channel, and YES is determined in step $S_{2106}$, it is checked in the processing in steps $S_{2107}$ to $S_{2109}$ having the same judgment conditions as those in steps $S_{2103}$ to $S_{2105}$ if the key code value falls within a range of $48 \leqq K \leqq 63$, $32 \leqq K < 48$, $16 \leqq K < 32$, or $0 \leqq K < 16$. Thus, in steps $S_{2114}$ to $S_{2117}$, tone color parameters for the Y color and corresponding to one of the FM, TM, DPCM, and PCM methods are set in an empty channel.

Embodiment D of Ke board Key Processing

Furthermore, the embodiment D of the keyboard key processing will be described below.

In the embodiment C, as shown in FIG. 57, the tone generation channels to which the X and Y tone colors are assigned are fixed as the first to fourth tone generation channels and the fifth to eighth tone generation channels, respectively. In the embodiment D, channels to which each tone color is assigned are not fixed, and the X and Y tone colors are sequentially assigned to empty channels, as shown in FIG. 58 like in the embodiment B.

Figure 54:
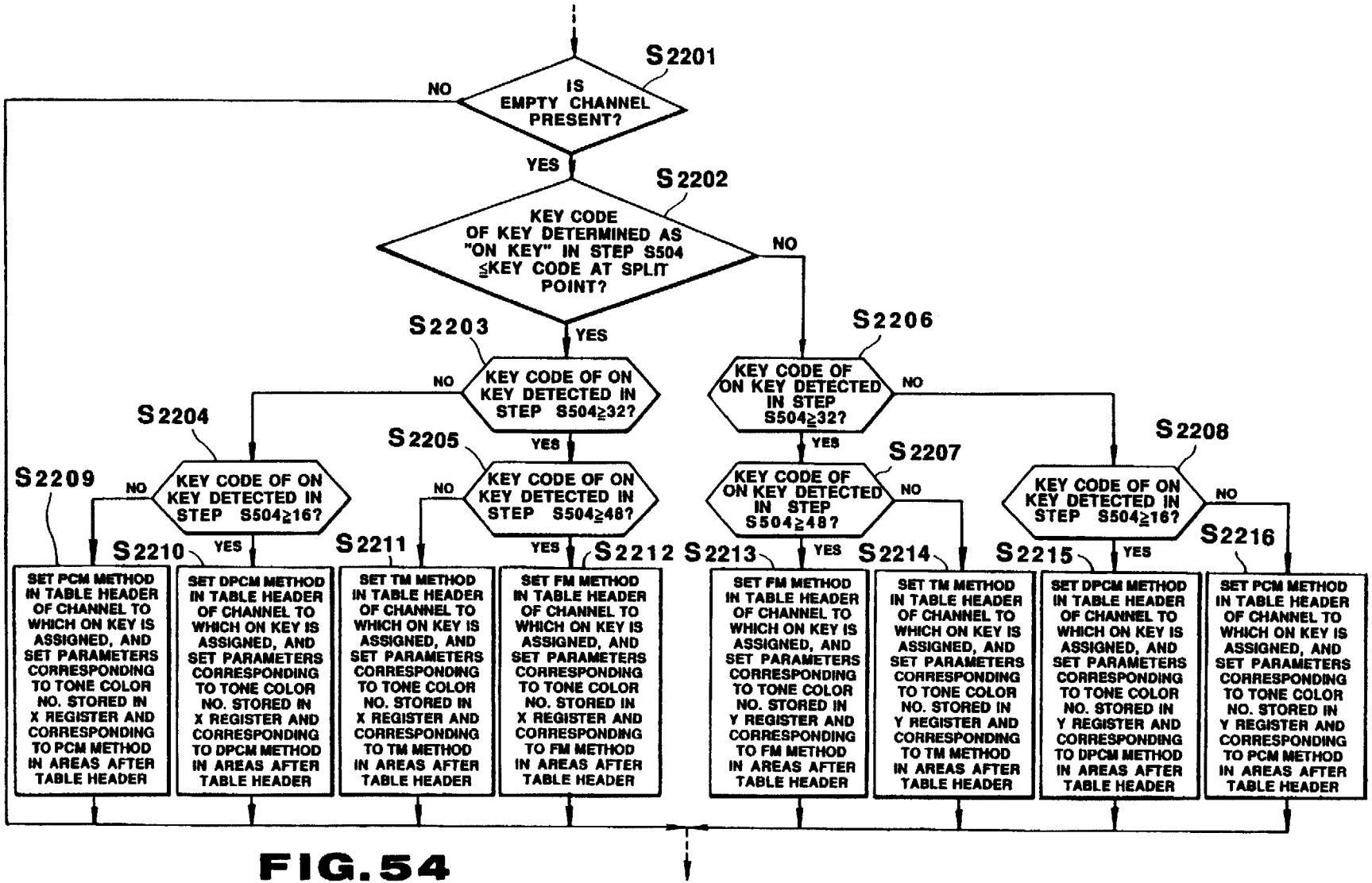
FIG. 54 is an operation flow chart of an embodiment D of keyboard key processing.

FIG. 54 is an operation flow chart of the embodiment D of the keyboard key processing in step $S_{505}$ in the main flow chart shown in FIG. 31. As shown in FIG. 54, it is checked if the first to eighth channels include an empty channel ($S_{2201}$). If there is empty channel, tone color assignment is performed. The processing operations in steps $S_{2202}$ to $S_{2216}$ are the same as those in steps $S_{2201}$, $S_{2203}$ to $S_{2205}$, and $S_{2206}$ to $S_{2217}$ in the embodiment C shown in FIG. 53.

Demonstration Performance Processing

The operations of the demonstration performance processing ($S_{506}$) in the main flow chart shown in FIG. 31 when a demonstration performance (automatic performance) is executed in some electronic musical instruments in addition to the keyboard key processing described above, will be described in detail below.

In the fourth embodiment, different tone colors and sound source methods can be assigned to the tone generation channels in accordance with whether the ON key plays a melody or accompaniment part.

Figure 55:
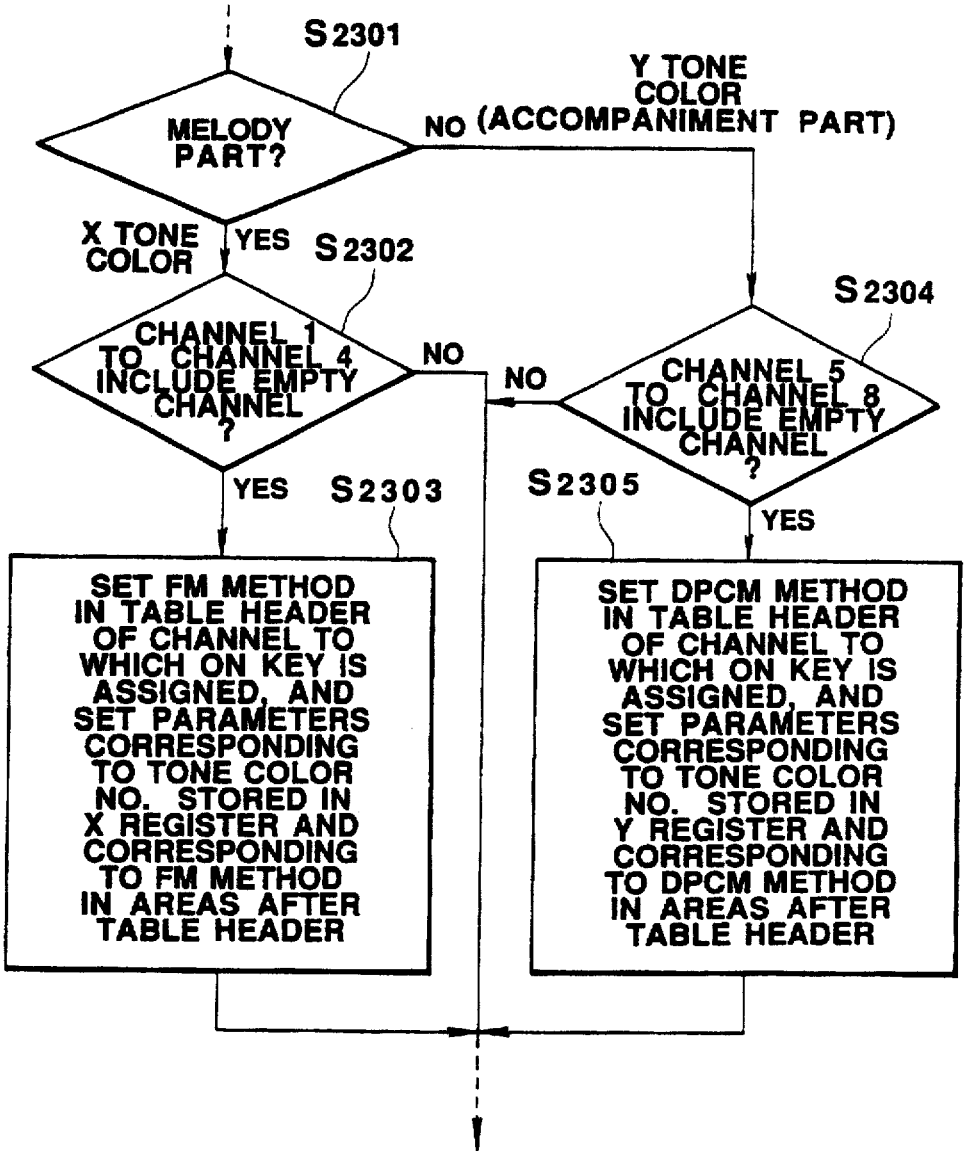
FIG. 55 is an operation flow chart of an embodiment A of demonstration performance processing.

FIG. 55 is an operation flow chart of an embodiment A of the demonstration performance processing in step $S_{506}$ in the main flow chart shown in FIG. 31. In the embodiment A, X and Y tone colors are assigned to the tone generation channels, as shown in FIG. 57, in the same manner as the embodiment A or C of the keyboard key processing.

It is checked whether or not an ON key designated by automatic performance data read out from the control data/waveform data ROM 2121 (FIG. 27) plays a melody (or accompaniment part) ($S_{2301}$).

If YES in step $S_{2301}$, i.e., if it is determined that the key plays the melody part, it is checked if the first to fourth tone generation channels include an empty channel ($S_{2302}$).

If there is no empty channel, and NO is determined in step $S_{2302}$, no assignment is performed.

If there is an empty channel, and YES is determined in step $S_{2302}$, tone color parameters for the X tone color are set in the FM format shown in FIG. 37 in one tone generation channel area of the first to fourth channels on the RAM 2061 (FIG. 27) to which the ON key is assigned. More specifically, sound source method No. data S representing the FM method is set in the first area of the corresponding tone generation channel area (see the column of FM in FIG. 37). Then, the tone color parameters corresponding to the tone color of the tone color No. presently stored in the X tone color No. register (FIG. 48) on the RAM 2061 are read out from a data architecture portion shown in FIG. 47 of the control data/waveform data ROM 2121, and are set in the second and subsequent areas of the tone generation channel area ($S_{2303}$).

If NO in step $S_{2301}$, it is checked if the fifth to eighth tone generation channels include an empty channel ($S_{2304}$).

If there is no empty channel, and NO is determined in step $S_{2304}$, no assignment is performed.

If there is an empty channel, and YES is determined in step $S_{2304}$, tone color parameters for the Y tone color are set in the DPCM format shown in FIG. 37 in one tone generation channel area of the fifth to eighth channels on the RAM 2061 (FIG. 27) to which the ON key is assigned. More specifically, sound source method No. data S representing the DPCM method is set in the first area of the corresponding tone generation channel area (see the column of DPCM in FIG. 37). Then, the tone color parameters corresponding to the tone color of the tone color No. presently stored in the X tone color No. register (FIG. 48) on the RAM 2061 are read out from a data architecture portion shown in FIG. 47 of the control data/waveform data ROM 2121, and are set in the second and subsequent areas of the tone generation channel area ($S_{2305}$).

Figure 56:
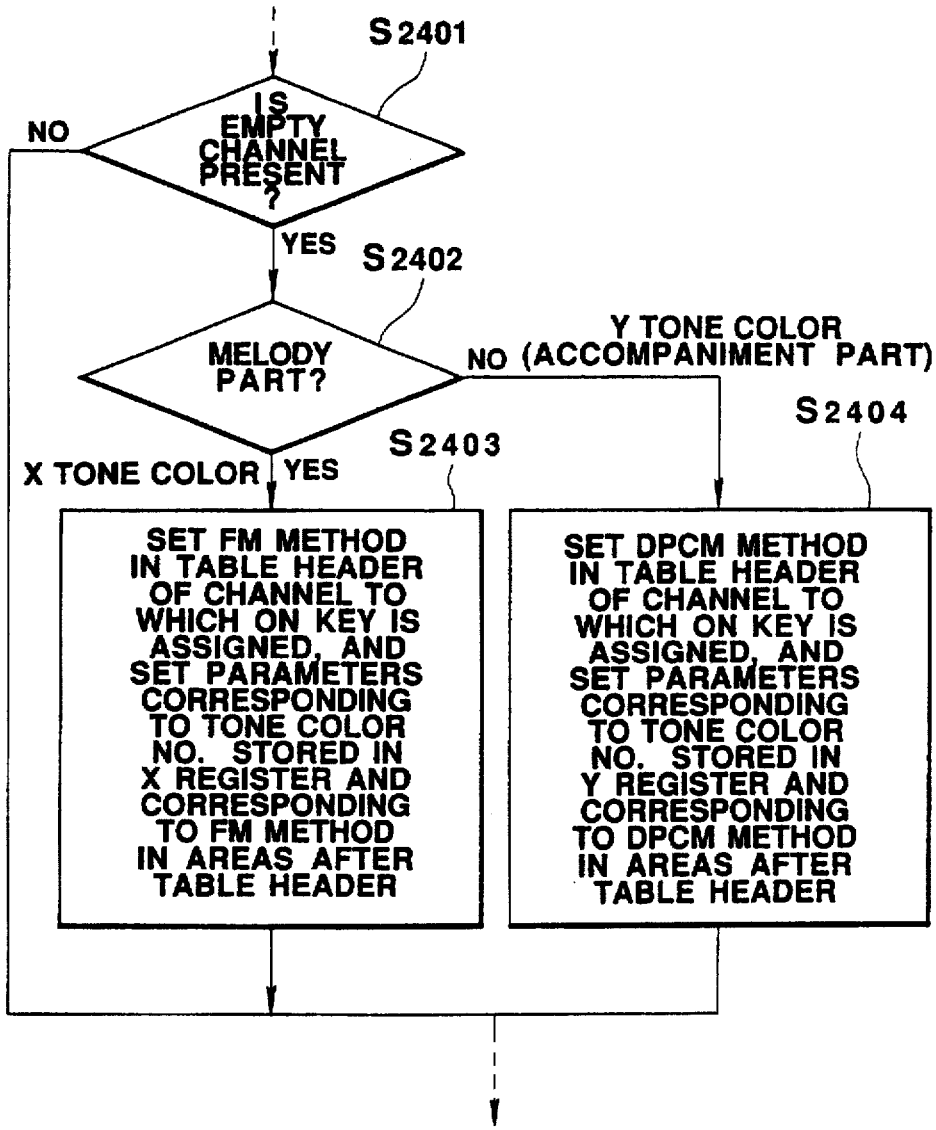
FIG. 56 is an operation flow chart of an embodiment B of demonstration performance processing.

FIG. 56 is an operation flow chart of an embodiment B of demonstration performance processing in step $S_{506}$ in the main flow chart of FIG. 31. In the embodiment B, channels to which each tone color is assigned are not fixed, and the X and Y tone colors are sequentially assigned to empty channels, as shown in FIG. 58 like in the embodiment B or D of the keyboard key processing.

In FIG. 56, it is checked if the first to eighth channels include an empty channel ($S_{2401}$). If there is an empty channel, tone color assignment is performed. The processing operations in steps $S_{2402}$ to $S_{2404}$ are the same as tones in steps $S_{2302}$ to $S_{2304}$ in the embodiment A of the demonstration performance processing shown in FIG. 55.

Other Embodiments

In the embodiments A to D of the keyboard key processing described above, two tone colors are switched to have a split point for key code or velocity values as a boundary, and sound source methods are switched in units of tone colors in accordance with the velocity or key code values. Contrary to this, the sound source methods may be switched to have a split point as a boundary, and tone colors may be switched in units of sound source methods in accordance with, e.g., velocity values.

The number of split points is not limited to one, and a plurality of tone colors or sound source methods may be switched in regions having two or more split points as boundaries.

Furthermore, performance data associated with the split point is not limited to a key code or a velocity.

On the other hand, in the embodiments A and B of the demonstration performance processing, different tone colors and sound source methods can be assigned to tone generation channels in accordance with a melody or accompaniment part in a demonstration performance (automatic performance) mode. However, the present invention is not limited to this. For example, tone colors and sound source methods may be switched in accordance with whether a player plays a melody or accompaniment part.

In the embodiments A and B of the demonstration performance processing, an assignment state of tone generation is changed in a permanent combination of tone colors and sound source methods in accordance with a melody or accompaniment part. However, like in the keyboard key processing, only tone colors or sound source methods may be changed, and the kind of parameters may be desirably selected.

Summary of the Fifth Embodiment

The summary of this embodiment will be described below.

Figure 59:
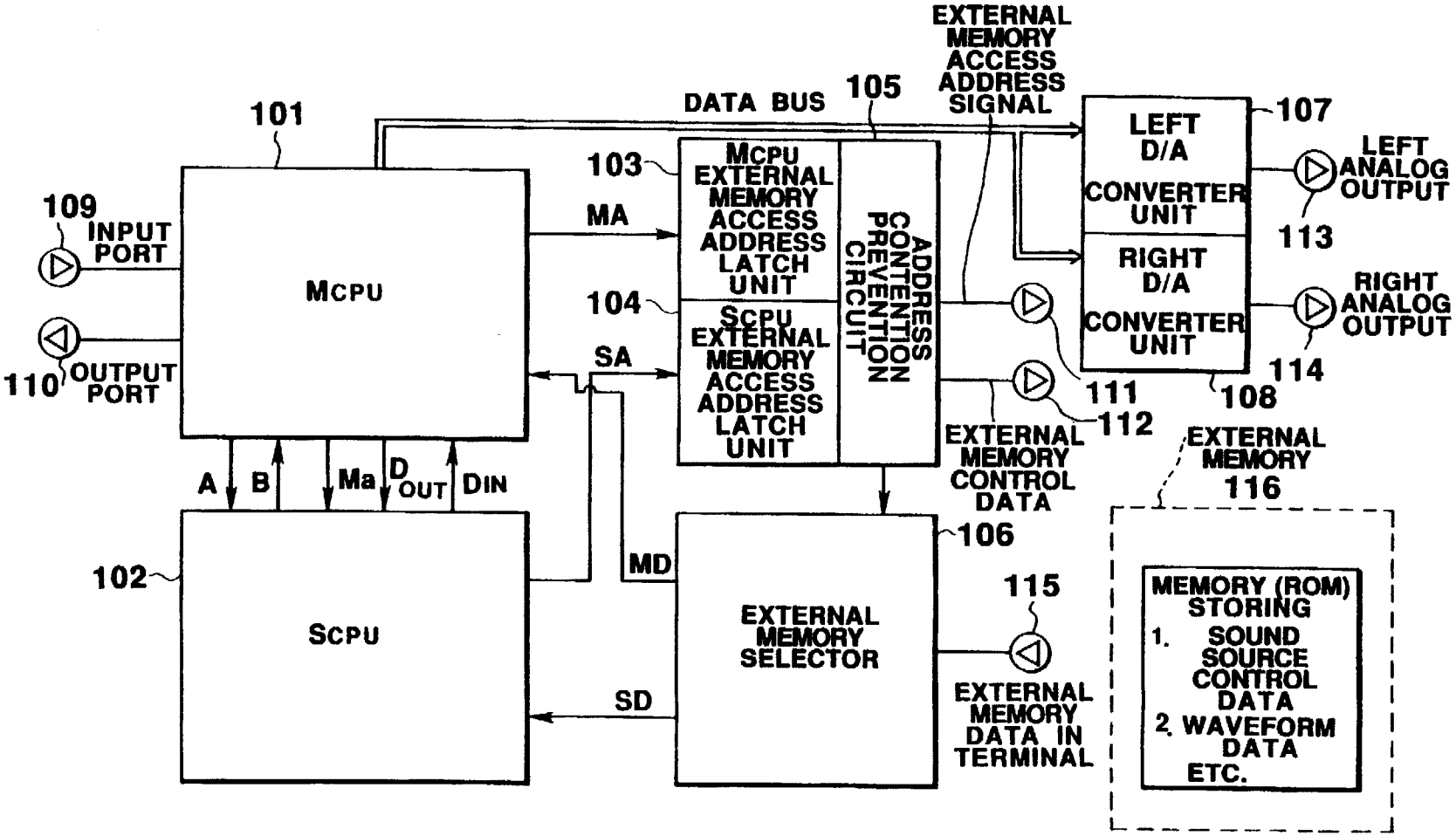
FIG. 59 is a block diagram showing the overall arrangement according to a fifth embodiment of the present invention.

FIG. 59 is a block diagram showing the overall arrangement of this embodiment. In FIG. 59, components other than an external memory 1162 are constituted in one chip. Of these components, two, i.e., master and slave CPUs (central processing units) exchange data to share sound source processing for generating musical tones.

In, e.g., a 16-channel polyphonic system, 8 channels are processed by a master CPU 1012, and the remaining 8 channels are processed by a slave CPU 1022.

The sound source processing is executed in a software manner, and sound source methods such as PCM (Pulse Code Modulation) and DPCM (Differential PCM) methods, and sound source methods based on modulation methods such as FM and phase modulation methods are assigned in units of tone generation channels.

A sound source method is automatically designated for tone colors of specific instruments, e.g., a trumpet, a tuba, and the like. For tone colors of other instruments, a sound source method can be selected by a selection switch, and/or can be automatically selected in accordance with a performance tone range, a performance strength such as a key touch, and the like.

In addition, different sound source methods can be assigned to two channels for one ON event of a key. That is, for example, the PCM method can be assigned to an attack portion, and the FM method can be assigned to a sustain portion.

Furthermore, in, e.g., the FM method, when software processing is executed by a versatile CPU according to a sound source processing algorithm, it requires too much time. However, this embodiment can also solve this problem.

Arrangement of the Fifth Embodiment

The fifth embodiment will be described below with reference to the accompanying drawings.

In FIG. 59, the external memory 1162 stores musical tone control parameters such as target values of envelope values, a musical tone waveform in the PCM (pulse code modulation) method, a musical tone differential waveform in the DPCM (differential PCM) method, and the like.

The master CPU (to be abbreviated to as an MCPU hereinafter) 1012 and the slave CPU (to be abbreviated to as an SCPU hereinafter) 1022 access the data on the external memory 1162 to execute sound source processing while sharing processing operations. Since these CPUs 1012 and 1022 commonly use waveform data of the external memory 1162, a contention may occur when data is loaded from the external memory 1162. In order to prevent this contention, the MCPU 1013 and the SCPU 1022 output an address signal for accessing the external memory, and external memory control data from output terminals 1112 and 1122 of an access address contention prevention circuit 1052 via an external memory access address latch unit 1032 for the MCPU, and an external memory access address latch unit 1042 for the SCPU. Thus, a contention between addresses from the MCPU 1012 and the SCPU 1022 can be prevented.

Data read out from the external memory 1162 on the basis of the designated address is input from an external memory data input terminal 1152 to an external memory selector 1062. The external memory selector 1062 separates the readout data into data to be input to the MCPU 1012 via a data bus MD and data to be input to the SCPU 1022 via a data bus SD on the basis of a control signal from the address contention prevention circuit 1052, and inputs the separated data to the MCPU 1012 and the SCPU 1022. Thus, a contention between readout data can also be prevented.

After the MCPU 1012 and the SCPU 1022 perform corresponding sound source processing operations of the input data by software, musical tone data of all the tone generation channels are accumulated, and a left-channel analog output and a right-channel analog output are then output from a left output terminal 1132 of a left D/A converter unit 1072 and a right output terminal 1142 of a right D/A converter unit 1082, respectively.

Figure 60:
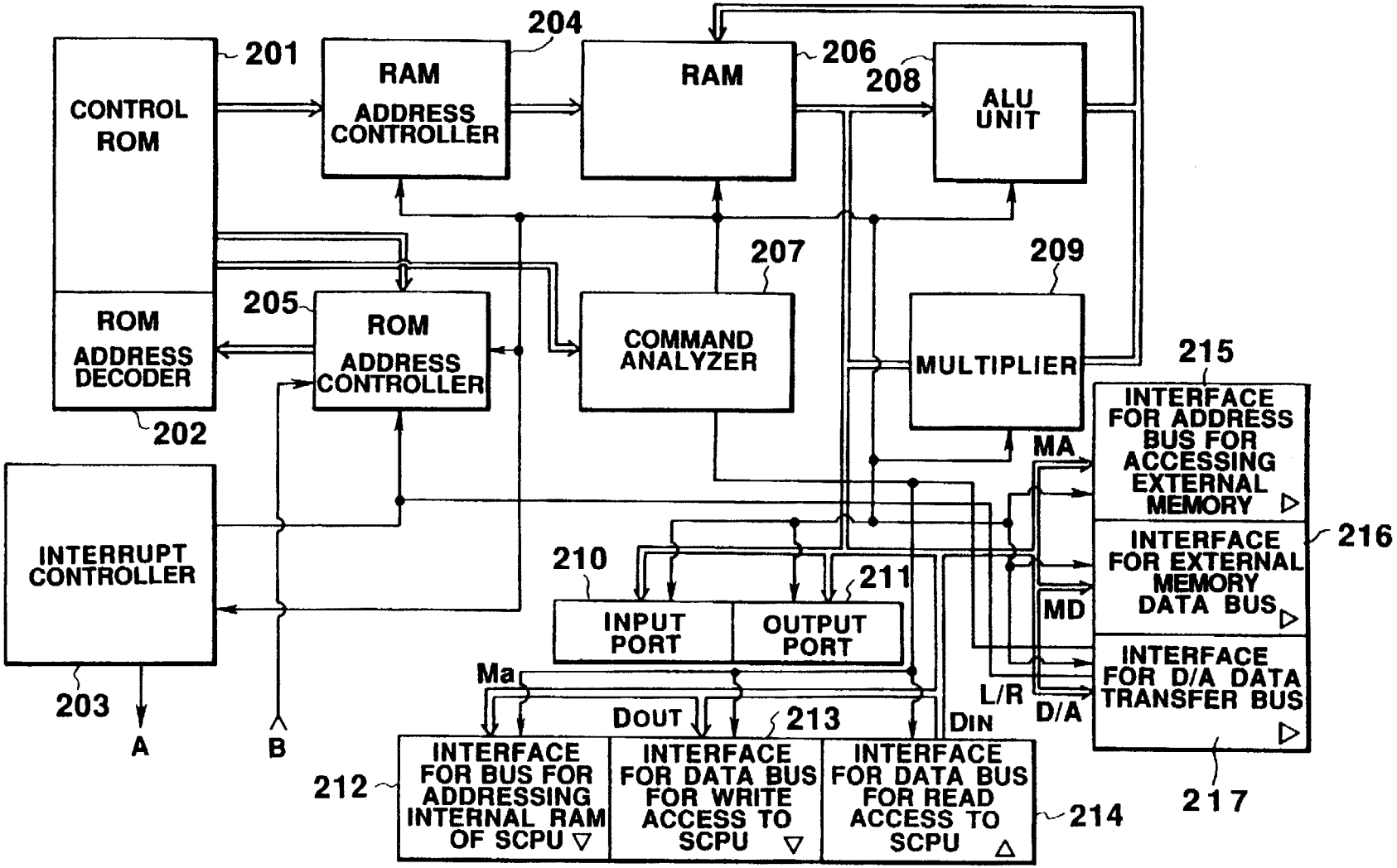
FIG. 60 is a block diagram showing an internal arrangement of a master CPU.

FIG. 60 is a block diagram showing an internal arrangement of the MCPU 1012.

In FIG. 60, a control ROM 2012 stores a musical tone control program (to be described later), and sequentially outputs program words (commands) addressed by a ROM address controller 2052 via a ROM address decoder 2022. This embodiment employs a next address method. More specifically, the word length of each program word is, e.g., 28 bits, and a portion of a program word is input to the ROM address controller 2052 as a lower bit portion (intra-page address) of an address to be read out next. Note that the SCPU 1012 may comprise a conventional program counter type CPU instead of control ROM 2012.

A command analyzer 2072 analyzes operation codes of commands output from the control ROM 2012, and sends control signals to the respective units of the circuit so as to execute designated operations.

When an operand of a command from the control ROM 2012 designates a register, the RAM address controller 2042 designates an address of a corresponding internal resister of a RAM 2062. The RAM 2062 stores various musical tone control data (to be described later with reference to FIGS. 74 and 75) for eight tone generation channels, and includes various buffers (to be described later) or the like. The RAM 2062 is used in sound source processing (to be described later).

When a command from the control ROM 2012 is an arithmetic command, an ALU unit 2082 and a multiplier 2092 respectively execute an addition/subtraction, and a multiplication on the basis of an instruction from the command analyzer 2072.

On the basis of an internal hardware timer (not shown), an interrupt controller 2032 supplies a reset cancel signal A to the SCPU 2012 (FIG. 59) and an interrupt signal to the D/A converter units 1072 and 1082 (FIG. 59) at predetermined time intervals.

Figure 70:
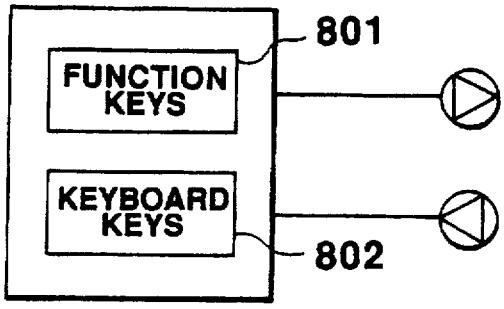
FIG. 70 illustrates an arrangement of a function key and a keyboard key.
Figure 71:
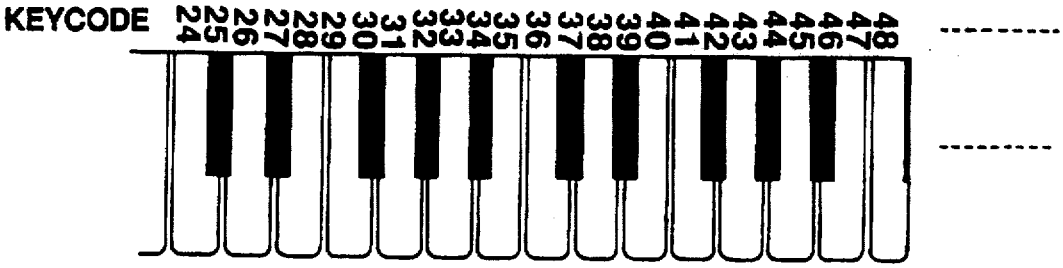
FIG. 71 is an explanatory view of keyboard keys.

In addition to the above-mentioned arrangement, the MCPU 1012 shown in FIG. 60 comprises the following interfaces associated with various buses: an interface 2152 for an address bus MA for addressing the external memory 1162 to access it; an interface 2162 for the data bus MD for exchanging the accessed data with the MCPU 1012 via the external memory selector 1062; an interface 2122 for a bus Ma for addressing the internal RAM of the SCPU 1022 so as to execute data exchange with the SCPU 1022; an interface 2132 for a data bus $D_{OUT}$ used by the MCPU 1012 to write data in the SCPU 1022; an interface 2142 for a data bus $D_{IN}$ used by the MCPU 1012 to read data from the SCPU 1022; an interface 2172 for a D/A data transfer bus for transferring final output waveforms to the left and right D/A converter units 1072 and 1082; and input and output ports 2102 and 2112 for exchanging data with an external switch unit or a keyboard unit (FIGS. 70, and 71).

Figure 61:
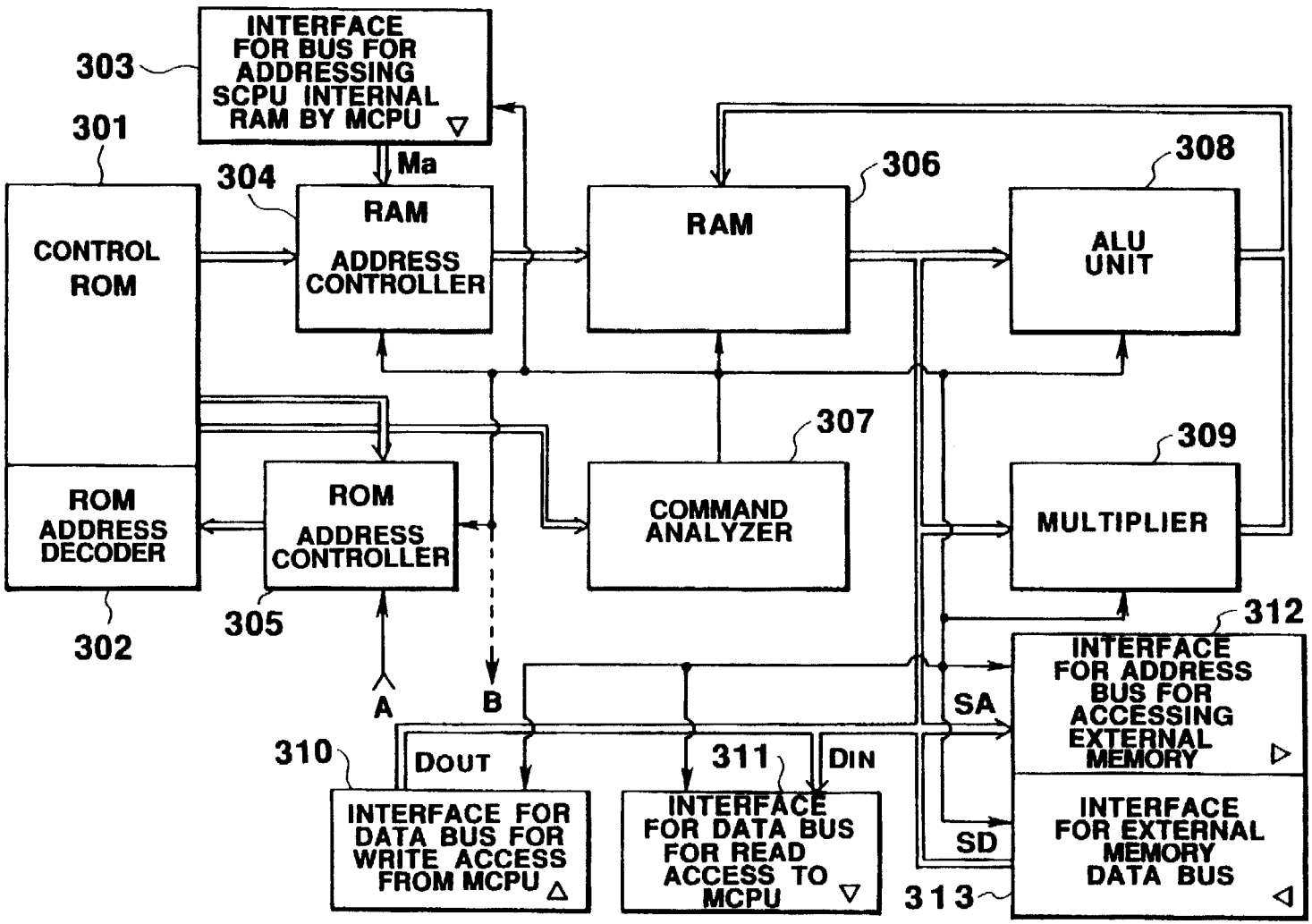
FIG. 61 is a block diagram showing an internal arrangement of a slave CPU.

FIG. 61 shows the internal arrangement of the SCPU 1022.

Since the SCPU 1022 executes sound source processing upon reception of a processing start signal from the MCPU 1012, it does not comprise an interrupt controller corresponding to the controller 2032 (FIG. 60), I/O ports, corresponding to the ports 2102 and 2112 (FIG. 60) for exchanging data with an external circuit, and an interface, corresponding to the interface 2172 (FIG. 60) for outputting musical tone signals to the left and right D/A converter units 1072 and 1082. Other circuits 3012, 3022, and 3042 to 3092 have the same functions as those of the circuits 2012, 2022, and 2042 to 2092 shown in FIG. 60. Interfaces 3032, and 3102 to 3132 are arranged in correspondence with the interface 2122 to 2162 shown in FIG. 60. Note that the internal RAM address of the SCPU 1022 designated by the MCPU 1012 is input to the RAM address controller 3042. The RAM address controller 3042 designates an address of the RAM 3062. Thus, accumulated waveform data for eight tone generation channels generated by the SCPU 1022 and held in the RAM 3062 are output to the MCPU 1012 via the data bus $D_{IN}$. This will be described later.

In addition to the above-mentioned arrangement, in this embodiment, function keys 8012, keyboard keys 8022, and the like shown in FIGS. 70 and 71 are connected to the input port 2102 of the MCPU 1012. Theses portions substantially constitute an instrument operation unit.

The D/A converter unit as one characteristic feature of the present invention will be described below.

Figure 68:
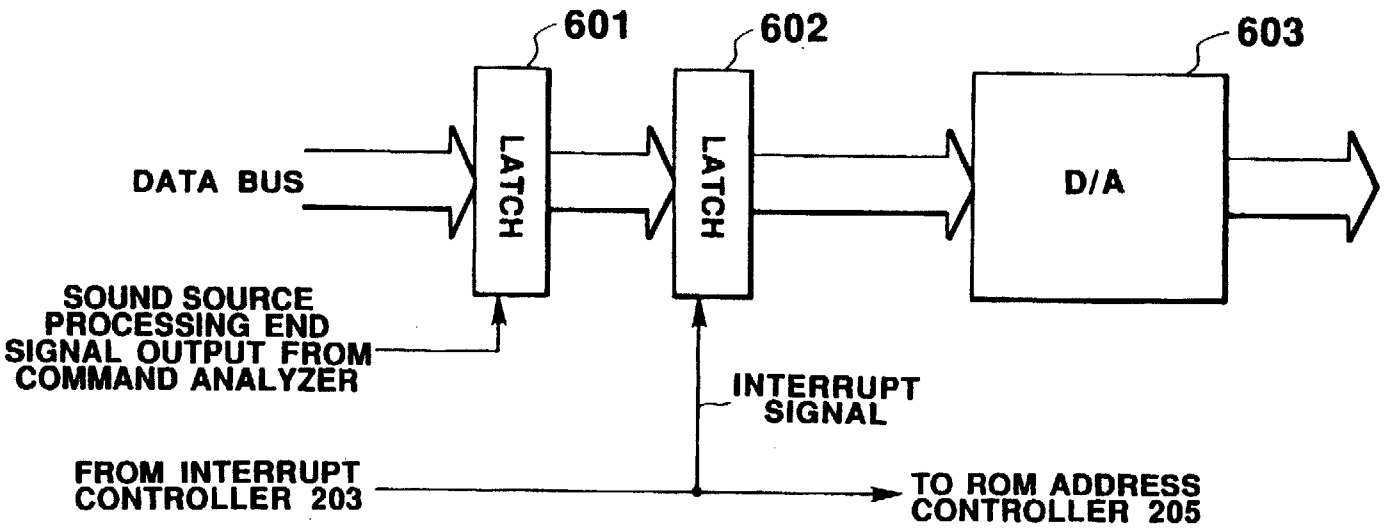
FIG. 68 is a diagram of a D/A converter unit according to the fifth embodiment.
Figure 69:
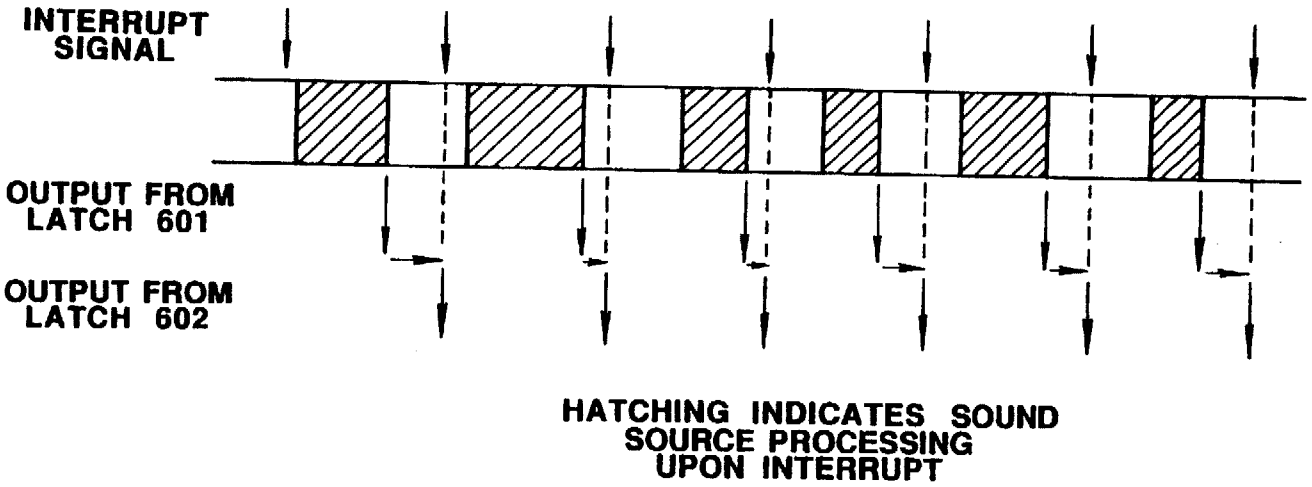
FIG. 69 is a timing chart in D/A conversion.

FIG. 68 shows the internal arrangement of the left or right D/A converter unit 1027 or 1082 (the two converter units have the same contents) shown in FIG. 59. One sample data of a musical tone generated by sound source processing is input to a latch 6012 via a data bus. When the clock input terminal of the latch 6012 receives a sound source processing end signal from the command analyzer 2072 (FIG. 60) of the MCPU 1012, musical tone data for one sample on the data bus is latched by the latch 6012, as shown in FIG. 69.

Figure 67:
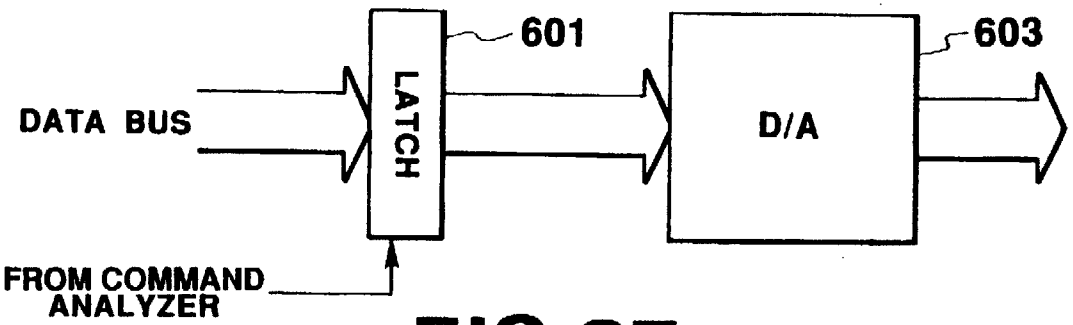
FIG. 67 is a diagram of a conventional D/A converter unit.

A time required for the sound source processing changes depending on the sound source processing software program. For this reason, a timing at which each sound source processing is ended, and musical tone data is latched by the latch 6012 is not fixed. For this reason, as shown in FIG. 67, an output from the latch 6012 cannot be directly input to a D/A converter 6032.

In this embodiment, as shown in FIG. 68, the output from the latch 6012 is latched by a latch 6022 in response to an interrupt signal equal to a sampling clock interval output from the interrupt controller 2032, and is output to the D/A converter 603 at predetermined time intervals.

Since a change in processing time can be absorbed using the two latches 6012 and 6022, no complicated control program for outputting musical tone data to a D/A converter 6032 is required.

Overall Operation of the Fifth Embodiment

The overall operation of this embodiment will be described below.

Figures 62, 63:
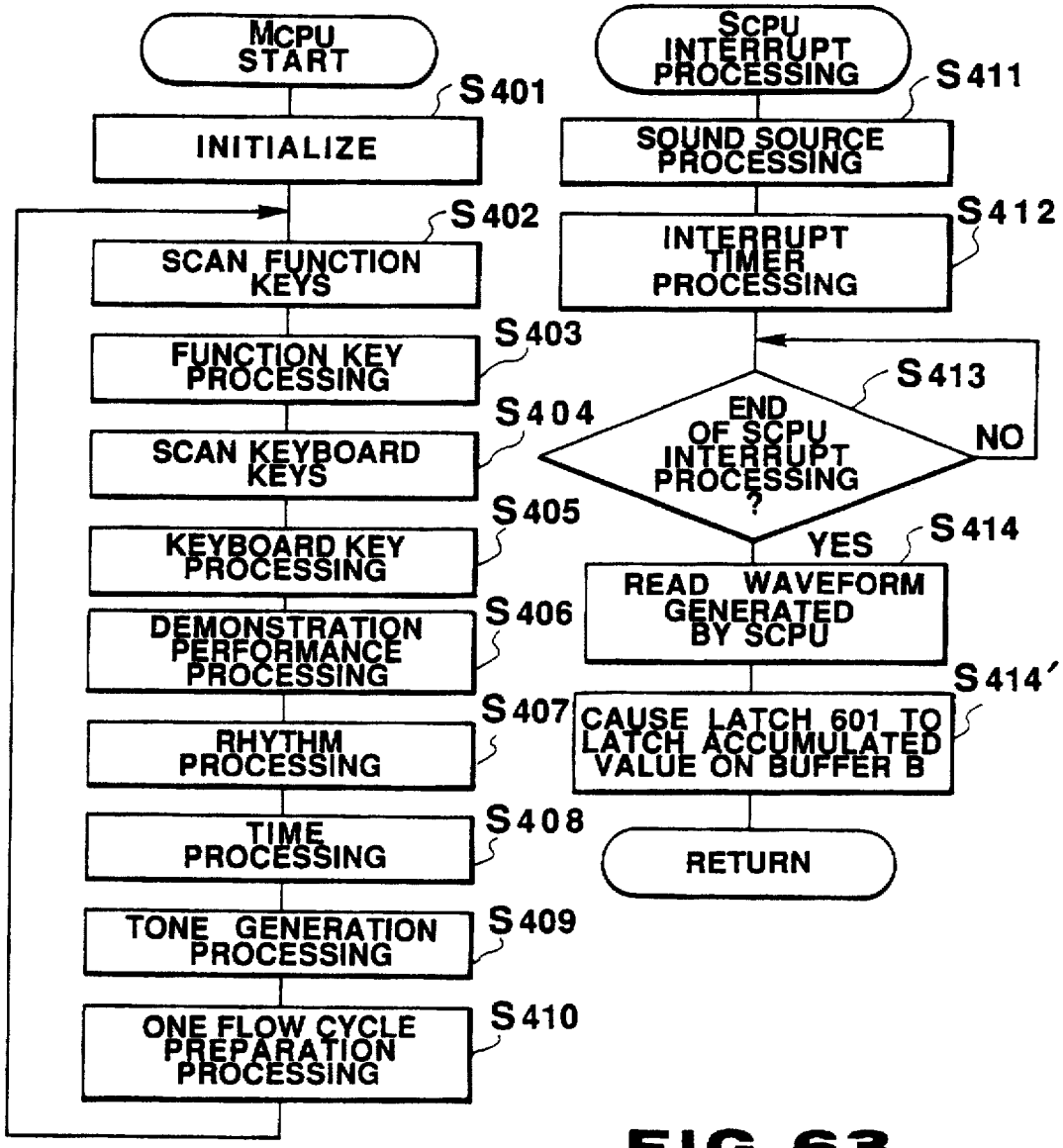
FIGS. 62 to 65 are flow charts showing operations of the overall arrangement of the fifth embodiment.

In this embodiment, basically, the MCPU 1012 is mainly operated, and repetitively executes a series of processing operations in steps $S_{402}$ to $S_{410}$, as shown in the main flow chart of FIG. 62. The sound source processing is performed by interrupt processing. More specifically, the MCPU 1012 and the SCPU 1022 are interrupted at predetermined time intervals, and each CPU executes sound source processing for generating musical tones for eight channels. Upon completion of this processing, musical tone waveforms for 16 channels are added, and are output from the left and right D/A converter units 1072 and 1082. Thereafter, the control returns from the interrupt state to the main flow. Note that the above-mentioned interrupt processing is periodically executed on the basis of the internal hardware timer in the interrupt controller 2032 (FIG. 60). This period is equal to a sampling period when a musical tone is output.

The schematic operation of this embodiment has been described. The operation of this embodiment will be described in detail below with reference to FIGS. 62 to 65.

Figure 64:
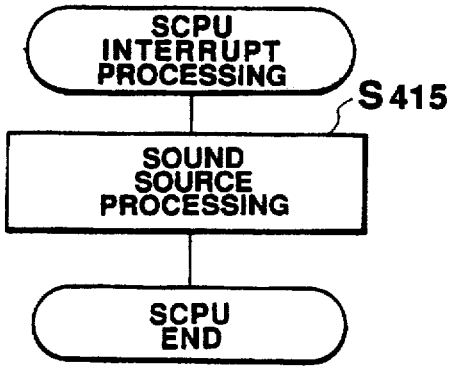
Figure 65:
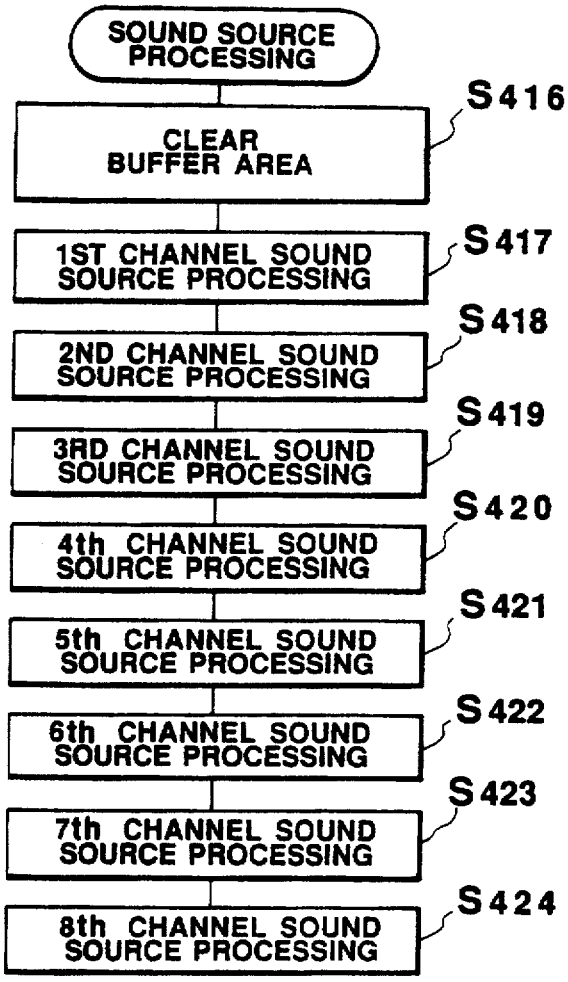

When the interrupt controller 2032 interrupts repetitively executed processing operations in steps $S_{402}$ to $S_{410}$ in the main flow chart of FIG. 62, MCPU interrupt processing shown in FIG. 63 and SCPU interrupt processing shown in FIG. 64 are simultaneously started. "Sound source processing" in FIGS. 63 and 64 is shown in FIG. 65.

The main flow chart or FIG. 62 shows a processing flow executed by the MCPU 1012 in a state wherein no interrupt signal is supplied from the interrupt controller 2032.

When the power switch is turned on, the system e.g., the contents of the RAM 2062 in the MCPU 1012 are initialized ($S_{401}$).

The function keys externally connected to the MCPU 1012, e.g., tone color switches, and the like (FIG. 90), are scanned ($S_{402}$) to fetch respective switch states from the input port 2102 to a key buffer area in the RAM 2062. As a result of scanning, a function key whose state is changed is discriminated, and processing of a corresponding function is executed ($S_{403}$). For example, a musical tone number or an envelope number is set, or if optional functions include a rhythm performance function, a rhythm number is set.

Thereafter, states of ON keyboard keys are fetched in the same manner as the function keys ($S_{404}$), and keys whose states are changed are discriminated, thus executing key assignment processing ($S_{405}$).

When a demonstration performance key of the function keys 8012 (FIGS. 70 and 71) is depressed, demonstration performance data (sequencer data) are sequentially read out from the external memory 1162 to execute, e.g., key assignment processing ($S_{406}$). When a rhythm start key is depressed, rhythm data are sequentially read out from the external memory 1162 to execute, e.g., key assignment processing ($S_{407}$).

Thereafter, timer processing is executed ($S_{408}$). More specifically, time data which is incremented by interrupt timer processing ($S_{412}$) (to be described later) is compared with time control sequencer data sequentially read out for demonstration performance control or time control rhythm data read out for rhythm performance control, thereby executing time control when a demonstration performance in step $S_{406}$ or a rhythm performance in step $S_{407}$ is performed.

In tone generation processing in step $S_{409}$, pitch envelope processing, and the like are executed. In this processing, an envelope is added to a pitch of a musical tone to be generated, and pitch data is set in a corresponding tone generation channel.

Furthermore, one flow cycle preparation processing is executed ($S_{410}$). In this processing, processing for changing a state of a tone generation channel assigned with a note number corresponding to an ON event detected in the keyboard key processing in step $S_{405}$ to an "ON event" state, and processing for changing a state of a tone generation channel assigned with a note number corresponding to an OFF event to a "muting" state, and the like are executed.

The MCPU interrupt processing shown in FIG. 63 will be described below.

When the interrupt controller 2032 of the MCPU 1012 interrupts the MCPU 1012, the processing in the main flow chart shown in FIG. 62 is interrupted, and the MCPU interrupt processing in FIG. 63 is started. In this case, control is made to avoid contents of resisters to be subjected to write access in the main flow program in FIG. 62 from being rewritten in the MCPU interrupt processing program. For this reason, the MCPU interrupt processing uses resisters different from those used in the main flow program. As a result, register save/restoration processing normally executed at the beginning and end of interrupt processing can be omitted. Thus, transition between the processing of the main flow chart shown in FIG. 62 and the MCPU interrupt processing can be quickly performed.

Subsequently, in the MCPU interrupt processing, sound source processing is started ($S_{411}$). The sound source processing is shown in FIG. 65.

Simultaneously with the above-mentioned operations, the interrupt controller 2032 of the MCPU 1012 outputs the SCPU reset cancel signal A (FIG. 59) to the ROM address controller 3052 of the SCPU 1022, and the SCPU 1022 starts execution of the SCPU interrupt processing (FIG. 64).

Sound source processing ($S_{415}$) is started in the SCPU interrupt processing almost simultaneously with the source processing ($S_{411}$) in the MCPU interrupt processing. In this manner, since each of the MCPU 1012 and the SCPU 1022 simultaneously executes sound source processing of eight tone generation channels, the sound source processing for 16 tone generation channels can be executed in a processing time for eight tone generation channels, and a processing speed can be almost doubled (the interrupt processing will be described later with reference to FIG. 66).

In the interrupt timer processing in step $S_{412}$, the value of time data (not shown) on the RAM 2062 (FIG. 60) is incremented by utilizing the fact that the interrupt processing shown in FIG. 63 is executed for every predetermined sampling period. More specifically, a time elapsed from power-on can be detected based on the value of the time data. The time data obtained in this manner is used in time control in the timer processing in step $S_{408}$ in the main flow chart shown in FIG. 62.

The MCPU 1012 then waits for an SCPU interrupt processing end signal B from the SCUP 1022 after interrupt timer processing in step $S_{412}$ ($S_{413}$).

Upon completion of the sound source processing in step $S_{415}$ in FIG. 64, the command analyzer 3072 of the SCPU 1022 supplies an SCPU processing end signal B (FIG. 59) to the ROM address controller 2052 of the MCPU 1012. In this manner, YES is determined in step $S_{413}$ in the MCPU interrupt processing in FIG. 63.

As a result, waveform data generated by the SCPU 1022 are written in the RAM 2062 of the MCPU 1012 via the data bus $D_{IN}$ shown in FIG. 59 ($S_{414}$). The waveform data are stored in a predetermined buffer area (a buffer B to be described later) on the RAM 3062 of the SCPU 1022. The command analyzer 2072 of the MCPU 1012 designates addresses of the buffer area to the RAM address controller 3042, thus reading the waveform data.

In step $S_{414}'$, the contents of the buffer area B are latched by the latches 6012 (FIG. 68) of the left and right D/A converter units 1072 and 1082.

The operation of the sound source processing executed in step $S_{411}$ in the MCPU interrupt processing or in step $S_{415}$ in the SCPU interrupt processing will be described below with reference to the flowchart of FIG. 65.

A waveform addition area on the RAN 2062 or 3062 is cleared ($S_{416}$). Then, sound source processing is executed in units of tone generation channels ($S_{417}$ to $S_{424}$). After the sound source processing for the eighth channel is completed, waveform data obtained by adding those for eight channels is obtained in the buffer area B. These processing operations will be described in detail later.

Figure 66:
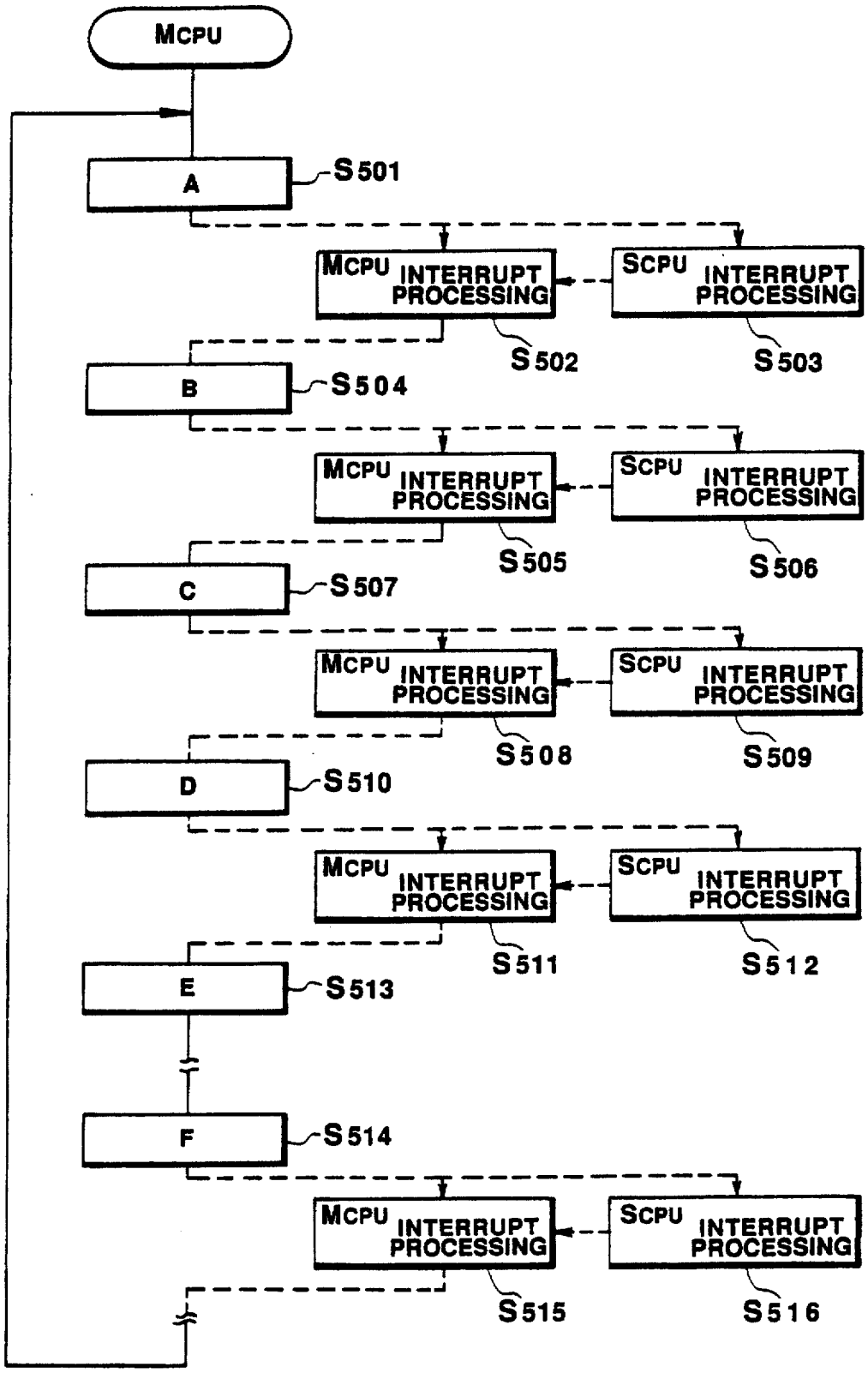
FIG. 66 is a schematic view showing the relationship among the main operation flow charts and interrupt processing.

FIG. 66 is a schematic flow chart showing the relationship among the processing operations of the flow charts shown in FIGS. 62, 63, and 64. As can be seen from FIG. 66, the MCPU 1012 and the SCPU 1022 share the sound source processing.

Given processing A (the same applies to B, C, . . . , F) is executed ($S_{501}$). This "processing" corresponds to, for example, "function key processing", or "keyboard key processing" in the main flow chart shown in FIG. 62. Thereafter, the MCPU interrupt processing and the SCPU interrupt processing are executed, so that the MCPU 1012 and the SCPU 1022 simultaneously start sound source processing ($S_{502}$ and $S_{503}$). Upon completion of the SCPU interrupt processing of the SCPU 1022, the SCPU processing end signal B is input to the MCPU 1012. In the MCPU interrupt processing, the sound source processing is ended earlier than the SCPU interrupt processing, and the MCPU waits for the end of the SCPU interrupt processing the SCPU processing end signal B is discriminated in the MCPU interrupt processing, waveform data generated by the SCPU 1022 is supplied to the MCPU 1012, and is added to the waveform data generated by the MCPU 1012. The waveform data is then output to the left and right D/A converter units 1072 and 1082. Thereafter, the control returns to some processing B in the main flow chart.

The above-mentioned operations are repeated ($S_{504}$ to $S_{506}$) while executing the sound source processing for all the tone generation channels (16 channels as a total of those of the MCPU 1012 and the SCPU 1022). The repetition processing continues as long as musical tones are being produced.

Data Architecture in Sound Source Processing

The sound source processing executed in step $S_{411}$ (FIG. 63) and step $S_{415}$ (FIG. 64) will be described in detail below.

Figure 72:
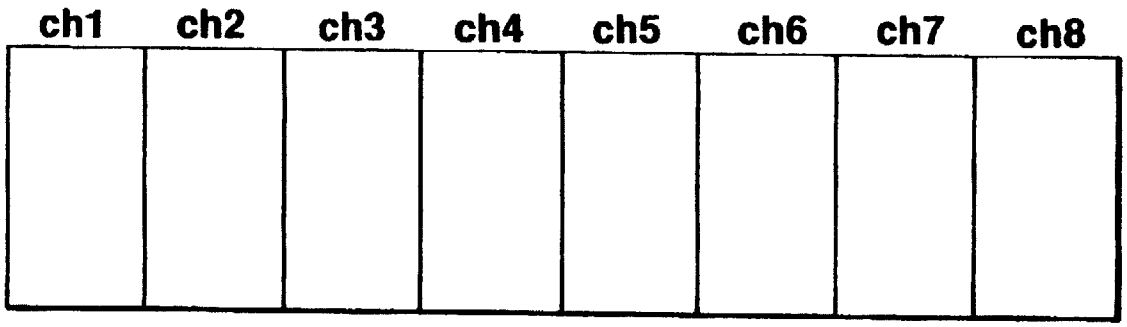
FIG. 72 shows storage areas in units of tone generation channels on a RAM.

In this embodiment, as described above, the two CPUs, i.e., the MCPU 1012 and the SCPU 1022 share the sound source processing in units of eight channels. Data for the sound source processing for eight channels are set in areas corresponding to the respective tone generation channels in the RAMs 2062 and 3062 of the MCPU 1012 and the SCPU 1022, as shown in FIG. 72.

Figure 75:
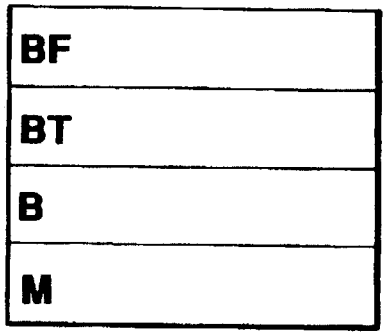
FIG. 75 shows buffer areas on the RAM.

Buffers BF, BT, B, and M are allocated on the RAM, as shown in FIG. 75.

Figure 73:
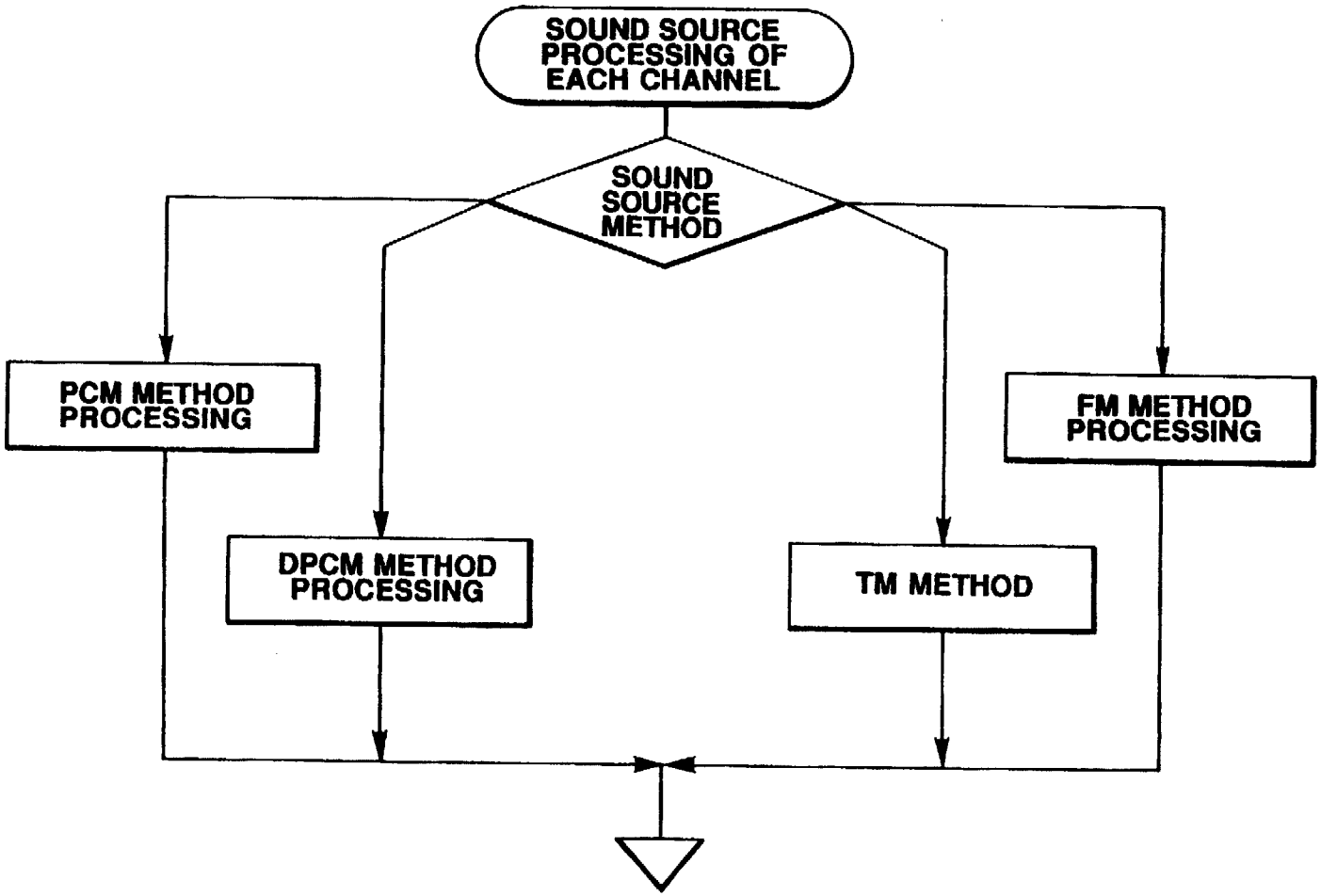
FIG. 73 is a schematic diagram upon selection of a sound source processing method of each tone generation channel.

In each tone generation channel area shown in FIG. 72, an arbitrary sound source method can be set by an operation (to be described in detail later), as schematically shown in FIG. 73. When the sound source method is set, data are set in each tone generation channel area in FIG. 72 in a data format of the corresponding sound source method, as shown in FIG. 74. In this embodiment, as will be described later, different sound methods can be assigned to the tone generation channels.

In Table 1 showing the data formats of the respective sound source methods shown in FIG. 74, G indicates a sound source method number for identifying the sound source methods. A represents an address designated when waveform, data in read out in the sound source processing, and $A_I$, $A_1$, and $A_2$ represent integral parts of current addresses, and directly correspond to addresses of the external memory 1162 (FIG. 59) where waveform data are stored. $A_F$ represents a decimal part of the current address, and is used for interpolating waveform data read out from the external memory 1162.

$A_E$ and $A_L$ respectively represent end and loop addresses. $P_I$, $P_1$ and $P_2$ represent integral parts of pitch data, and $P_F$ represents a decimal part of pitch data. For example, $P_I$=1 and $P_F$=0 express a pitch of an original tone, $P_I$=2 and $P_F$=0 express a pitch higher than the original pitch by one octave, and $P_I$=0 and $P_F$=0.5 express a pitch lower by one octave.

$X_P$ represents previous sample data, and $X_N$ represents the next sample data. D represents a difference between two adjacent sample data, and E represents an envelope value. Furthermore, O represents an output value, and C represents a flag which is used when a sound source method to be assigned to a tone generation channel is changed in accordance with performance data, as will be described later.

various other control data will be described in descriptions of the respective sound source methods.

When data shown in FIG. 74 are stored in the RAMs 2062 and 3062 of the MCPU 1012 and the SCPU 1022, and the sound source methods (to be described later) are determined, data are set in units of channels shown in FIG. 72 in the format shown in FIG. 74.

The sound source processing operations of the respective sound source methods executed using the above-mentioned data architecture will be described below in turn. These sound source processing operations are realized by analyzing and executing a sound source processing program stored in the control ROM 2012 or 3012 by the command analyzer 2072 or 3072 of the MCPU 1012 or the SCPU 1022. Assume that the processing is executed under this condition unless otherwise specified.

In the flow chart shown in FIG. 65, in the sound source processing (one of steps $S_{417}$ to $S_{424}$) for each channel, the sound source method No. data G of the data in the data format (Table 1) shown in FIG. 74 stored in the corresponding tone generation channel of the RAM 2062 or 3062 is discriminated to determine sound source processing of a sound source method to be described below.

Sound Source Processing Based on PCM Method

When the sound source method No. data G indicates the PCM method, sound source processing based on the PCM method shown in the operation flow chart of FIG. 38 is executed. Variables in the flow chart are data in a PCM format of Table 1 shown in FIG. 74, which data are stored in the corresponding tone generation channel area (FIG. 72) of the RAM 2062 or 3062 of the MCPU 1012 or the SCPU 1022.

Of an address group of the external memory 1162 (FIG. 59) where PCM waveform data are stored, an address where waveform data as an object to be currently processed is stored is assumed to be ($A_I$, $A_F$) shown in FIG. 40.

Pitch data ($P_I$, $P_F$) is added to the current address ($S_{1001}$). The pitch data corresponds to the type of an ON key of the keyboard keys 8012 shown in FIGS. 70 and 71.

It is then checked if the integral part $A_I$ of the sum address is changed ($S_{1002}$). If NO in step $S_{1002}$, an interpolation data value O corresponding to the decimal part $A_F$ of the address (FIG. 40) is calculated by arithmetic processing $D \times A_F$ using a difference D as a difference between sample data $X_N$ and $X_P$ at addresses $(A_I+1)$ and $A_I$ ($S_{1007}$). Note that the difference D has already been obtained by the sound source processing at previous interrupt timing (see step $S_{1006}$ to be described later).

The sample data $X_P$ corresponding to the integral part $A_I$ of the address is added to the interpolation data value O to obtain a new sample data value O (corresponding to $X_Q$ in FIG. 40) corresponding to the current address $(A_I, A_F)$ ($S_{1008}$).

Thereafter, the sample data is multiplied with the envelope value E ($S_{1009}$), and the content of the obtained data O is added to a value held in the waveform data buffer B (FIG. 75) in the RAM 2062 or 3062 of the MCPU 1012 or the SCPU 1022 ($S_{1010}$).

Thereafter, the control returns to the main flow chart shown in FIG. 62. The control is interrupted in the next sampling period, and the operation flow chart of the sound source processing shown in FIG. 38 is executed again. Thus, pitch data $(P_I, P_F)$ is added to the current address $(A_I, A_F)$ ($S_{1001}$).

The above-mentioned operations are repeated until the integral part $A_I$ of the address is changed ($S_{1002}$).

Before the integral part is changed, the sample data $X_P$ and the difference D are left unchanged, and only the interpolation data O is updated in accordance with the address $A_F$. Thus, every time the address $A_F$ is updated, new sample data $X_Q$ is obtained.

If the integral part $A_I$ of the current address is changed ($S_{1002}$) as a result of addition of the current address $(A_I, A_F)$ and the pitch data $(P_I, P_F)$ in step $S_{1001}$, it is checked if the address $A_I$ has reached or exceeded the end address $A_E$ ($S_{1003}$).

If YES in step $S_{1003}$, the next loop processing is executed. More specifically, a value $(A_I-A_E)$ as a difference between the updated current address $A_T$ and the end address $A_E$ is added to the loop address $A_L$ to obtain a new current address $(A_I, A_F)$. A loop reproduction is started from the obtained new current address $A_I$ ($S_{1004}$). The end address $A_E$ is an end address of an area of the external memory 1162 (FIG. 59) where PCM waveform data are stored. The loop address $A_L$ is an address of a position where a player wants to repeat an output of a waveform, and known loop processing is realized by the PCM method.

If NO in step $S_{1003}$, the processing in step $S_{1004}$ is not executed.

Sample data is then updated. In this case, sample data corresponding to the new updated current address $A_T$ and the immediately preceding address $(A_I-1)$ are read out as $X_N$ and $X_P$ from the external memory 1162 (FIG. 59) ($S_{1005}$).

Furthermore, the difference so far is updated with a difference D between the updated data $X_N$ and $X_P$ ($S_{1006}$).

The following operation is as described above.

In this manner, waveform data by the PCM method for one channel is generated.

Sound Source Processing Based on DPCM Method

The sound source processing based on the DPCM method will be described below.

The operation principle of the DPCM method will be briefly described below with reference to FIG. 41.

In FIG. 41, sample data $X_P$ corresponding to an address $A_I$ of the external memory 1162 (FIG. 59) is obtained by adding sample data corresponding to an address $(A_I-1)$ (not shown) to a difference between the sample data corresponding to the address $(A_I-1)$ and sample data corresponding to the address $A_I$.

A difference D with the next sample data is written at the address $A_I$ of the external memory 1162 (FIG. 59). Sample data at the next address $(A_I+1)$ is obtained by $X_P+D$.

In this case, if the decimal part of the current address is represented by $A_F$, as shown in FIG. 41, sample data corresponding to the current address $A_F$ is obtained by $X_P+D \times A_F$.

In this manner, in the DPCM method, a difference D between sample data corresponding to the current address and the next address is read out from the external memory 1162 (FIG. 59), and is added to the current sample data to obtain the next sample data, thereby sequentially forming waveform data.

The operation of the above-mentioned DPCM method will be described below with reference to the operation flow chart shown in FIG. 39. Variables in the flow chart are DPCM data in Table 1 shown in FIG. 74, which data are stored in the corresponding tone generation channel area (FIG. 74) on the RAM 2062 or 3062 of the MCPU 1012 or the SCPU 1022.

Of addresses on the external memory 1162 (FIG. 59) where DPCM differential waveform data are stored, an address where waveform data as an object to be currently processed is stored is assumed to be $(A_I, A_F)$ shown in FIG. 41.

Pitch data $(P_I, P_F)$ is added to the current address $(A_I, A_F)$ ($S_{1101}$).

It is then checked if the integral part $A_I$ of the sum address is changed ($S_{1102}$). If NO in step $S_{1102}$, an interpolation data value O corresponding to the decimal part $A_F$ of the address is calculated by arithmetic processing $D \times A_F$ using a difference D at the address $A_I$ in FIG. 41 ($S_{1114}$). Note that the difference D has already been obtained by the sound source processing at the previous interrupt timing (see steps $S_{1106}$ and $S_{1110}$ to be described later).

The interpolation data value O is added to sample data $X_P$ corresponding to the integral part $A_I$ of the address to obtain a new sample data value O (corresponding $X_Q$ in FIG. 41) corresponding to the current address $(A_I, A_F)$ ($S_{1115}$).

Thereafter, the sample data value O is multiplied with an envelope value E ($S_{1116}$), and the obtained value is added to a value stored in the waveform data buffer B (FIG. 75) in the RAM 2062 or 3062 of the MCPU 1012 or the SCPU 1022 ($S_{1117}$).

Thereafter, the control returns to the flow chart shown in FIG. 62. The control is interrupted in the next sampling period, and the operation flow chart of the sound source processing shown in FIG. 39 is executed again. Thus, pitch data $(P_I, P_F)$ is added to the current address $(A_I, A_F)$ ($S_{1101}$).

The above-mentioned operations are repeated until the integral part $A_I$ of the address is changed.

Before the integral part is changed, the sample data $X_P$ and the difference D are left unchanged, and only the interpolation data O is updated in accordance with the address $A_F$. Thus, every time the address $A_F$ is updated, new sample data $X_Q$ is obtained.

If the integral part $A_I$ of the present address is changed ($S_{1102}$) as a result of addition of the current address $(A_I, A_F)$ and the pitch data $(P_I, P_F)$ in step $S_{1101}$, it is checked if the address $A_I$ has reached or exceeded the end address $A_E$ ($S_{1103}$).

If NO in step $S_{1103}$, sample data corresponding to the integral part $A_I$ of the updated current address is calculated by the loop processing in steps $S_{1104}$ to $S_{1107}$. More specifically, a value before the integral part $A_I$ of the current address is changed is stored in a variable "old $A_I$" (see the column of DPCM in Table 1 shown in FIG. 74). This can be realized by repeating processing in step $S_{1106}$ or $S_{1113}$ (to be described later). The old $A_I$ value is sequentially incremented $S_{1106}$, and differential waveform data in the external memory 1162 (FIG. 59) addressed by the old $A_I$ values are read out as D in step $S_{1107}$. The readout data D are sequentially accumulated on sample data $X_P$ in step $S_{1105}$. When the old $A_I$ value becomes equal to the integral part $A_I$ of the changed current address, the sample data $X_P$ has a value corresponding to the integral part $A_I$ of the changed current address.

When the sample data $X_P$ corresponding to the integral part $A_I$ of the current address is obtained in this manner, YES is determined in step $S_{1104}$, and the control starts the arithmetic processing of the interpolation value ($S_{1114}$) described above.

The above-mentioned sound source processing is repeated at the respective interrupt timings, and when the judgment in step $S_{1103}$ is changed to YES, the control enters the next loop processing.

An address value ($A_I$–$A_E$) exceeding the end address $A_E$ is added to the loop address $A_L$, and the obtained address is defined as an integral part $A_I$ of a new current address ($S_{1108}$).

An operation for accumulating the difference D several times depending on an advance in address from the loop address $A_L$ is repeated to calculate sample data $X_P$ corresponding to the integral part $A_I$ of the new current address. More specifically, sample data $X_P$ is initially set as the value of sample data $X_{PL}$ (see the column of DPCM in Table 1 shown in FIG. 74) at the preset loop address $A_L$ and the old $A_I$ is set as the value of the loop address $A_L$ ($S_{1110}$). The following processing operations in steps $S_{1110}$ to $S_{1113}$ are repeated. More specifically, the old $A_I$ value is sequentially incremented in step $S_{1113}$, and differential waveform data on the external memory 1162 (FIG. 59) designated by the incremented old $A_I$ values read out as data D. The data D are accumulated on the sample data XP in step $S_{1112}$. When old $A_I$ value becomes equal to the integral part $A_I$ of the new current address, the sample data $X_P$ has a value corresponding to the integral part $A_I$ of the new current address after loop processing.

When the sample data $X_P$ corresponding to the integral part $A_I$ of the new current address is obtained in this manner, YES is determined in step $S_{1111}$, and the control enters the above-mentioned arithmetic processing of the interpolation value ($S_{1114}$).

As described above, waveform data by the DPCM method for one tone generation channel is generated.

Sound Source Processing Based on FM Method (Part 1)

The sound source processing based on the FM method will be described below.

In the FM method, hardware or software elements having the same contents, called "operators", as indicated by OP1 to OP4 in FIGS. 76 to 79, are normally used, and are connected based on connection rules indicated by algorithms 1 to 4 in FIGS. 76 to 79, thereby generating musical tones. In this embodiment, the FM method is realized by a software program.

The operation of this embodiment executed when the sound source processing is performed using two operators will be described below with reference to the operation flow chart shown in FIG. 42. The algorithm of the processing is shown in FIG. 43. Variables in the flow chart are FM format data in Table 1 shown in FIG. 74, which data are stored in the corresponding tone generation channel area (FIG. 72) on the RAM 2062 or 3062 of the MCPU 1012 or the SCPU 1022.

First, processing of an operator 2 (OP2) as a modulator is performed. In pitch processing (processing for accumulating pitch data for determining an incremental width of an address for reading out waveform data stored in the waveform memory 1162), since no waveform data interpolation is performed unlike in the PCM method, an address consists of an integral address $A_2$, and has no decimal address. Further, modulation waveform data are stored in the external memory 1162 (FIG. 59) at sufficiently fine incremental widths.

Pitch data $P_2$ is added to the present address $A_2$ ($S_{1301}$).

A feedback output $F_{O2}$ is added to the address $A_2$ as a modulation input to obtain a new address $A_{M2}$ which corresponds to phase of a sine wave ($S_{1302}$). The feedback output $F_{O2}$ has already been obtained upon execution of processing in step $S_{1305}$ (to be described later) at the immediately preceding interrupt timing.

The value of a sine wave corresponding to the address $A_{M2}$ is calculated. In practice, sine wave data are stored in the external memory 1162 (FIG. 59), and are obtained by addressing the external memory 1162 by the address $A_{M2}$ to read out the corresponding data ($S_{1303}$).

Subsequently, the sine wave data is multiplied with an envelope value $E_2$ to obtain an output $O_2$ ($S_{1304}$).

Thereafter, the output $O_2$ is multiplied with a feedback level $F_{L2}$ to obtain a feedback output $F_{O2}$ ($S_{1305}$). This output $F_{O2}$ serves as an input to the operator 2 (OP2) at the next interrupt timing.

The output $O_2$ is multiplied with a modulation level $M_{L2}$ to obtain a modulation output $M_{O2}$ ($S_{1306}$). The modulation output $M_{O2}$ serves as a modulation input to an operator 1 (OP1).

The control then enters processing of the operator 1 (OP1). This processing is substantially the same as that of the operator 2 (OP2) described above, except that there is no modulation input based on the feedback output.

The current address $A_1$ of the operator 1 is added to pitch data $P_1$ ($S_{1307}$), and the sum is added to the above-mentioned modulation output $M_{O2}$ to obtain a new address $A_{M1}$ ($S_{1308}$).

The value of sine wave data corresponding to this address $A_{M1}$ (phase) is read out from the external memory 1162 (FIG. 59) ($S_{1309}$), and is multiplied with an envelope value $E_1$ to obtain a musical tone waveform output $O_1$ ($S_{1310}$).

The output $O_1$ is added to a value held in the buffer B (FIG. 75) in the RAM 2062 (FIG. 60) or the RAM 3062 (FIG. 61) ($S_{1311}$), thus completing the FM processing for one tone generation channel.

Sound Source Processing Based on TM (Triangular Wave Modulation) Method (Part 1)

The sound source processing based on the TM method will be described below.

The principle of the TM method is already described in the fourth embodiment. Therefore, the description of the TM method itself is omitted.

The sound source processing based on the TM method will be described below with reference to the operation flow chart shown in FIG. 44. In this case, the sound source processing is also performed using two operators like in the FM method shown in FIGS. 42 and 43, and the algorithm of the processing is shown in FIG. 45. Variables in the flow chart are TM format data in Table 1 shown in FIG. 74, which data are soured in the corresponding tone generation channel area (FIG. 72) on the RAM 2062 or 3062 of the MCPU 1012 or the SCPU 1022.

First, processing of an operator 2 (OP2) as a modulator is performed. In pitch processing, since no waveform data interpolation is performed unlike in the PCM method, an address for addressing the external memory 1162 consists of only an integral address $A_2$.

The current address $A_2$ is added to pitch data $P_2$ ($S_{1401}$).

A modified sine wave corresponding to the address $A_2$ (phase) is read out from the external memory 1162 (FIG. 59) by the modified sine conversion $f_c$, and is output as a carrier signal $O_2$ ($S_{1402}$).

Subsequently, a feedback output $F_{O2}$ ($S_{1460}$) as a modulation signal, is added to the carrier signal $O_2$, and the sum signal is output as a new address $O_2$ ($S_{1403}$). The feedback output $F_{O2}$ has already been obtained upon execution of processing in step $S_{1406}$ (to be described later) at the immediately preceding interrupt timing.

The value of a triangular wave corresponding to the address $O_2$ is calculated. In practice, triangular wave data are stored in the external memory 1162 (FIG. 59), and are obtained by addressing the external memory 1162 by the address $O_2$ to read out the corresponding data ($S_{1404}$).

Subsequently, the triangular wave data is multiplied with an envelope value $E_2$ to obtain an output $O_2$ ($S_{1405}$).

Thereafter, the output $O_2$ is multiplied with a feedback level $F_{L2}$ to obtain a feedback output $F_{O2}$ ($S_{1407}$). In this embodiment, the output $F_{O2}$ serves as an input to the operator 2 (OP2) at the next interrupt timing.

The output $O_2$ is multiplied with a modulation level $M_{L2}$ to obtain a modulation output $M_{O2}$ ($S_{1407}$). The modulation output $M_{O2}$ serves as a modulation input to an operator 1 (OP1).

The control then enters processing of the operator 1 (OP1). This processing is substantially the same as that of the operator 2 (OP2) described above, except that there is no modulation input based on the feedback output.

The current address $A_1$ of the operator 1 is added to pitch data $P_1$ ($S_{1408}$), and the sum is subjected to the above-mentioned modified sine conversion to obtain a carrier signal $O_1$ ($S_{1409}$).

The carrier signal $O_1$ is added to the modulation output $M_{O2}$ to obtain a new value $O_1$ ($S_{1410}$), and the value $O_1$ is subjected to triangular wave conversion ($S_{1411}$). The converted value is multiplied with an value $E_1$ to obtain a musical tone waveform output $O_1$ ($S_{1412}$).

The output $O_1$ is added to a value held in the buffer B (FIG. 75) in the RAM 2062 (FIG. 61) or the RAM 3062 (FIG. 61), thus completing the TM processing for one tone generation channel.

The sound source processing operations based on four methods, i.e., the PCM, DPCM, FM, and TM methods have been described. The FM and TM methods are modulation methods, and, in the above examples, two-operator processing operations are executed based on the algorithms shown in FIGS. 43 and 45. However, in sound source processing in an actual performance, more operators are used, and the algorithms are more complicated. FIGS. 76 to 79 show examples. In an algorithm 1 shown in FIG. 76, four modulation operations including a feedback input are performed, and a complicated waveform can be obtained. In each of algorithms 2 and 3 shown in FIGS. 77 and 78, two sets of algorithms each having a feedback input are arranged parallel to each other, and these algorithms are suitable for expressing a change in tone color during, e.g., transition from an attack portion to a sustain portion. An algorithm 4 shown in FIG. 84 has a feature close to a sine wave synthesis method.

The sound source processing operations based on the FM and TM methods using four operators shown in FIGS. 76 to 79 will be described below in turn with reference to FIGS. 80 and 81.

Sound Source Processing Based on FM Method (Part 2)

Figure 80:
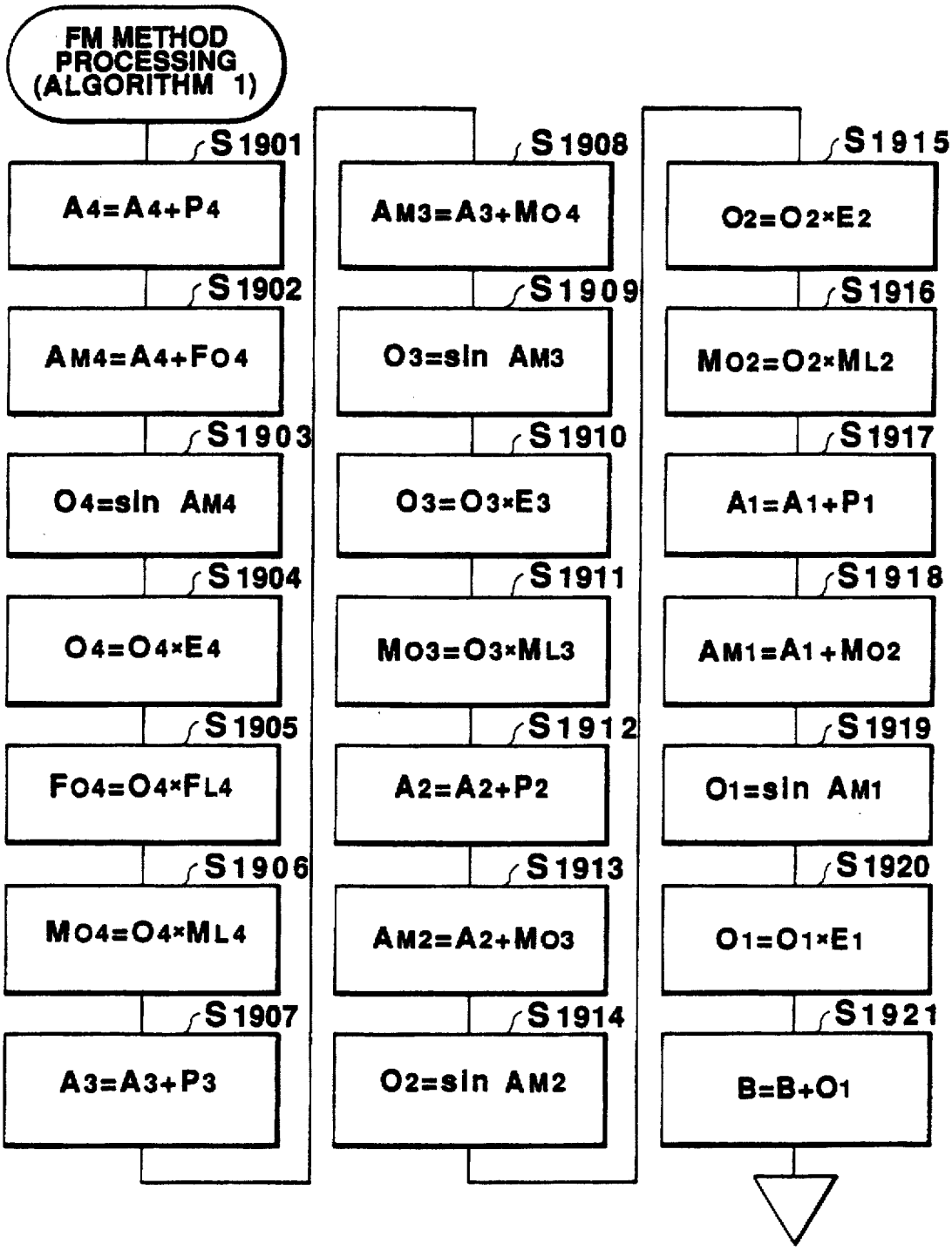
FIG. 80 is an operation flow chart of sound source processing based on an FM method (Part 2)
Figure 81:
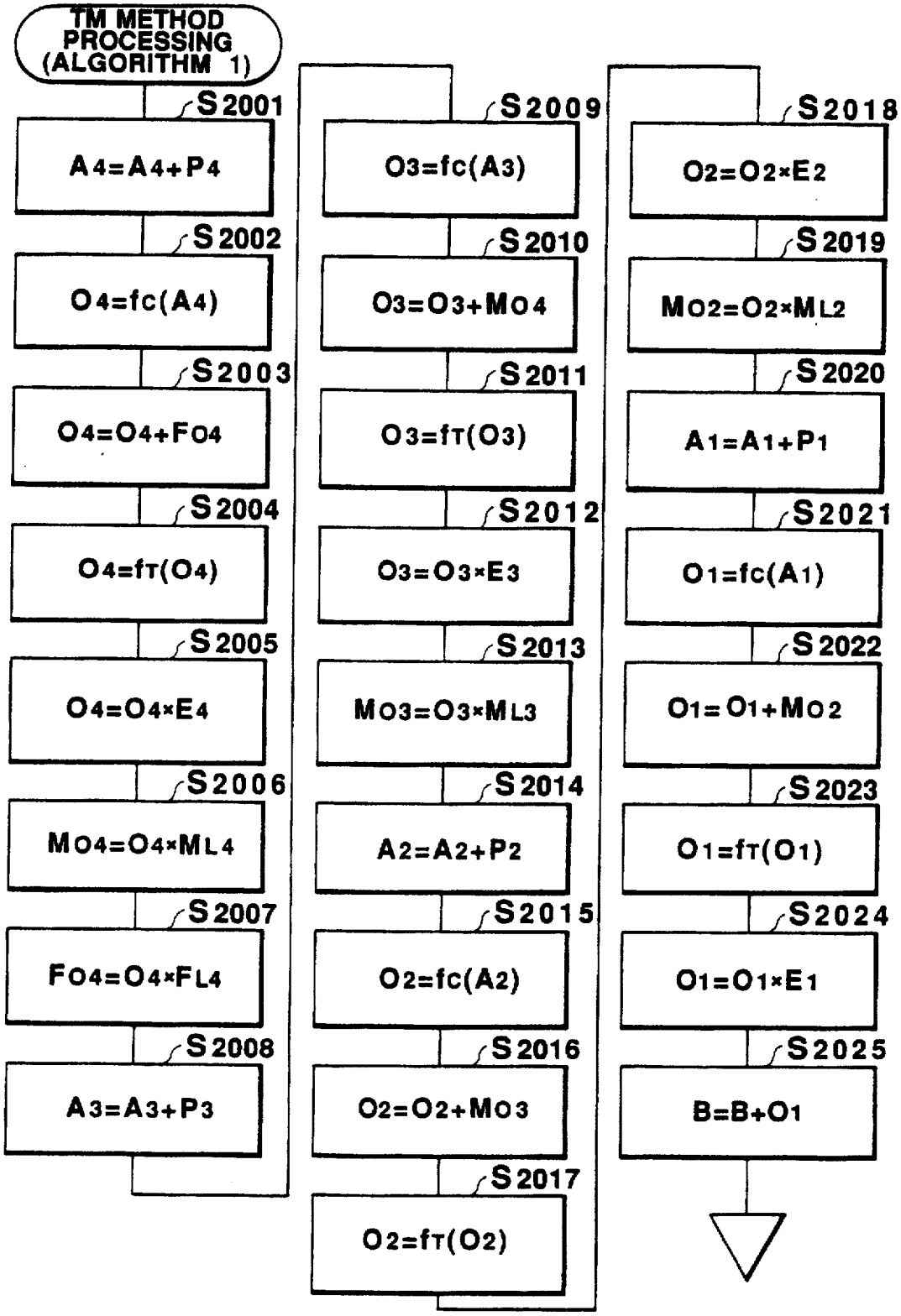
FIG. 81 is an operation flow chart of sound source processing based on a TM method (Part 2)

FIG. 80 is an operation flow chart of normal sound source processing based on the FM method corresponding to the algorithm 1. Variables in the flow chart are stored in the corresponding tone generation channel area (FIG. 72) on the RAM 2062 or 3062 of the MCPU 1012 or the SCPU 1022. Although the variables used in FIG. 80 are not the same as data in the FM format of Table 1 in FIG. 74, they are obtained by expanding the concept of the data format shown in FIG. 74, and only have different suffixes.

First, the present address $A_4$ of an operator 4 (OP4) is added to pitch data $P_4$ ($S_{1901}$). The address $A_4$ is added to a feedback output $F_{O4}$ ($S_{1905}$) as a modulation input to obtain a new address $A_{M4}$ ($S_{1902}$). Furthermore, the value of a sine wave corresponding to the address $M_4$ (phase) is read out from the external memory 1162 (FIG. 59) ($S_{1903}$), and is multiplied with an envelope value $E_4$ to obtain an output $O_4$ ($S_{1904}$). Thereafter, the output $O_4$ is multiplied with a feedback level $F_{L4}$ to obtain a feedback output $F_{O4}$ ($S_{1905}$). The output $O_4$ is multiplied with a modulation level $M_{L4}$ to obtain a modulation output $M_{O4}$ ($S_{1906}$). The modulation output $M_{O4}$ serves as a modulation input to the next operator 3 (OP3).

The control then enters processing of the operator 3 (OP3). This processing is substantially the same as that of the operator 4 (OP4) described above, except that there is no modulation input based on the feedback output. The current address $A_3$ of the operator 3 (OP3) is added to pitch data $P_3$ to obtain a new current address $A_3$ ($S_{1907}$). The address $A_3$ is added to a modulation output $M_{O4}$ as a modulation input, thus obtaining a new address $A_{M3}$ ($S_{1908}$). Furthermore, the value of a sine wave corresponding to the address $A_{M3}$ (phase) is read out from the external memory 1162 (FIG. 59) ($S_{1909}$) and is multiplied with an envelope value $E_3$ to obtain an output $O_3$ ($S_{1910}$). Thereafter, the output $O_3$ is multiplied with a modulation level $M_{L3}$ to obtain a modulation output $MO_3$ ($S_{1911}$). The modulation output $M_{O3}$ serves as a modulation input to the next operator 2 (OP2).

Processing of the operator 2 (OP2) is then executed. However, this processing is substantially the same as that of the operator 3, except that a modulation input is different, and a detailed description thereof will be omitted.

Finally, the control enters processing of an operator 1 (OP1). In this case, the same processing operations as described above are performed up to step $S_{1920}$. A musical tone waveform output $O_1$ obtained in step $S_{1920}$ is added to data stored in the buffer B as a carrier ($S_{1921}$).

Sound Source Processing Based on TM Method (Part 2)

Figure 76:
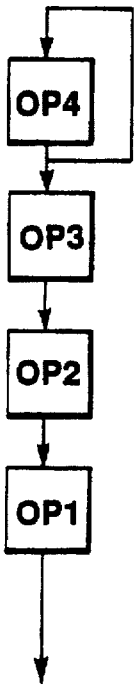
FIGS. 76 to 79 are charts showing algorithms in a modulation method.

FIG. 75 is an operation flow chart of normal sound source processing based on the TM method corresponding to the algorithm 1 shown in FIG. 76. Variables in the flow chart are stored in the corresponding tone generation channel area (FIG. 72) on the RAM 2062 or 3062 of the MCPU 1012 or the SCPU 1022. Although the variables used in FIG. 80 are not the same as data in the TM format of Table 1 in FIG. 74, they are obtained by expanding the concept of the data format shown in FIG. 74, and only have different suffixes.

The current address $A_4$ of the operator 4 (OP4) is added to pitch data $P_4$ ($S_{2061}$). A modified sine wave to the above-mentioned address $A_4$ (phase) is read out from the external memory 1162 (FIG. 59) by the modified sine conversion $f_c$, and is output as a carrier signal $O_4$ ($S_{2002}$). A feedback output $F_{O4}$ (see $S_{2007}$) as a modulation signal is added to the carrier signal $O_4$, and the sum signal is output as a new address $O_4$ ($S_{2003}$). The value of a triangular wave corresponding to the address $O_4$ (phase) is read out from the external memory 1162 (FIG. 59) (to be referred to as a triangular wave conversion hereinafter) ($S_{2004}$), and is multiplied with an envelope value $E_4$, thus obtaining an output $O_4$ ($S_{2005}$). Thereafter, the output $O_4$ is multiplied with a modulation level $M_{L4}$ to obtain a modulation output $M_{O4}$ ($S_{2006}$). The output $O_4$ is multiplied with a feedback level $F_{L4}$ to obtain a feedback output $F_{O4}$ ($S_{2007}$). The modulation output $M_{O4}$ serves as a modulation input to the next operator 3 (OP3).

The control then enters processing of the operator 3 (OP3). This processing is substantially the same as that of the operator 4 (OP4) described above, except that there is no modulation input based on the feedback output. The current address $A_3$ of the operator 3 (OP3) is added to pitch data $P_3$ ($S_{2008}$) and the sum is subject to modified sine conversion to obtain a carrier signal $O_3$ ($S_{2009}$). The carrier signal $O_3$ is added to the above-mentioned modulation output $M_{O4}$ to obtain a new value $O_3$ ($S_{2010}$), and the value $O_3$ is subject to triangular wave conversion ($S_{2011}$). The converted value is multiplied with an envelope value $E_3$ to obtain an output $O_3$ ($S_{2012}$). The output $O_3$ is multiplied with a modulation level $M_{L3}$ to obtain a modulation output $M_{O3}$ ($S_{2013}$). The modulation output $M_{O3}$ serves as a modulation input to the next operator 2 (OP2).

Processing of the operator 2 (OP2) is then executed. However, this processing is substantially the same as that of the operator 3, except that a modulation input is different, and a detailed description thereof will be omitted.

Finally, the control enters processing of an operator 1 (OP1). In this case, the same processing operations as described above are performed up to step $S_{2024}$. A musical tone waveform output $O_1$ obtained in step $S_{2024}$ is accumulated in the buffer B (FIG. 75) as a carrier ($S_{2025}$).

The embodiment of the normal sound processing operations based on the modulation methods has been described. However, the above-mentioned processing is for one tone generation channel, and in practice, the MCPU 1012 and the SCPU 1022 each execute processing for eight channels (FIG. 65). If a modulation method is designated in a given tone generation channel, the above-mentioned sound source processing based on the modulation method is executed.

Modification of Modulation Method (Part 1)

The first modulation of the sound source processing based on the modulation method will be described below.

Figure 82:
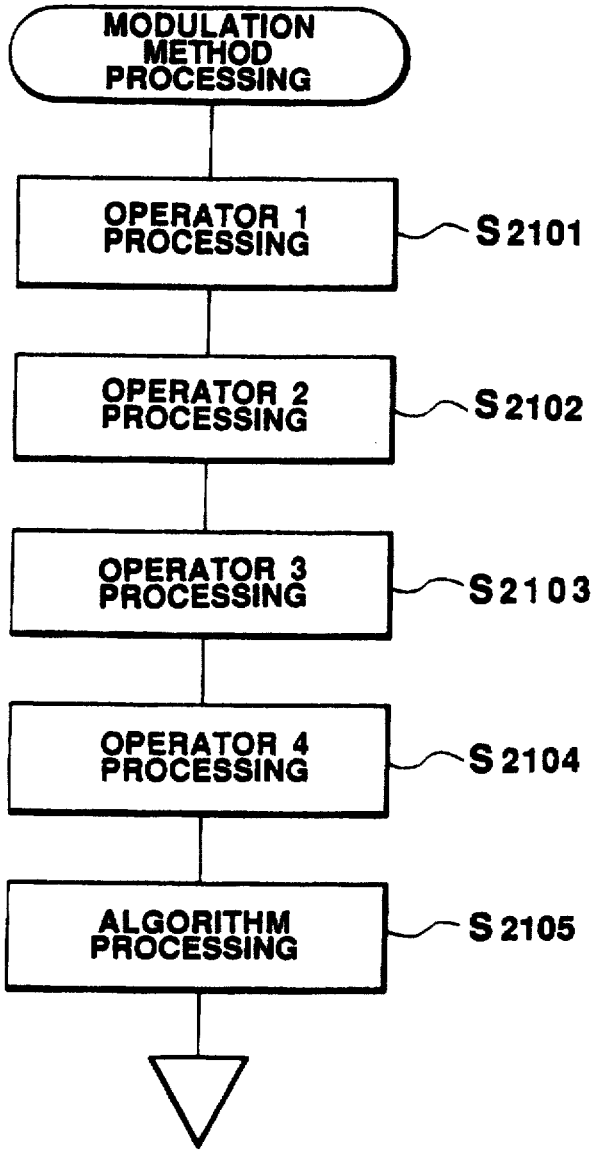
FIG. 82 is an operation flow chart of a first modulation of the modulation method.

The basic concept of this processing is shown in the flow chart of FIG. 82.

In FIG. 82, operator 1, 2, 3, and 4 processing operations have the same program architecture although they have different variable names to be used.

Each operator processing cannot be executed unless a modulation input is determined. This is because a modulation input to each operator processing varies depending on the algorithm, as shown in FIGS. 76 to 79. Which operator processing output is used as a modulation input or whether or not an output from its own operator processing is fed back, and is used as its own modulation input in place of another operator processing must be determined. In the operation flow chart shown in FIG. 82, such determinations are simultaneously performed in algorithm processing ($S_{2105}$), and the connection relationship obtained by this processing determine modulation inputs to the respective operator processing operations ($S_{2102}$ to $S_{2104}$). Note that a given initial value is set as an input to each operator processing at the beginning of tone generation.

When the operator processing and the algorithm processing are separated in this manner, the program of the operator processing can remain the same, and only the algorithm processing can be modified in correspondence with algorithms. Therefore, the program size of the overall sound source processing based on the modulation method can be greatly reduced.

Figure 83:
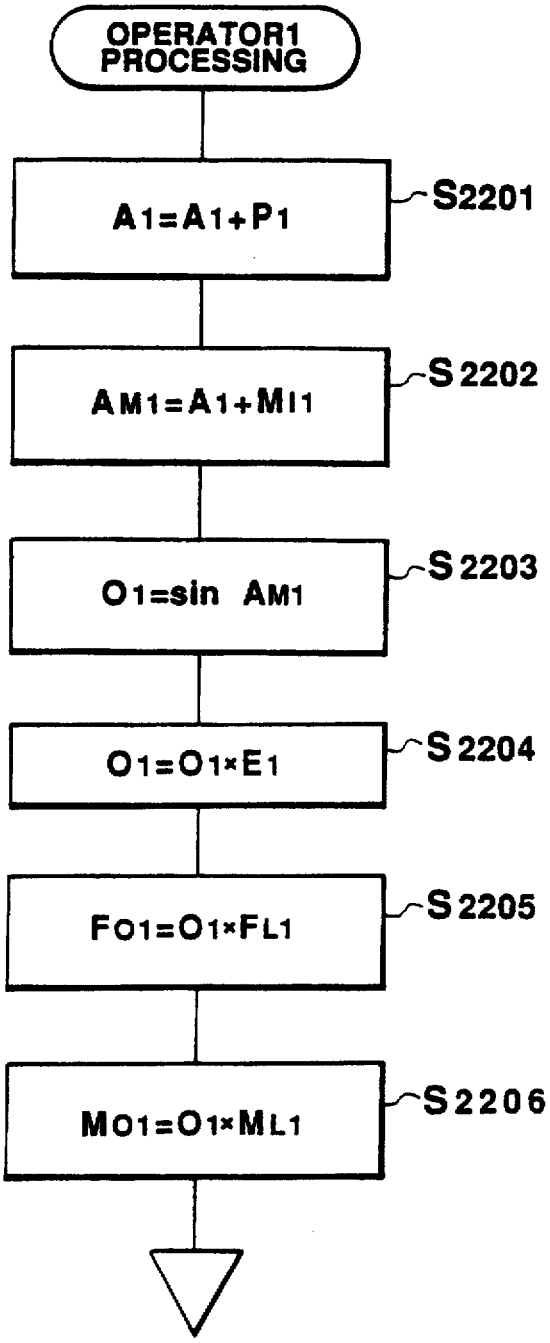
FIG. 83 is an operation flow chart of operator 1 processing based on the FM method according to the first modification.
Figure 84:
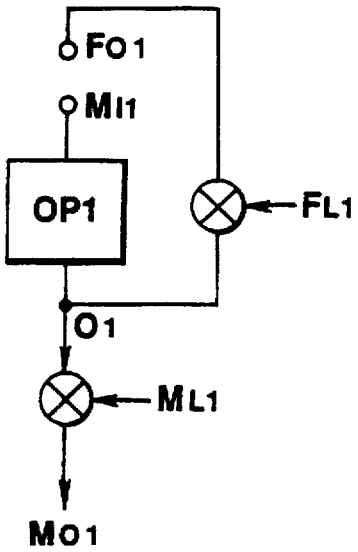
FIG. 84 is a chart showing an arithmetic algorithm per operator in the operator 1 processing based on the FM method according to the first modification.

A modification of the FM method based on the above-mentioned basic concept will be described below. The operator 1 processing in the operation flow chart showing operator processing based on the FM method in FIG. 82 is shown in FIG. 83, and an arithmetic algorithm per operator is shown in FIG. 84. The remaining operator 2 to 4 processing operations are the same except for different suffix numbers of variables. Variables in the flow chart are stored in the corresponding tone generation channel (FIG. 72) on the RAM 2062 or 3062 of the MCPU 1012 or the SCPU 1022.

An address $A_1$ corresponding to a phase angle is added to pitch data $P_1$ to obtain a new address $A_1$ ($S_{2201}$). The address $A_1$ is added to a modulation input $M_{I1}$, thus obtaining an address $A_{M1}$ ($S_{2202}$). The modulation input $M_{I1}$ is determined by the algorithm processing in step $S_{2105}$ (FIG. 82) at the immediately preceding interrupt timing, and may be a feed back output $F_{O1}$ of its own operator, or an output $M_{O2}$ from another operator, e.g., an operator 2 depending on the algorithm. The value of a sine wave corresponding to this address (phase) $A_{M1}$ is read out from the external memory 1162 (FIG. 59), thus obtaining an output $O_1$ ($S_{2203}$). Thereafter, a value obtained by multiplying the output $O_1$ with envelope data $E_1$ serves as an output $O_1$ of the operator 1 ($S_{2204}$). The output $O_1$ is multiplied with a feedback level $F_{L1}$ to obtain a feedback output $F_{O1}$ ($S_{2205}$). The output $O_1$ is multipied with a modulation level $M_{L1}$, thus obtaining a modulation output $M_{O1}$ ($S_{2206}$).

Figure 85:
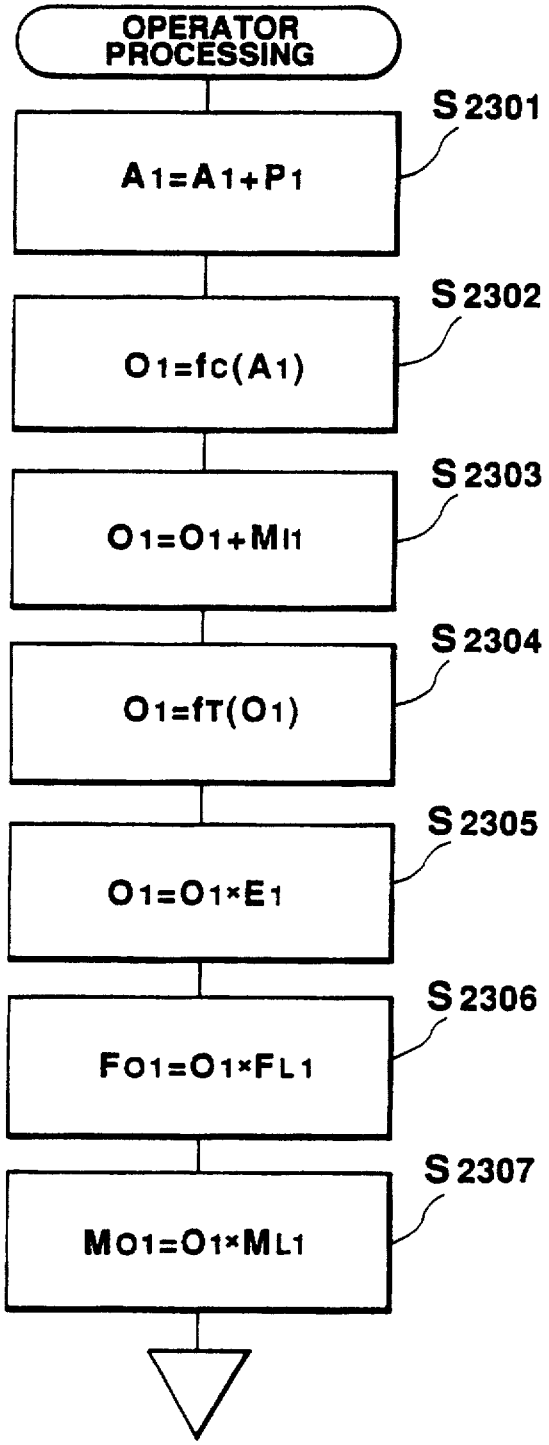
FIG. 85 is an operation flow chart of operator 1 processing based on the TM method according to the first modification.
Figure 86:
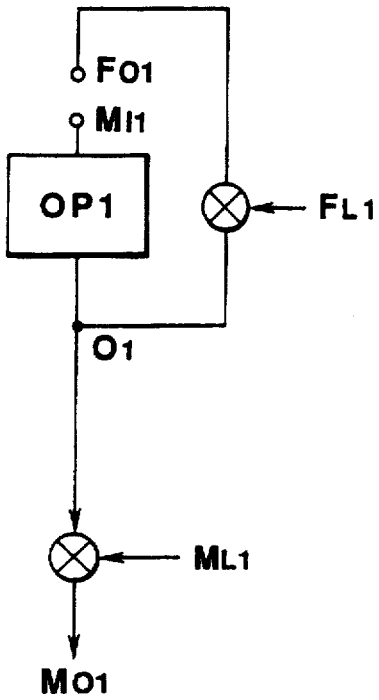
FIG. 86 is a chart showing an arithmetic algorithm per operator in the operator 1 processing based on the TM method according to the first modification.

A modification of the TM method based on the above-mentioned basic concept will be described below. The operator 1 processing in the operation flow chart showing operator processing based on the TM method in FIG. 82 is shown in FIG. 85, and an arithmetic algorithm per operator is shown in FIG. 86. The remaining operator 2 to 4 processing operations are the same except for different suffix numbers of variables. Variables in the flow chart are stored in the corresponding tone generation channel (FIG. 72) on the RAM 2062 or 3062 of the MCPU 1012 or the SCPU 1022.

The current address $A_1$ is added to pitch data $P_1$ ($S_{2301}$). A modified sine wave corresponding to the above-mentioned address $A_1$ (phase) is read out from the external memory 1162 (FIG. 59) by the modified sine conversion $f_c$, and is generated as a carrier signal $O_1$ ($S_{2302}$). The output $O_1$ is added to a modulation input $M_{I1}$ as a modulation signal, and the sum is defined as a new address $O_1$ ($S_{2303}$). The value of a triangular wave corresponding to the address $O_1$ (phase) is read out from the external memory 1162 ($S_{2304}$), and is multiplied with an envelope value $E_1$ to obtain an output $O_1$ ($S_{2306}$). Thereafter, the output $O_1$ is multiplied with a feedback level $F_{L1}$ to obtain a feedback output $F_{O1}$ ($S_{2306}$). The output $O_1$ is multiplied with a modulation level $M_{L1}$ to obtain a modulation output $M_{O1}$ ($S_{2307}$).

Figure 87:
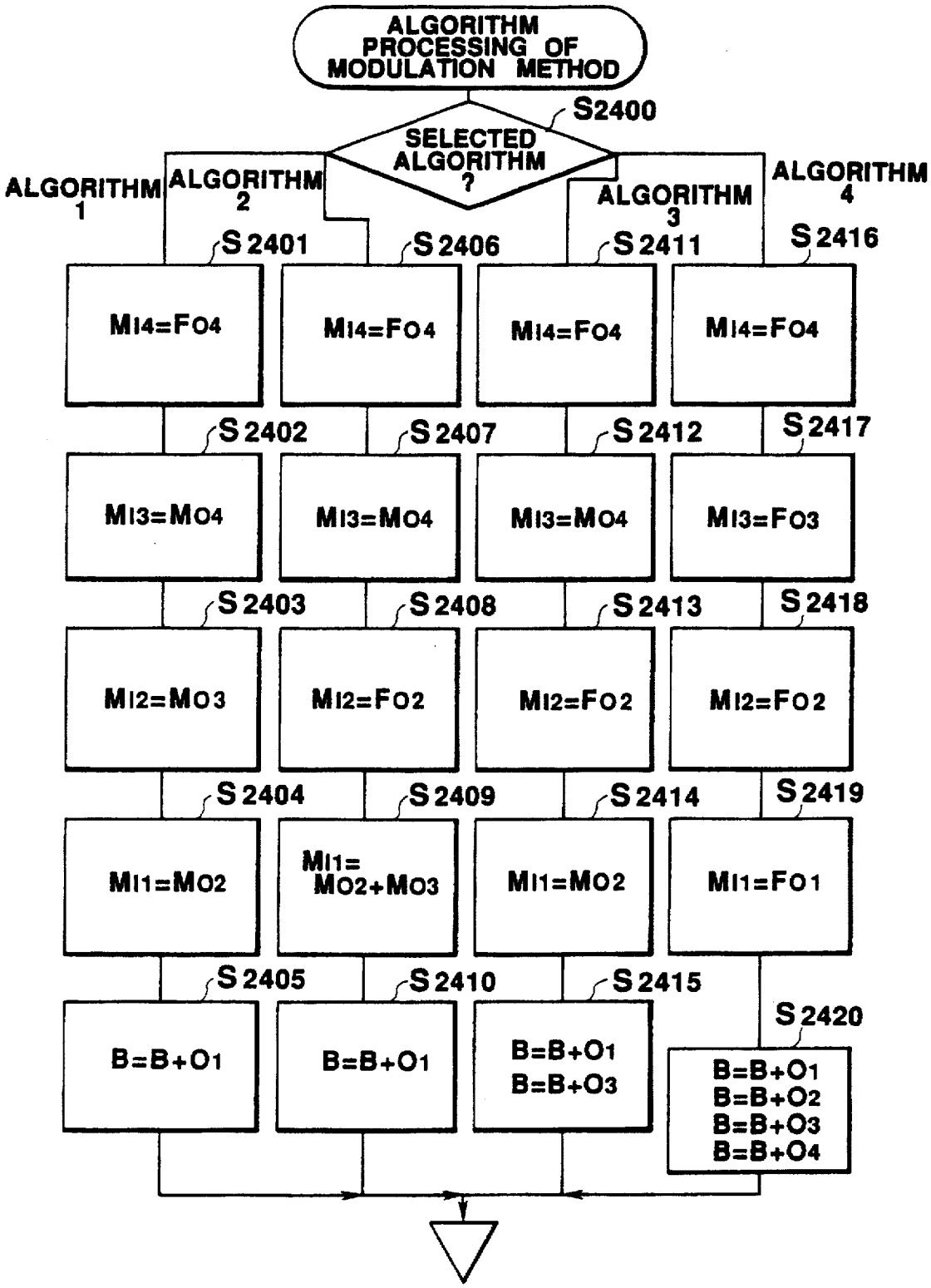
FIG. 87 is an operation flow chart of algorithm processing according to the modification.

The algorithm processing in step $S_{2105}$ in FIG. 82 for determining a modulation input in the operator processing in both the above-mentioned modulation methods, i.e., the FM and TM methods will be described in detail below with reference to the operation flow chart of FIG. 87. The flow chart shown in FIG. 87 is common to both the FM and TM methods, and the algorithms 1 to 4 shown in FIG. 76 to 79 are selectively processed. In this case, choices of the algorithms 1 to 4 are made based on an instruction (not shown) from a player ($S_{2400}$).

The algorithm 1 is of a series four-operator (to be abbreviated to as an OP hereinafter) type, and only the OP4 has a feedback input. More specifically, in the algorithm 1,

- a feedback output $F_{O4}$ of the OP4 serves as the modulation input $M_{I4}$ of the OP4 ($S_{2401}$),
- a modulation output $M_{O4}$ of the OP4 serves as a modulation input $M_{I3}$ of the OP3 ($S_{2402}$),
- a modulation output OP3 of the OP3 serves as a modulation input $M_{I2}$ of the OP2 ($S_{2403}$),
- a modulation output $M_{O2}$ of the OP2 serves as a modulation input $M_{I1}$ of the OP1 ($S_{2404}$), and
- an output $O_1$ from the OP1 is added to the value held in the buffer B (FIG. 75) as a carrier output ($S_{2405}$).

Figure 77:
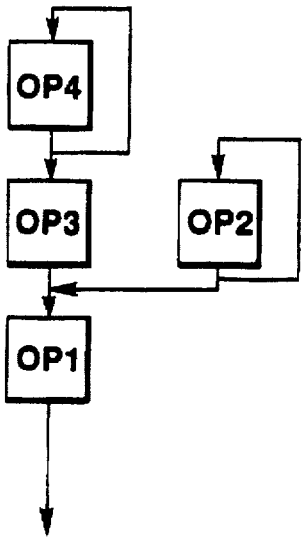
Figure 78:
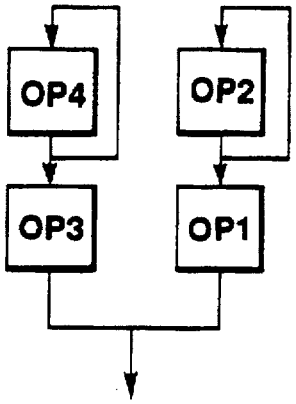
Figure 79:
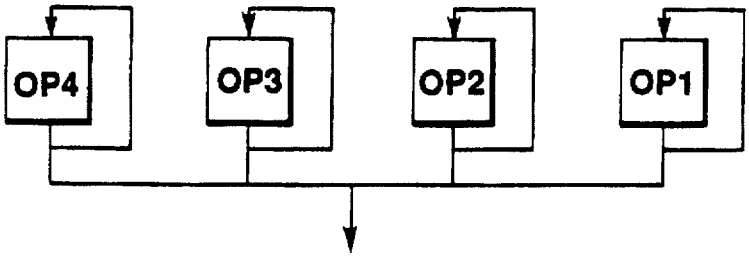

In the algorithm 2, as shown in FIG. 77, the OP2 and the OP4 have feedback inputs. More specifically, in the algorithm 2,

- a feedback output $F_{O4}$ of the OP4 serves as a modulation input $M_{I4}$ of the OP4 ($S_{2406}$),
- a modulation output $M_{O4}$ of the OP4 serves as a modulation input $M_{I3}$ of the OP3 ($S_{2407}$),
- a feedback output $F_{O2}$ of the OP2 serves as a modulation input $M_{I2}$ of the OP2 ($S_{2408}$),
- modulation outputs $M_{O2}$ and $M_{O3}$ of the OP2 and serve as a modulation input $M_{I1}$ of the OP1 ($S_{2409}$), and
- an output $O_1$ from the OP1 is added to the value held in the buffer B as a carrier output ($S_{2410}$).

In the algorithm 3, the OP2 and OP4 have feedback inputs, and two modules in which two operators are connected in series with each other are connected in parallel with each other. More specifically, in the algorithm 3,

- a feedback output $F_{O4}$ of the OP4 serves as a modulation input $M_{I4}$ of the OP4 ($S_{2411}$),
- a modulation output $M_{O4}$ of the OP4 serves as a modulation input MI3 of the OP3 ($S_{2412}$),
- a feedback output $F_{O2}$ of the OP2 serves as a modulation input $M_{I2}$ of the OP2 ($S_{2413}$),
- a modulation output $M_{O2}$ of the OP2 serves as a modulation input $M_{I1}$ of the OP1 ($S_{2414}$), and
- outputs $O_1$ and $O_3$ from the OP1 and OP3 are added to the value held in the buffer B as carrier outputs ($S_{2415}$).

The algorithm 4 is of a parallel four-OP type, and all the OPs have feedback inputs. More specifically, in the algorithm 4,

- a feedback output $F_{O4}$ of the OP4 serves as a modulation input $M_{I4}$ of the OP4 ($S_{2416}$),
- a feedback output $F_{O3}$ of the OP3 serves as a modulation input $M_{I3}$ of the OP3 ($S_{2417}$),
- a feedback output $F_{O2}$ of the OP2 serves as a modulation input $M_{I2}$ of the OP2 ($S_{2418}$),
- a feedback output $F_{O1}$ of the OP1 serves as a input MI1 of the OP1 ($S_{2419}$), and
- outputs $O_1$, $O_2$, $O_3$, and $O_4$ from all the OPs are added to the value held in the buffer B ($S_{2420}$).

The sound source processing for one channel is completed by the above-mentioned operator processing and algorithm processing, and tone generation (sound source processing) continues in this state unless the algorithm is changed.

Modification of Modulation Method (Part 2)

The second modification of the sound source processing based on the modulation method will be described below.

In the various modulation methods described above, processing time is increased as the complicated algorithms are programmed, and as the number of tone generation channels (the number of polyphonic channels) is increased.

In the second modification to be described below, the first modification shown in FIG. 82 is further developed, so that only operator processing is performed at a given interrupt timing, and only algorithm processing is performed at the next interrupt timing. Thus, the operator processing and the algorithm processing are alternately executed. In this manner, a processing load per interrupt timing can be greatly reduced. As a result, one sample data per two interrupts is output.

Figure 88:
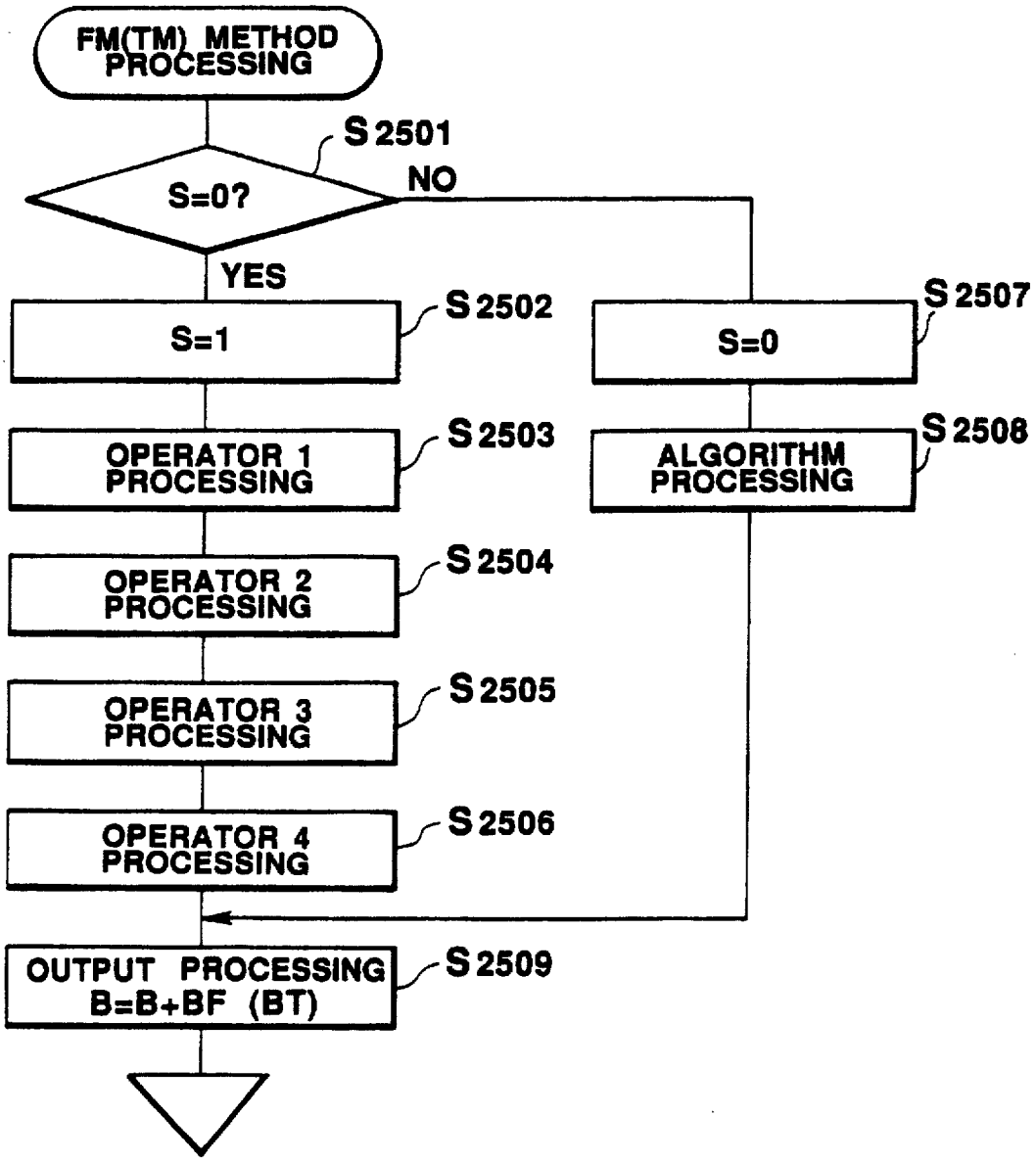
FIG. 88 is an operation flow chart of a second modification of the modulation method.

This operation will be described below with reference to the operation flow chart shown in FIG. 88.

In order to alternately execute the operator processing and the algorithm processing, whether or not a variable S is zero is checked ($S_{2501}$). The variable is provided for each tone generation channel, and is stored in the corresponding tone generation channel area (FIG. 72) on the RAM 2062 or 3062 of the MCPU 1012 or the SCPU 1022.

If S=0 at a given interrupt timing, the process enters an operator processing route, and sets the variable S to a value "1" ($S_{2502}$). Subsequently, operator 1 to 4 processing operations are executed ($S_{2503}$ to $S_{2506}$). This processing is the same as that in FIGS. 83 and 84, or 85 and 86.

The process exits from the operator processing route, and executes output processing for setting a Value of the buffer BF (for the FM method) or the buffer BT (for the TM method) ($S_{2510}$). The buffer BF or BT is provided for each tone generation channel, and is stored in the corresponding tone generation channel area (FIG. 72) on the RAM 2062 or 3062 of the MCPU 1012 or the SCPU 1022. The buffer BF or BT stores a waveform output value after the algorithm processing. At the current interrupt timing, however, no algorithm processing been 15 executed, and the content of the buffer BF or BT is not updated. For this reason, the same waveform output value as that at the immediately preceding interrupt timing is output.

With the above processing, sound source processing for one tone generation channel at the current interrupt timing is completed. In this case, data obtained by the current operator 1 to 4 processing operations are stored in the corresponding tone generation channel area (FIG. 72) on the RAM 2062 or 3062 of the MCPU 1012 or the SCPU 1022.

At the next interrupt timing, since the variable S is set to be "1" at the immediately preceding interrupt timing, the flow advances to step $S_{2507}$. The process then enters an algorithm processing route, and sets the variable S to be a value "0". Subsequently, the algorithm processing is executed ($S_{2508}$).

Figure 89:
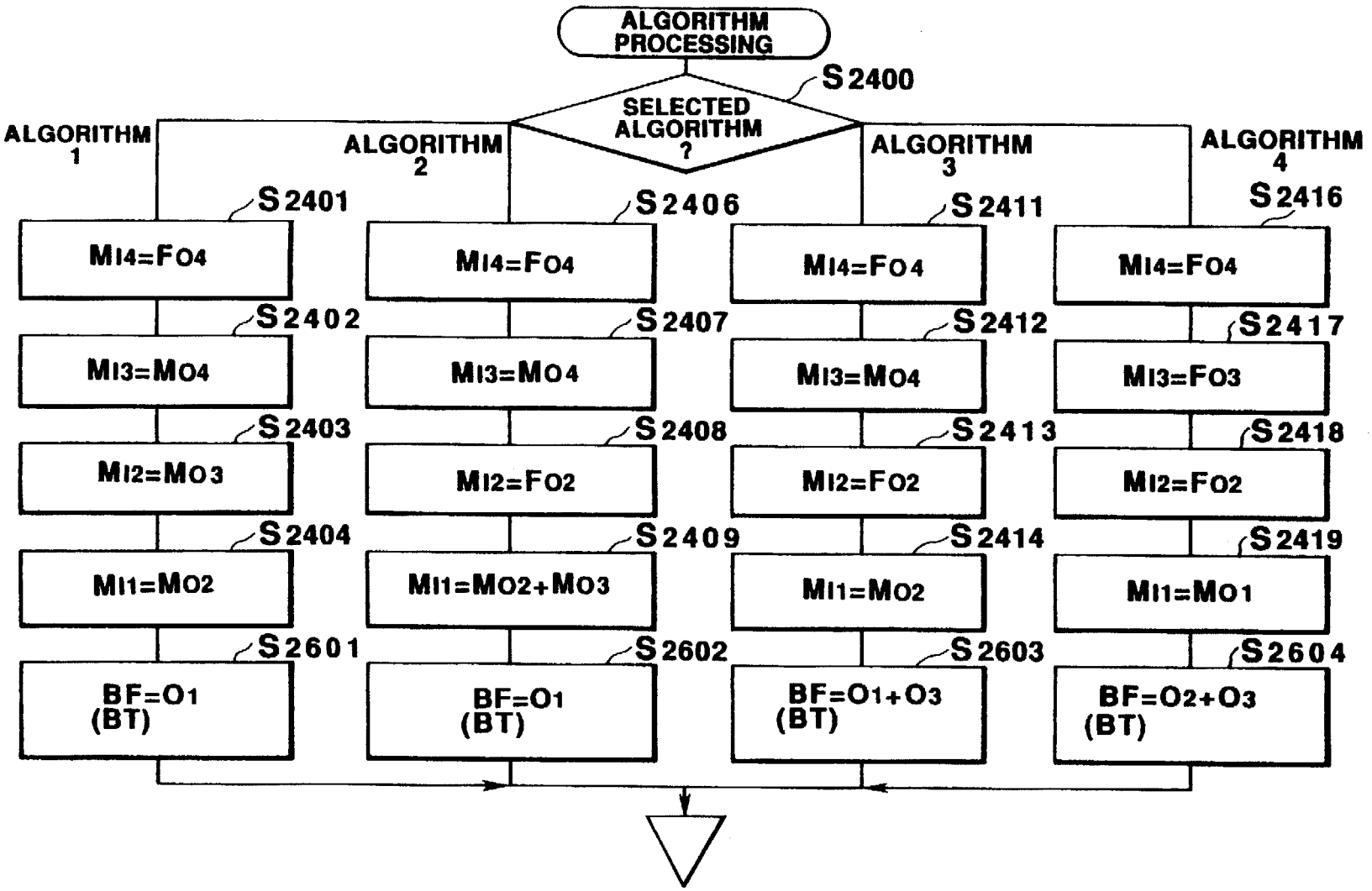
FIG. 89 is an operation flow chart of algorithm processing according to the second modification.

In this processing, the data processed in the operator 1 to 4 processing operations at the immediately preceding interrupt timing and stored in the corresponding tone generation channel area (FIG. 72) are used, and processing for determining a modulation input for the next operator processing is executed. In this processing, the content of the buffer BF or BT is rewritten, and a waveform output value at that interrupt timing can be obtained. The algorithm processing is shown in detail in the operation flow chart of FIG. 89. In this flow chart, the same processing operations as in FIG. 87 are executed in steps denoted by the same reference numerals as in FIG. 87. A difference between FIGS. 87 and 89 is an output portion in steps $S_{2601}$ to $S_{2604}$. In the case of algorithms 1 and 2, the content of the output $O_1$ of the operator 1 processing is directly stored in the buffer BF or BT ($S_{2601}$ and $S_{2602}$). In the case of the algorithm 3, a value as a sum of the outputs $O_1$ and $O_3$ is stored in the buffer or BT ($S_{2603}$). Furthermore, in the case of the algorithm 4, a value as a sum of the output $O_1$ and the outputs O2, O3, and O4 is stored in the buffer BF or BT ($S_{2604}$).

As described above, since the operator processing and the algorithm processing are alternately executed at every other interrupt timing, a processing load per interrupt timing of the sound source processing program can be remarkably decreased. In this case, since an interrupt period need not be prolonged, the processing load can be reduced without increasing an interrupt time of the main operation flow chart shown in FIG. 62, i.e., without influencing the program operation. Therefore, a keyboard key sampling interval executed in FIG. 62 will not be prolonged, and the response performance of an electronic musical instrument will not be impaired.

The operations for generating musical tone data in units of tone generation channels by the software sound source processing operations based on various sound source methods have been described.

Function Key Processing

The operation of the function key processing ($S_{403}$) in the main operation flow chart shown in FIG. 62 when an actual electronic musical instrument is played will be described in detail below.

In the above-mentioned sound source processing executed for each tone generation channel, parameters corresponding to sound source methods are set in the formats shown in FIG. 74 in the corresponding tone generation channel area (FIG. 72) on the RAM 2062 or 3062 (FIGS. 60 and 61) by one of the function keys 8012 (FIG. 70) connected to the operation panel of the electronic musical instrument via the input port 2102 (FIG. 60) of the MCPU 1012.

Figure 90:
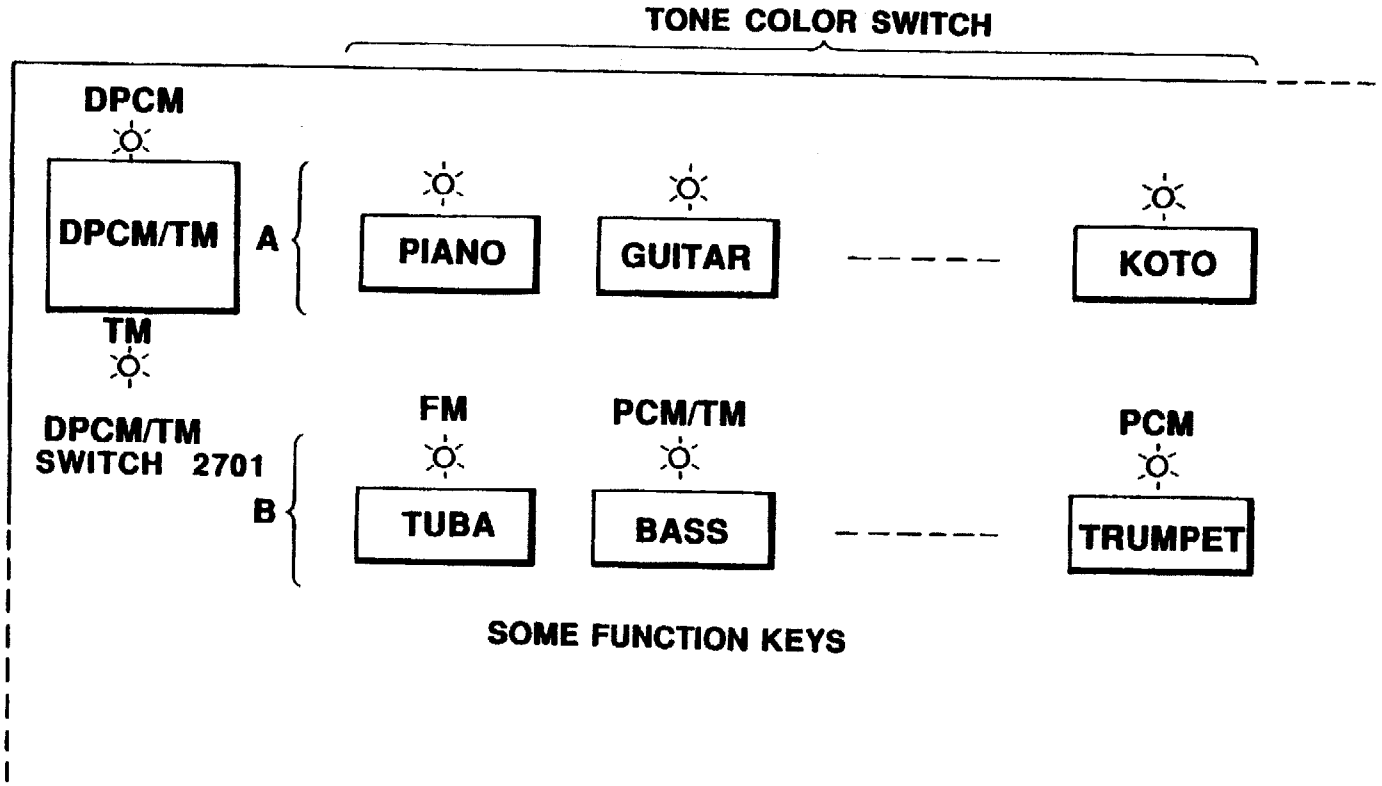
FIG. 90 shows an arrangement of some function keys.

FIG. 90 shows an arrangement of some function keys 8012 shown in FIG. 70. In FIG. 90, some function keys 8012 are realized as tone color switches. When one of switches "piano", "guitar", . . . , "koto" in a group A is depressed, a tone color of the corresponding instrument tone is selected, and a guide lamp is turned on. Whether the tone color of the selected instrument tone is generated in the DPCM method or the TM method is selected by a DPCM/TM switch 27012.

On the other hand, when a switch "tuba" in a group B is depressed, a tone color based on the FM method is designated; when a switch "bass" is depressed, a tone color on both the PCM and TM methods is designated; and when a switch "trumpet" is depressed, a tone color based on the PCM method is designated. Then, a musical tone based on the designated sound source method is generated.

Figure 91:
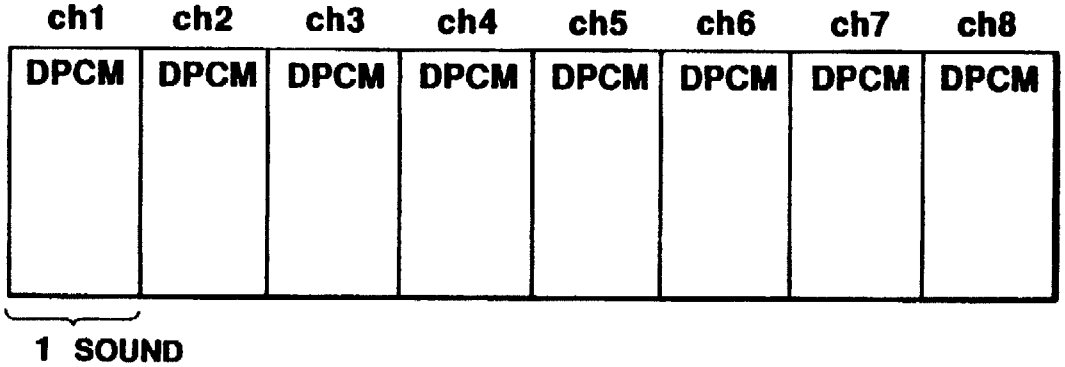
FIGS. 91 and 92 show examples of assignments of sound source methods to tone generation channels.
Figure 92:
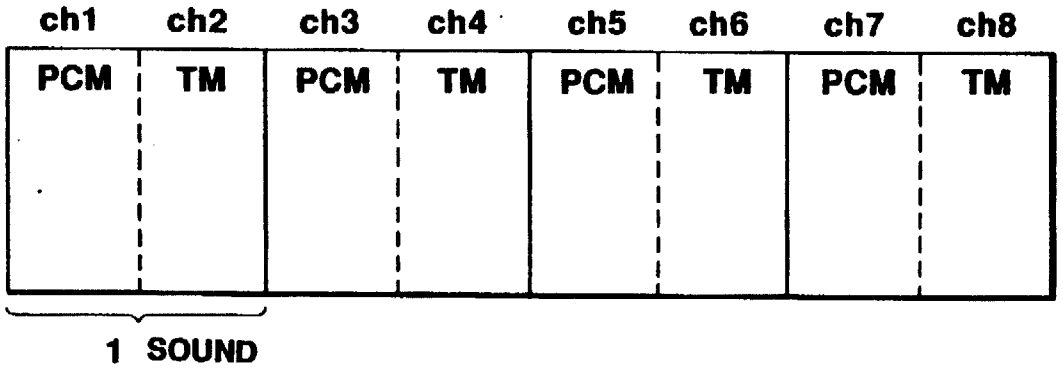

FIGS. 91 and 92 show of sound source methods to the respective tone generation channel region (FIG. 72) on the RAM 2062 or 3062 when the switches "piano" and "bass" are depressed. When the switch "piano" is depressed, the DPCM method is assigned to all the 8-tone polyphonic tone generation channels of the MCPU 1012 and the SCPU 1022, as shown in FIG. 91. When the switch "bass" is depressed, the PCM method is assigned to the odd-numbered tone generation channels, and the TM method is assigned to the even-numbered tone generation channels, as shown in FIG. 92. Thus, a musical tone waveform for one musical tone can be obtained by mixing tone waveforms generated in the two tone generation channels based on the PCM and TM methods. In this case, a 4-tone polyphonic system per CPU is attained, and an 8-tone polyphonic system as a total of two CPUs is attained.

Figure 93:
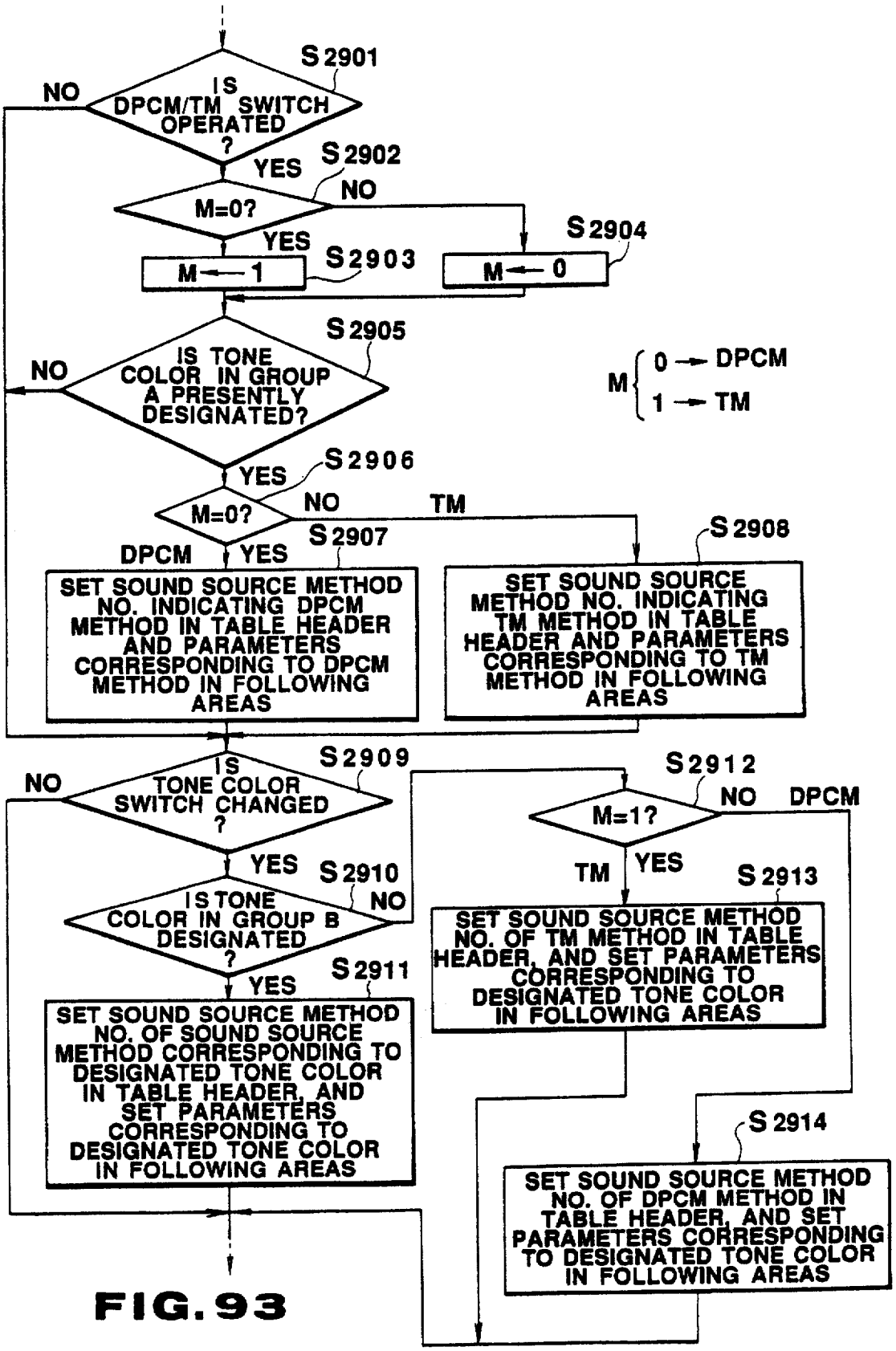
FIG. 93 is an operation flow chart of function key processing.

FIG. 93 is a partial operation flow chart of the function key processing in step $S_{403}$ in the main operation flow chart shown in FIG. 62, and shows processing corresponding to the tone color designation switch group shown in FIG. 90.

It is checked if a player operates the DPCM/TM switch 27012 ($S_{2901}$). If YES in step $S_{2901}$, it is checked if a variable M is zero ($S_{2902}$). The variable M stored on the RAM 2062 (FIG. 60) of the MCPU 1012, and has a value "0" for the DPCM method; a value "1" for the TM method. If YES in step $S_{2902}$, i.e., if it is determined that the value of the variable M is 0, the variable M is set to be a value "1" ($S_{2903}$). This means that the DPCM/TM switch 27012 is depressed in the DPCM method selection state, and the selection state is changed to the TM method selection state. However, if NO in step $S_{2902}$, i.e., if it is determined that the value of the variable M is "1", the variable M is set to be a value "0" ($S_{2904}$). This means that the DPCM/TM switch 27012 is depressed in the TM method selection state, and the selection state is changed to the DPCM method selection state.

It is checked if a tone color in the group A shown in FIG. 90 is currently designated ($S_{2905}$). Since the DPCM/TM switch 27012 is valid for tone colors of only group A, only when a tone color in the group A is designated, and YES is determined in step $S_{2905}$, operations corresponding to the DPCM/TM switch 27012 in steps $S_{2906}$ to $S_{2908}$ are executed.

It is checked if the variable M is "0" ($S_{2906}$).

YES in step $S_{2906}$, since the DPCM method is selected by the DPCM/TM switch 27012, DPCM data are set in the DPCM format shown in FIG. 74 in the corresponding tone generation channel areas on the RAMs 2062 and 3062 (FIGS. 60 and 61). More specifically, sound source method No. data G indicating the DPCM method is set in the start area of the corresponding tone generation channel area (see the column of DPCM in FIG. 74). Subsequently, various parameters corresponding to currently designated tone colors are respectively set in the second and subsequent areas of the corresponding tone generation channel area ($S_{2907}$).

If NO in step S2906, since the TM method is selected by the DPCM/TM switch 27012, TM data are set in the TM format shown in FIG. 74 in the corresponding generation channel areas. More specifically, sound source method No. data G indicating the TM method is set in the start area of the corresponding tone generation channel area. Subsequently, various parameters corresponding to currently designated tone colors are respectively set in the second and subsequent areas of the corresponding tone generation channel area ($S_{2908}$).

A case has been exemplified wherein the DPCM/TM switch 27012 shown in FIG. 90 is operated. If the switch 27012 is not operated and NO is determined in step $S_{2901}$, or if tone color of the group A is not designated and NO is determined in step $S_{2905}$, processing from step $S_{2909}$ is executed.

It is checked in step $S_{2909}$ if a change in tone color switch shown in FIG. 90 is detected.

If NO in step $S_{2909}$, since processing for the tone color switches need not be executed, the function key processing ($S_{403}$ in FIG. 62) is ended.

If it is determined that a change in tone color switch is detected, and YES is determined in step $S_{2909}$, it is checked if a tone color in the group B is designated ($S_{2910}$).

If a tone color in the group B is designated, and YES is determined in step $S_{2910}$, data for the sound source method corresponding to the designated tone color are set in the predetermined format in the corresponding tone generation channel areas on the RAMs 2062 and 3062 (FIGS. 60 and 61). More specifically, sound source method No. data G indicating the sound source method is set in the start area of the corresponding tone generation channel area (FIG. 74). Subsequently, various parameters corresponding to the currently designated tone color are respectively set in the second and subsequent areas of the corresponding tone generation channel area ($S_{2911}$). For example, when the switch "bass" in FIG. 90 is selected, data corresponding to the PCM method are set in the odd-numbered tone generation channel areas, and data corresponding to the TM method are set in the even-numbered tone generation channel areas.

If it is determined that the tone color switch in the group A is designated, and NO is determined in step $S_{2910}$, it is checked if the variable M is "1" ($S_{2912}$). If the TM method is currently selected, and YES is determined in step $S_{2912}$, data are set in the TM format (FIG. 74) in the corresponding tone generation channel area ($S_{2913}$) like in step $S_{2908}$ described above.

If the DPCM method is selected, and NO is determined in step $S_{2912}$, data are set in the DPCM format (FIG. 74) in the corresponding tone generation channel area ($S_{2914}$) like in step $S_{2907}$ described above.

Embodiment A of ON Event Keyboard Key Processing

The operation of the keyboard key processing ($S_{405}$) in the main operation flow chart shown in FIG. 62 executed when an actual electronic musical instrument is played will be described below.

The first embodiment of ON event keyboard key processing will be described below.

In this embodiment, when a tone color in the group A shown in FIG. 90 is designated, the sound source method to be set in the corresponding tone generation channel area of the RAM 2062 or 3062 (FIGS. 60 and 61) is automatically switched in accordance with an ON key position, i.e., a tone range of a musical tone. This embodiment has a boundary between key code numbers 31 and 32 on the keyboard shown in FIG. 71. That is, when a key code of an ON key falls within a bass tone range equal to or lower than the 31st key code, the DPCM method is assigned to the corresponding tone generation channel. On the other hand, when a key code of an ON key falls within a high tone range equal to or higher than the 32nd key code, the TM method is assigned to the corresponding tone generation channel. When a tone color in the group B in FIG. 90 is designated, no special keyboard key processing is executed.

Figure 94:
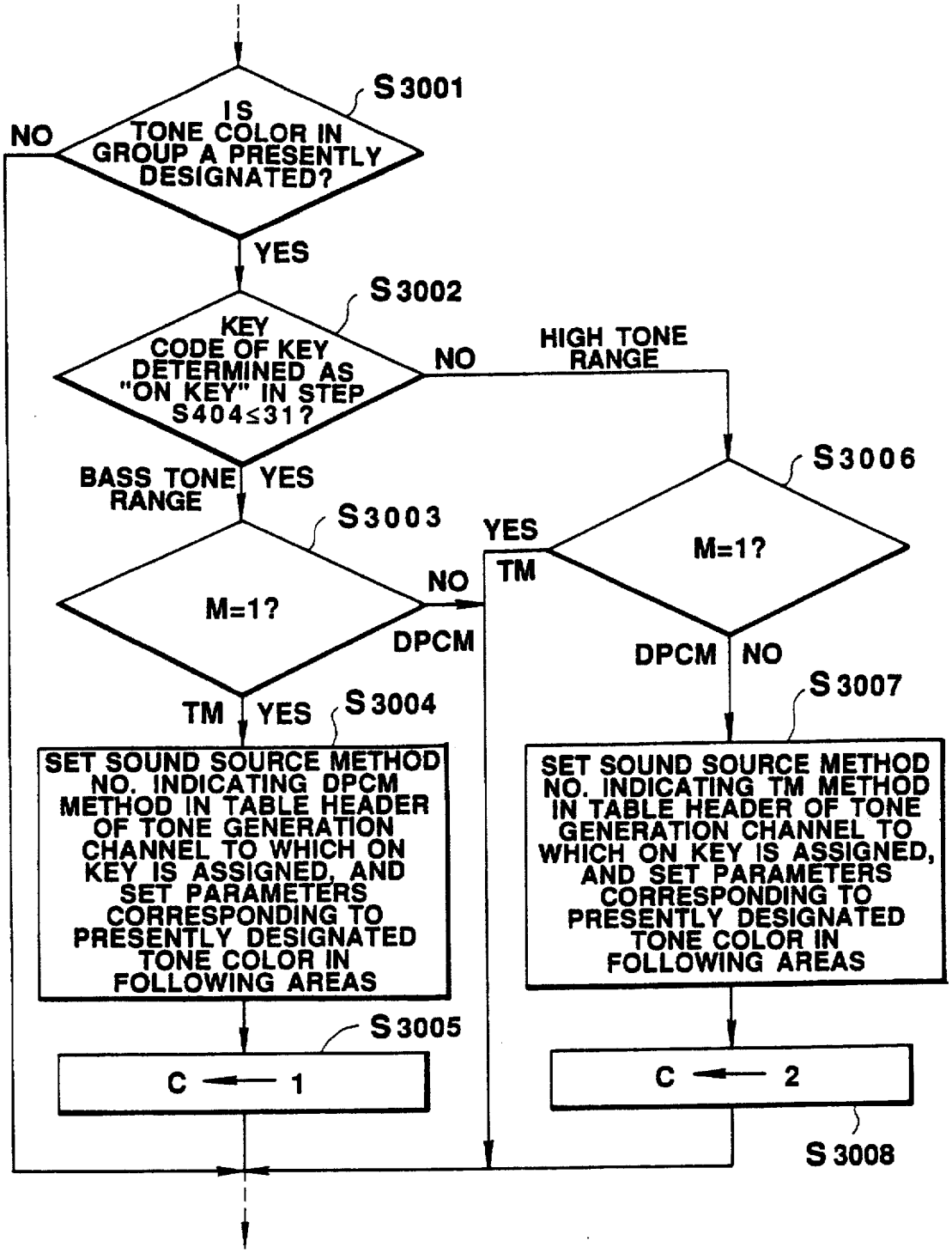
FIG. 94 is en operation flow chart of an embodiment A of ON event keyboard key processing.

FIG. 94 is a partial operation flow chart of the keyboard key processing in step $S_{405}$ in the main operation flow chart of FIG. 62.

It is checked if a tone color in the group A is currently designated ($S_{3001}$).

If NO in step $S_{3001}$, and a tone color in the group B is currently designated, special processing in FIG. 94 is not performed.

If YES in step $S_{3001}$, and a tone color in the group A is currently designated, it is checked if a key code of a key which is detected as an "ON key" in the keyboard key scanning processing in step $S_{404}$ in the main operation flow chart shown in FIG. 62 is equal to or lower than the 31st key code ($S_{3002}$).

If a key in the bass tone range equal to or lower than the 31st key code is depressed, and YES is determined in step $S_{3002}$, it is checked if the variable M is "1" ($S_{3003}$). The variable M is set in the operation flow chart shown in FIG. 93 as a part of the function key processing in step $S_{403}$ in the main operation flow chart shown in FIG. 62, and is "0" for the DPCM method; "1" for the TM method, as described above.

If YES (M="1") in step $S_{3003}$, i.e., if it is determined that the TM method is currently designated as the sound source method, DPCM data in FIG. 74 are set in a tone generation channel area of the RAM 2062 or 3062 (FIGS. 60 and 61) where the ON key is assigned so as to change the TM method to the DPCM method as a sound source method for the bass tone range (see the column of DPCM in FIG. 74). More specifically, sound source method No. data G indicating the DPCM method is set in the start area of the corresponding tone generation channel area. Subsequently, various parameters corresponding to the currently designated tone color are respectively set in the second and subsequent areas of the corresponding tone generation channel area ($S_{3004}$). Thereafter, a value "1" is set in a flag C ($S_{3005}$). The flag C is a variable (FIG. 74) stored in each tone generation channel area on the RAM 2062 (FIG. 60) of the MCPU 1012, and is used in OFF event processing to be described later with reference to FIG. 96.

If it is determined that a key in the high tone range equal to or higher than the 31st key code is depressed, and NO is determined in step $S_{3002}$, it is checked if the variable M is "1" ($S_{3006}$).

If NO (M="0") in step $S_{3006}$, i.e., if it is determined that the DPCM method is currently designated as the sound source method, TM data in FIG. 74 are set in a tone generation channel area of the RAM 2062 or 3062 (FIGS. 60 and 61) where the ON key is assigned so as to change the DPCM method to the TM method as a sound source method for the high tone range (see the column of TM in FIG. 74). More specifically, sound source method No. data G indicating the TM method is set in the start area of the corresponding tone generation channel area. Subsequently, various parameters corresponding to the currently designated tone color are respectively set in the second and subsequent areas of the corresponding tone generation channel area ($S_{3007}$). Thereafter, a value "2" is set in a flag C ($S_{3008}$).

In the above-mentioned processing, if NO in step S3003 and if YES in step $S_{3006}$, since the desired sound source method is originally selected, no special is executed.

Embodiment B of ON Event Keyboard Key Processing

The second embodiment of the ON event keyboard key processing will be described below.

In the embodiment B of the ON event keyboard key processing, when a tone color in the group A in FIG. 90 is designated, a sound source method to be set in the corresponding tone generation channel area (FIG. 72) on the RAM 2062 or 2062 (FIGS. 60 and 61) of the MCPU 1012 or the SCPU 1022 is automatically switched in accordance with an ON key speed, i.e., a velocity. In this case, a switching boundary is set at a velocity value "64" half the maximum value "127" of the MIDI (Musical Instrument Digital Interface) standards. That is, when the velocity value of an ON key is equal to or larger than 64, the DPCM method is assigned; when the velocity of an ON key is equal to or smaller than 64, the TM method is assigned. When a tone color in the group B in FIG. 90 is designated, no special keyboard key processing is executed.

Figure 95:
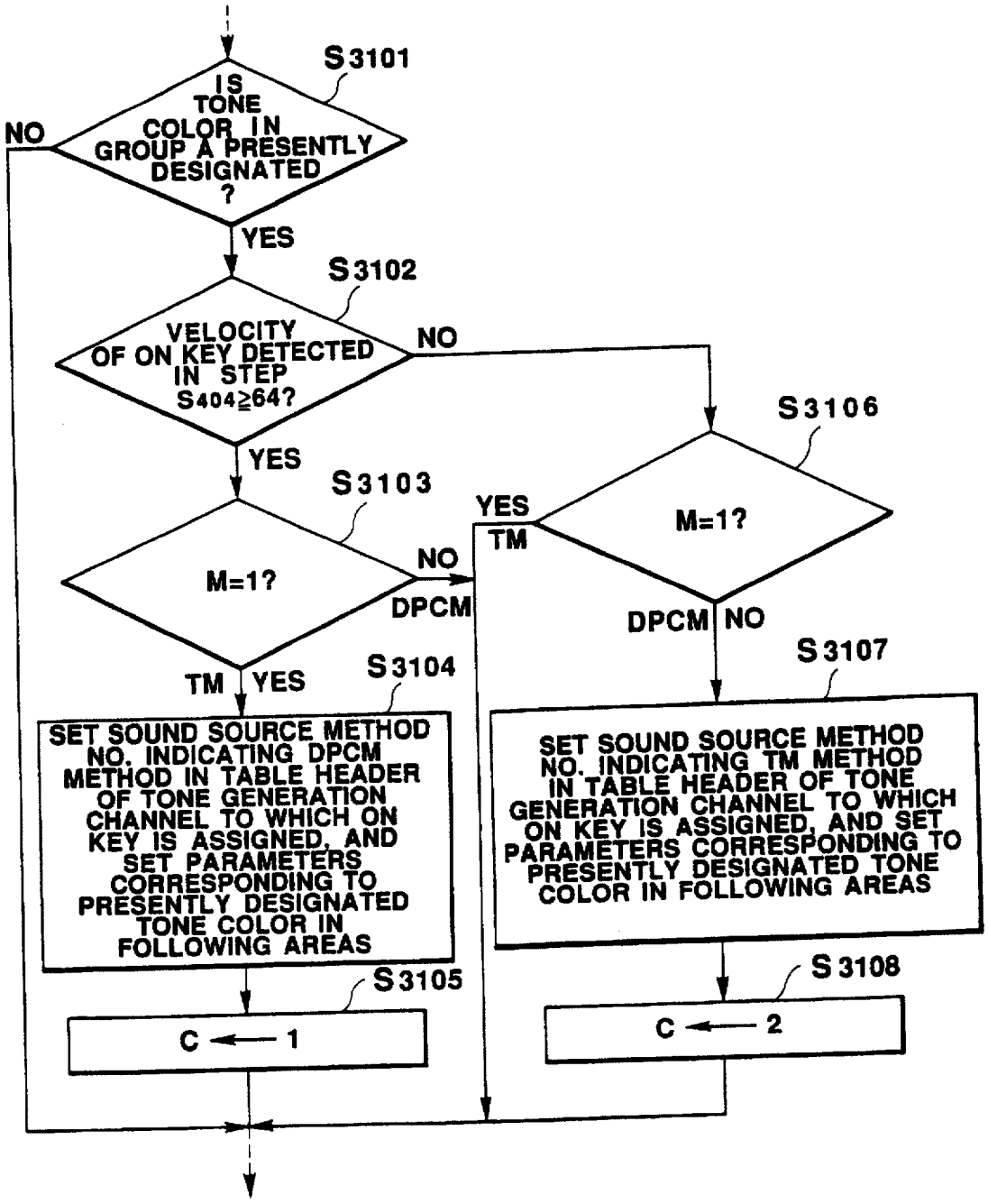
FIG. 95 is an operation flow chart of an second embodiment B of ON event keyboard key processing.

FIG. 95 is a partial operation flow chart of the keyboard key processing in step $S_{405}$ in the main operation flow chart shown in FIG. 62.

It is checked if a tone color in the group A in FIG. 90 is currently designated ($S_{3101}$).

If NO in step S3101, and a tone color in the group B is presently selected, the special processing in FIG. 94 is not executed.

If YES in step $S_{3101}$, and a tone color in the group A is presently selected, it is checked if the velocity of a key which is detected as an "ON key" in the keyboard key scanning processing in step $S_{404}$ in the main operation flow Chart Shown in FIG. 62 is equal to or larger than 64 ($S_{3102}$). Note that the velocity value "64" corresponds to "mp (mezzo piano)" of the MIDI standards.

If it is determined that the velocity value is equal to or larger than 64, and YES is determined in step $S_{3102}$, it is checked if the variable M is "1" ($S_{3102}$). The variable M is set in the operation flow chart shown in FIG. 93 as a part of the function key processing in step $S_{403}$ in the main operation flow chart shown in FIG. 62, and is "0" for the DPCM method; "1" for the TM method, as described above.

If YES (M="1") in step $S_{3103}$, and the TM method is currently designated as the sound source method, DPCM data in FIG. 74 are set in a tone generation channel area of the RAM 2062 or 3062 (FIGS. 60 and 61) where the ON key is assigned so as to change the TM method to the DPCM method as a sound source method for a fast ON key operation ($S_{3104}$), and a value "1" is set in the flag C ($S_{3105}$).

If it is determined that the velocity value is smaller than 64 and NO is determined in step $S_{3102}$, it is further checked if the variable M is "1" ($S_{3106}$).

NO (M="0") in step S3106, and the DPCM method is currently designated as the sound source method, TM data in FIG. 74 are set in a tone generation channel area of the RAM 2062 or 3062 where the ON key is assigned so as to change the DPCM method to the TM method as a sound source method for a slow ON key operation ($S_{3107}$). Thereafter, a value "2" is set in the flag C ($S_{3108}$).

In the above-mentioned processing, if NO in step $S_{3103}$ and if YES in step $S_{3106}$, since the desired sound source method is originally selected, no special processing is executed.

Embodiment of OFF Event Keyboard Key Processing

The embodiment of the OFF event keyboard key processing will be described below.

According to the above-mentioned ON event keyboard key processing, the sound source method is automatically set in accordance with a key range (tone range) or a velocity. Upon an OFF event, the set sound source method must be restored. The embodiment of the OFF event keyboard key processing to be described below can realize this processing.

Figure 96:
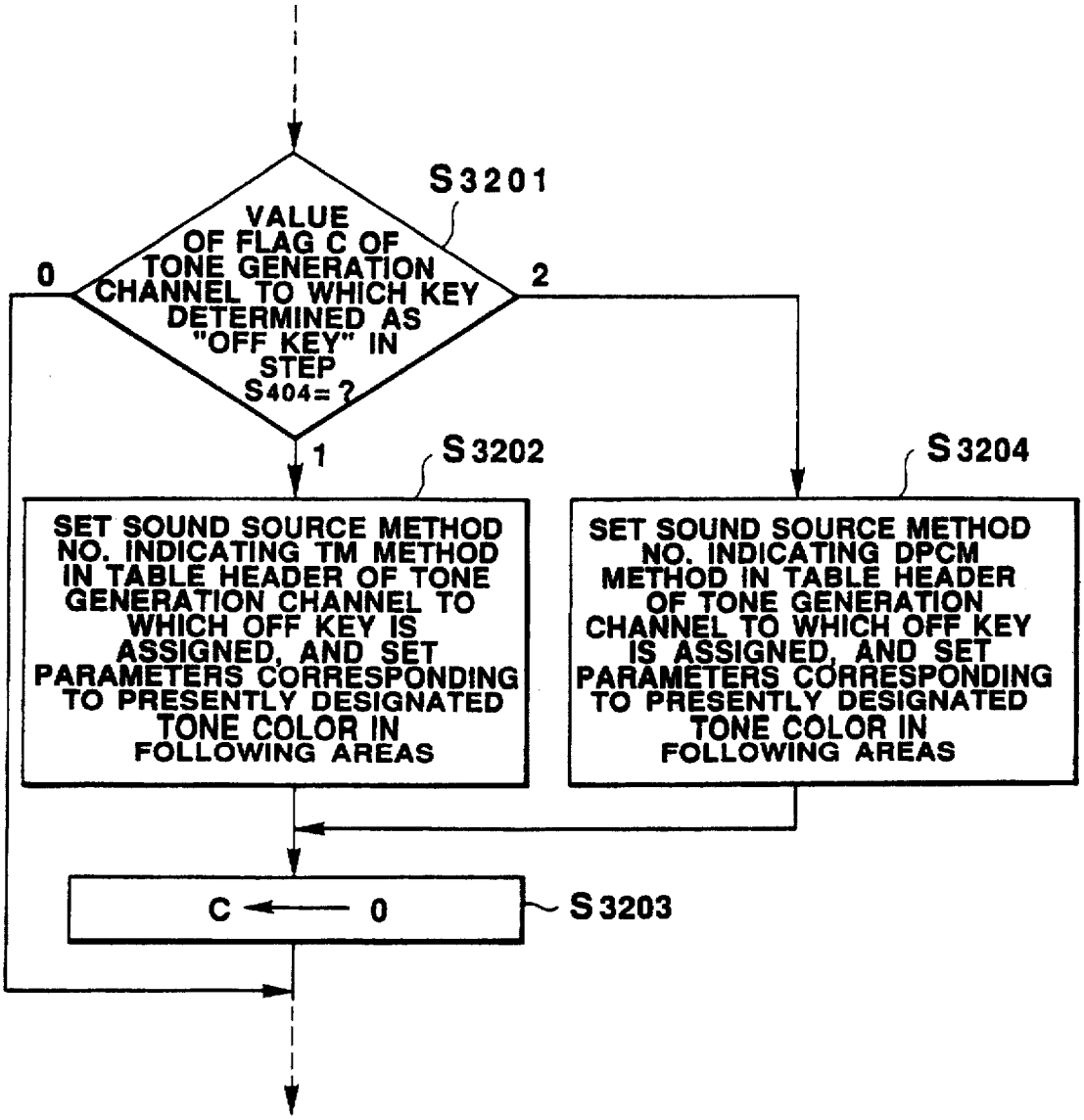
FIG. 96 is an operation flow chart of an embodiment of OFF event keyboard key processing.

FIG. 96 is a partial operation flow chart of the keyboard key processing in step $S_{405}$ in the main operation flow chart shown in FIG. 62.

The value of the flag C set in the tone generation channel area on the RAM 2062 or 3062 (FIGS. 60 and 61), where the key determined as an "OFF key" in the keyboard key scanning processing in step $S_{404}$ in the main operation flow chart of FIG. 62 is assigned, is checked. The flag C is set in steps $S_{3005}$ and $S_{3008}$ in FIG. 94, or in step $S_{3105}$ or $S_{3108}$ in FIG. 95, has an initial value "0", is set to be "1" when the sound source method is changed from the TM method to the DPCM method upon an ON event, and is set to be "2" when the sound source method is changed from the DPCM method to the TM method. When the sound source method is left unchanged upon an ON event, the flag C is left at the initial value "0".

If it is determined in step $S_{3201}$ in the OFF event processing in FIG. 96 that the value of the flag C is "0", since the sound source method is left unchanged in accordance with a key range or a velocity, no special processing is executed, and normal OFF event processing is performed.

If it is determined in step $S_{3201}$ that the value of the flat C is "1", the sound source method is changed from the TM method to the DPCM method upon an ON event. Thus, TM data in FIG. 74 is set in the tone generation channel area on the RAM 2062 or 3062 (FIG. 60 or 61) where the ON key is assigned to restore the sound source method to the TM method. More specifically, sound source No. data G indicating the TM method is set in the start area of the corresponding tone generation channel area. Subsequently, various parameters corresponding to the presently designated tone color are respectively set in the second and subsequent areas of the corresponding tone generation channel area ($S_{3202}$).

If it is determined in step $S_{3201}$ that the value of the flat C is "2", the sound source method is changed from the DPCM method to the TM method. Thus, DPCM data in FIG. 74 is set in the tone generation channel area on the RAM 2062 or 3062 where the ON key is assigned to restore the sound source method from the TM method to the DPCM method. More specifically, sound source method No. data G indicating the DPCM method is set in the start area of the corresponding tone generation channel area. Subsequently, various parameters corresponding the presently designated tone color are respectively set in the second and subsequent areas of the corresponding tone generation channel area ($S_{3203}$).

After the above-mentioned operation, the value of the flat C is reset to "0", and the processing in FIG. 96 is completed. Subsequently, normal OFF event processing (not shown) is executed.

Other Embodiments

In the above embodiments of the present invention described above, as shown in FIG. 59, the two CPUs, i.e., the MCPU 1012 and the SCPU 1022 share processing of different tone generation channels. However, the number of CPUs may be one or three or more.

If the control ROMs 2012 and 3012 shown in FIGS. 60 and 61, and the external memory 1162 are constituted by, e.g., ROM cards, various sound source methods can be presented to a user by means of the ROM cards.

Furthermore, the input port 2102 of the MCPU 1012 shown in FIG. 60 can be connected to various other operation units in addition to the instrument operation unit shown in FIG. 70. Thus, various other electronic musical instruments can be realized. In addition, the present invention may be realized as a sound source module for executing only the sound source processing while receiving performance data from another electronic musical instrument.

Various methods of assigning sound source methods to tone generation channels by the function keys 8012 or the keyboard keys 8022 in FIG. 70 including those based on tone colors, tone ranges, and velocities, may be proposed.

In addition to the FM and TM methods, the present invention may be applied to various other modulation methods.

In the modulation method, the above embodiment exemplifies a 4-operator system. However, the number of operators is not limited to this.

In this manner, according to the present invention, a musical tone waveform generation apparatus can be constituted by versatile processors without requiring a special-purpose sound source circuit at all. For this reason, the circuit scale of the overall musical tone waveform generation apparatus can be reduced, and the apparatus can be manufactured in the same manufacturing technique as a conventional microprocessor when the apparatus is constituted by an LSI, thus improving the yield of chips. Therefore, manufacturing cost can be greatly reduced. Note that a musical tone signal output unit can be constituted by a simple latch circuit, resulting in almost no increase in manufacturing cost after the output unit is added.

When the modulation method is required to be changed between a phase modulation method and a frequency modulation method, or when the number of polyphonic channels is required to be changed, a sound source processing program to be stored in a program storage means need only be changed to meet the above requirements. Therefore, development cost of a new musical tone waveform generation apparatus can be greatly decreased, and a new sound source method can be presented to a user by means of, e.g., a ROM card.

In this case, since a data architecture for attaining a data link between a performance data processing program and a sound source processing program via musical tone generation data on a data storage means, and program architecture for executing the sound source processing program at predetermined time intervals while interrupting the performance data processing program are realized, two processors need not be synchronized, and the programs can be greatly simplified. Thus, complicated sound source processing such as the modulation method can be executed with a sufficient margin.

Furthermore, since a change in processing time depending on the type of modulation method or a selected musical tone generation algorithm in the modulation method can be absorbed by a musical tone signal output means, no complicated timing control program for outputting a musical tone signal to, e.g., a D/A converter can be omitted.

Furthermore, the present invention has, as an architecture of the sound source processing program, a processing architecture for simultaneously executing algorithm processing operations as I/O processing among operator processing operations before or after simultaneous execution of at least one operator processing as a modulation processing unit. For this reason, when one of a plurality of algorithms is selected to execute sound source processing, a plurality of types of algorithm processing portions are prepared, and need only be switched as needed. Therefore, the sound source processing program can be rendered very compact. The small program size can greatly contribute to a compact, low-cost musical tone waveform generation apparatus.

Additional advantages and modifications will readily occur to those skilled in the art. Therefore, the invention in its broader aspects is not limited to the specific details, and representative devices, shown and described herein. Accordingly, various modifications may be without departing from the spirit or scope of the general inventive concept as defined by the appended claims and their equivalents.

What is claimed is:

1. A musical tone signal outputting apparatus comprising:

a microcomputer for generating a digital musical tone signal under a program control, said microcomputer comprising:

time signal generating means for outputting an accurate sampling time signal with a predetermined sampling period;

computing means for computing a digital musical tone signal at timings which may vary with reference to said sampling time signal;

first latch means for latching the digital musical tone signal computed by said computing means at an ending timing of computation of the digital musical tone signal, which ending timing may vary with reference to said sampling time signal; and second latch means, provided between an output of said first latch means and an input of a digital-to-analog converting means, for latching an output signal of said first latch means at a timing of the sampling time signal to thereby produce, at an output of said second latch means, an accurately timed digital musical tone signal.

2. An apparatus according to claim 1, wherein said microcomputer is formed on an integrated circuit chip and wherein said integrated circuit chip comprises a digital-to-analog converter for converting said digital musical tone signals into analog signals, and a port for receiving an input to control said tone signal outputting apparatus.

3. An electronic musical instrument for digitally producing musical tone signals, comprising:

a microcomputer for generating a digital musical tone signal under a program control, said microcomputer comprising:

time signal generating means for outputting an accurate sampling time signal with a predetermined sampling period;

computing means for computing a digital musical tone signal at timings which may vary with reference to said sampling time signal;

first latch means for latching the digital musical tone signal computed by said computing means at an ending timing of computation of the digital musical tone signal which ending timing may vary with reference to said sampling time signal; and second latch means, provided between an output of said first latch means and an input of a digital-to-analog converting means, for latching an output signal of said first latch means at a timing of the sampling time signal to thereby produce, at an output of said second latch means, an accurately timed digital musical tone signal.

4. The electronic musical instrument according to claim 3, wherein said microcomputer is formed on an integrated circuit chip and wherein said integrated circuit chip comprises a digital-to-analog converter for converting said digital musical tone signals into analog signals, and a port for receiving an input to control said tone signal outputting apparatus.

5. A musical tone signal outputting apparatus to be used with several peripheral units, comprising:

a microcomputer for controlling operations of the peripheral units, and for generating a digital musical tone signal under a program control, said microcomputer comprising:

time signal generating means for outputting an accurate sampling time signal with a predetermined sampling period;

computing means for computing a digital musical tone signal at timings which may vary with reference to said sampling time signal;

first latch means for latching the digital musical tone signal computed by said computing means at an ending timing of computation of the digital musical tone signal, which ending timing may vary with reference to said sampling time signal; and second latch means, provided between an output of said first latch means and an input of a digital-to-analog converting means, for latching an output signal of said first latch means at a timing of the sampling time signal to thereby produce, at an output of said second latch means, an accurately timed digital musical tone signal.

6. An electronic musical instrument having a keyboard, for digitally producing musical tone signals, the electronic musical instrument comprising:

a microcomputer for controlling operations of the keyboard, and for generating a musical tone signal under a program control, said microcomputer comprising:

time signal generating means for outputting an accurate sampling time signal with a predetermined sampling period;

computing means for computing a digital musical tone signal at timings which may vary with reference to said sampling time signal;

first latch means for latching the digital musical tone signal computed by said computing means at an ending timing of computation of the digital musical tone signal, which ending timing may vary with reference to said sampling time signal; and second latch means, provided between an output of said first latch means and an input of a digital-to-analog converting means, for latching an output signal of said first latch means at a timing of the sampling time signal to thereby produce, at an output of said second latch means, an accurately timed digital musical tone signal.

7. A musical tone signal outputting apparatus comprising:

a microcomputer for generating a digital musical tone signal under a program control, said microcomputer comprising:

time signal generating means for outputting an accurate sampling time signal with a predetermined sampling period;

computing means for computing a digital musical tone signal at timings which may vary with reference to said sampling time signal;

first latch means for latching the digital musical tone signal computed by said computing means at an ending timing of computation of the digital musical tone signal, which ending timing may vary with reference to said sampling time signal; and second latch means, coupled to said first latch means, for latching an output signal of said first latch means at a timing of the sampling time signal to thereby produce, at an output of said second latch means, an accurately timed digital musical tone signal.

8. A musical tone waveform generation apparatus, comprising:

storage means for storing a plurality of sound source processing programs corresponding to a plurality of types of sound source methods;

a microcomputer for generating musical tone signals in arbitrary sound source methods in tone generation channels by executing the plurality of sound source programs stored in said storage means; and musical tone signal output means for outputting the musical tone signals generated by said microcomputer at predetermined constant output time intervals, said musical tone signal output means comprising:

timing signal generating means for generating a timing signal for each predetermined sampling period;

first latch means for latching a digital musical tone signal generated by said microcomputer at an outputting timing of the digital musical tone signal from said microcomputer; and second latch means for outputting the digital musical tone signal by latching an output signal of said first latch means when the timing signal is generated from said timing signal generating means.

9. An apparatus according to claim 8, further comprising tone color designation means for designating a tone color of a musical tone signal to be generated by said microcomputer, and wherein said microcomputer generates a musical tone signal having the tone color designated by a said sound source method according to the tone color designated by said tone color designation means in units of tone generation channels.

10. An apparatus according to claim 8, further comprising designation means for designating a sound source method in units of tone generation channels in said microcomputer, and wherein said microcomputer generates a musical tone signal by the sound source method designated by said designation means in units of tone generation channels.

11. An apparatus according to claim 8, further comprising pitch designation means for designating a pitch of a musical tone signal to be generated by said microcomputer, and wherein said microcomputer generates a musical tone signal at a pitch designated by said designation means by a said sound source method according to the designated pitch in units of tone generation channels.

12. An apparatus according to claim 8, further comprising a performance operation member for instructing said microcomputer to generate a musical tone signal, and wherein said microcomputer generates a musical tone signal by a said sound source method according to an operation speed of said performance operation member in units of tone generation channels.

13. An apparatus according to claim 8, further comprising output means for outputting performance data of a plurality of parts constituting a music piece, and wherein said microcomputer generates a musical tone signal by said sound source method in accordance with a part to which the performance data output from said output means belongs.

14. A musical tone waveform generation apparatus, comprising:

a plurality of musical tone waveform generation means, each comprising storage means for storing a plurality of sound source processing programs corresponding to a plurality of sound source methods, and a microcomputer for generating musical tone signals in arbitrary sound source methods in units of tone generation channels by executing at least one of the plurality of sound source programs stored in said storage means;

control means for controlling said plurality of musical tone waveform generation means to be operated substantially in parallel;

accumulation means for accumulating musical tone signals generated by said plurality of musical tone waveform generation means; and musical tone signal output means for outputting an accumulation result from said accumulation means at predetermined constant output time intervals, said musical tone signal output means comprising:

timing signal generating means for generating a timing signal for each predetermined sampling period;

first latch means for latching a digital musical tone signal generated by said accumulation means at an outputting timing of the digital musical tone signal from said accumulation means; and second latch means for outputting the digital musical tone signal by latching an output signal of said first latch means when the timing signal is generated from said timing signal generating means.

15. A musical tone waveform generation apparatus comprising:

storage means for storing a sound source processing program;

a microcomputer for executing the sound source processing program stored in said storage means to generate a musical tone signal;

output means for outputting performance data of a plurality of parts constituting a music piece;

tone color determination means for determining a tone color of the musical tone signal to be generated by said microcomputer in accordance with one of the plurality of parts to which the performance data output from said output means belongs;

control means for controlling said microcomputer to generate the musical tone signal having the tone color determined by said tone color determination means; and musical tone signal output means for outputting the musical tone signal generated by said microcomputer at predetermined constant output time intervals, said musical tone signal output means comprising:

timing signal generating means for generating a timing signal for each predetermined sampling period;

first latch means for latching a digital musical tone signal generated by said microcomputer at an outputting timing of the digital musical tone signal from said microcomputer; and second latch means for outputting the digital musical tone signal by latching an output signal of said first latch means when the timing signal is generated from said timing signal generating means.

16. A musical tone waveform generation apparatus comprising:

storage means for storing a sound source processing program based on a predetermined modulation method;

a microcomputer for generating a musical tone signal on the basis of a process of the modulation method by executing the sound source processing program stored in said storage means; and musical tone signal output means for outputting the musical tone signal generated by said microcomputer at predetermined constant output time intervals, said musical tone signal output means comprising:

timing signal generating means for generating a timing signal for each predetermined sampling period;

first latch means for latching a digital musical tone signal generated by said microcomputer at an outputting timing of the digital musical tone signal from said microcomputer; and second latch means for outputting the digital musical tone signal by latching an output signal of said first latch means when the timing signal is generated from said timing signal generating means.

17. An apparatus according to claim 16, wherein the modulation method is a method of receiving a mixed signal obtained by mixing a carrier signal and a modulation signal as an input and outputting a modulated musical tone signal as an output.

18. An apparatus according to claim 17, wherein a functional relationship between the input and the output is expressed by neither of sine and cosine function relationships, and the carrier signal is a signal for making the output to be a sine or cosine wave at a single frequency when the carrier signal is directly used as the input.

19. An apparatus according to claim 17, wherein a functional relationship between the input and the output is expressed by a sine function, and the carrier signal is defined by a sine wave.

20. A musical tone waveform generation apparatus comprising:

storage means for storing a sound source processing program associated with a modulation method, having an operator processing program for executing operator processings, and an algorithm processing program for executing algorithm processing for determining an input/output relationship among operator processings;

a microcomputer for generating a musical tone signal by executing the operator processings based on the operator processing program at a time, and executing the algorithm processing at a time based on the algorithm processing program independently of the operator processing program; and musical tone signal output means for outputting the musical tone signal generated by said microcomputer at predetermined constant output time intervals, said musical tone signal output means comprising:

timing signal generating means for generating a timing signal for each predetermined sampling period;

first latch means for latching a digital musical tone signal generated by said microcomputer at an outputting timing of the digital musical tone signal from said microcomputer; and second latch means for outputting the digital musical tone signal by latching an output signal of said first latch means when the timing signal is generated from said timing signal generating means.

21. An apparatus according to claim 20, wherein the modulation method is a method of receiving a mixed signal obtained by mixing a carrier signal and a modulation signal as an input and outputting a modulated musical tone signal as an output.

22. An apparatus according to claim 21, wherein a functional relationship between the input and the output is expressed by neither of sine and cosine function relationships, and the carrier signal is a signal for making the output to be a sine or cosine wave at a single frequency when the carrier signal is directly used as the input.

23. An apparatus according to claim 21, wherein a functional relationship between the input and the output is expressed by a sine function, and the carrier signal is defined by a sine wave.

24. A sound signal outputting apparatus comprising a microcomputer for generating a digital sound signal under a program control, said microcomputer comprising:

a timing signal generator for outputting an accurate sampling time signal with a predetermined sampling period;

a computing device for computing a digital sound signal under a program control at timings which may vary with reference to said sampling time signal, to generate a digital sound signal;

a first latch for latching the digital sound signal computed by said computing device at an ending timing of computation of the digital sound signal, which ending timing may vary with reference to said sampling time signal; and a second latch for latching an output signal of said first latch at a timing of the sampling time signal to thereby produce, at an output of said second latch, an accurately timed digital sound signal at a timing of the sampling time signal.

25. A sound signal outputting method comprising the following steps which are implemented using a microcomputer:

outputting an accurate sampling time signal with a predetermined sampling period;

computing, in said microcomputer, a digital sound signal under a program control at timings which may vary with reference to said sampling time signal, to generate a digital sound signal;

a first latching step of latching the digital sound signal computed by said computing step at an ending timing of computation of the digital sound signal, which may vary with reference to said sampling time signal; and a second latching step of latching the digital sound signal latched by said first latching step at a timing of the sampling time signal, to thereby produce an accurately timed digital sound signal.

* * * * *